US011945019B2

(12) United States Patent
Nedaie

(10) Patent No.: US 11,945,019 B2
(45) Date of Patent: Apr. 2, 2024

(54) BEHNAM ENGINE

(75) Inventor: Behnam Nedaie, Kitchener (CA)

(73) Assignee: Behnam Nedaie, Kitchener (CA)

( * ) Notice: Subject to any disclaimer, the term of this patent is extended or adjusted under 35 U.S.C. 154(b) by 2367 days.

(21) Appl. No.: 13/482,993

(22) Filed: May 29, 2012

(65) Prior Publication Data

US 2012/0234289 A1 Sep. 20, 2012

Related U.S. Application Data

(60) Provisional application No. 61/492,371, filed on Jun. 1, 2011.

(51) Int. Cl.

| | |
|---|---|
| ***F01M 11/04*** | (2006.01) |
| ***B21D 39/02*** | (2006.01) |
| ***B21D 51/32*** | (2006.01) |
| ***B21D 53/88*** | (2006.01) |
| *F01N 1/00* | (2006.01) |

(52) U.S. Cl.

CPC ..... *B21D 39/02* (2013.01); *B21D 51/32* (2013.01); *B21D 53/88* (2013.01); *F01N 1/00* (2013.01); *Y10T 29/53709* (2015.01)

(58) Field of Classification Search

CPC ..... F02B 75/32; F02B 41/00; F02B 41/02; F02B 2275/36; F01B 9/02; B21D 39/02; B21D 51/32; B21D 53/88

USPC ..... 123/197.4, 197.3, 90.17, 78 F

See application file for complete search history.

(56) References Cited

U.S. PATENT DOCUMENTS

| | | | | |
|---|---|---|---|---|
| 5,454,352 | A * | 10/1995 | Ward | F01B 9/047 123/197.1 |
| 7,219,647 | B1 * | 5/2007 | Brickley | F01B 9/02 123/197.1 |
| 2001/0017122 | A1 * | 8/2001 | Fantuzzi | F01B 9/06 123/197.4 |
| 2004/0261732 | A1 * | 12/2004 | Fantuzzi | F01B 9/06 123/55.5 |
| 2008/0121196 | A1 * | 5/2008 | Fantuzzi | F01B 1/08 123/55.2 |
| 2010/0071640 | A1 * | 3/2010 | Mustafa | F01L 3/205 123/54.2 |

* cited by examiner

*Primary Examiner* — Lindsay M Low
*Assistant Examiner* — Omar Morales

(57) ABSTRACT

Sets of apparatus for translating motion from a rotating non-circular loop to linear motion and in possible cases vice versa. Such mechanisms are used in muffler cap spinning technology and engine crankshaft with uneven strokes; but not restricted to said applications. The mechanisms include a non-circular cam, a linear sliding arm or piston and parts to connect them. Disclosure also includes an adjustable closure for a sliding arm which could be utilized for said muffler cap spinning mechanisms or other applications.

30 Claims, 118 Drawing Sheets

Figure 14A:
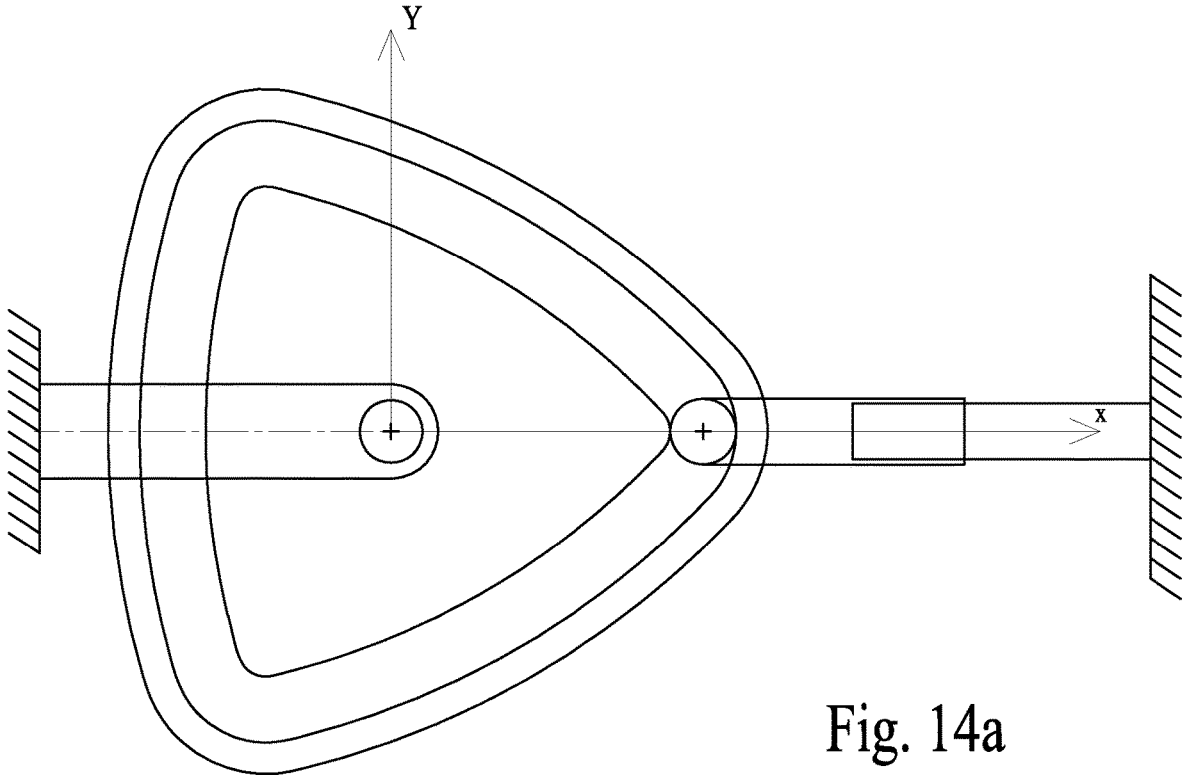
Figure 14B:
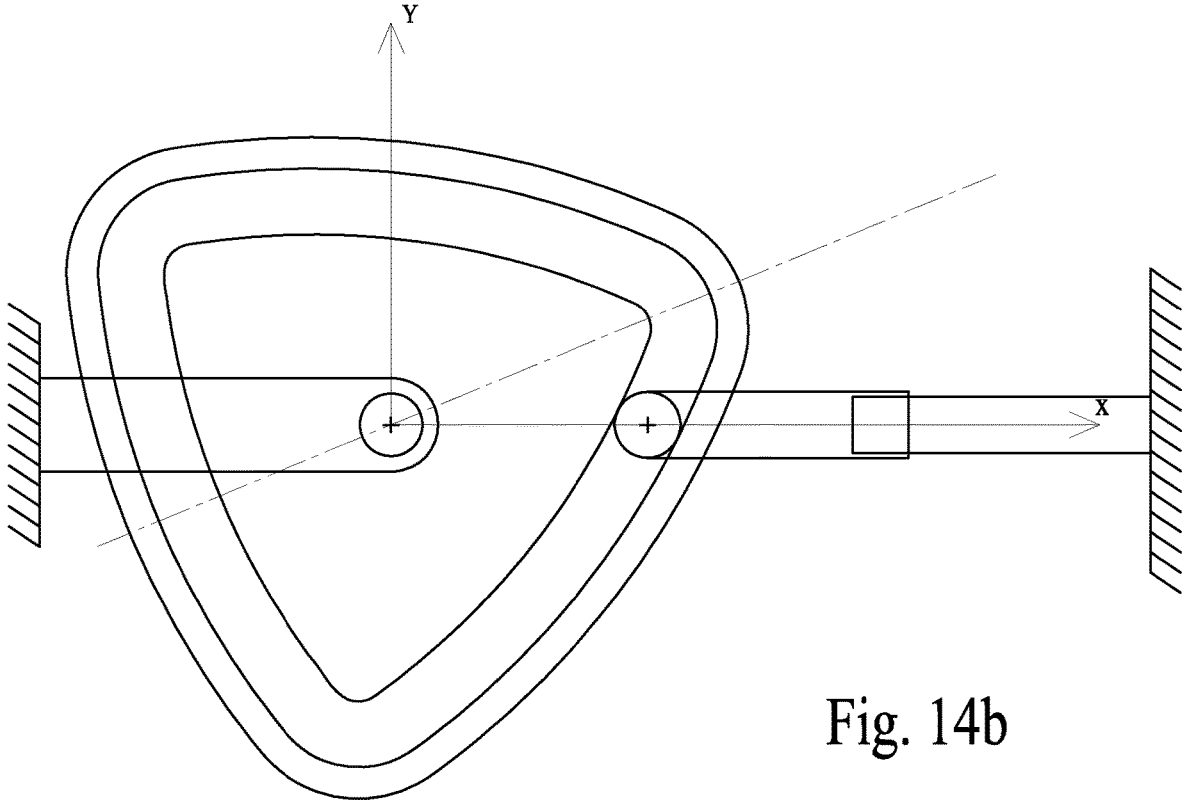
Figure 14C:
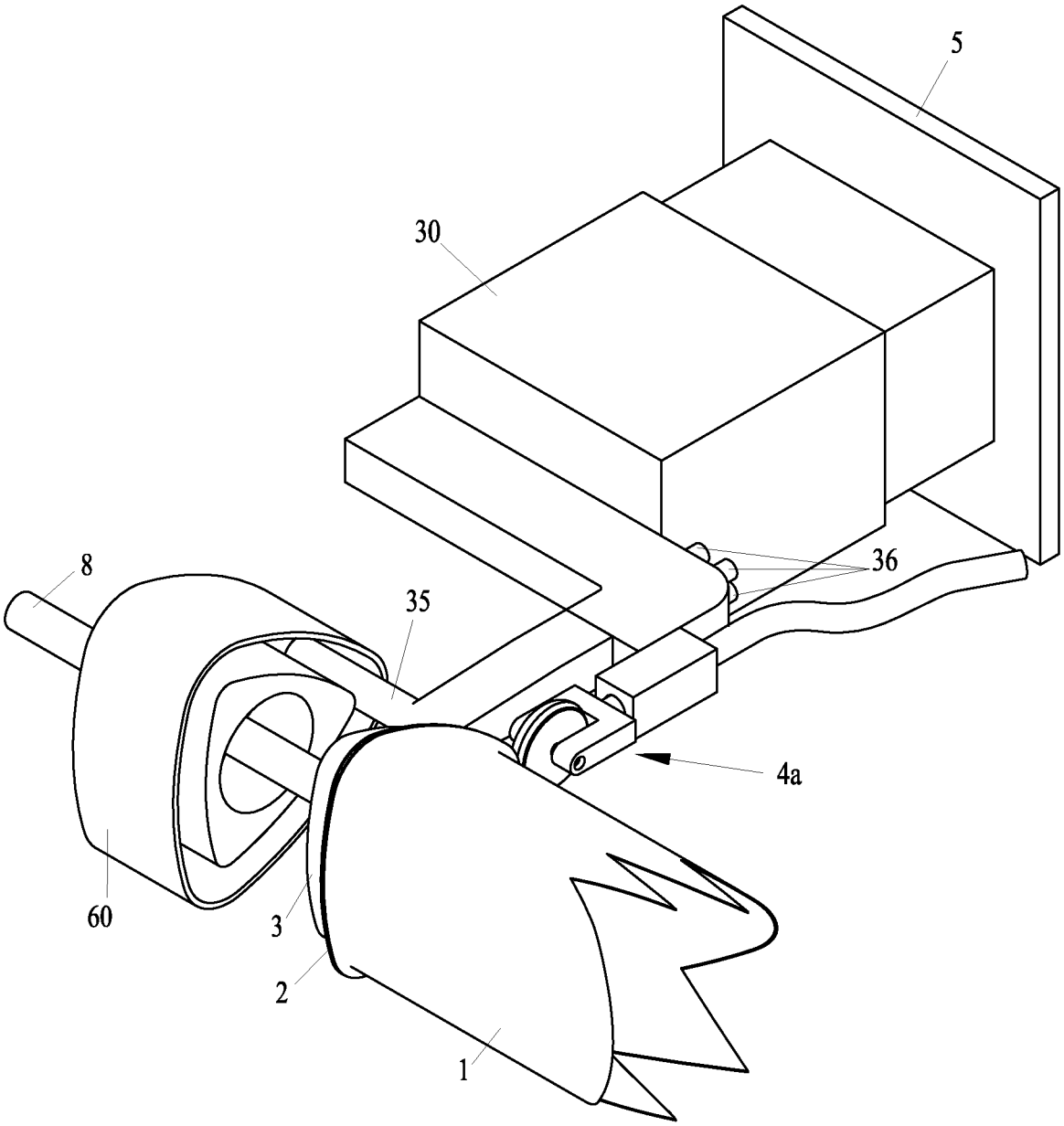
Figure 14D:
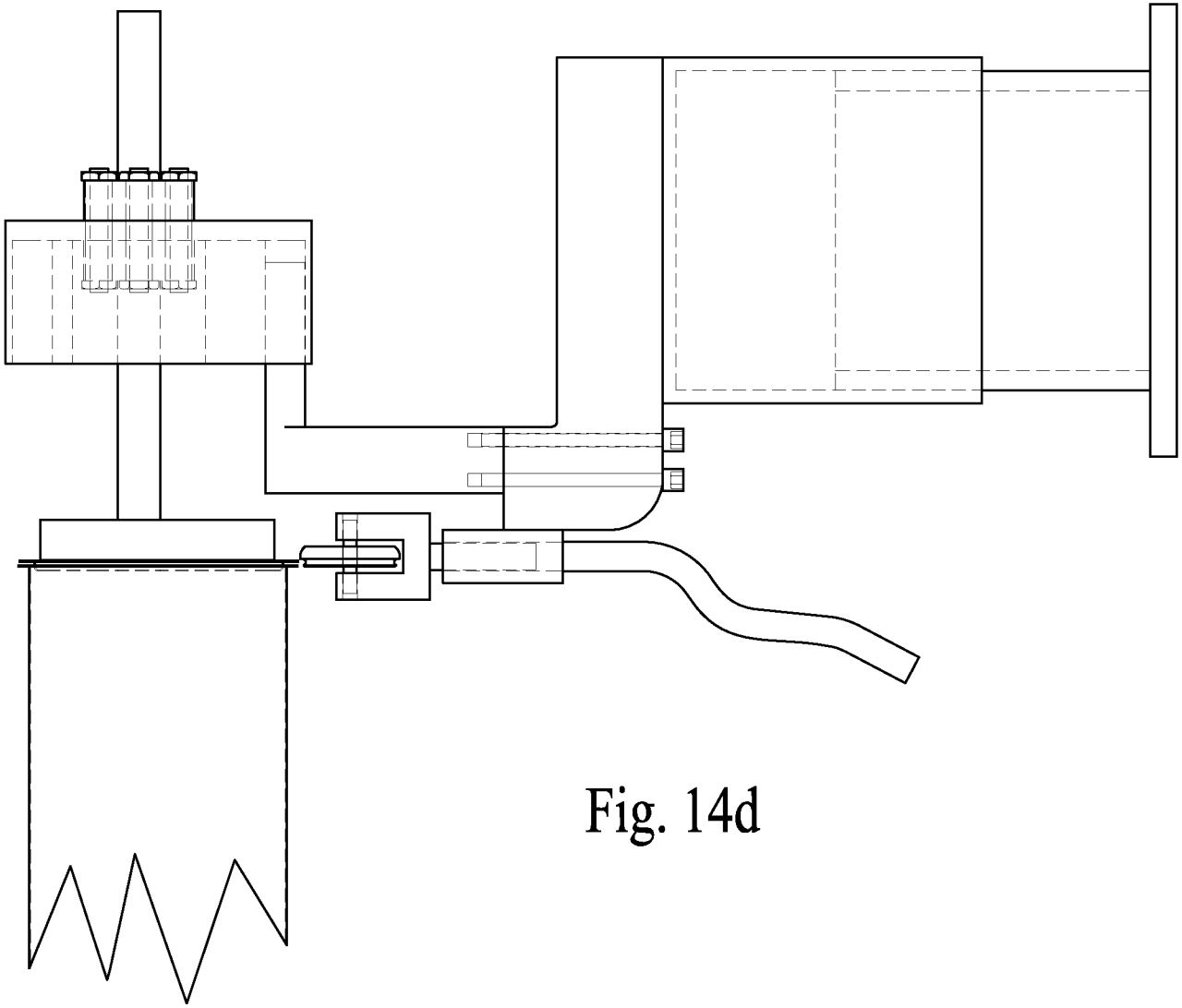
Figure 14E:
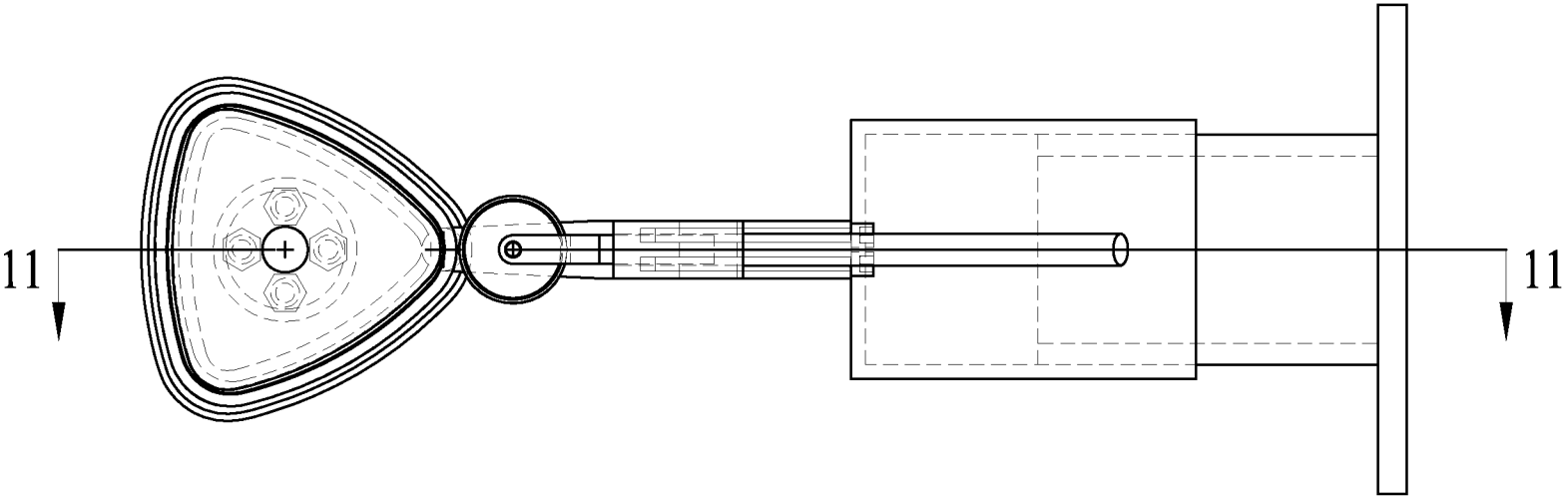

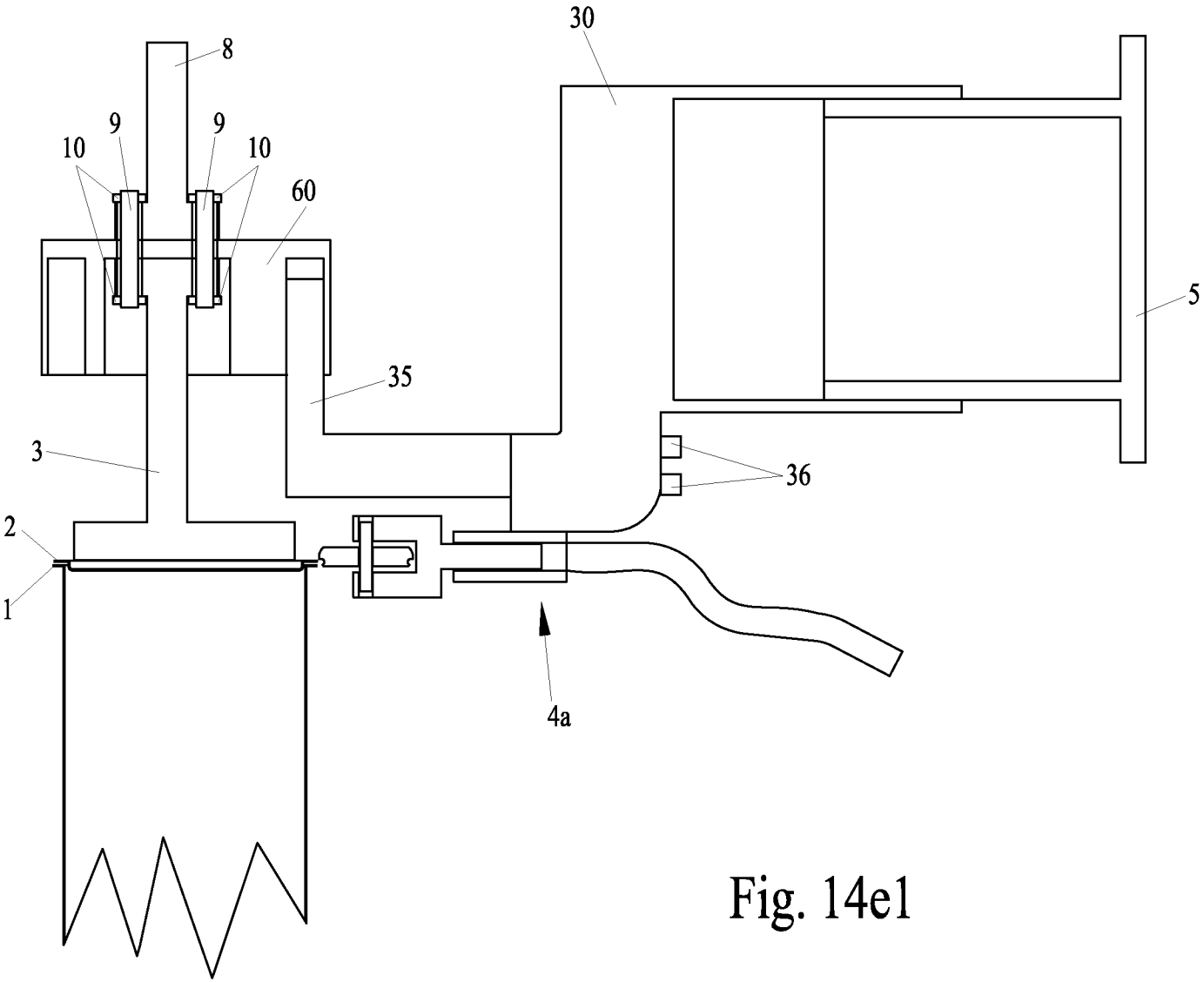
Fig. 14e1

BEHNAM ENGINE

BACKGROUND OF THE INVENTION

Fields of Invention

In industry there are applications which require converting the motion from a non-circular loop to linear motion or vice versa. One such application is in muffler cap spinning machines. In order to manufacture a muffler, different machines are used; one of these machines is the one which secures the two ends of the muffler to muffler shell. Normally in the industry, the two ends of the muffler are called "caps"; and since during the process, either the muffler shell and the cap(s), or the tooling around the muffler shell and the cap(s), are rotating, this equipment is widely known as "cap spinner". Other names for this machine are "end seamer" and "head spinner". In addition to that there are other applications where a cap is secured to a shell where they have non-circular cross-sections.

Another field which this invention tends to address is engine crankshaft. In gas and diesel engines the crankshaft provides the same stroke length for intake and power strokes. It is known that as a result, at the end of power stroke, at bottom dead center, the gas in cylinder chamber is still hot and under pressure and is able to produce mechanical power, but since the crankshaft does not allow the piston to travel any further down the cylinder in power stroke, all that power is sent to waste through the exhaust. It will be demonstrated in this disclosure that some of the same mechanisms which are used for muffler cap spinning, could work in reverse, providing a longer length for the power stroke than the length of intake stroke. Thus more power is generated by the engine for the same amount of fuel using these mechanisms than the power generated by normal crankshafts.

OBJECTIVE OF THE INVENTION

The principal objective of this invention is to introduce new methods of converting motion from a non-circular loop to linear motion and in possible cases, vice versa. The invention will show the application of these methods in muffler cap spinning machines and engine crankshaft. The term "Method" for the purpose of this disclosure is meant a geometrical configuration which could be applied to mechanisms under consideration.

For muffler cap spinning, this disclosure introduces six Methods of reading the path of motion from a non-circular cam and translating it to linear motion by using a sliding arm and dictating the motion of the sliding arm to the roller which performs the action of seaming. The use of an adjustable closure for a sliding arm which could be utilized for the said Methods is also explained. In addition to that different options and combinations associated with the Methods are presented.

In the case of engine crankshaft, the said Methods are used in reverse in order to provide a longer length for power stroke than the length of intake stroke. This will result in improved fuel efficiency. There shall be six crankshaft mechanisms. The Fourth Method shall not be used for engine crankshaft and will address only muffler cap spinner. But from the Third Method two different mechanisms shall be presented for engine crankshaft. In addition to the application of said Methods to engine crankshaft, different options for the crankshaft mechanisms shall be discussed. In particular geometric profiles for crank cams shall be illustrated in order to have better than normal fuel combustion and emission control.

LIST OF FIGURES

Figure 1A:
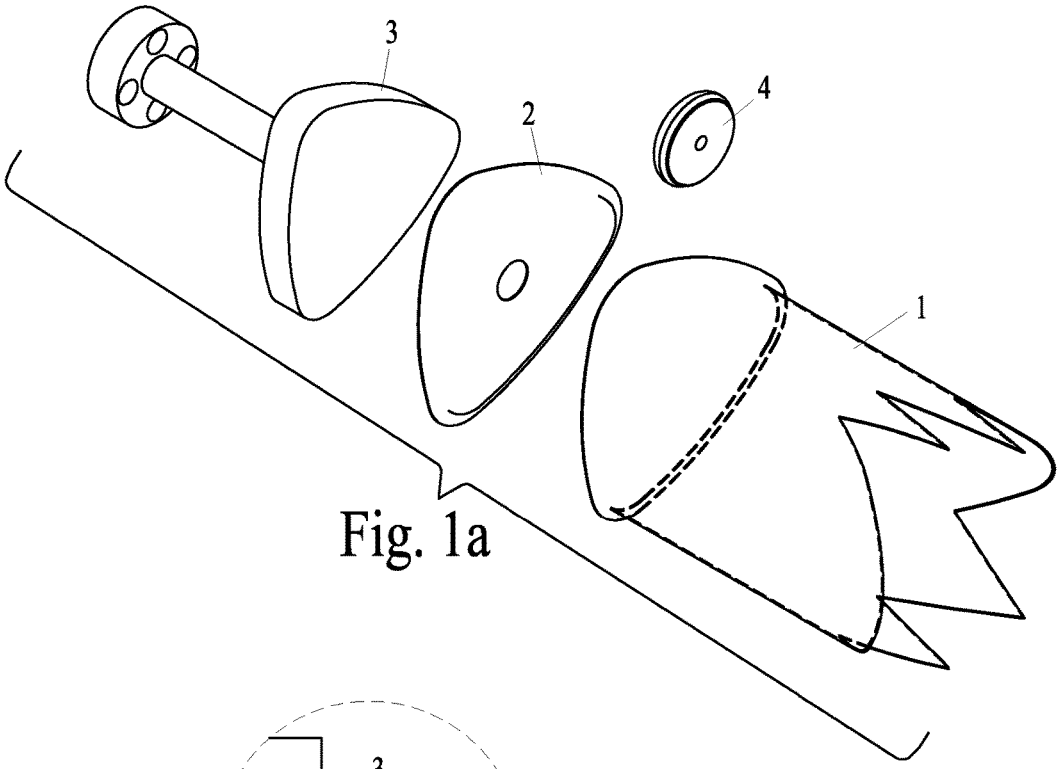

The disclosure shall be presented by the aid of the following figures:

FIG. 1*a* shows an isometric view of separated parts muffler shell 1, muffler cap 2, cap holding nose 3 and roller 4.

Figure 1B:
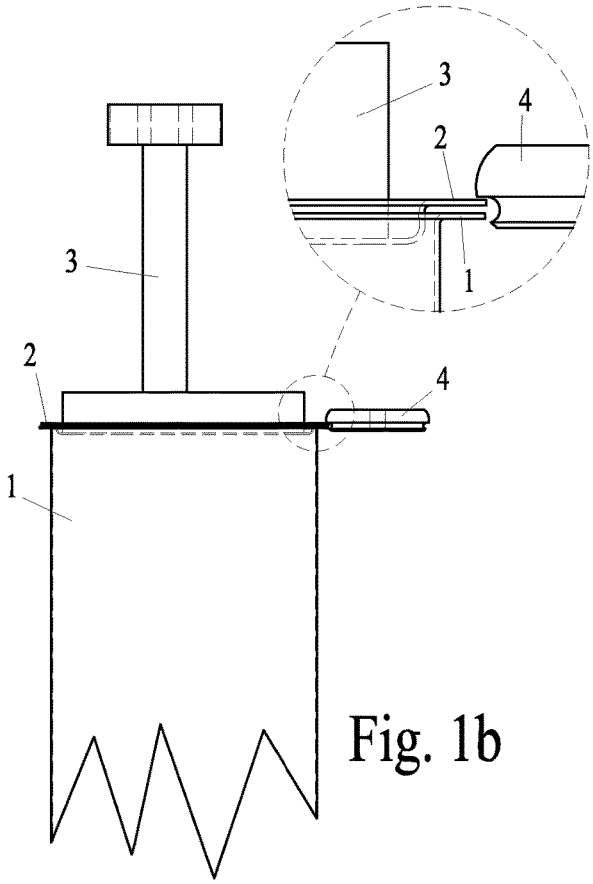

FIG. 1*b* shows a top view of parts said in FIG. 1*a* while engaged.

Figure 1C:
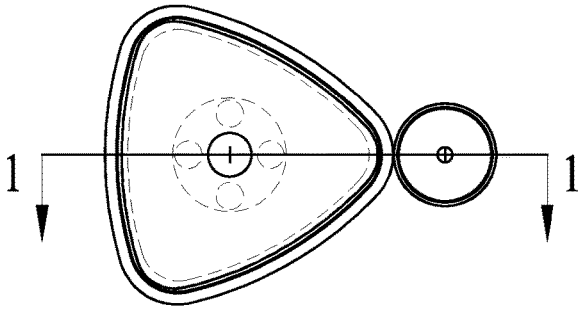

FIG. 1*c* shows a front end view of parts said in FIG. 1*b*.

Figure 1D:
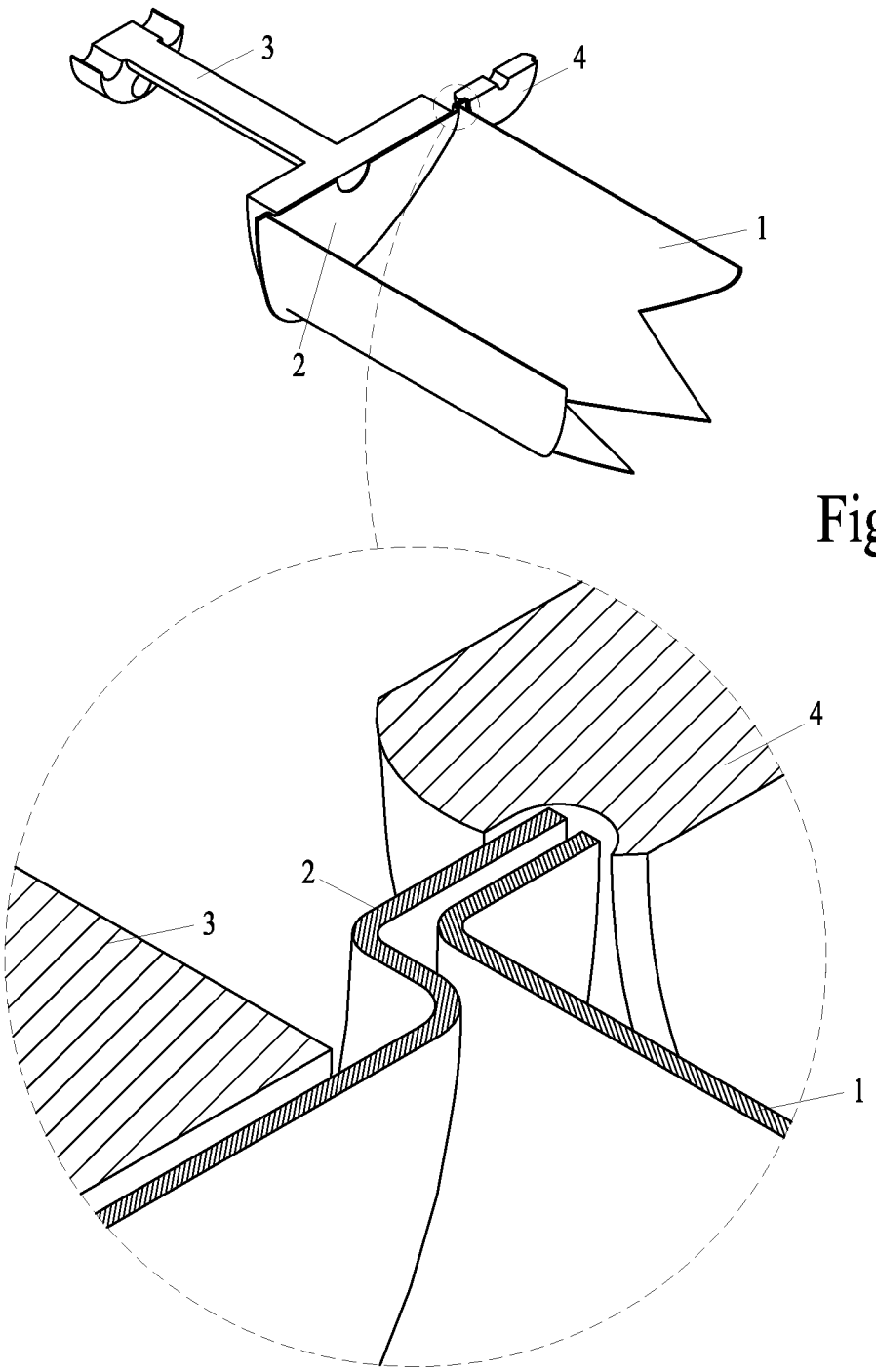

FIG. 1*d* shows an isometric view of section 1-1 shown in FIG. 1*c*.

Figure 1E:
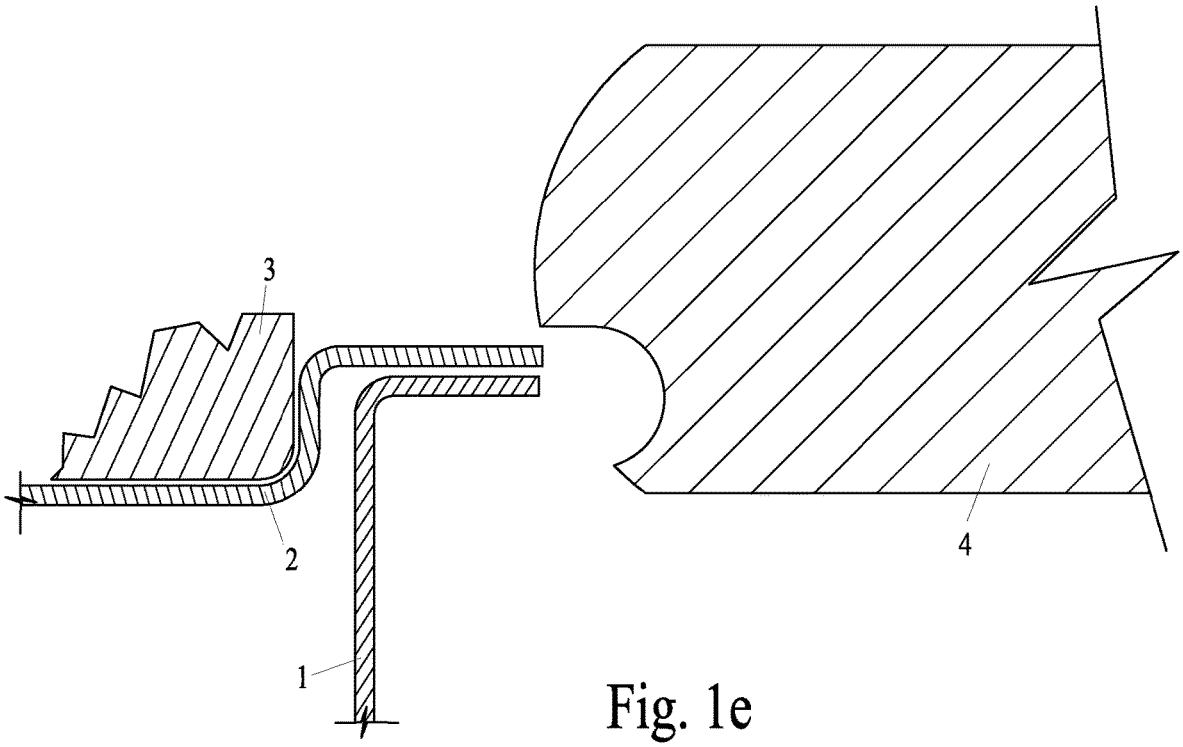

FIG. 1*e* shows an enlarged top view of corner detail shown in FIG. 1*d* before the action of seaming.

Figure 1F:
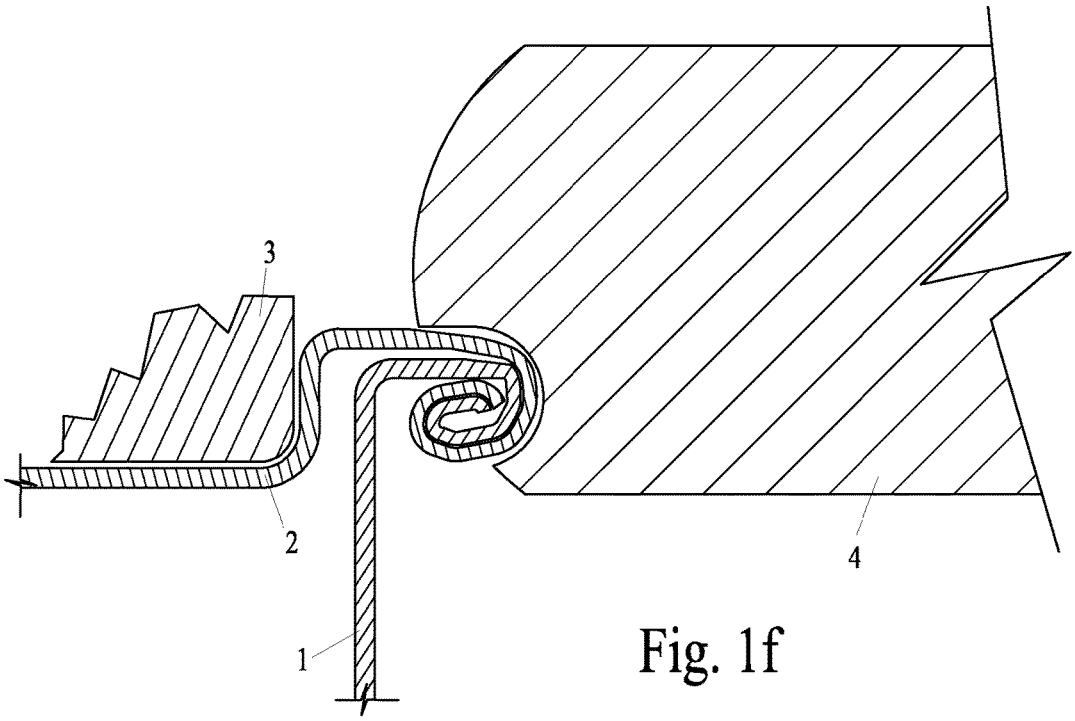

FIG. 1*f* shows an enlarged top view of corner detail shown in FIG. 1*d* after the action of seaming.

Figure 1H:
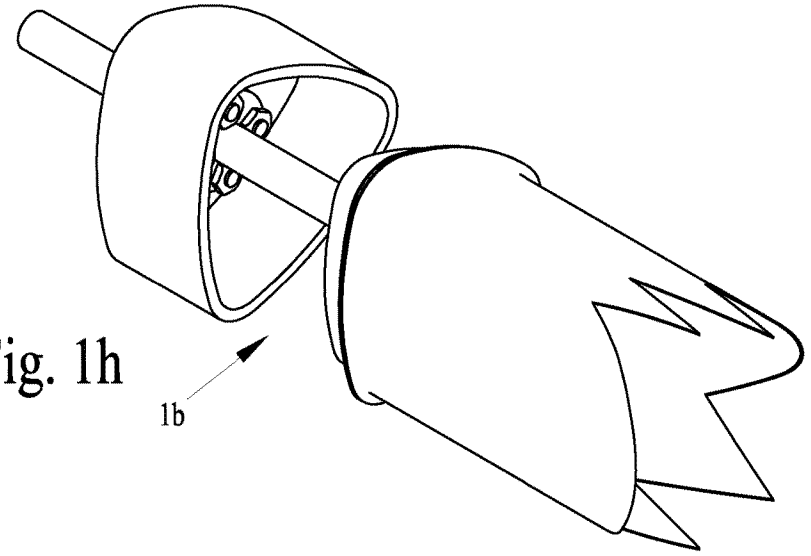
Figure 1I:
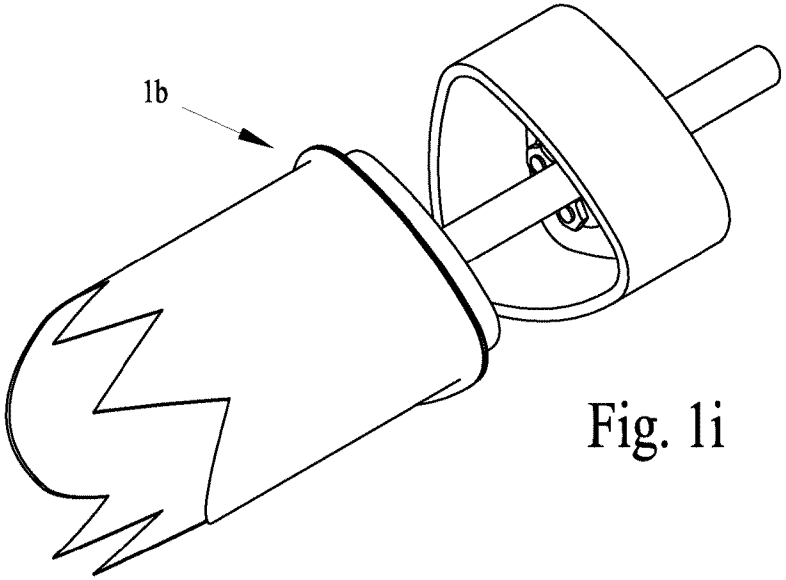
Figure 1G:
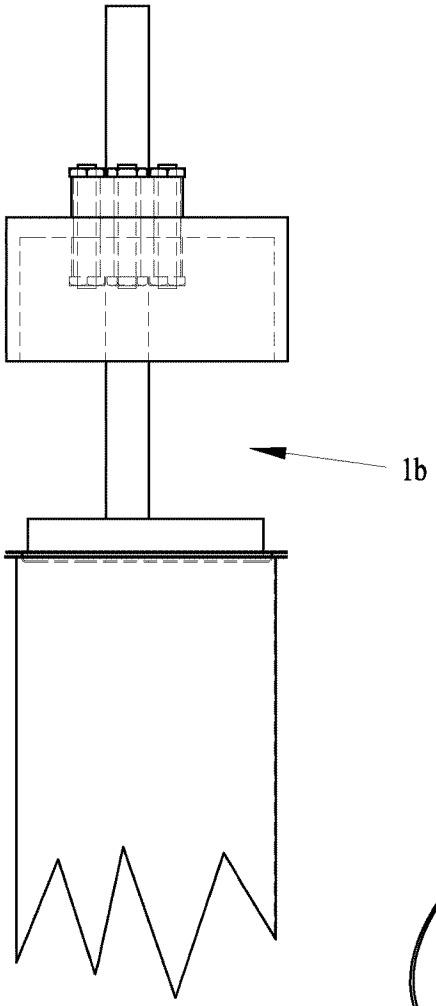

FIG. 1*g* shows a top view of an apparatus for muffler ready for end seaming.

FIG. 1*h* shows an isometric view of apparatus said in FIG. 1*g*.

FIG. 1*i* shows an additional isometric view of apparatus said in FIG. 1*g*.

Figure 1J:
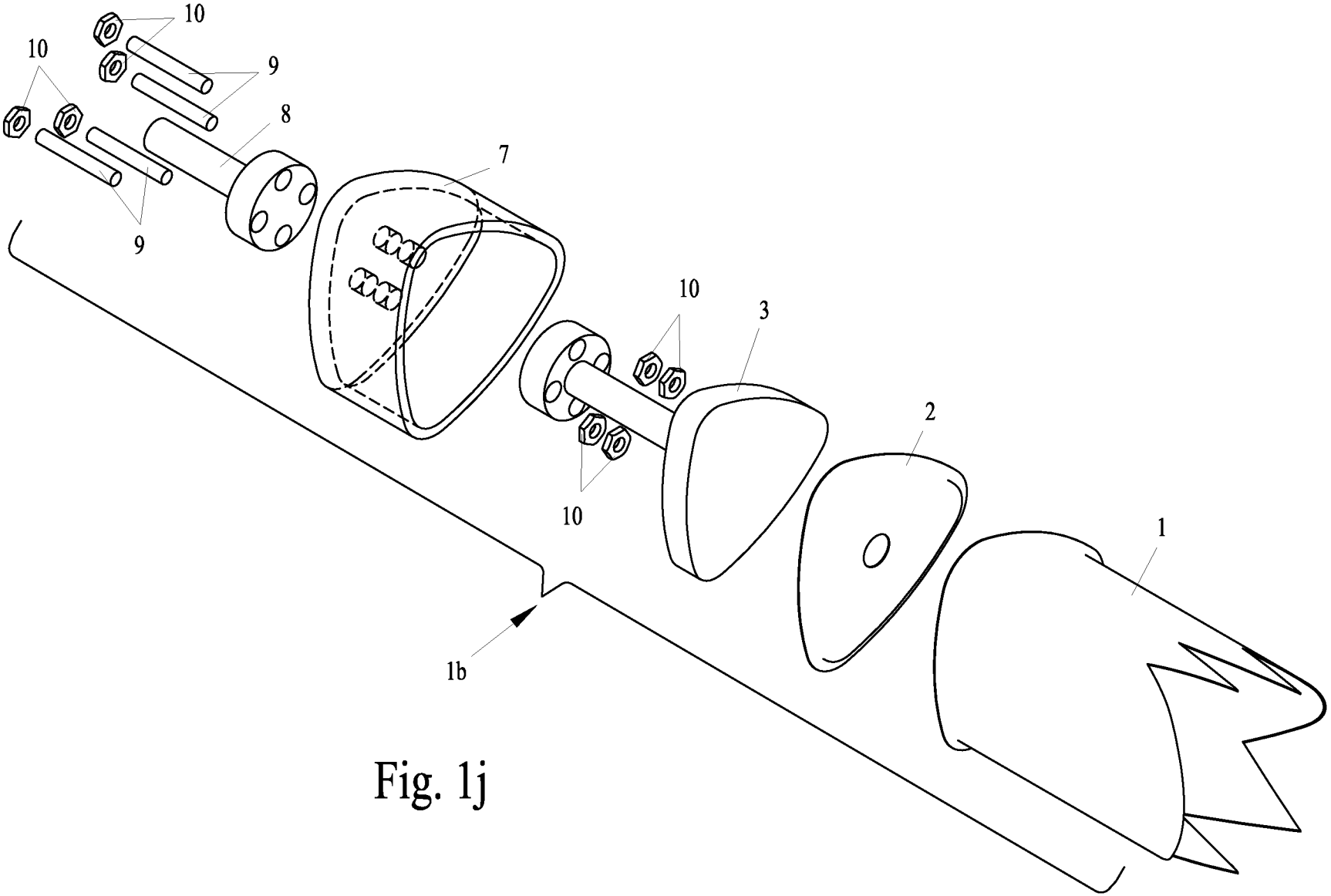
Figure 11:
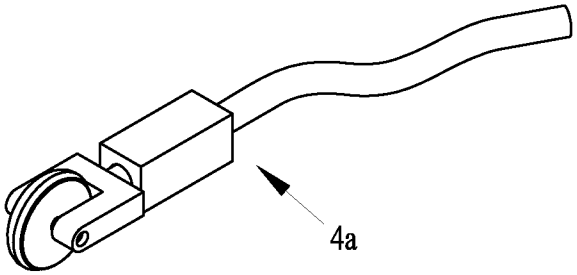

FIG. 1*j* shows an isometric exploded view of apparatus said in FIG. 1*g*.

Figure 1M:
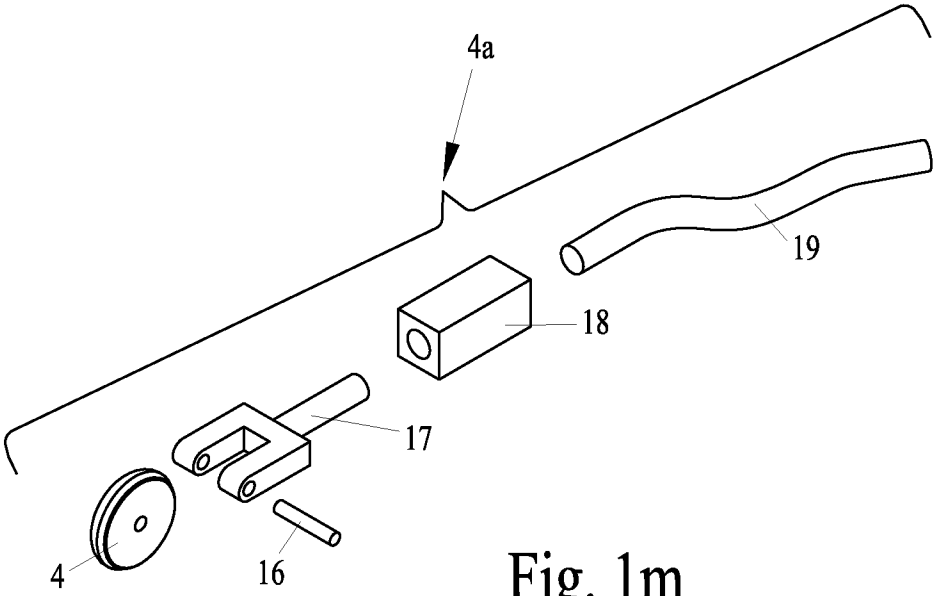
Figure 1K:
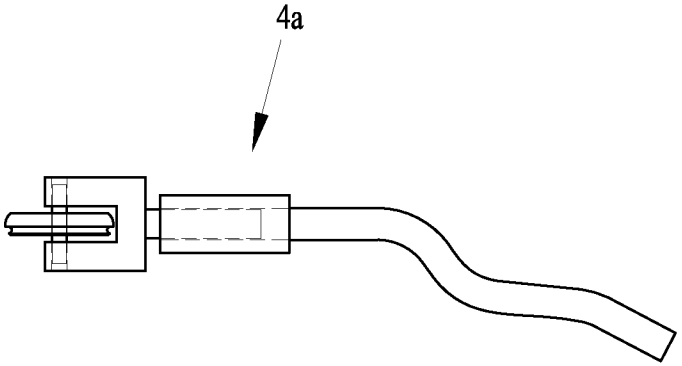

FIG. 1*k* shows a top view of a simple hydraulic apparatus holding curling roller.

FIG. 1*l* shows an isometric view of apparatus said in FIG. 1*k*.

FIG. 1*m* shows an isometric exploded view of apparatus said in FIG. 1*k*.

Figure 2A:
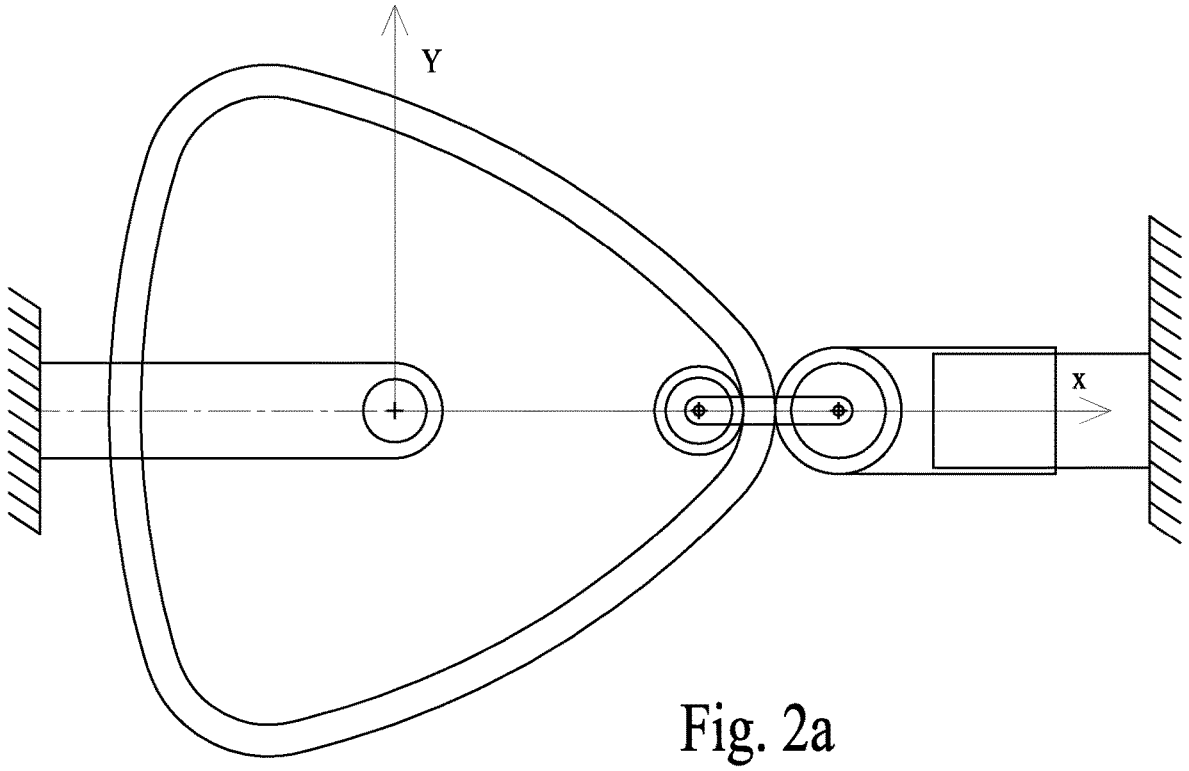

FIG. 2*a* is a simplified geometry of the First Method applied to muffler cap spinner without the geometry parts being labelled.

Figure 2B:
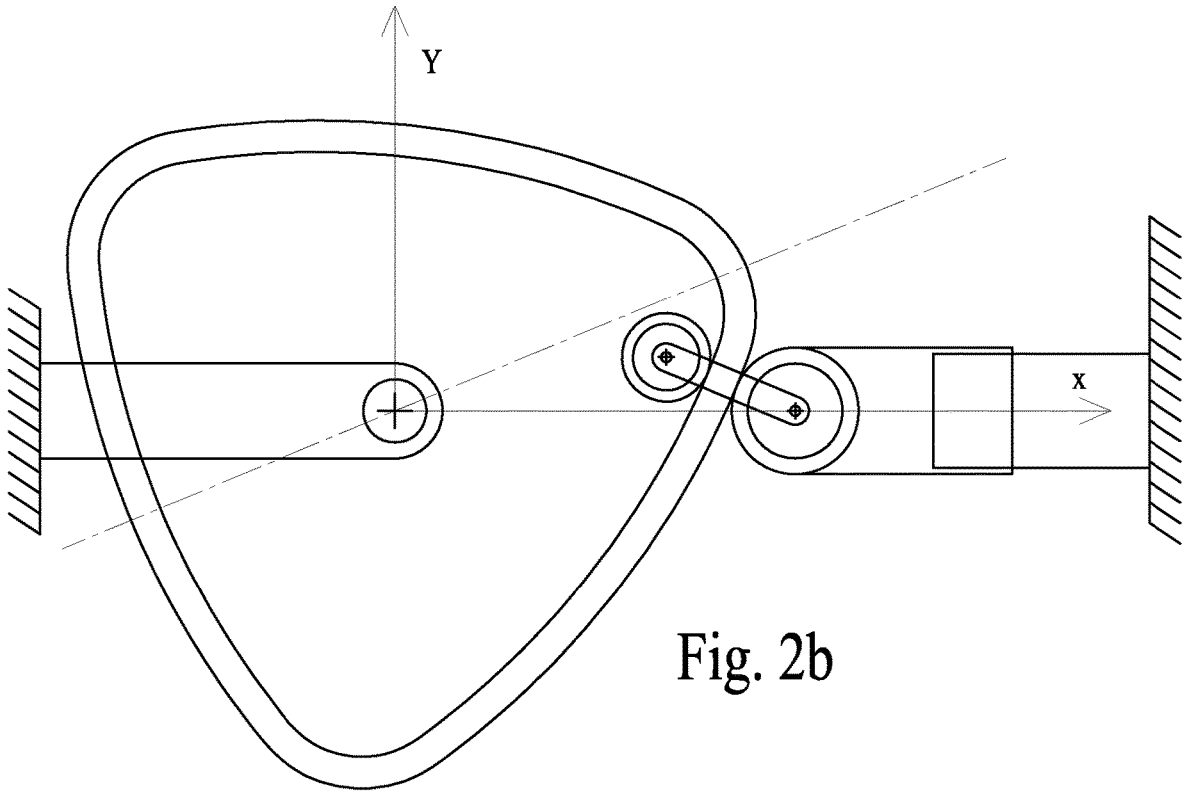

FIG. 2*b* is a simplified geometry said in FIG. 2*a* after a cam rotation of 22.5 degrees in counter clockwise direction.

Figure 3A:
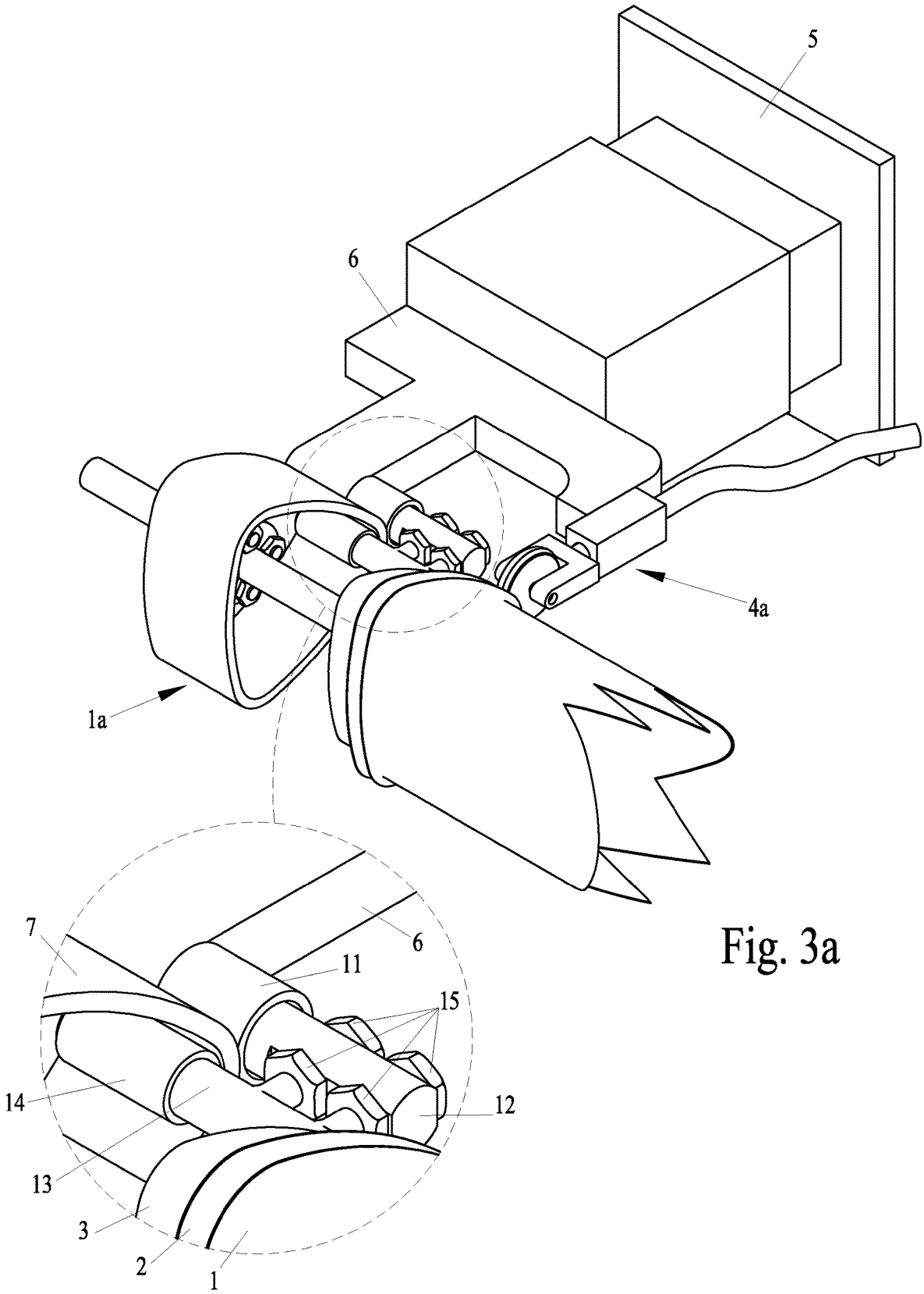

FIG. 3*a* is an isometric view of a typical mechanism using the First Method for muffler cap spinning.

Figure 3B:
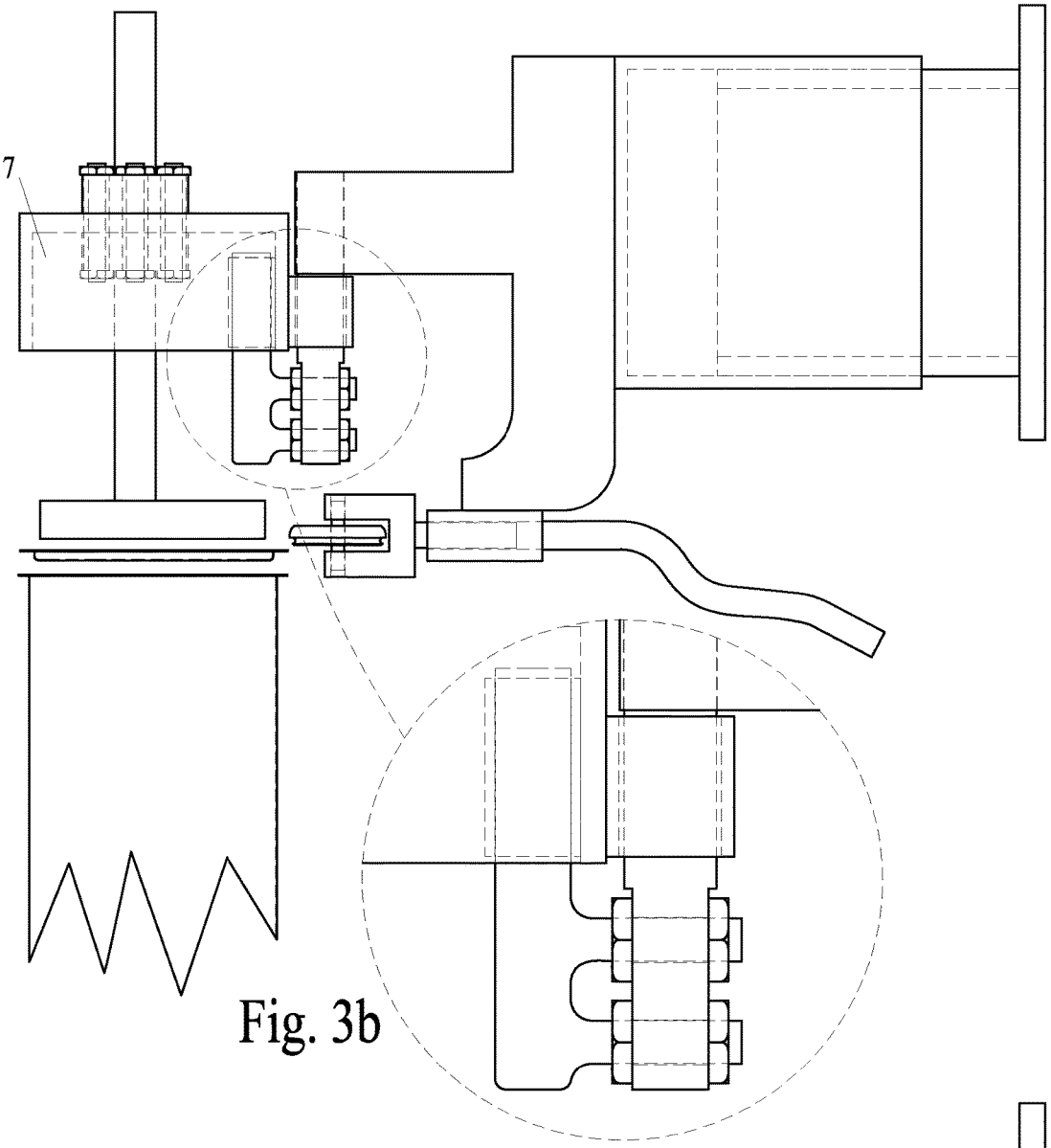

FIG. 3*b* is the top view of the mechanism said in FIG. 3*a*.

Figure 3C:
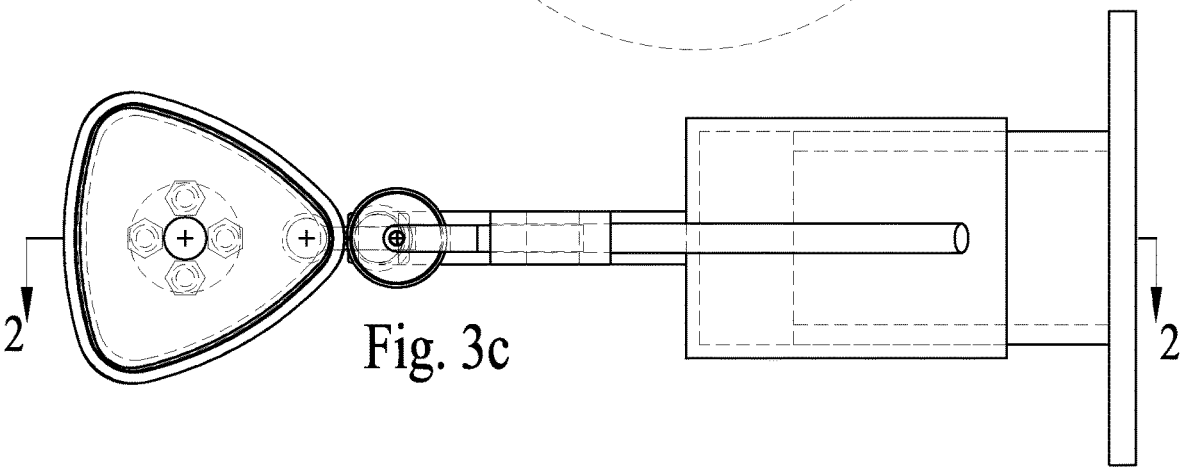

FIG. 3*c* is the front end view of mechanism said in FIG. 3*a*.

Figure 3D:
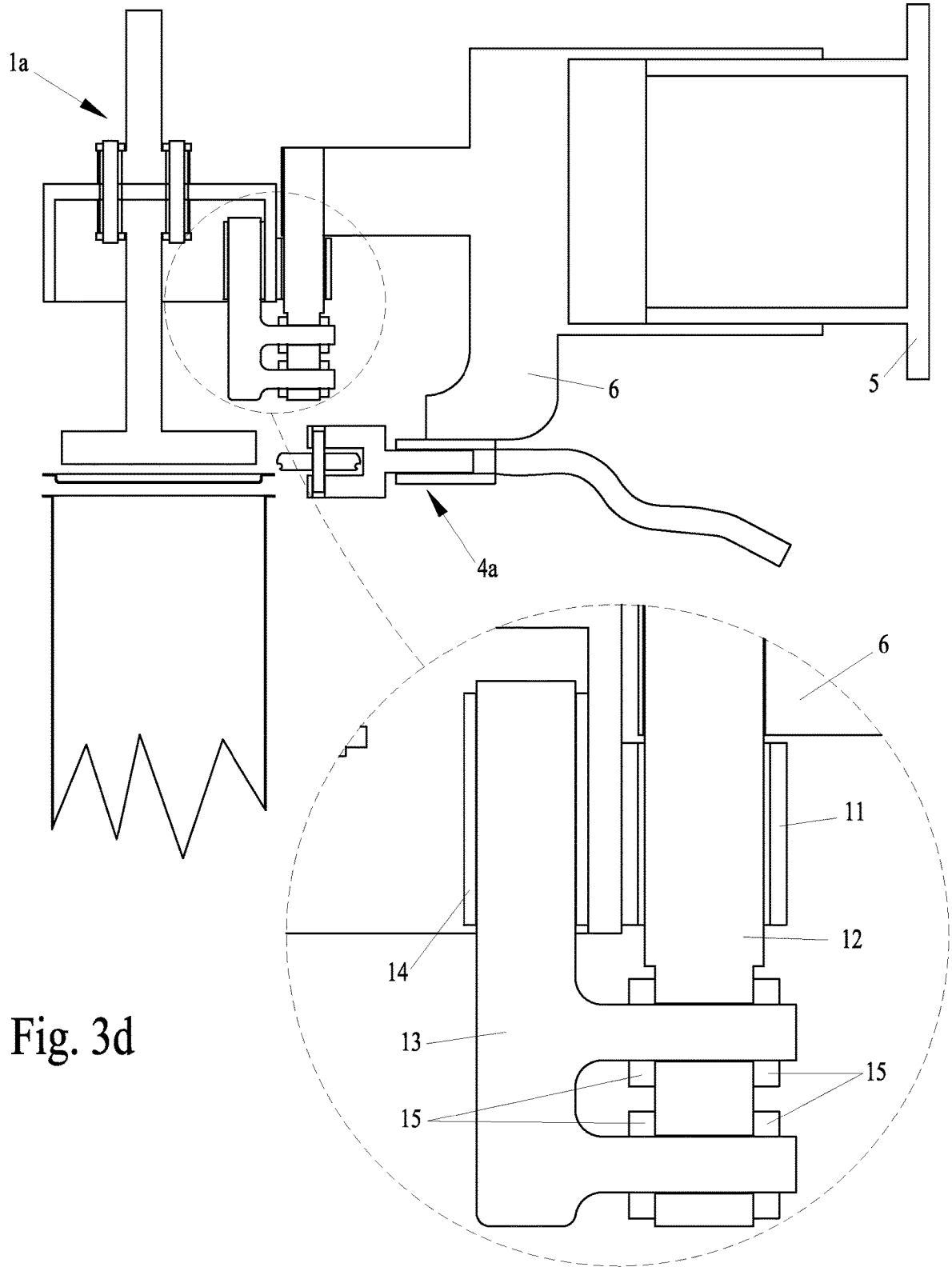

FIG. 3*d* is the section view of section 2-2 from FIG. 3*c*.

Figure 3E:
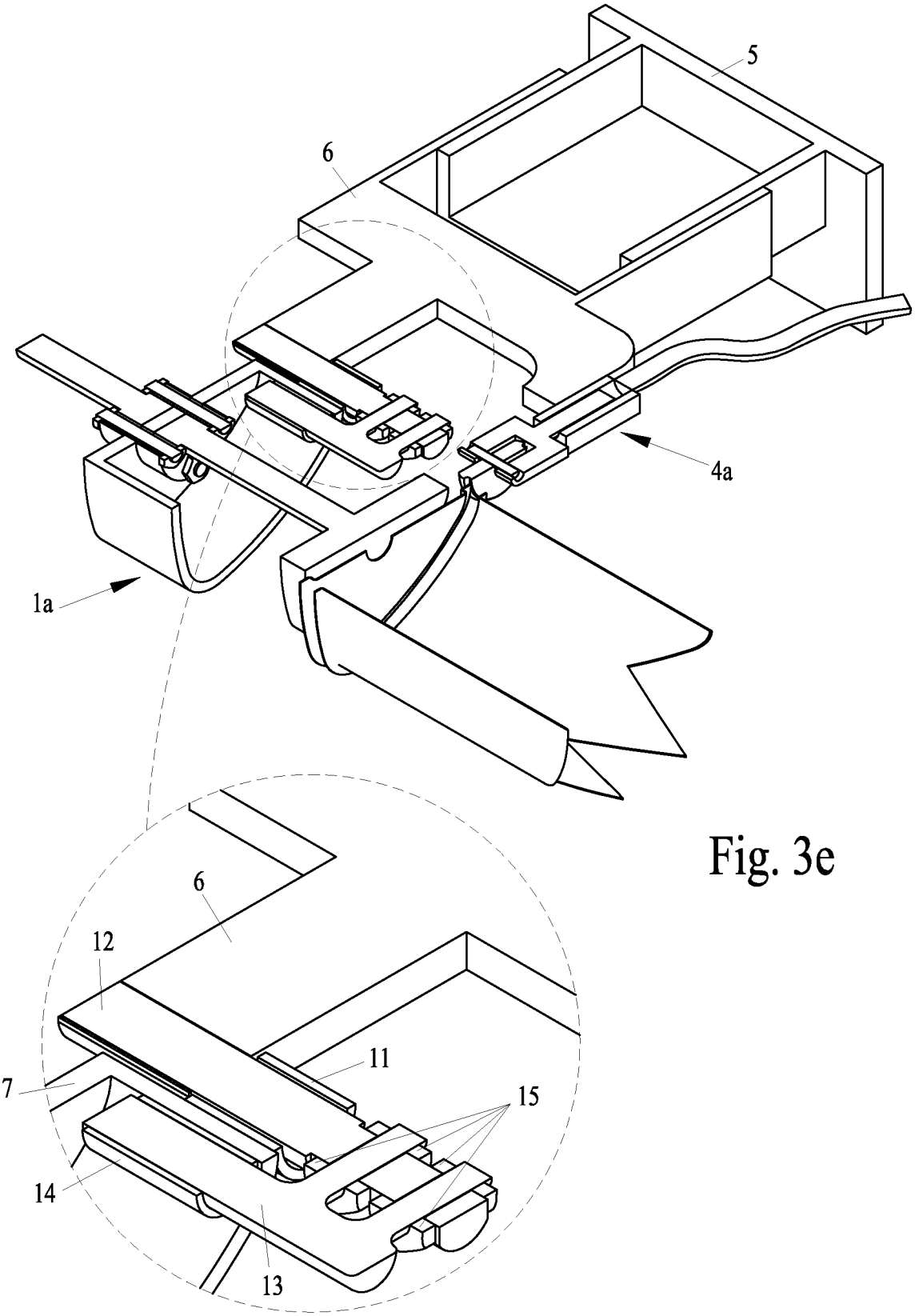

FIG. 3*e* is the isometric view of the section said FIG. 3*d*.

Figure 3F:
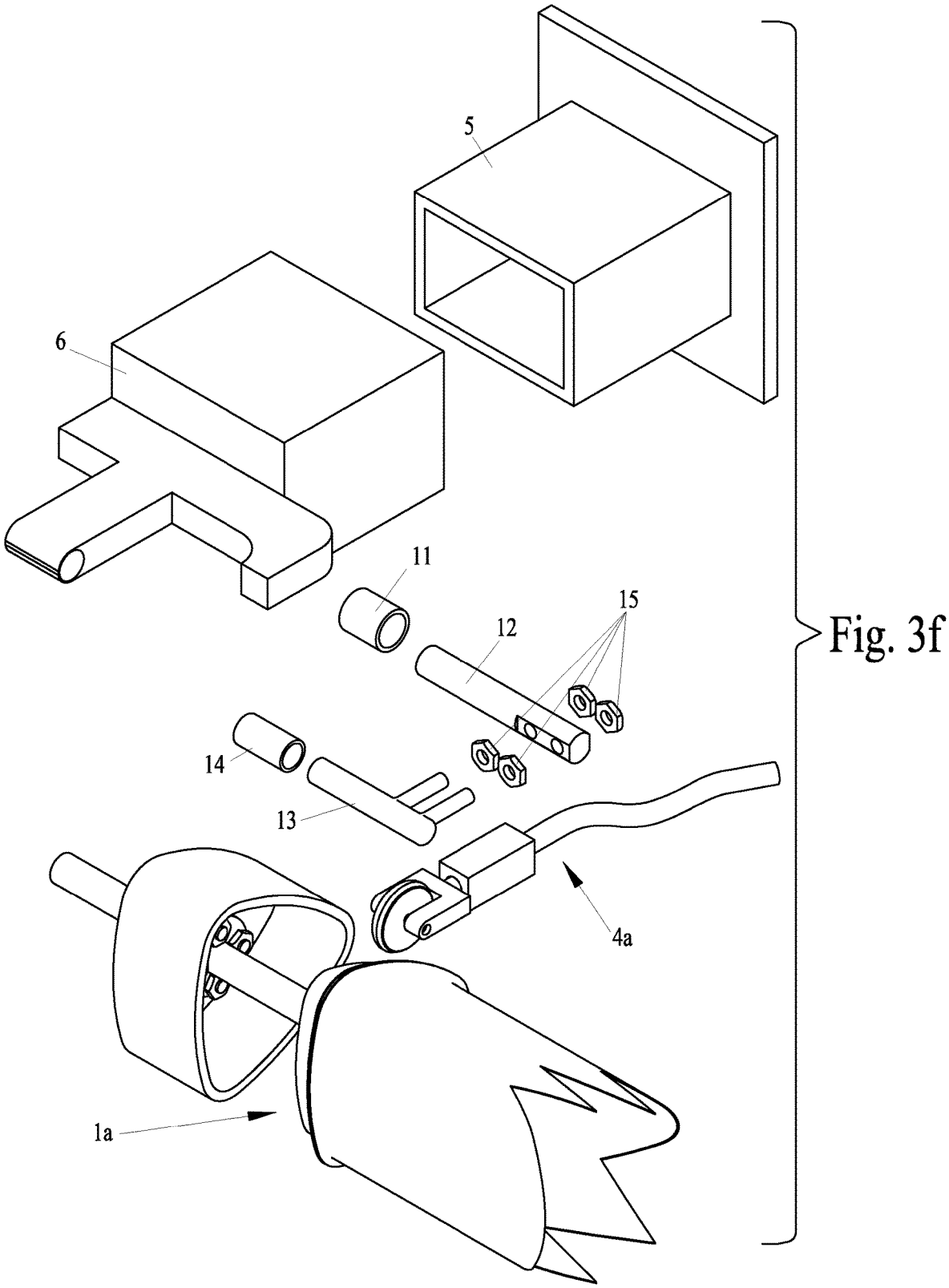

FIG. 3*f* shows the mechanism said in FIG. 3*a* disassembled and all parts labelled.

Figure 3G:
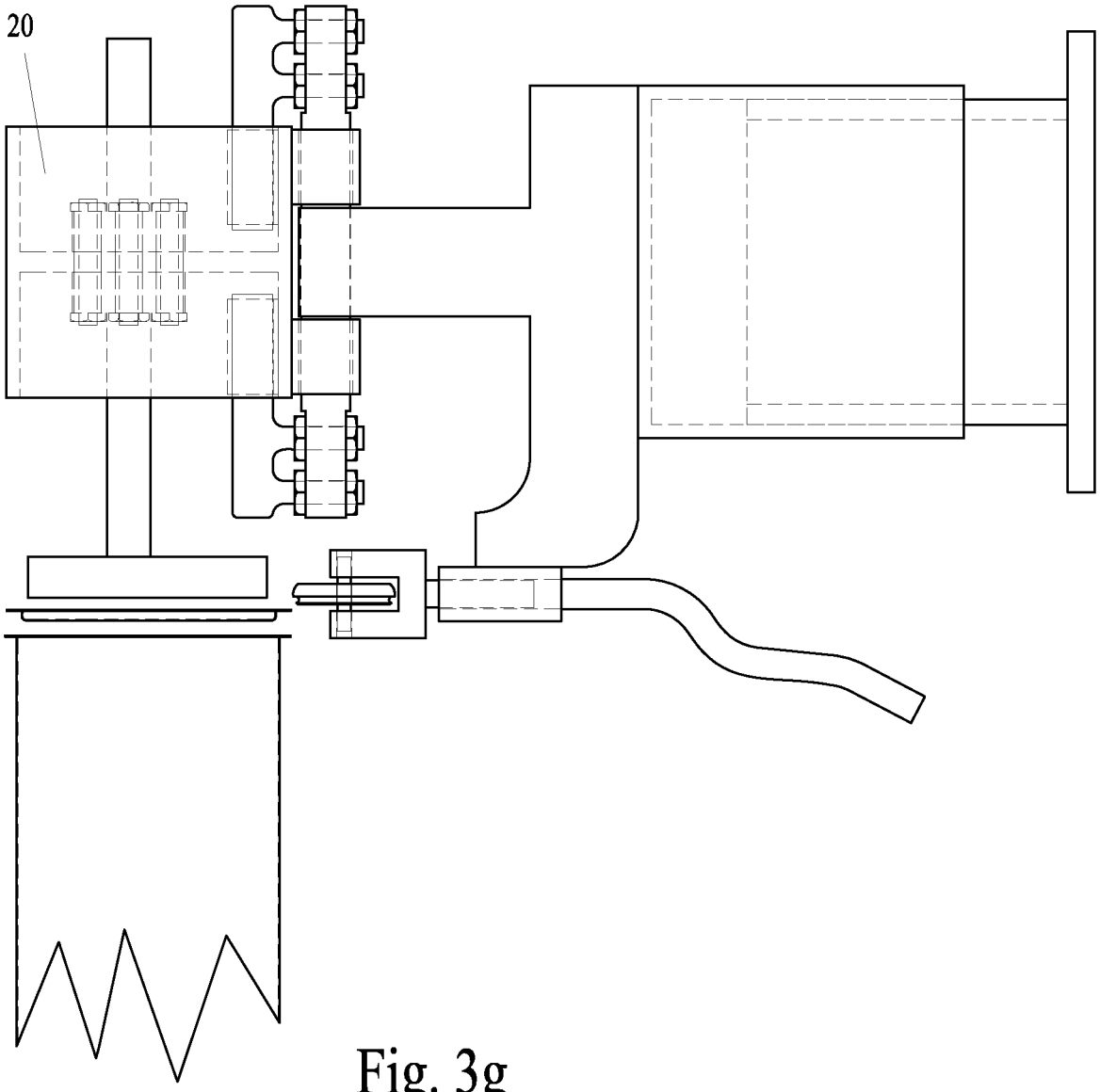

FIG. 3*g* shows the top view of a cap spinning mechanism using the First Method and utilizing an extended cam which has two connections to sliding arm.

Figure 3H:
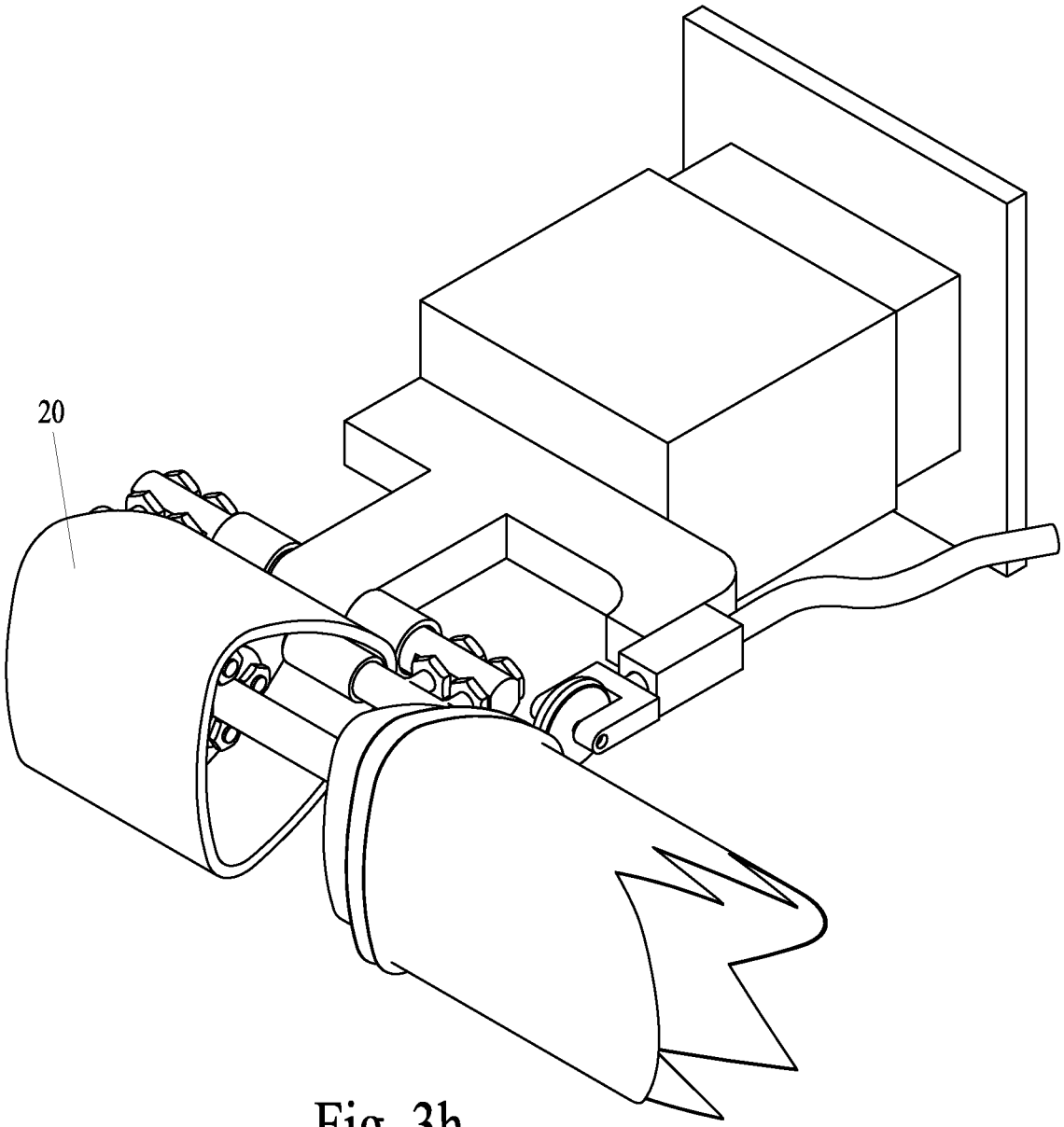

FIG. 3*h* shows the isometric view of the mechanism said in FIG. 3*g*.

Figure 3I:
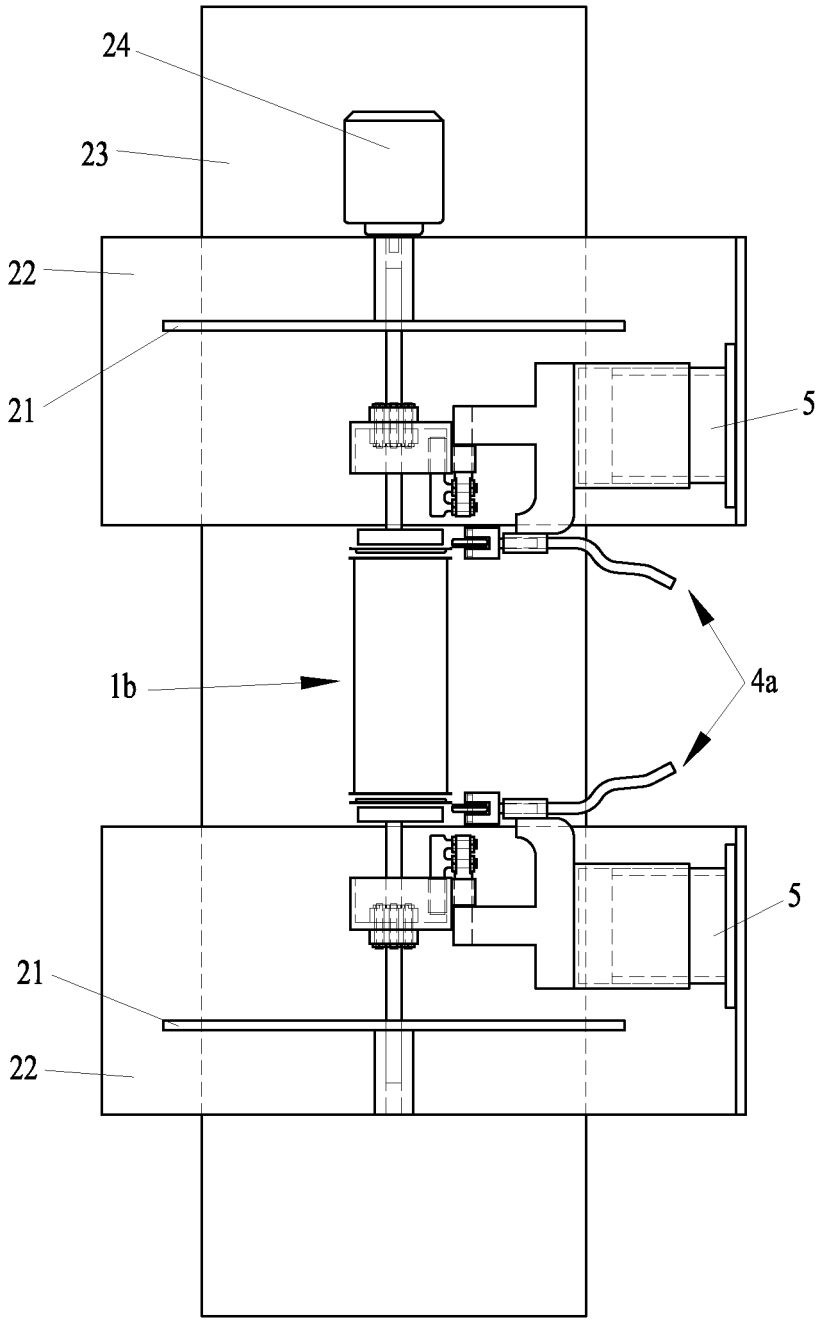

FIG. 3*i* shows the top view of a simplified muffler cap spinning machine using the First Method with one assembly on each side of the muffler shell.

Figure 3J:
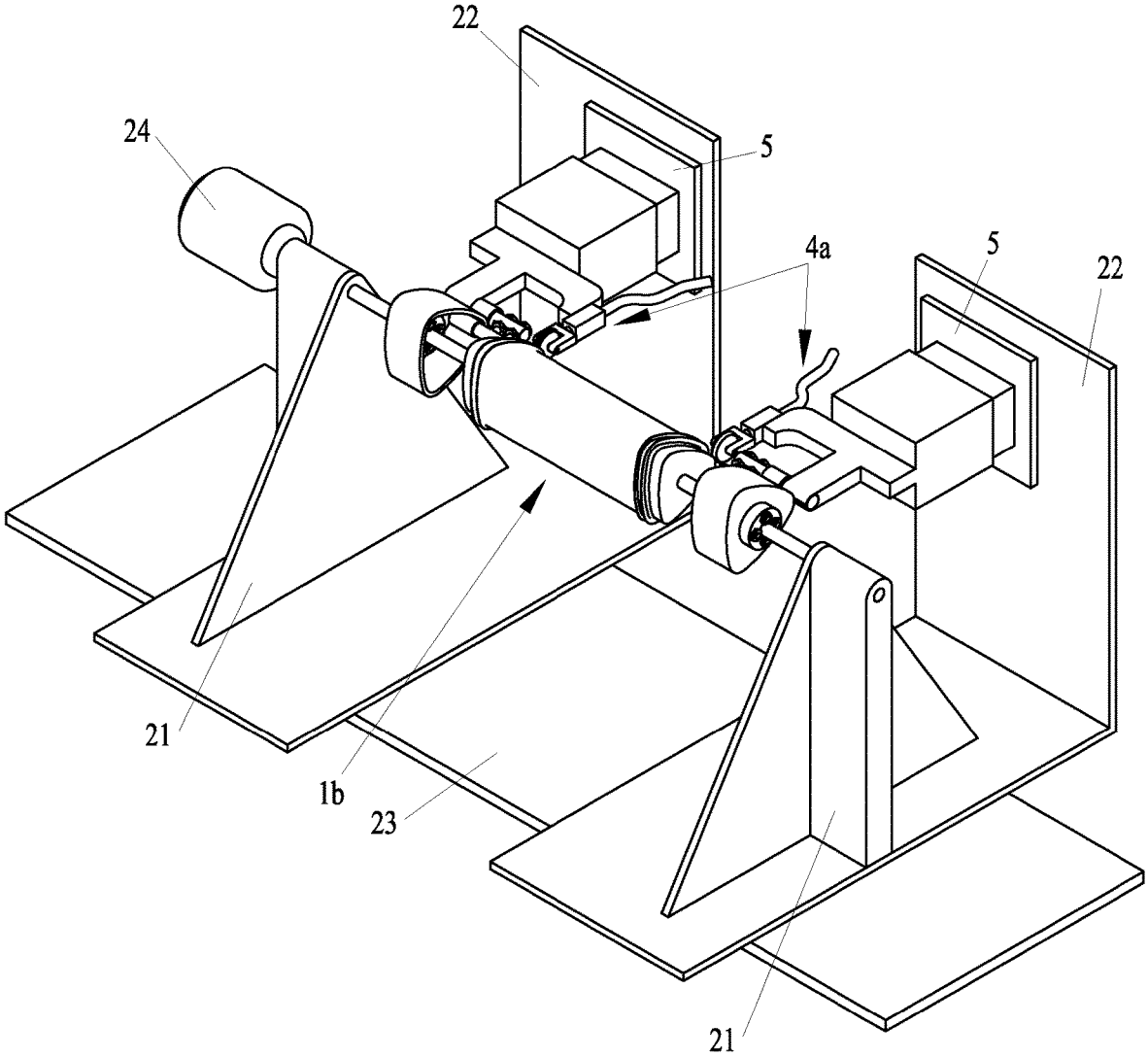

FIG. 3*j* shows the isometric view of the machine said in FIG. 3*i*.

Figure 3K:
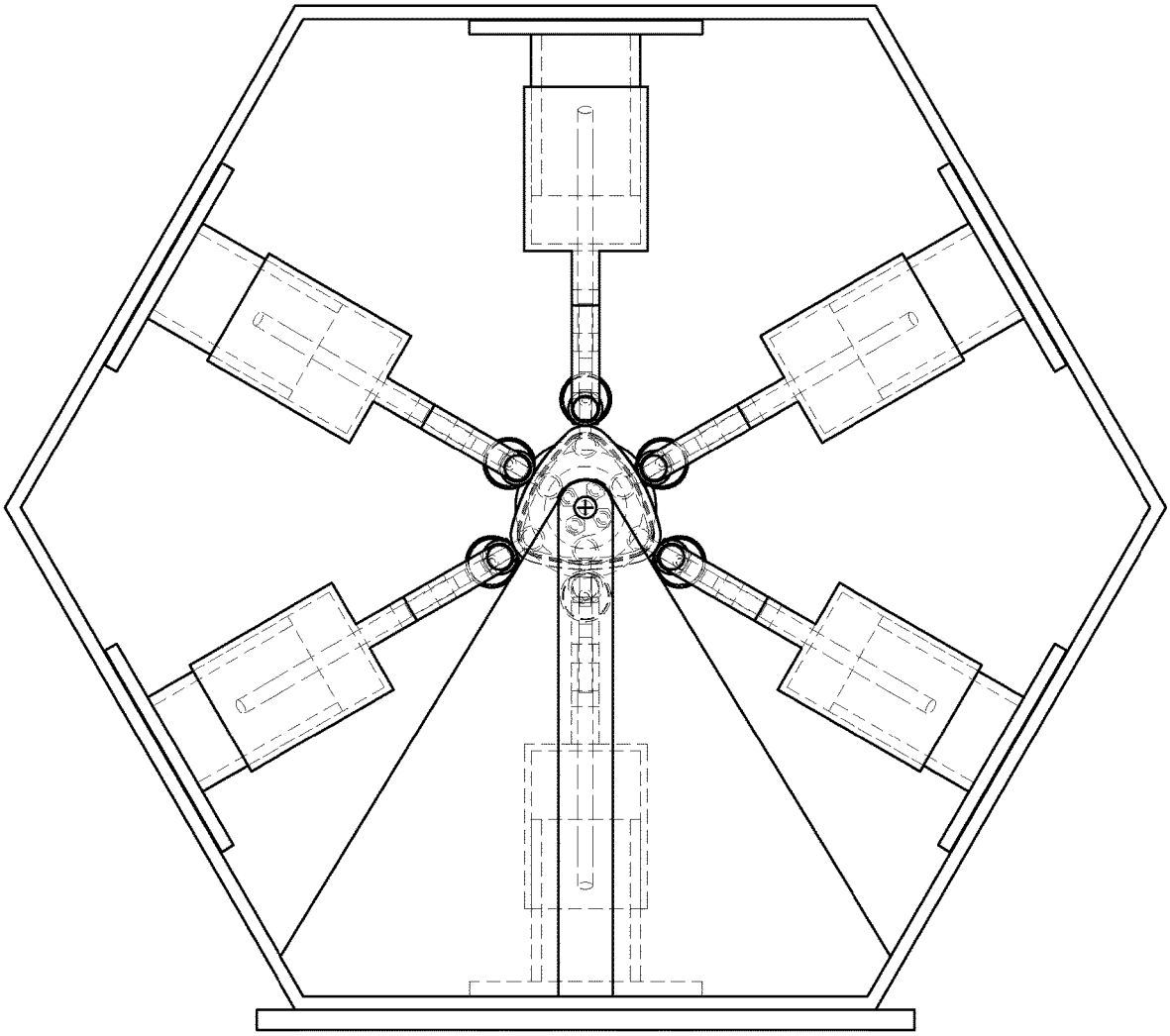
Figure 31:
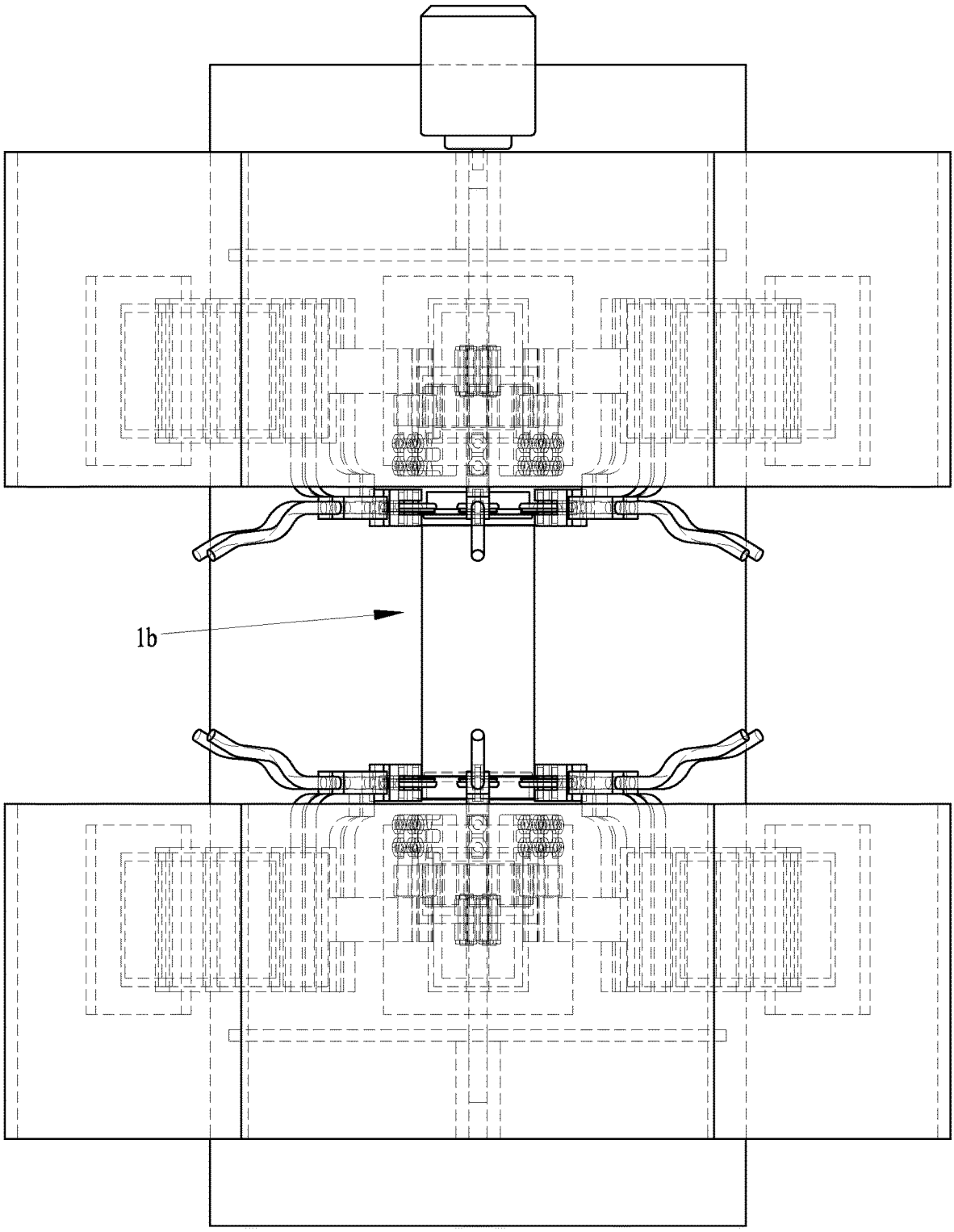

FIG. 3*k* shows the front view of a cap spinning machine with 6 points of engagement from either sides of the muffler.

FIG. 3*l* shows the top view of the cap spinning machine said in FIG. 3*k*.

Figure 3M:
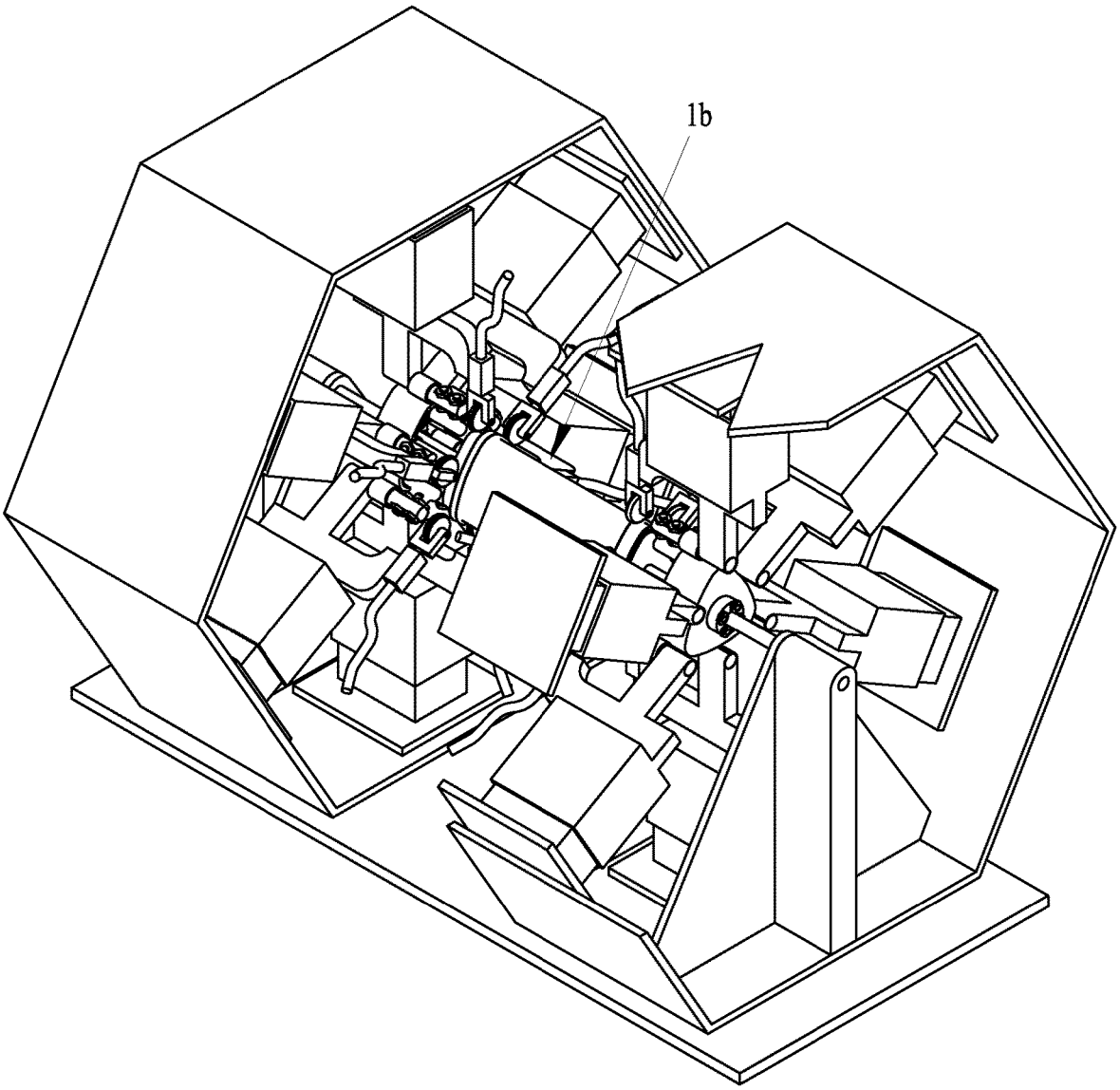

FIG. 3*m* shows the isometric view of the cap spinning machine said in FIG. 3*k*.

Figures 4A, 4B, 4C, 4D:
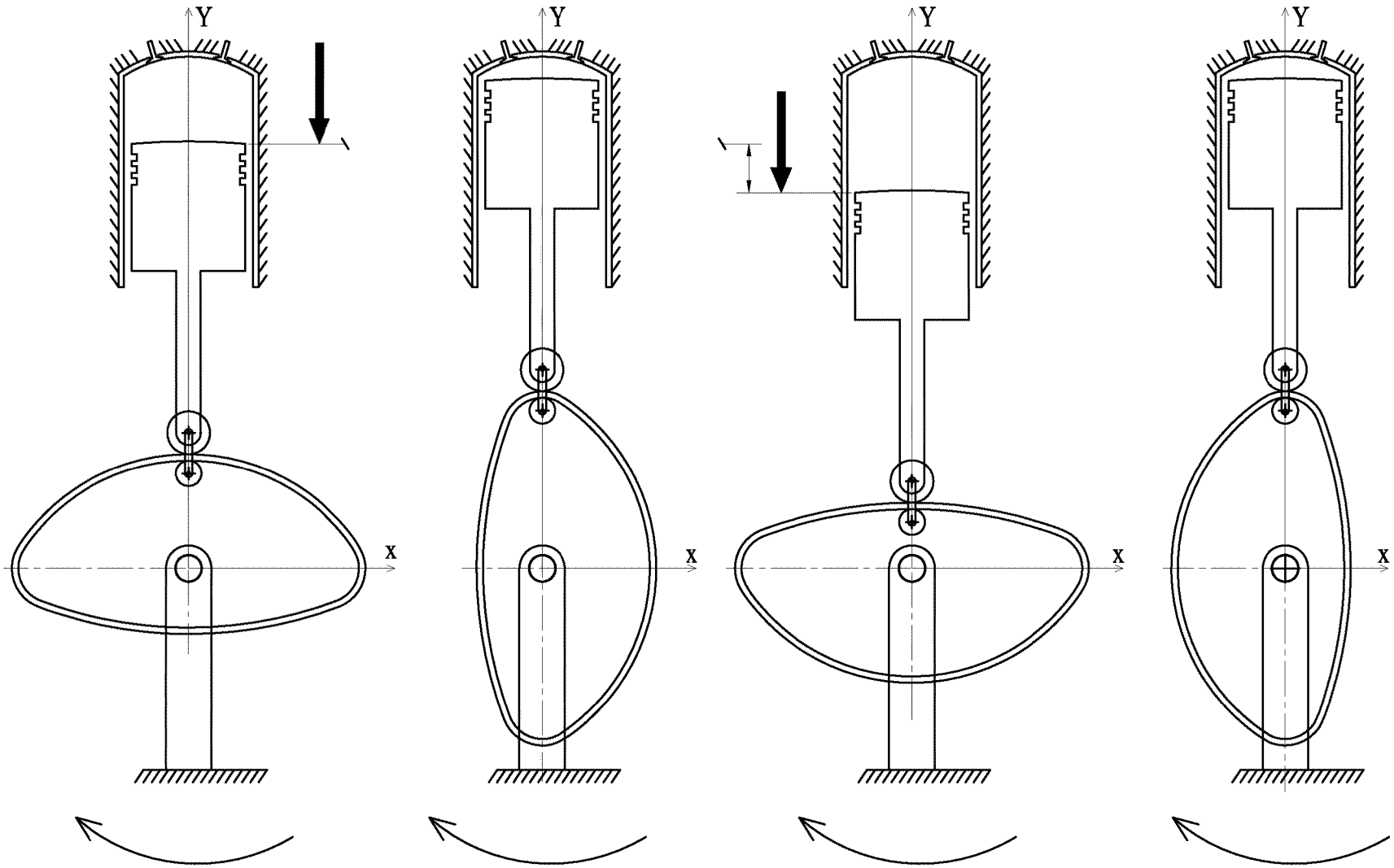

FIG. 4*a* shows the basic geometry of the invention using the First Method for engine crankshaft at the end of intake stroke at bottom dead center position.

FIG. 4*b* shows the basic geometry of the invention using the First Method for engine crankshaft at end of compression stroke at top dead center position.

FIG. 4*c* shows the basic geometry of the invention using the First Method for engine crankshaft at the end of power stroke at bottom dead center position.

FIG. 4*d* shows the basic geometry of the invention using the First Method for engine crankshaft at end of exhaust stroke at top dead center position.

Figure 4E:
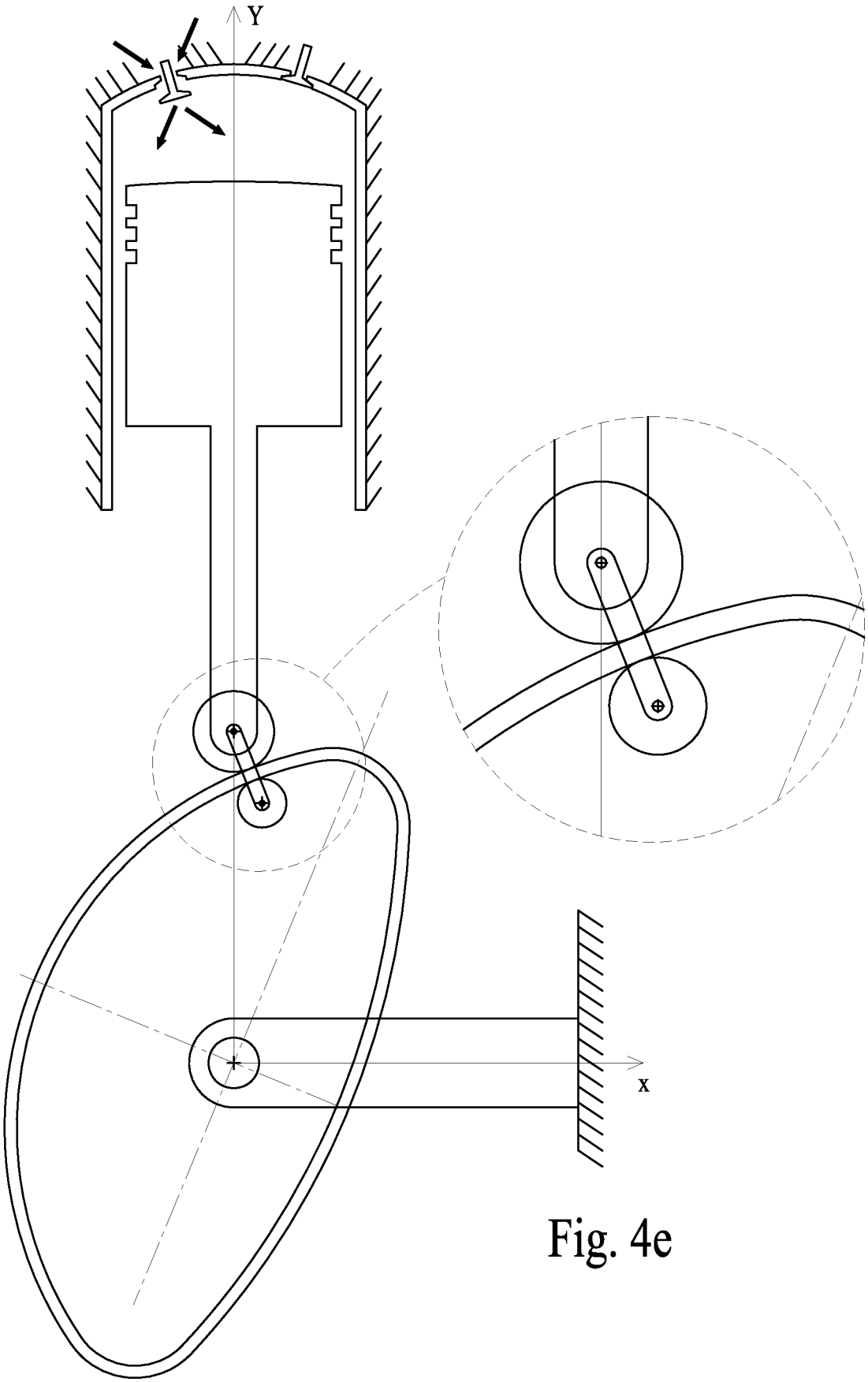

FIG. 4*e* shows the basic geometry of the art using the First Method for engine crankshaft during intake stroke after the crankshaft has rotated 22.5 degrees in clockwise direction from top dead center.

Figure 4F:
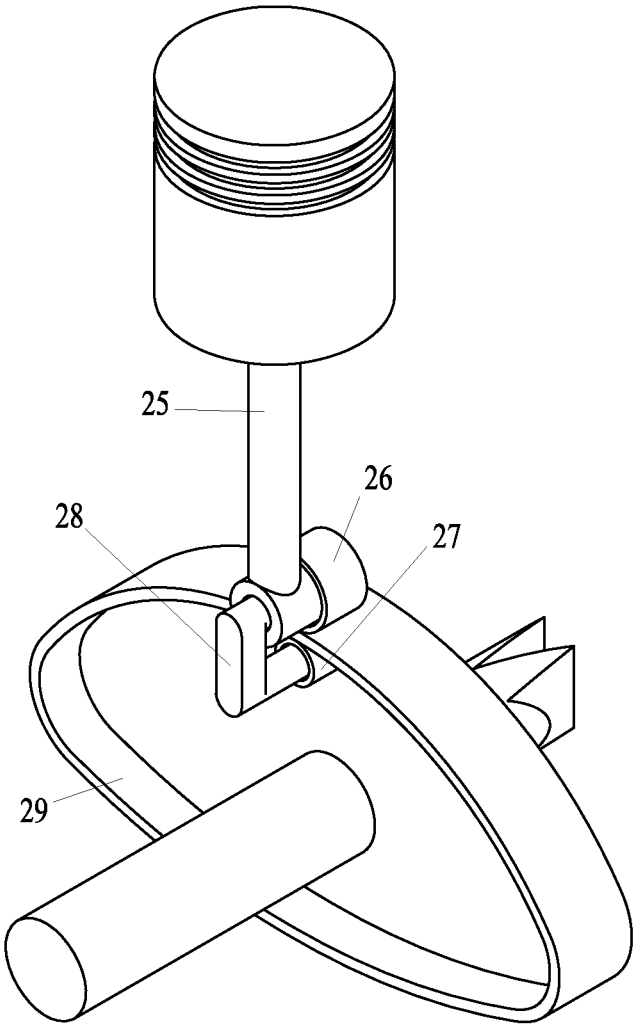

FIG. 4*f* shows the isometric view of a mechanism using the First Method for engine crankshaft.

Figure 4H:
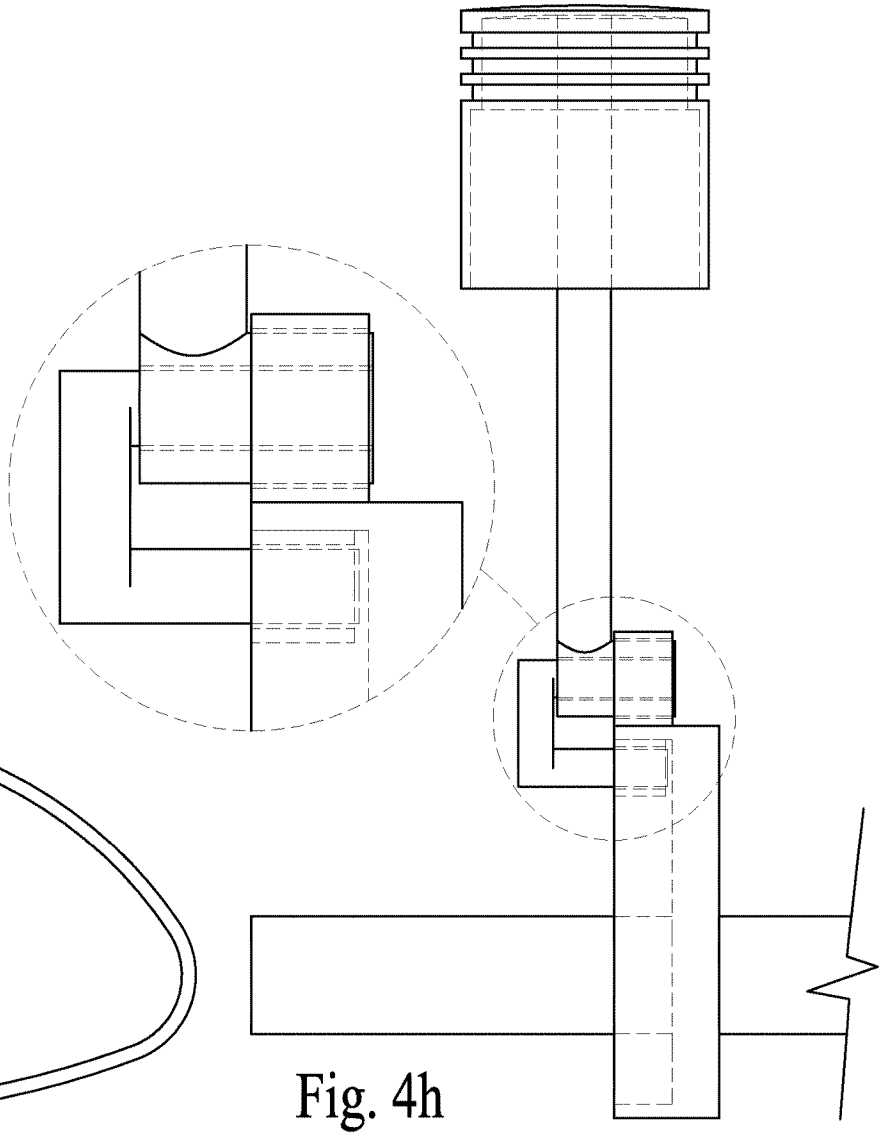
Figure 4G:
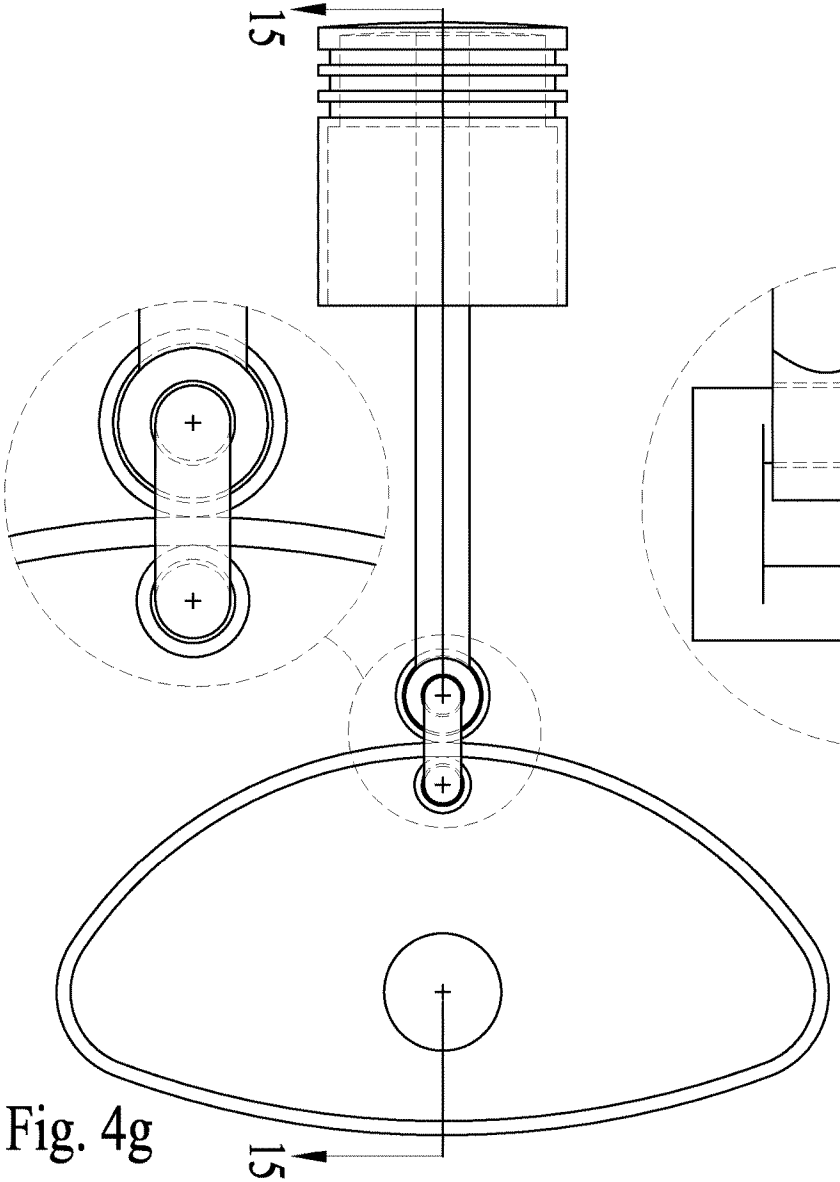

FIG. 4*g* shows the left end view of the mechanism said in FIG. 4*f*.

FIG. 4*h* shows the front end view of the mechanism said in FIG. 4*f*.

Figure 4I:
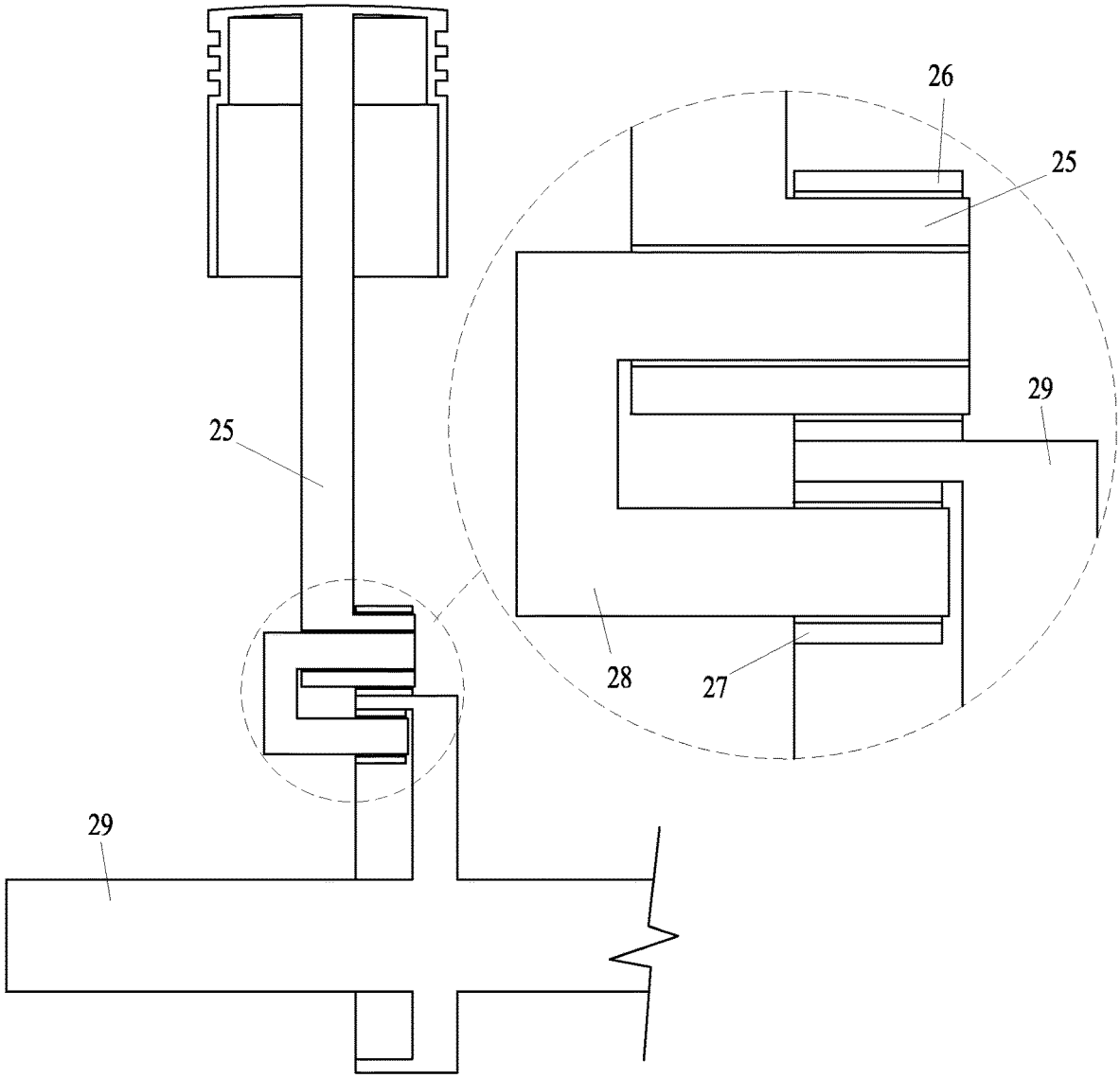

FIG. 4*i* is the section view of section 15-15 from FIG. 4*g*.

Figure 4J:
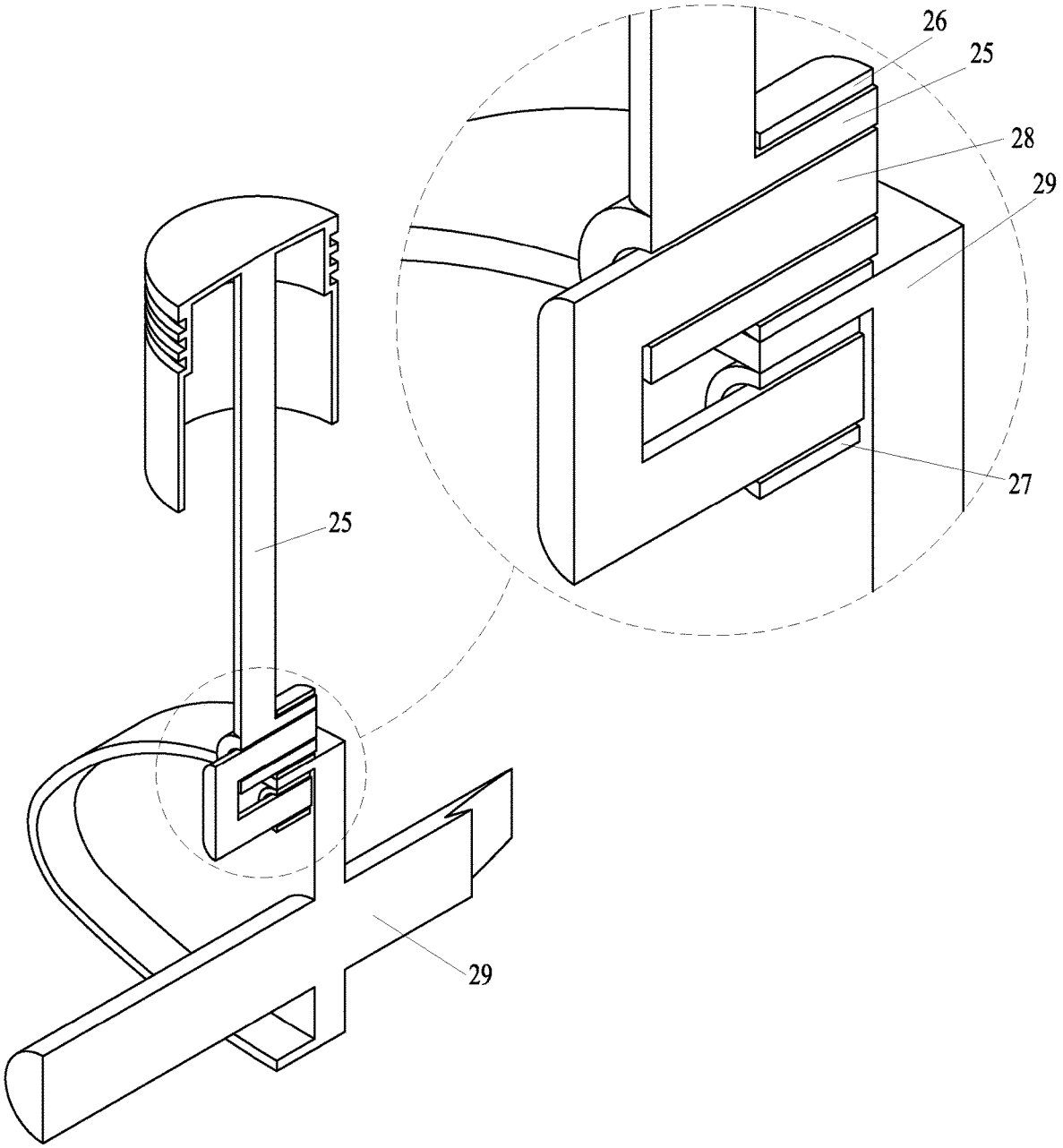

FIG. 4*j* is the isometric view of the section said FIG. 4*i*.

Figure 4K:
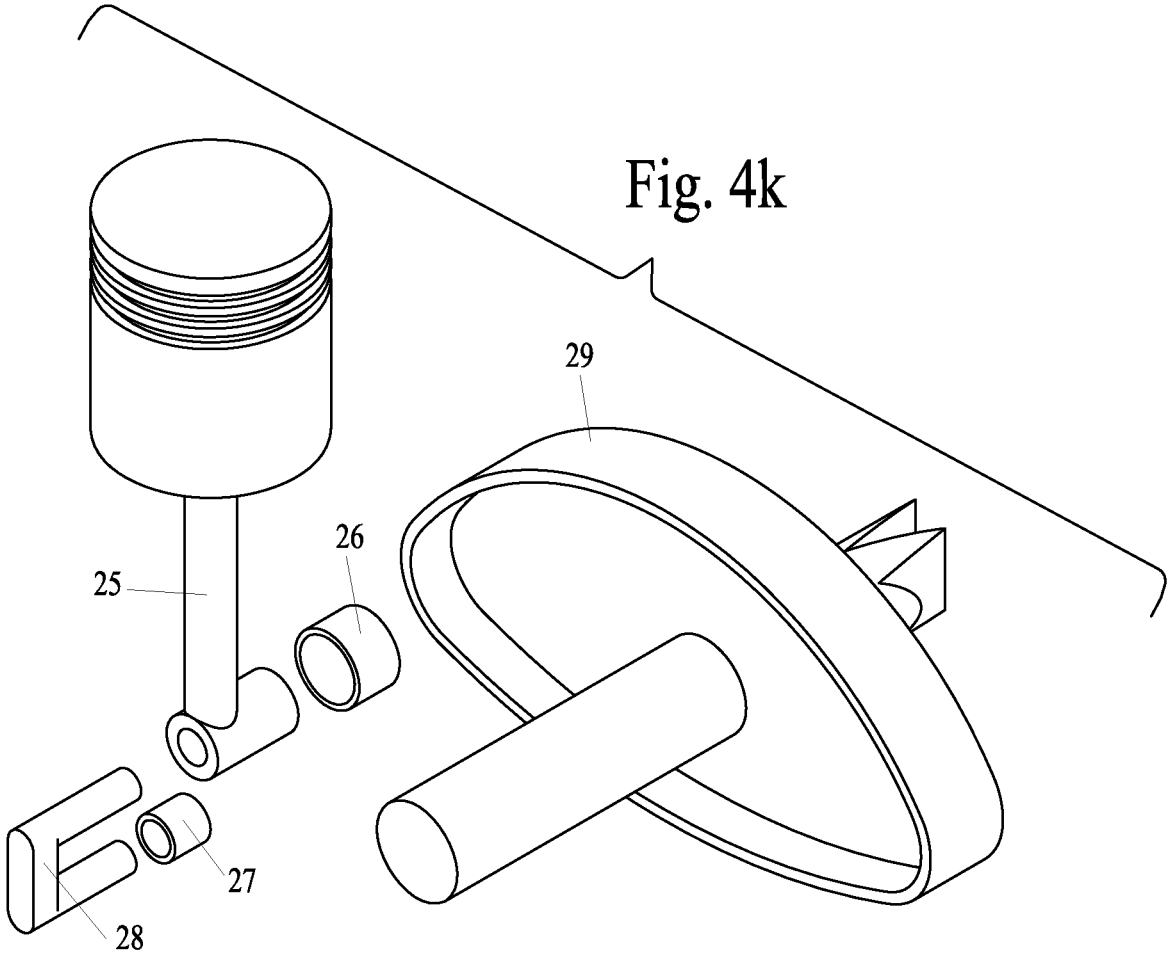

FIG. 4*k* shows the isometric view of the disassembled mechanism said in FIG. 4*f* with all parts labelled.

Figure 5A:
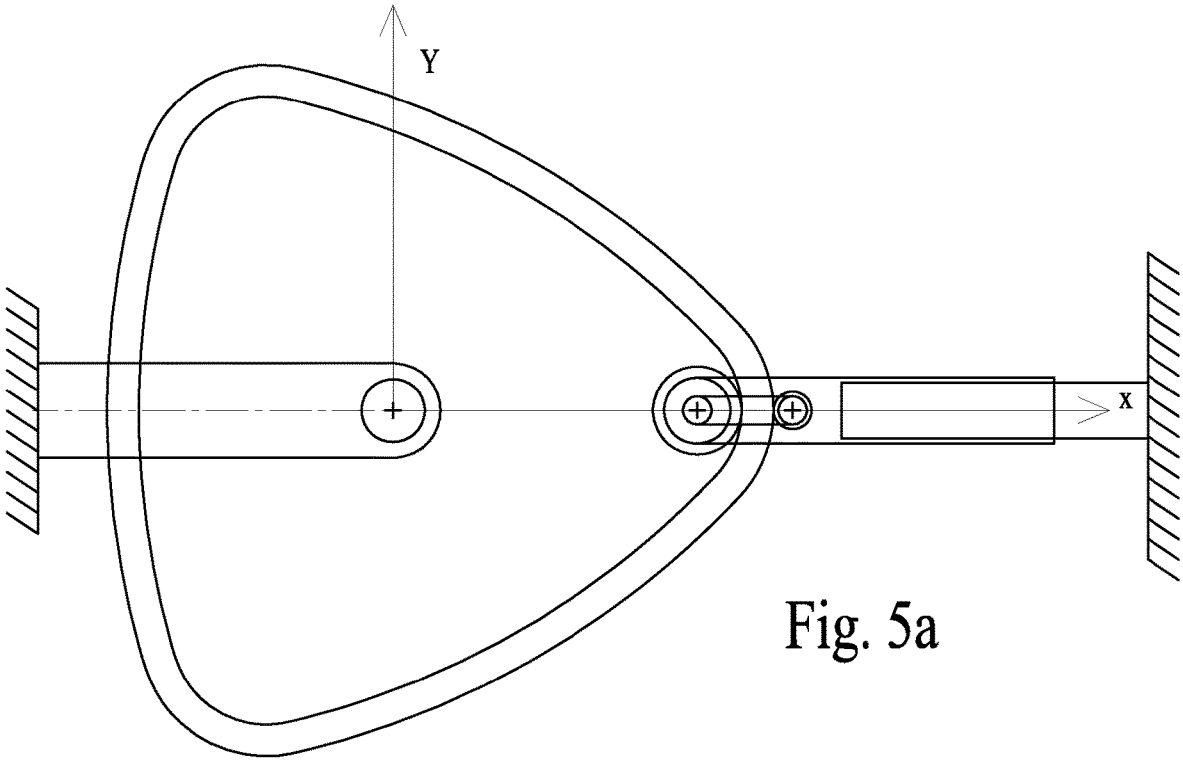

FIG. 5*a* is a simplified geometry for the Second Method applied to muffler cap spinner without the geometry parts being labelled.

Figure 5B:
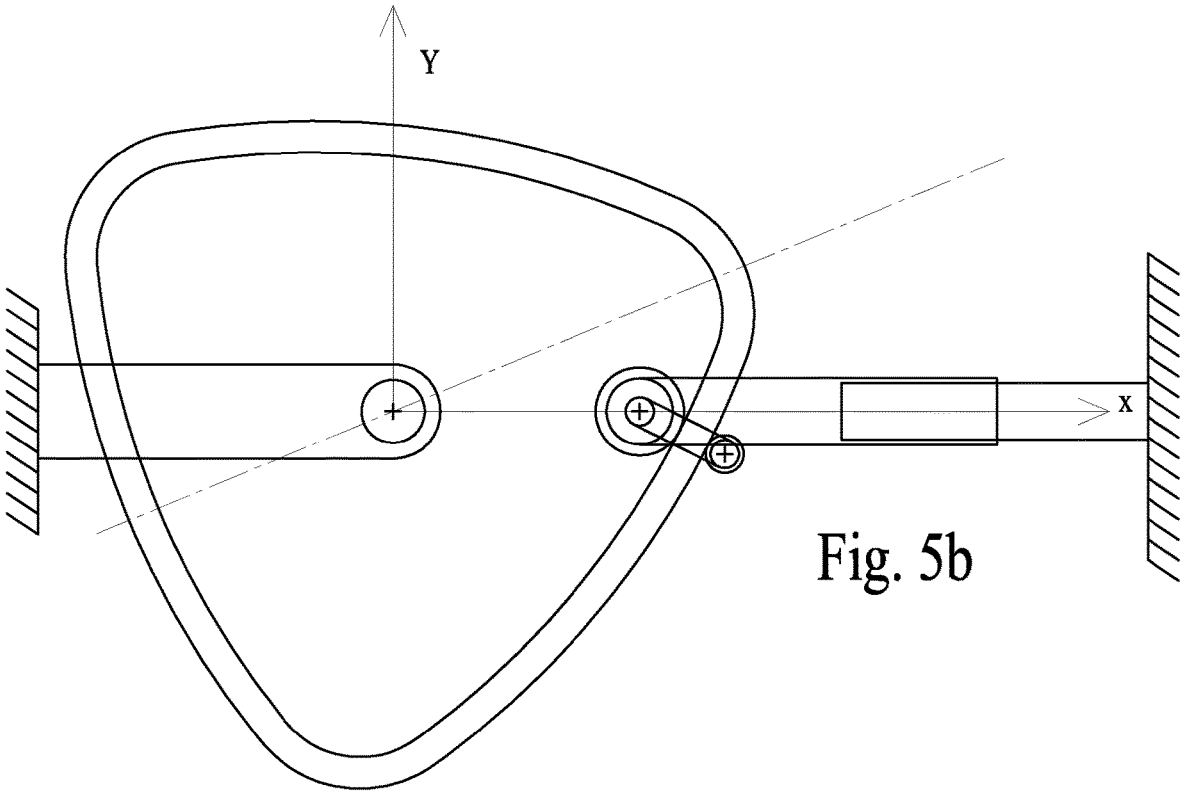

FIG. 5*b* is a simplified geometry said in FIG. 5*a* after a 22.5 degrees rotation of the cam in counter clockwise direction.

Figure 6A:
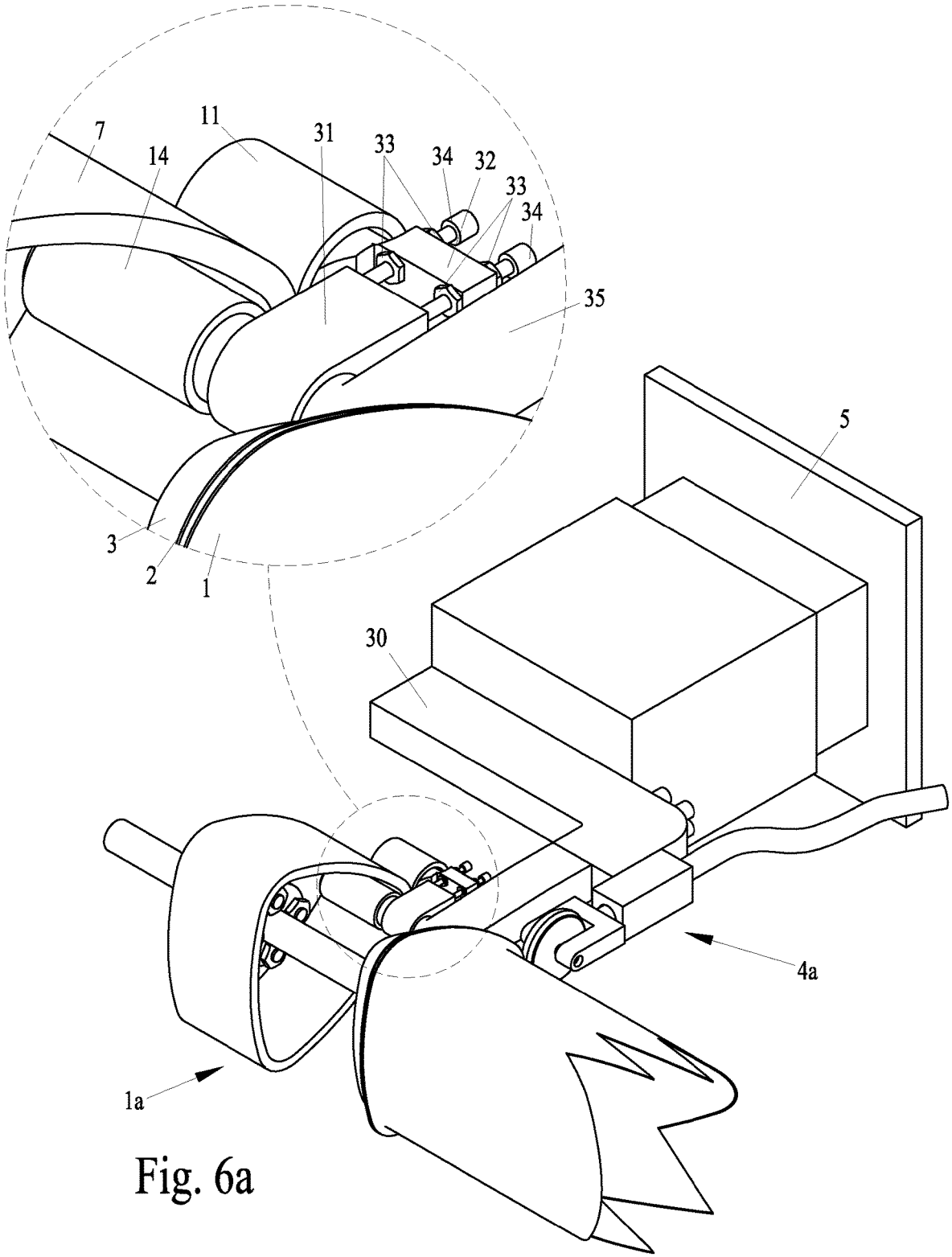

FIG. 6*a* shows the isometric view of a typical mechanism using the Second Method for muffler cap spinner.

Figure 6B:
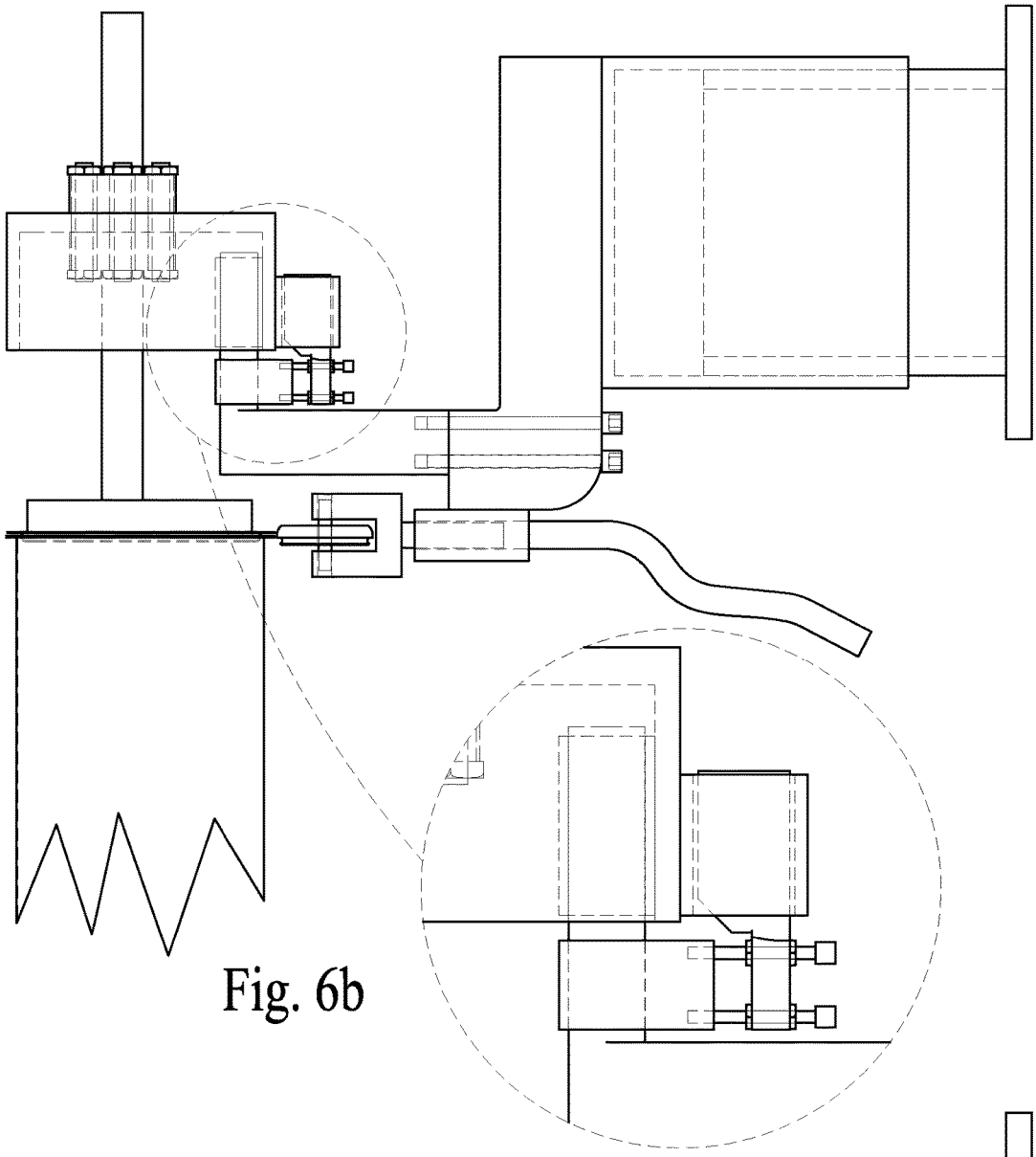

FIG. 6*b* shows the top view of mechanism said in FIG. 6*a*.

Figure 6C:
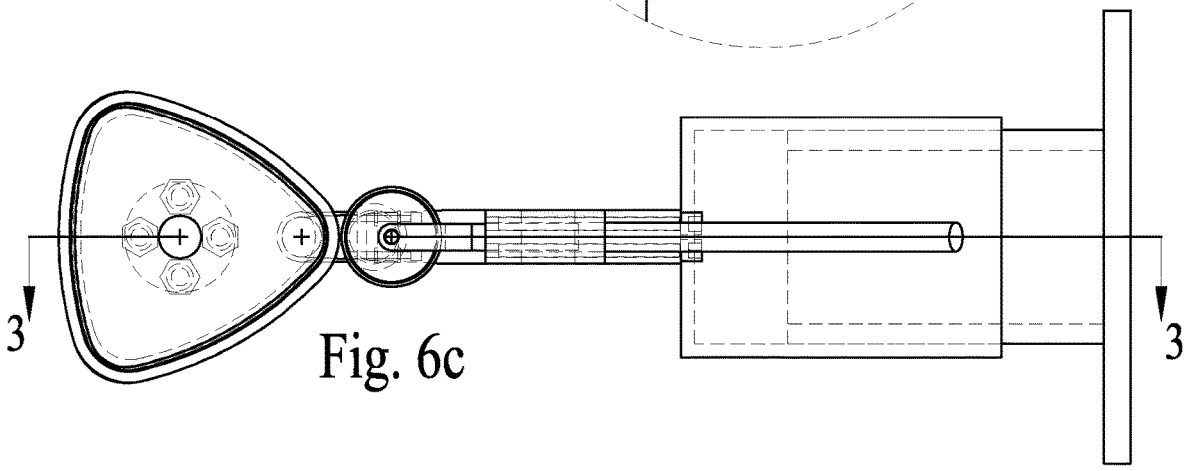

FIG. 6*c* shows the front end view of the mechanism said in FIG. 6*a*.

Figure 6D:
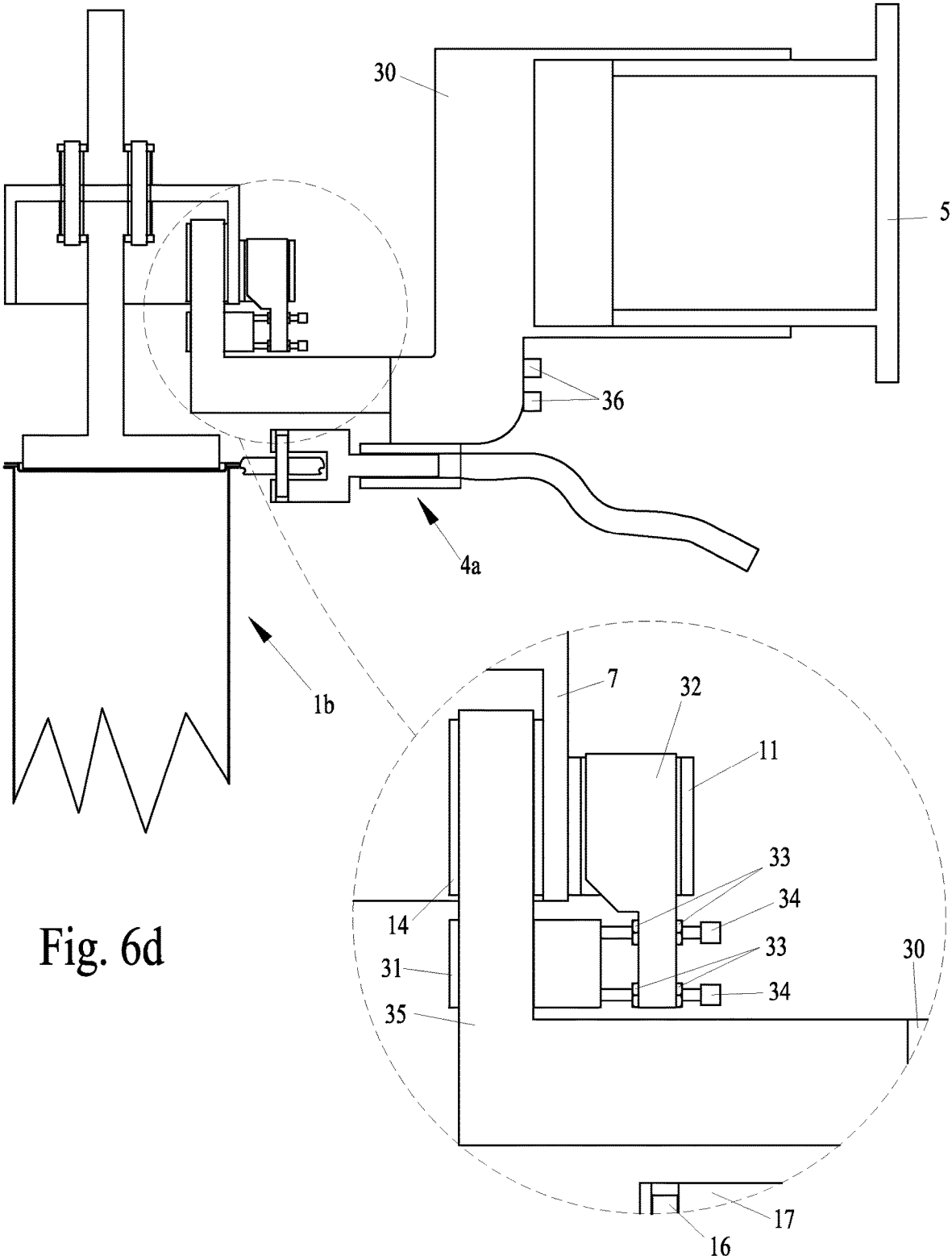

FIG. 6*d* is the section view of section 3-3 from FIG. 6*c*.

Figure 6E:
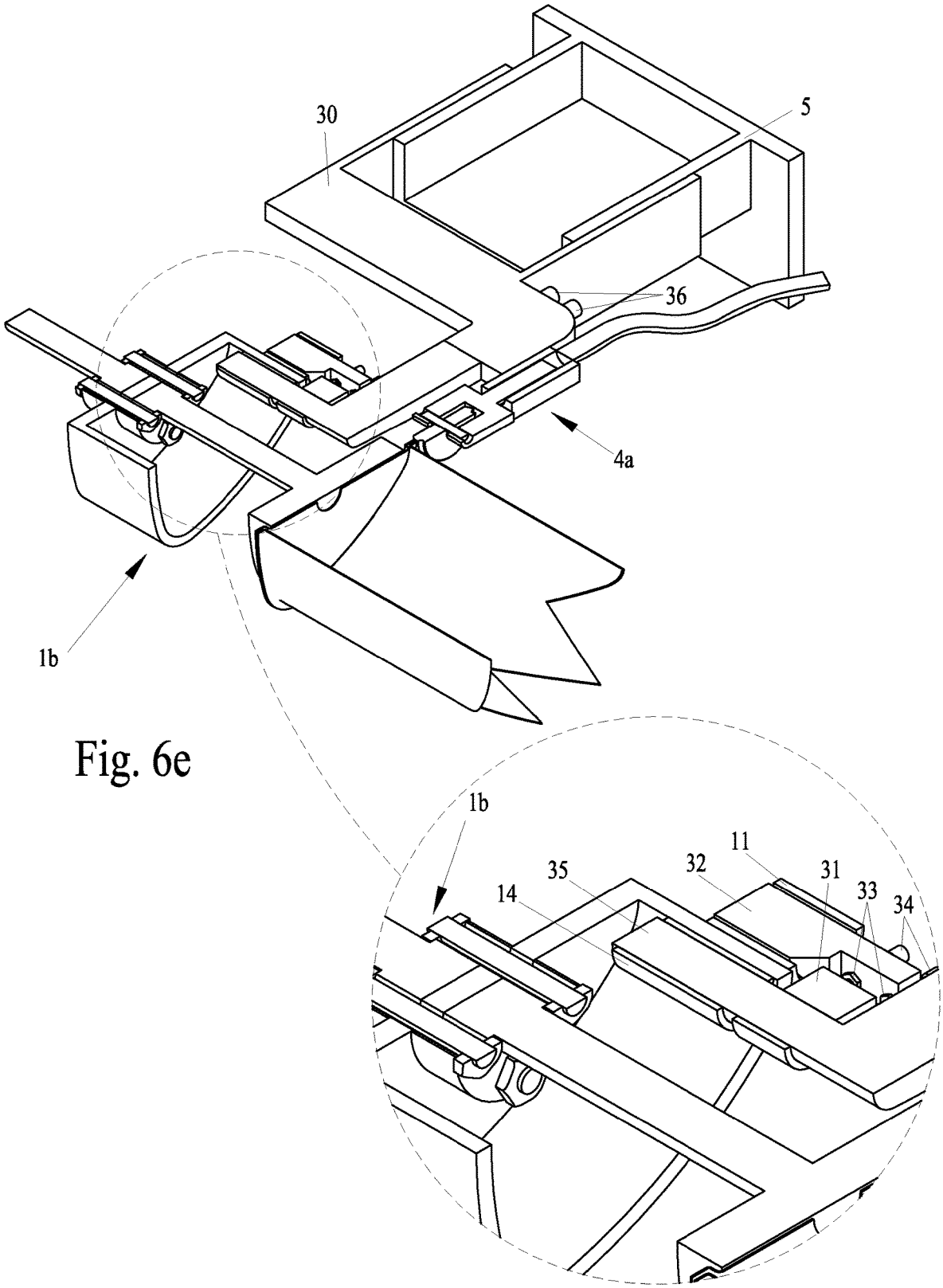

FIG. 6*e* is the isometric view of the section 3-3 said in FIG. 6*d*.

Figure 6F:
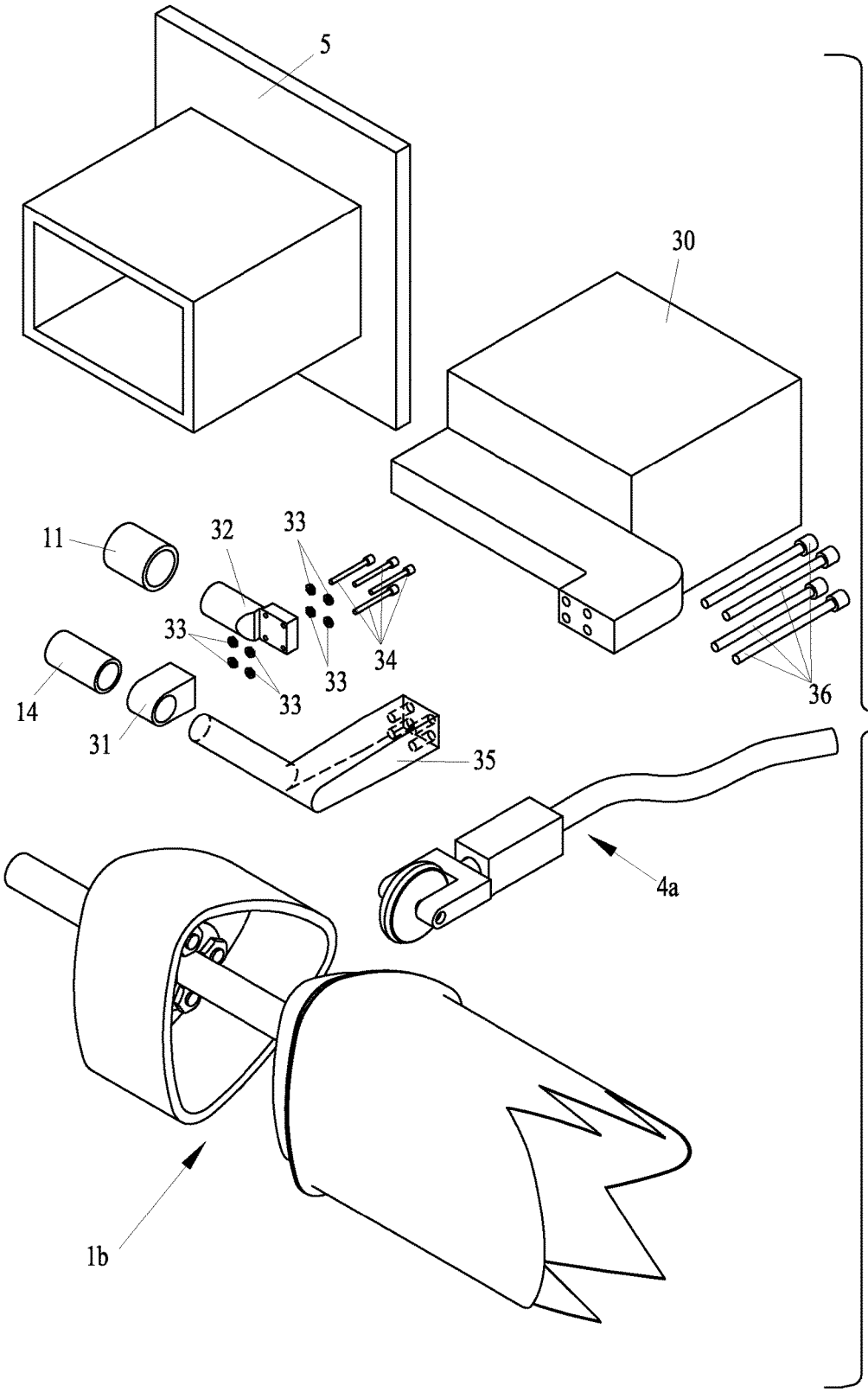

FIG. 6*f* shows the isometric view of the mechanism said in FIG. 6*a* disassembled and all parts labelled.

Figure 6G:
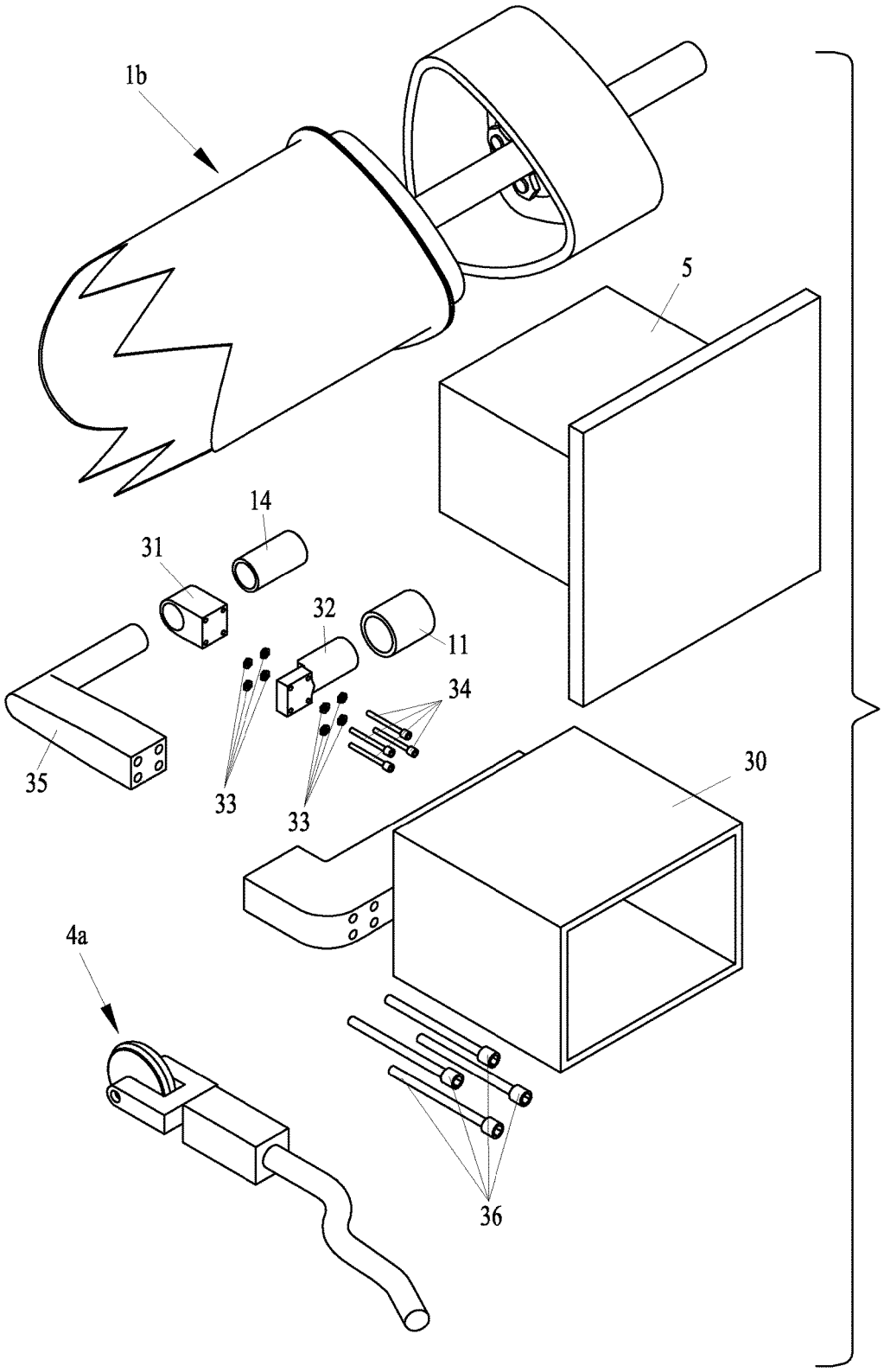

FIG. 6*g* shows an additional isometric view of the mechanism said in FIG. 6*a* disassembled and all parts labelled.

Figure 7:
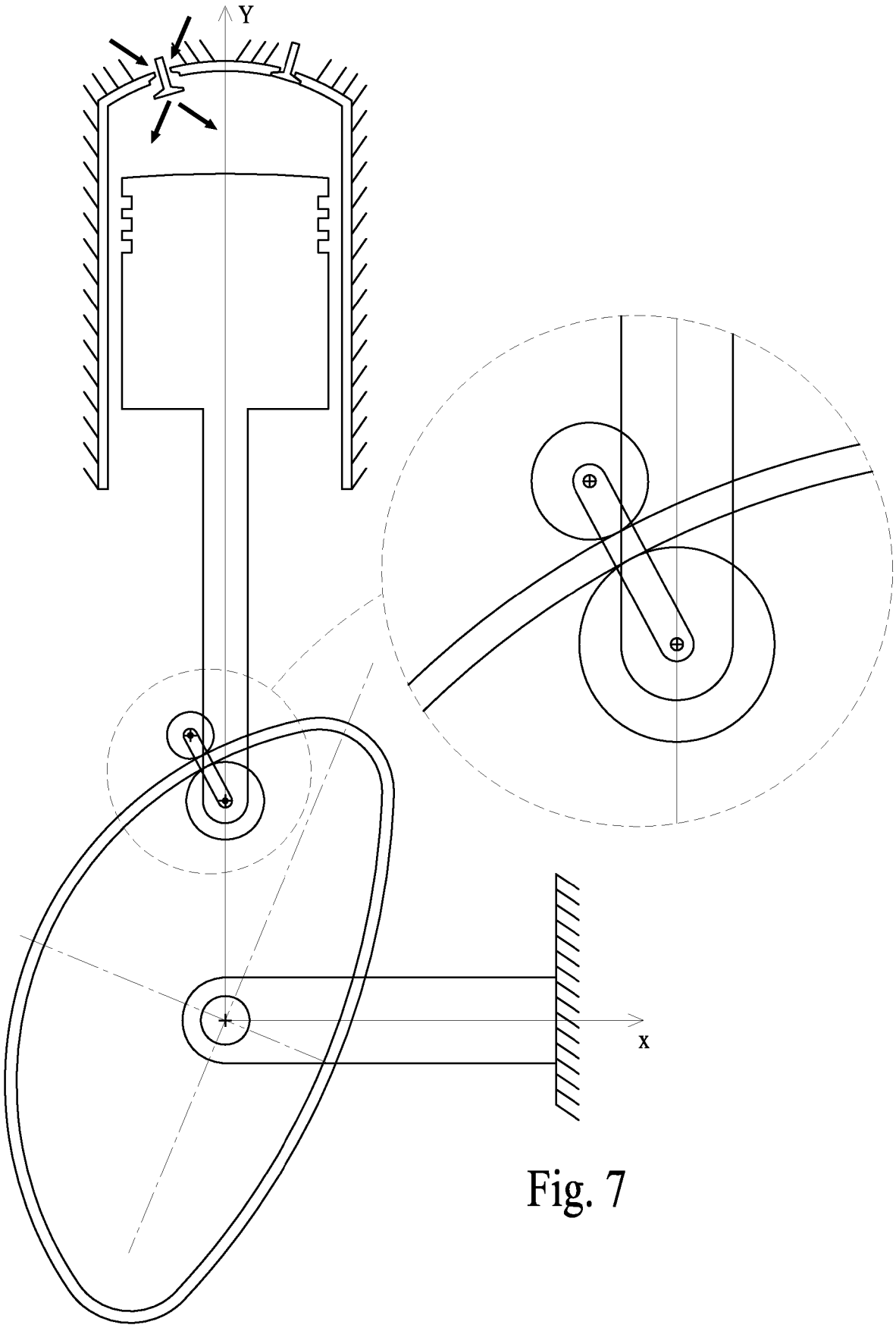

FIG. 7 shows the basic geometry of the art using the Second Method for engine crankshaft during intake stroke after the crankshaft has rotated 22.5 degrees in clockwise direction from top dead center position.

Figure 7A:
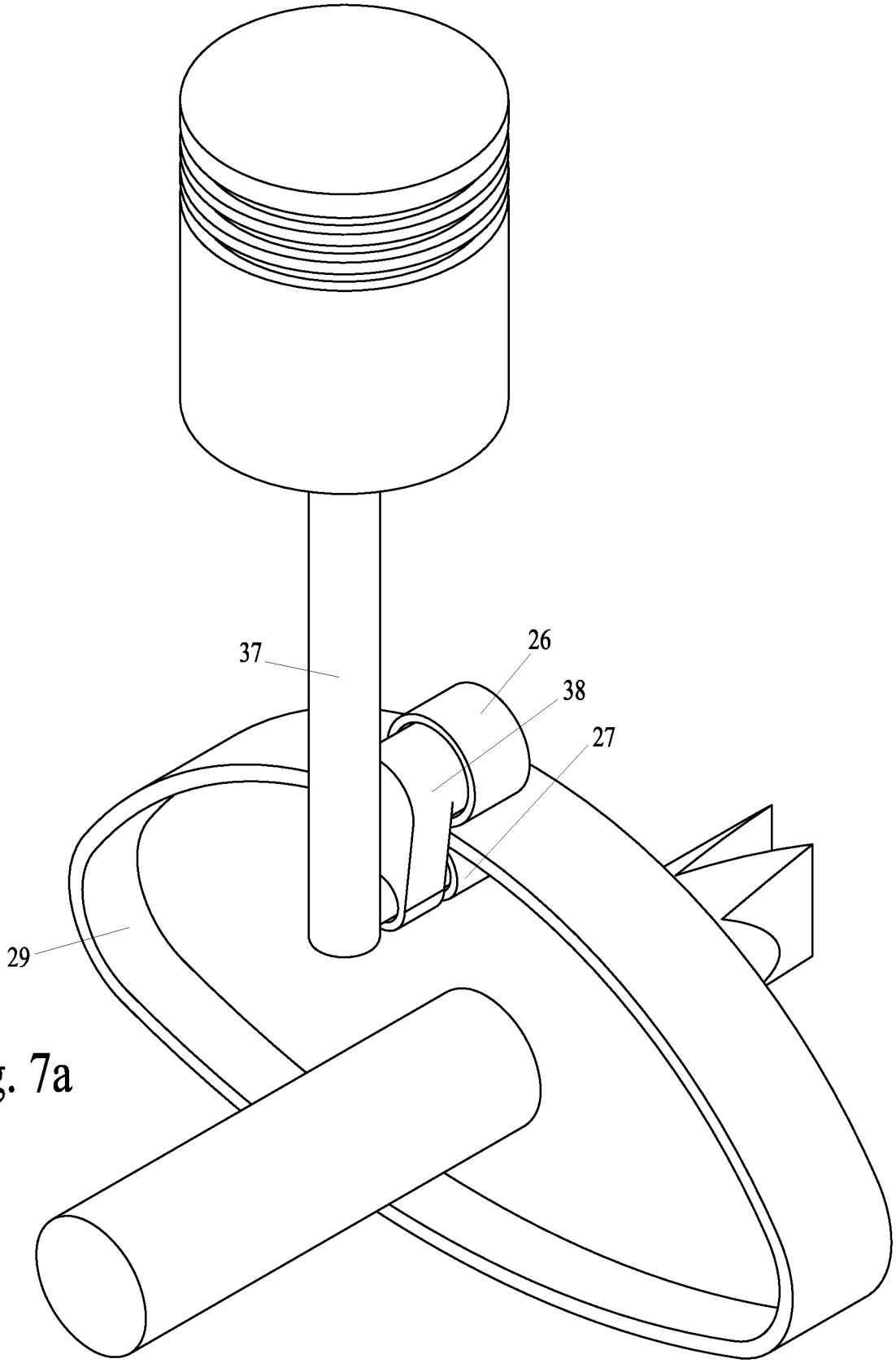

FIG. 7*a* shows the isometric view of a typical assembled mechanism using the Second Method for engine crankshaft with all parts labelled.

Figures 7B, 7C:
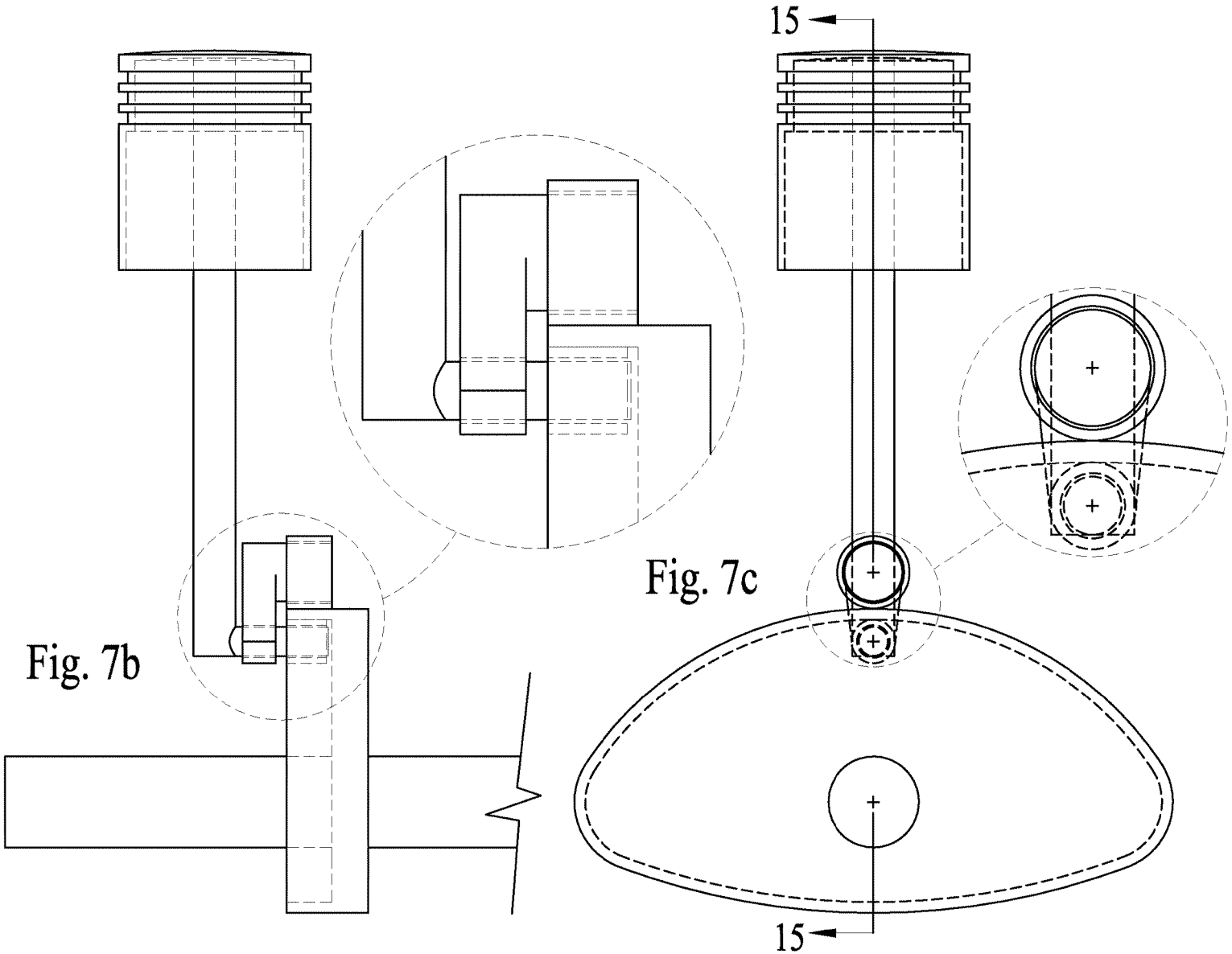

FIG. 7*b* shows the front view of the mechanism said in FIG. 7*a*.

FIG. 7*c* shows the right view of the mechanism said in FIG. 7*a*.

Figure 7D:
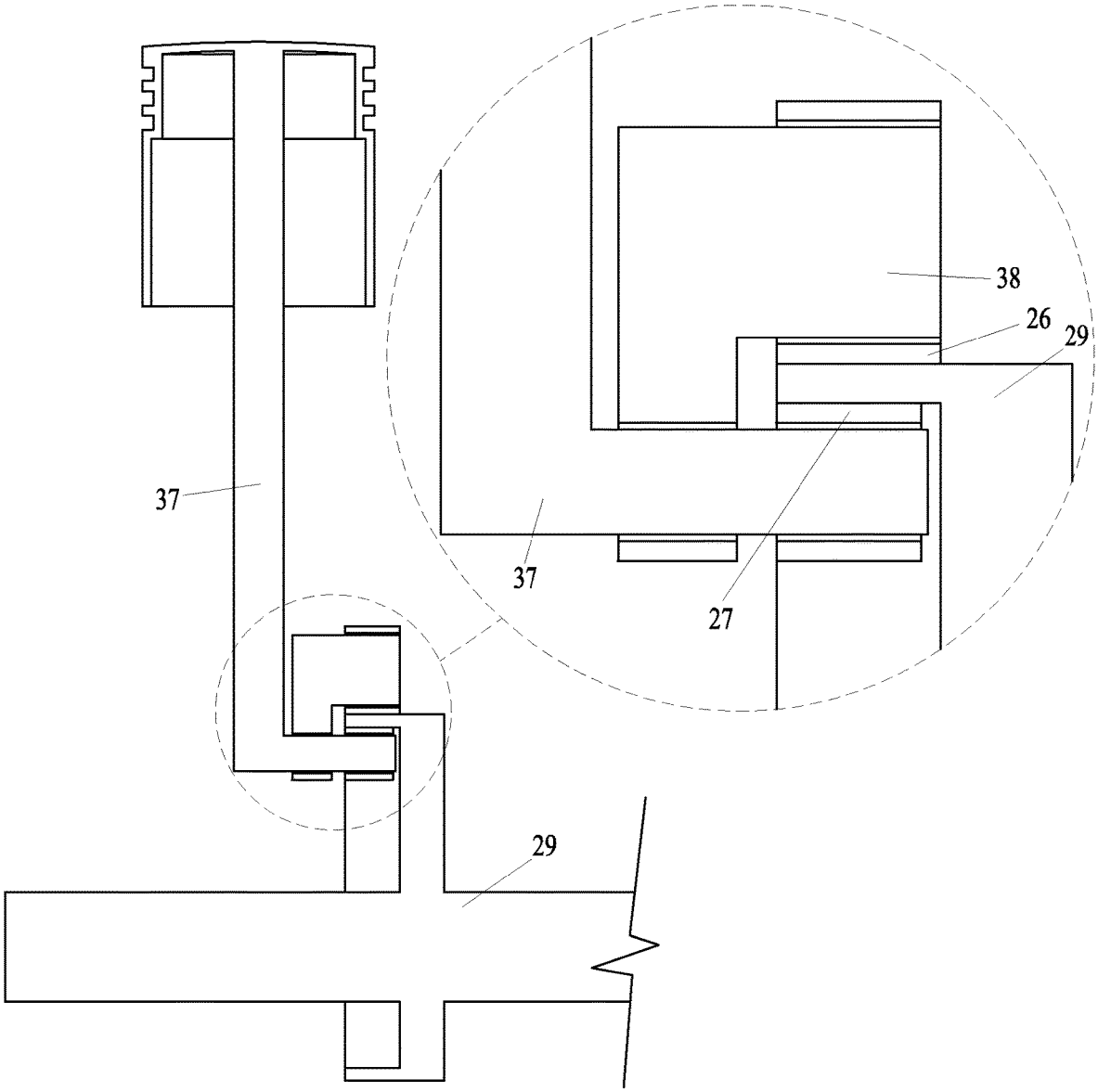

FIG. 7*d* shows the section view of section 15-15 shown from FIG. 7*c*.

Figure 7E:
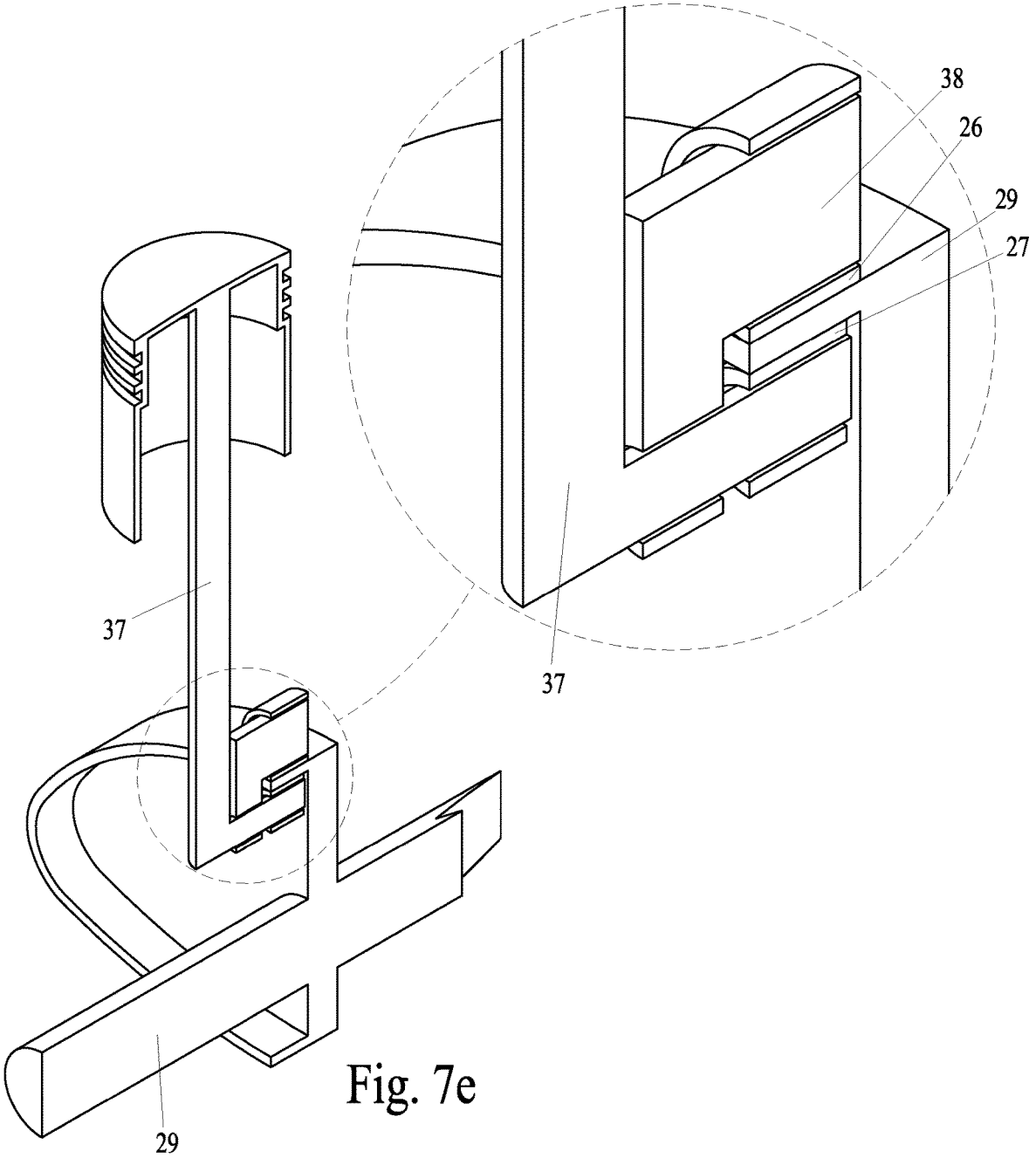

FIG. 7*e* shows the isometric view of the section 15-15 said in FIG. 7*d*.

Figure 7F:
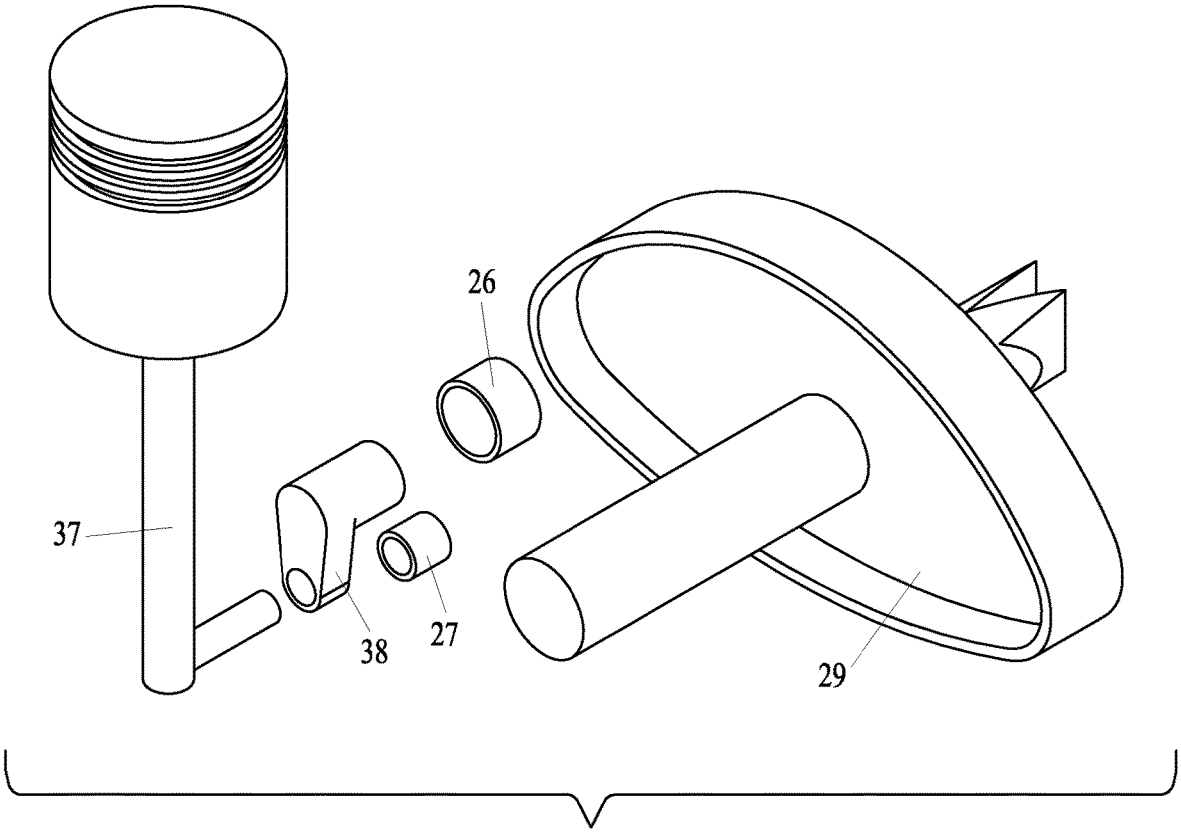

FIG. 7*f* shows the isometric view of the mechanism said in FIG. 7*a* disassembled and all parts labelled.

Figure 8A:
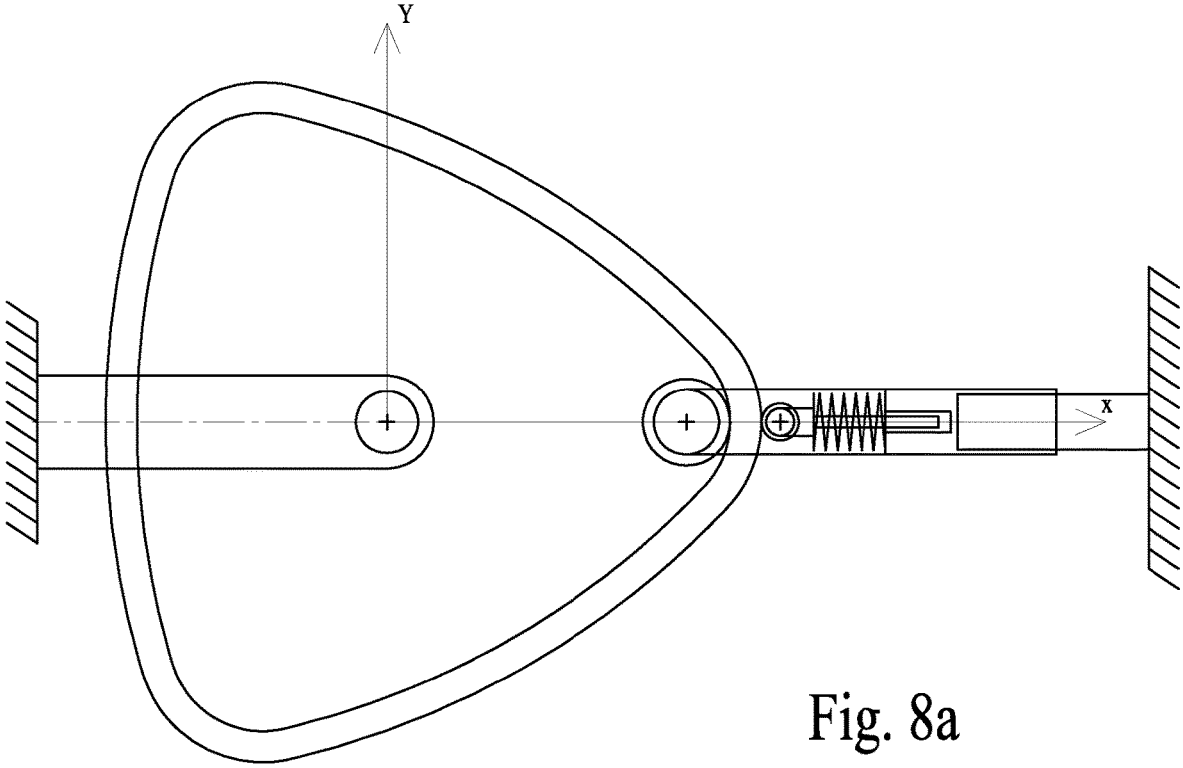

FIG. 8*a* is a simplified geometry for the Third Method applied to muffler cap spinner.

Figure 8B:
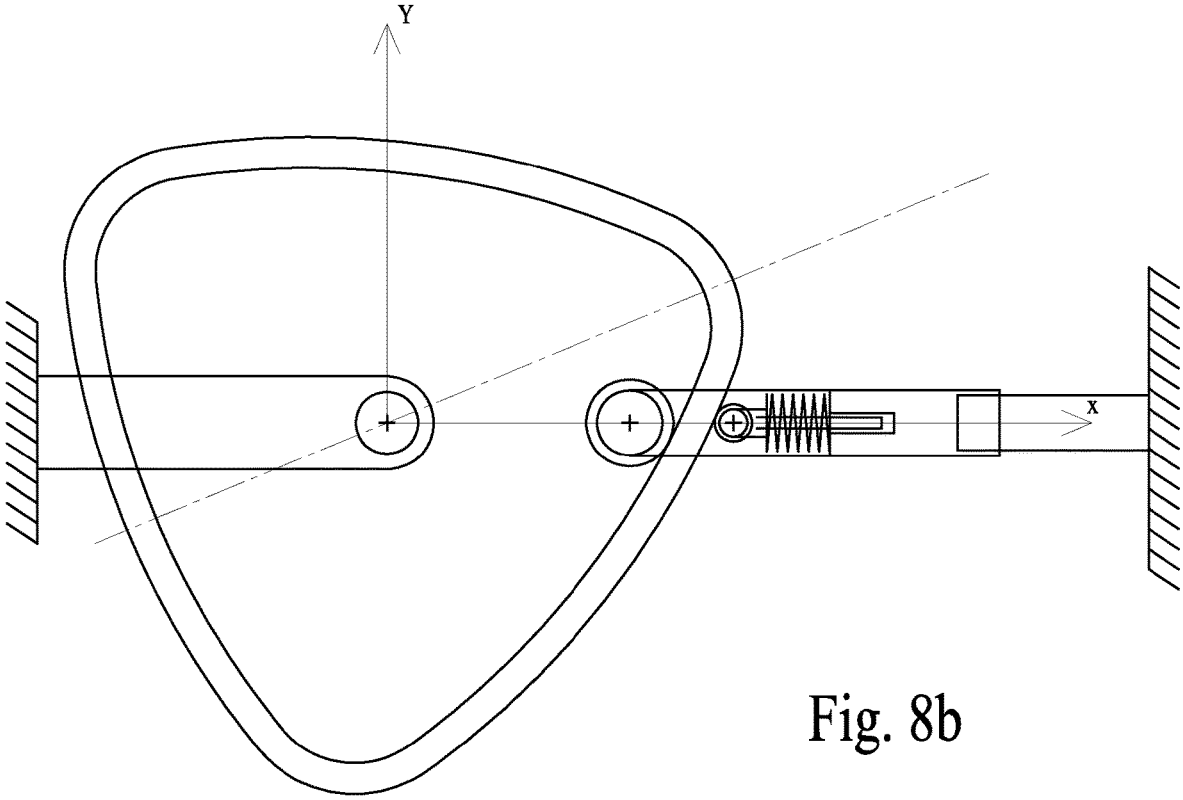

FIG. 8*b* is a simplified geometry said in FIG. 8*a* after a 22.5 degrees rotation of the cam in counter clock wise direction.

Figure 8C:
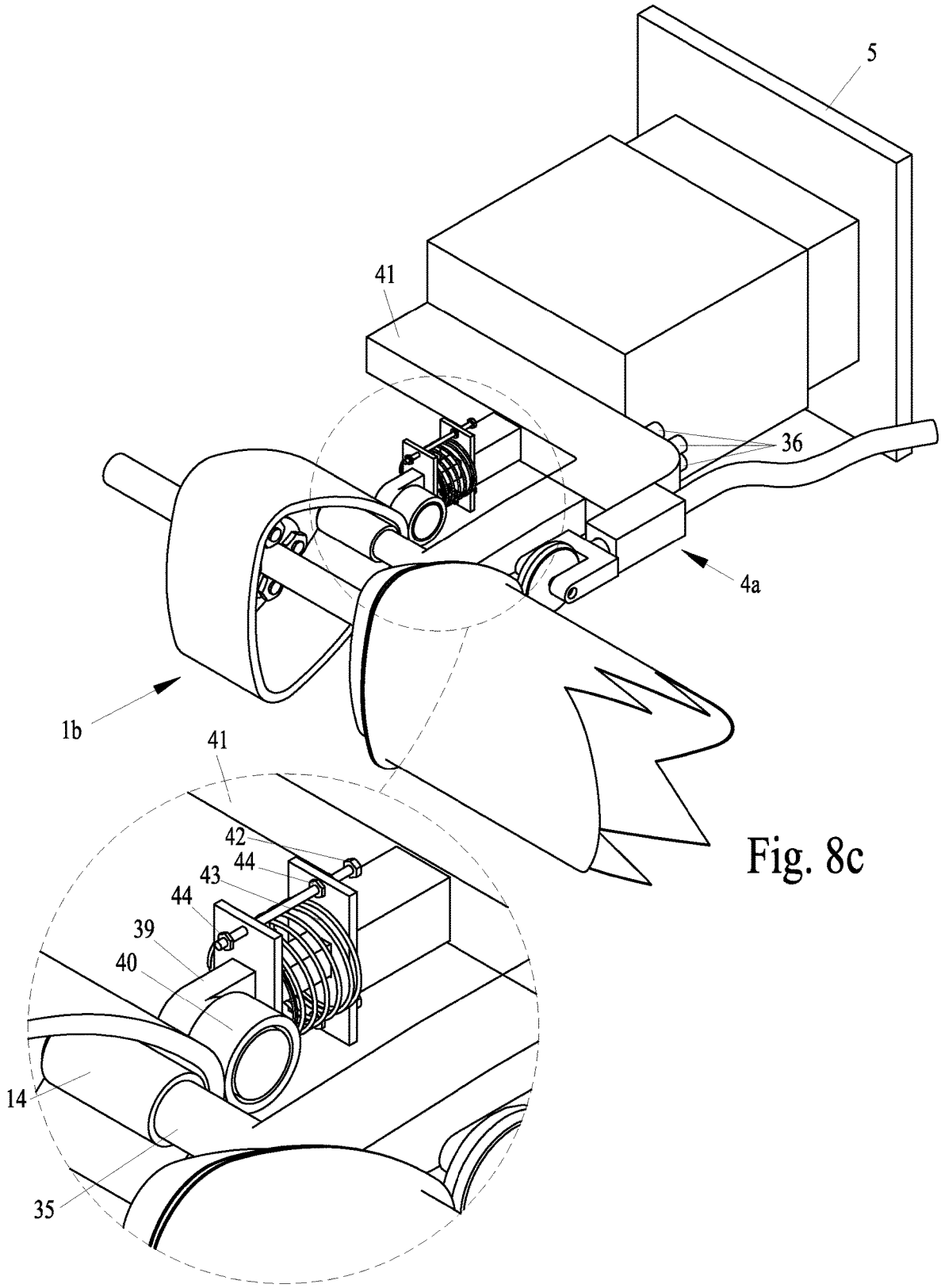

FIG. 8*c* shows the isometric view of a typical mechanism using the Third Method for muffler cap spinner.

Figure 8D:
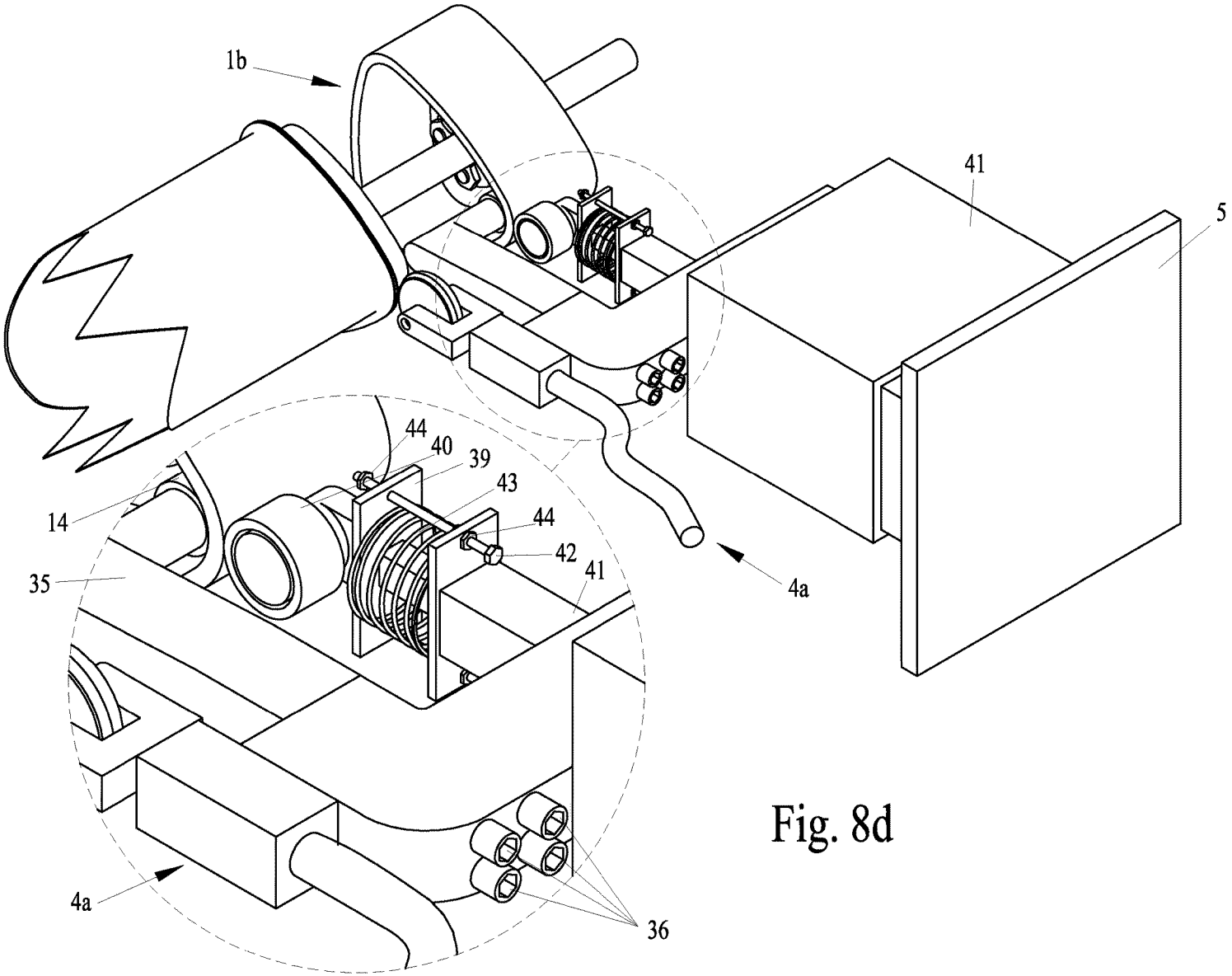

FIG. 8*d* shows an additional isometric view of the mechanism said in FIG. 8*c*.

Figure 8E:
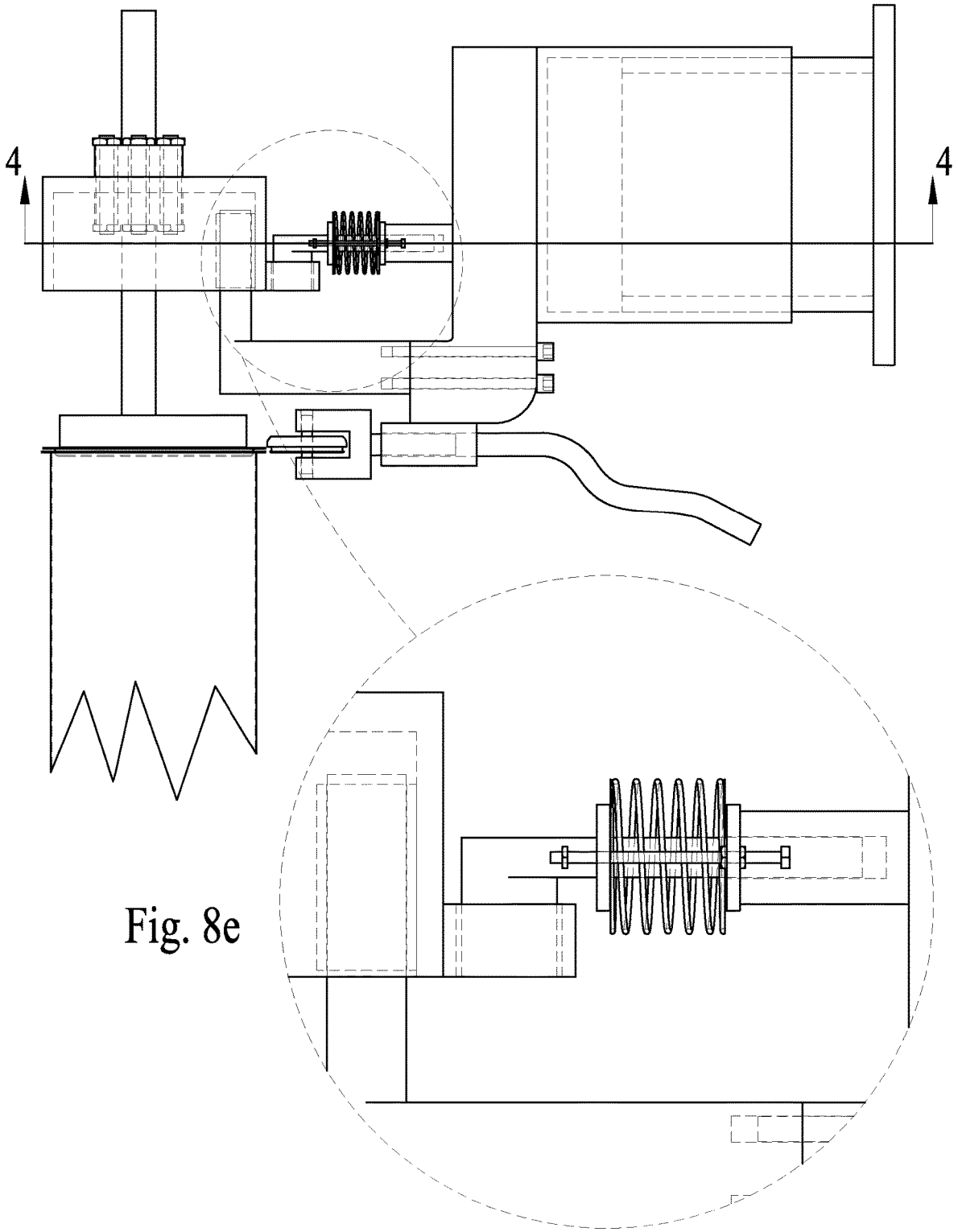

FIG. 8*e* shows the top view of the mechanism said in FIG. 8*c*.

Figure 8F:
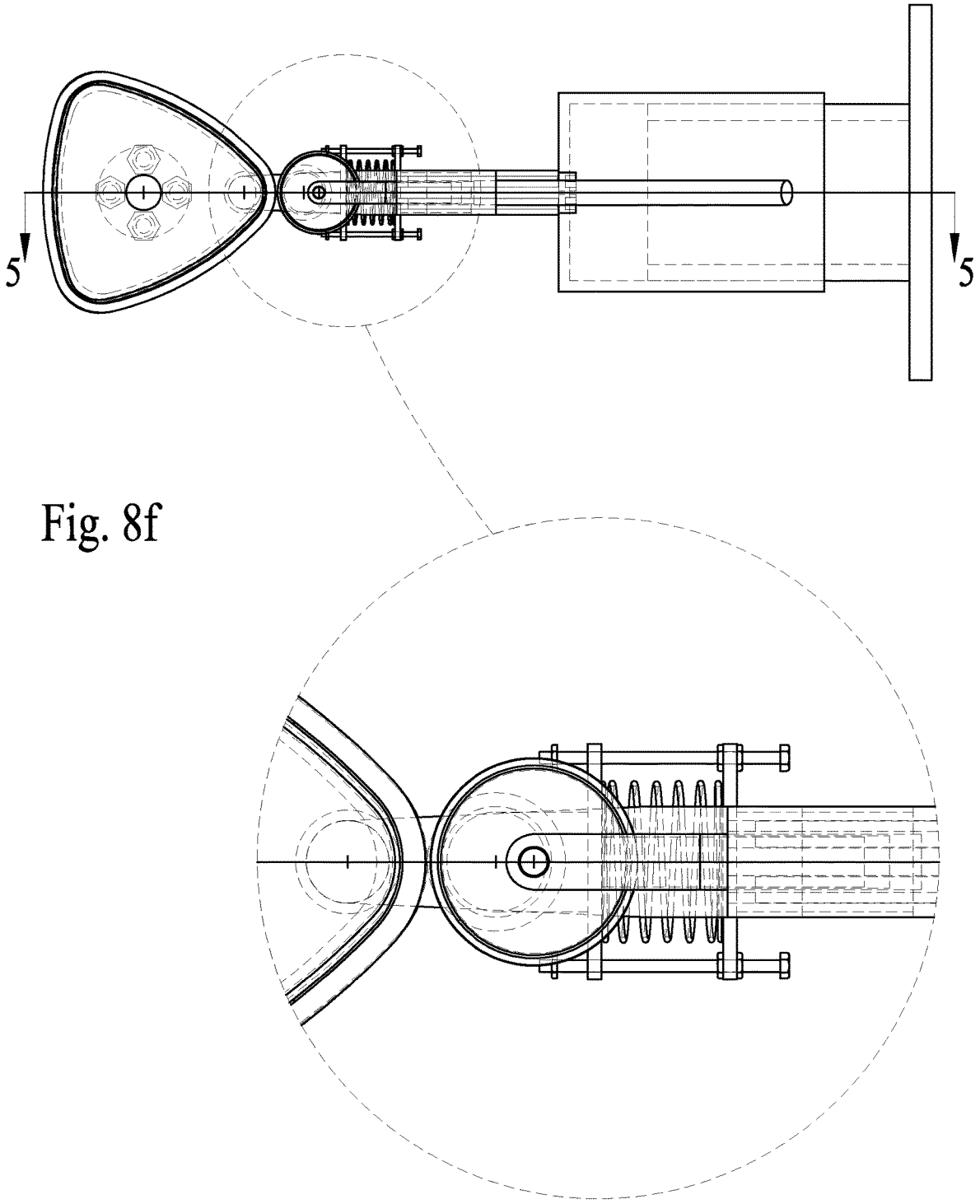

FIG. 8*f* shows the front view of the mechanism said in FIG. 8*c*.

Figure 8G:
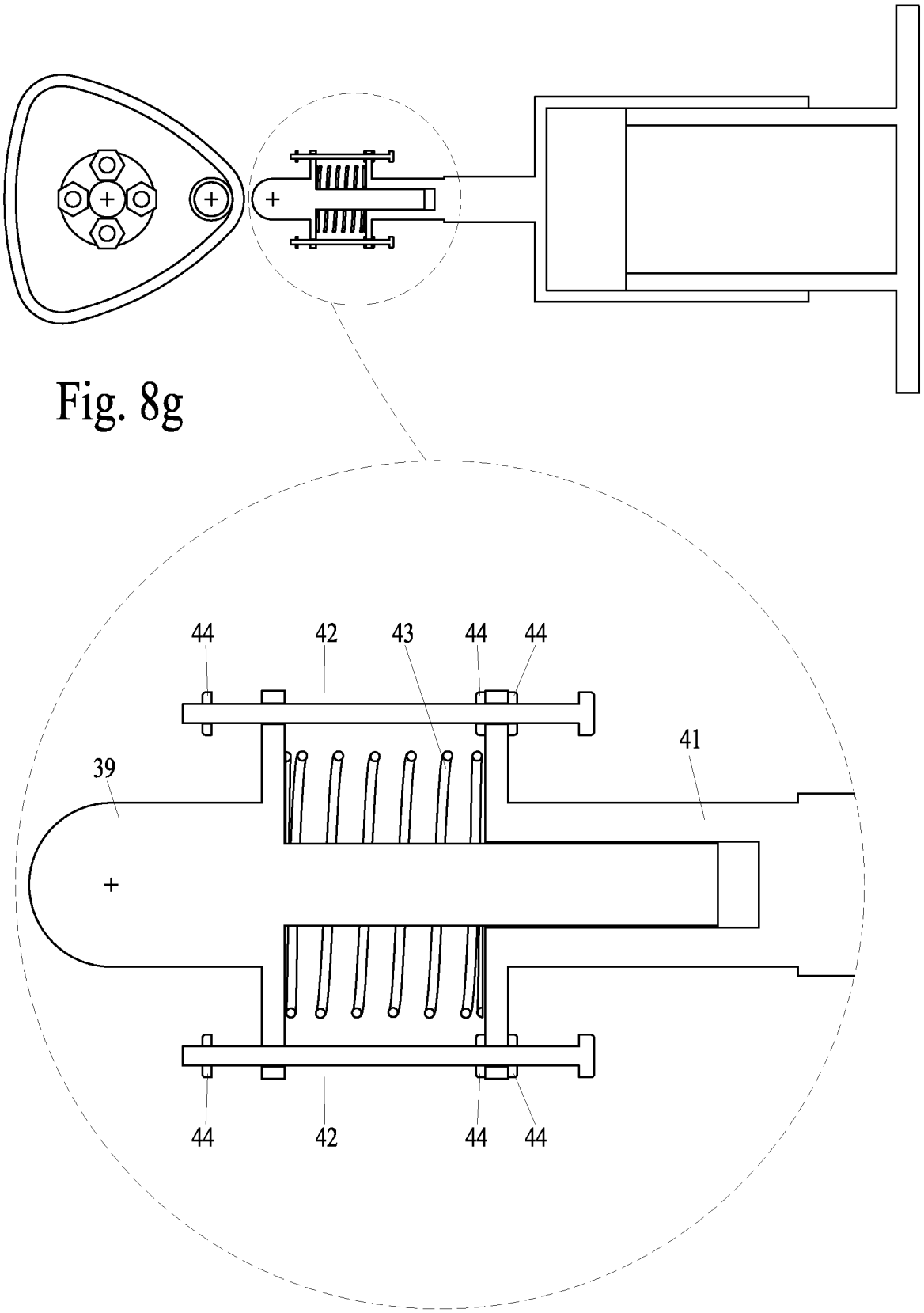

FIG. 8*g* shows the section view 4-4 from FIG. 8*e*.

Figure 8H:
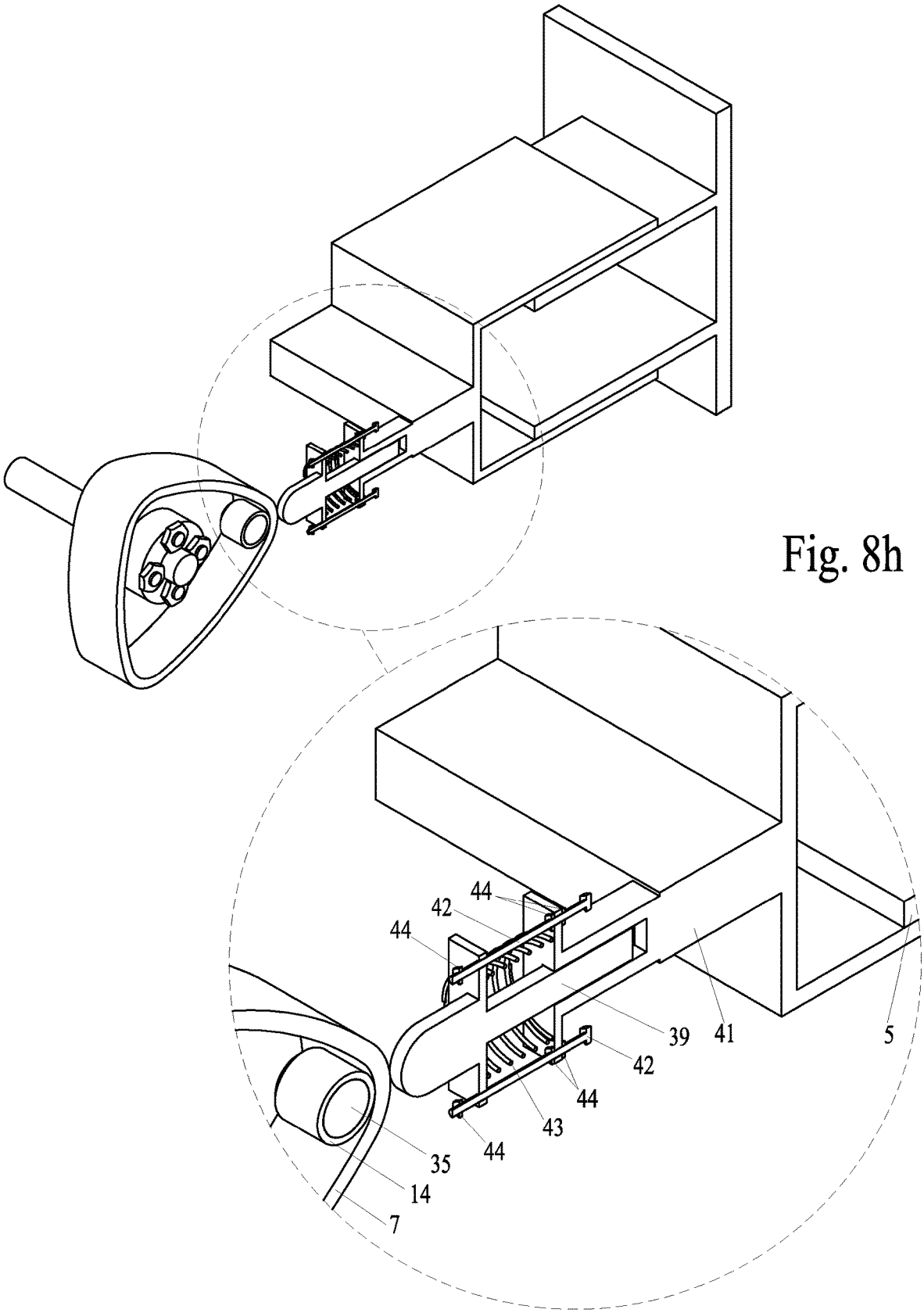

FIG. 8*h* shows the isometric view of the section said in FIG. 8*g*.

Figure 8I:
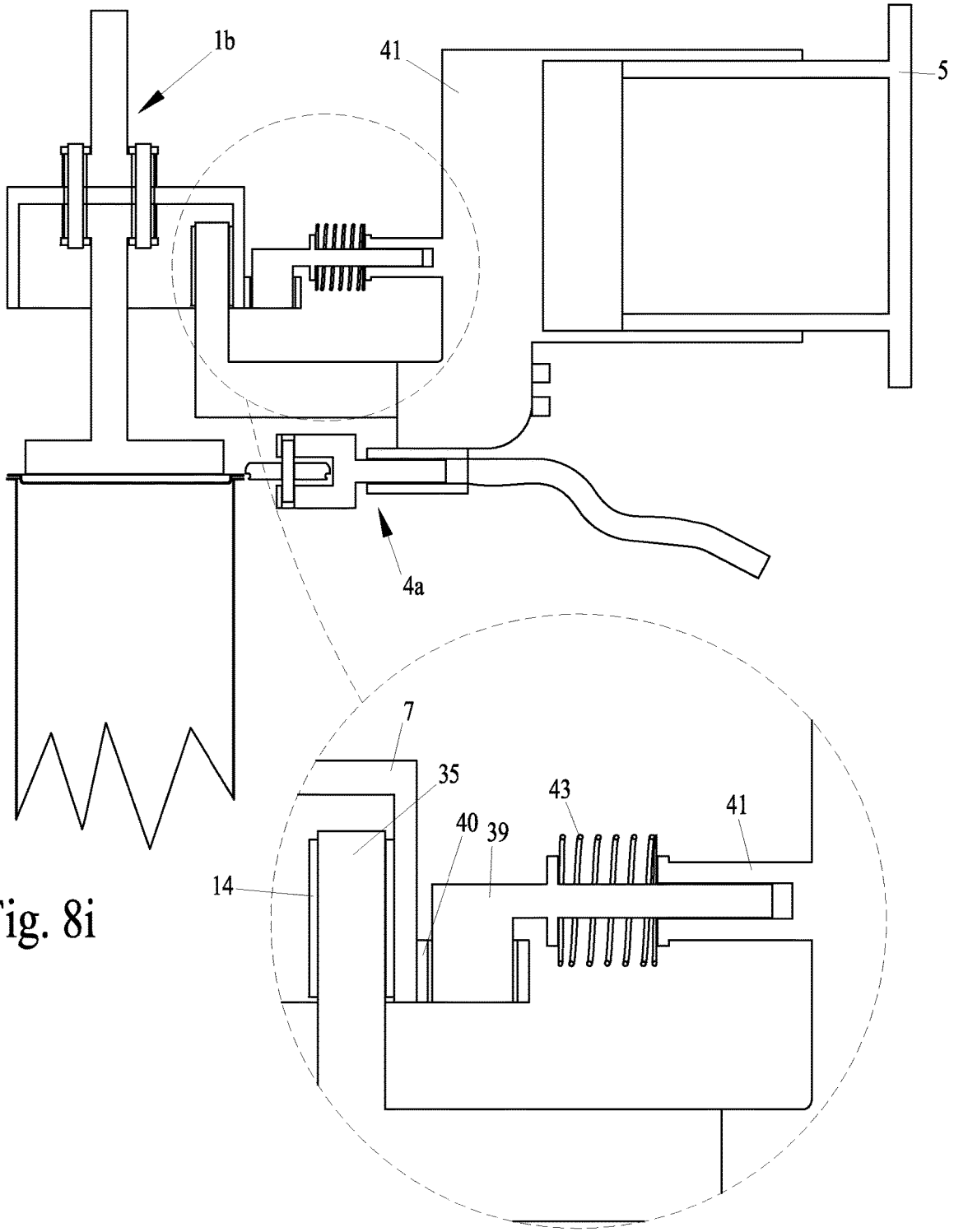

FIG. 8*i* shows the section view 5-5 from FIG. 8*f*.

Figure 8J:
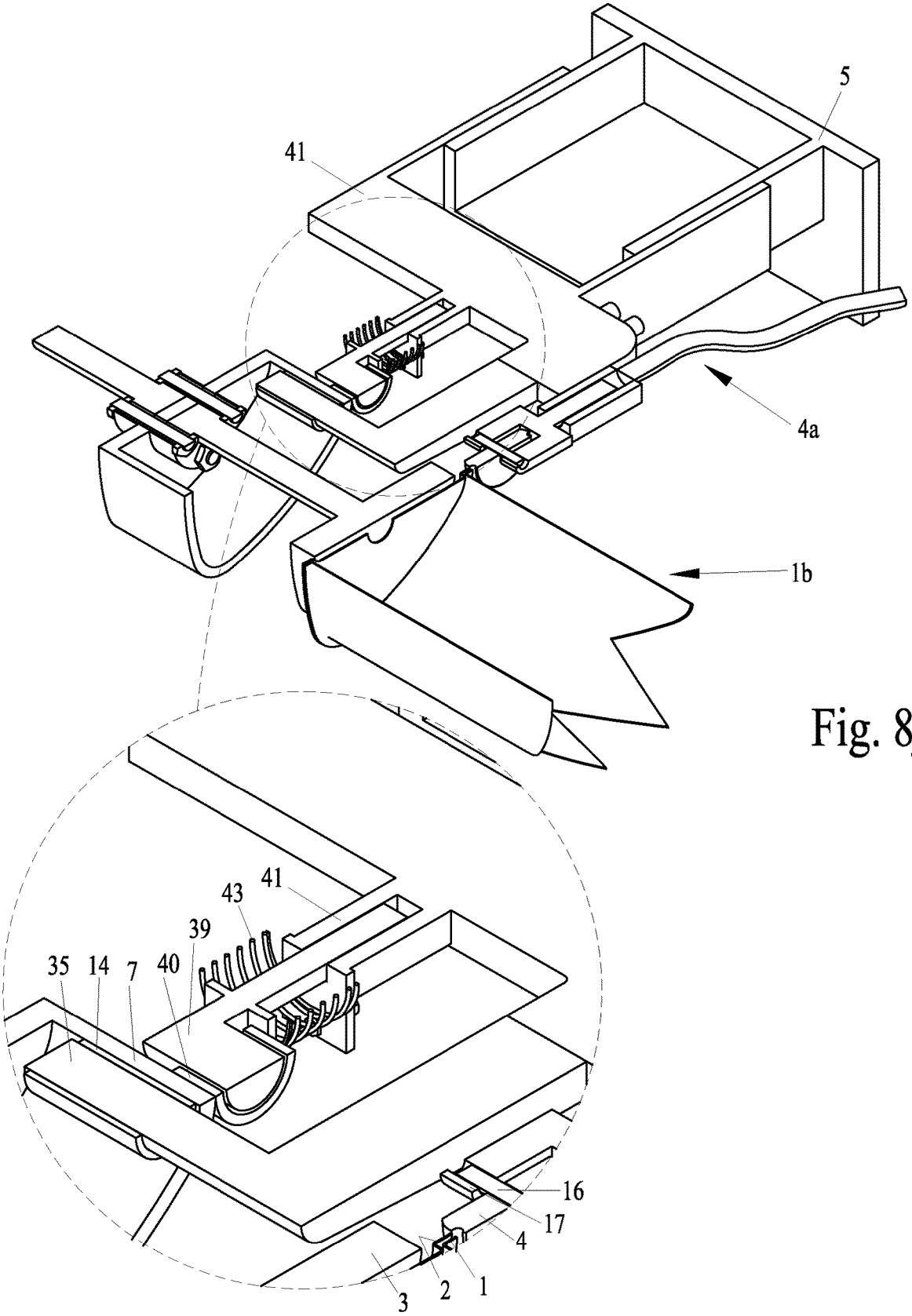

FIG. 8*j* shows the isometric view of the section said in FIG. 8*i*.

Figure 8K:
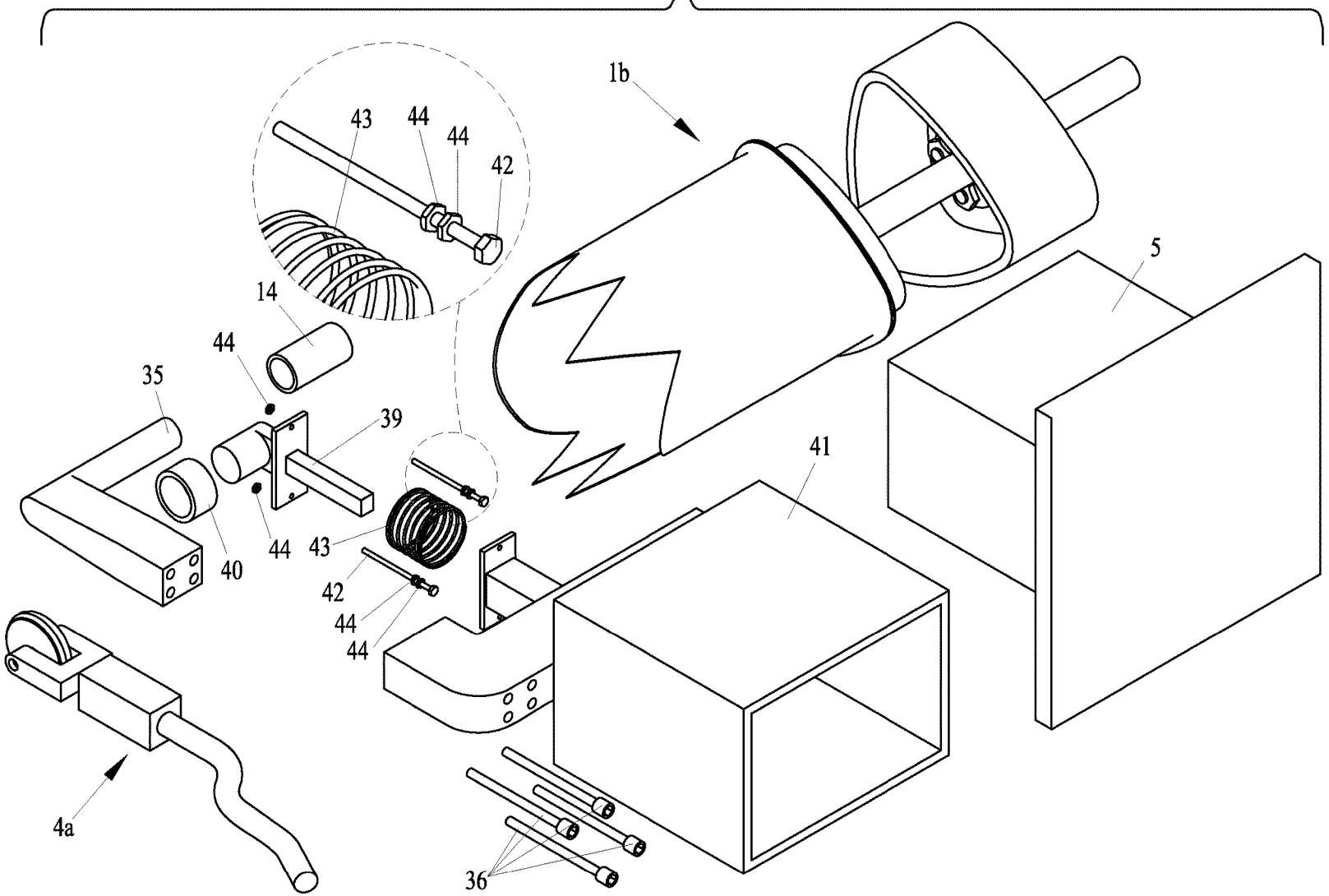
Figure 81:
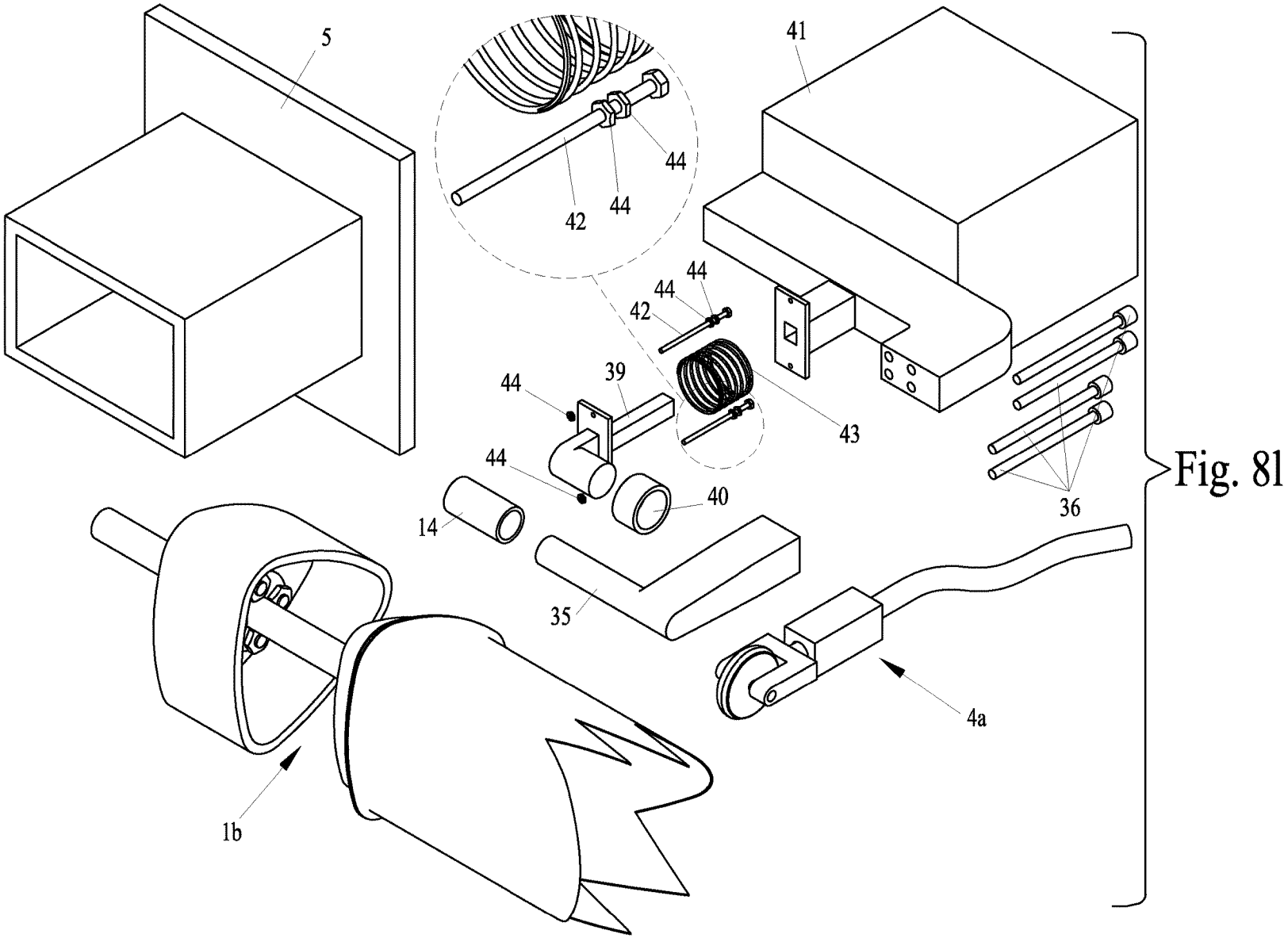

FIG. 8*k* shows the mechanism said in FIG. 8*c* disassembled and parts labelled.

FIG. 8*l* shows an additional isometric view of the mechanism said in FIG. 8*c* disassembled and parts labelled.

Figure 9A:
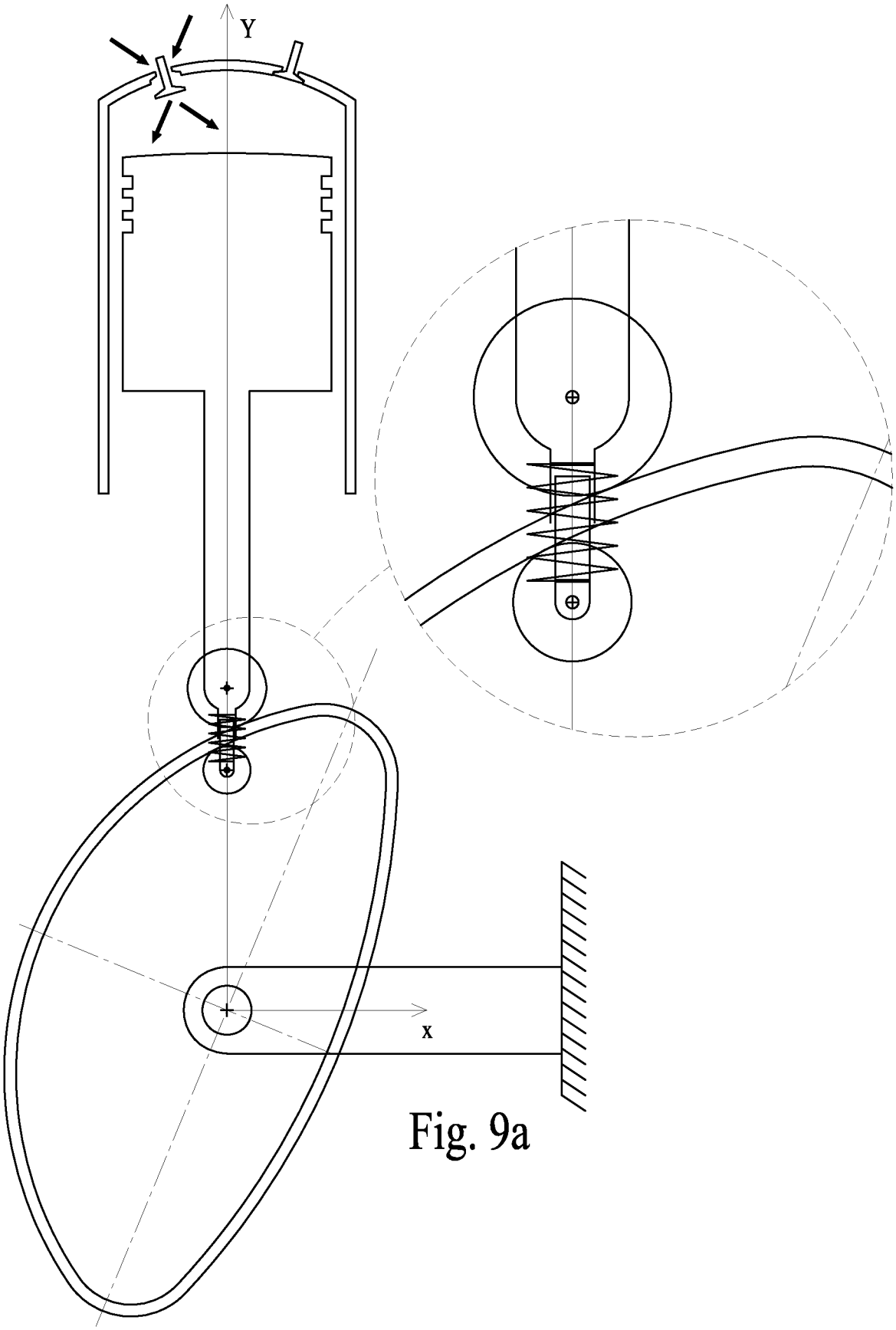

FIG. 9*a* is a simplified geometry for Method 3a with spring under tension applied to engine crankshaft during intake stroke after a 22.5 degrees rotation of the cam from top dead center position.

Figure 9B:
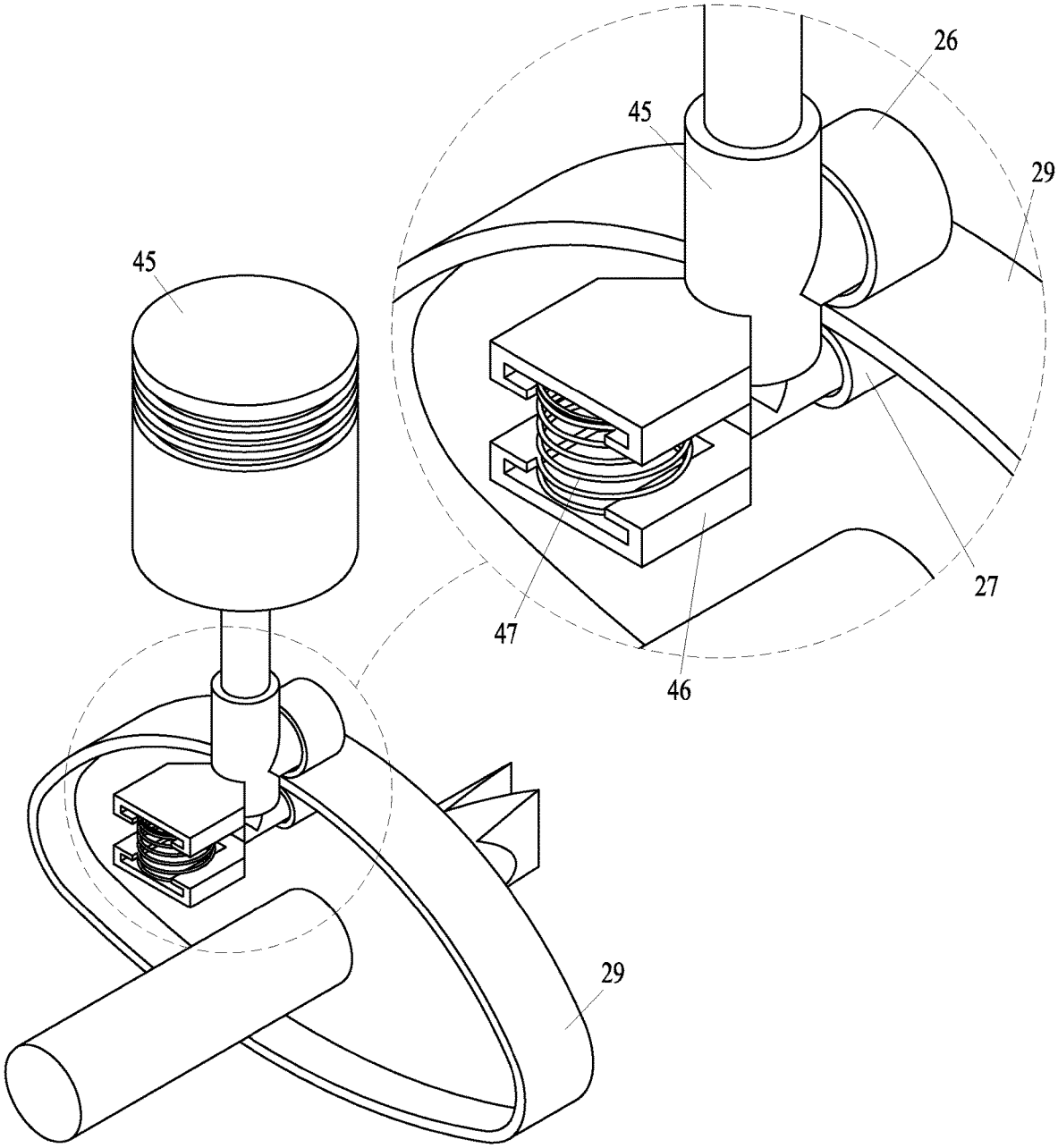

FIG. 9*b* shows the isometric view of a mechanism using Method 3a with spring under tension applied to engine crankshaft with all parts labelled.

Figure 9D:
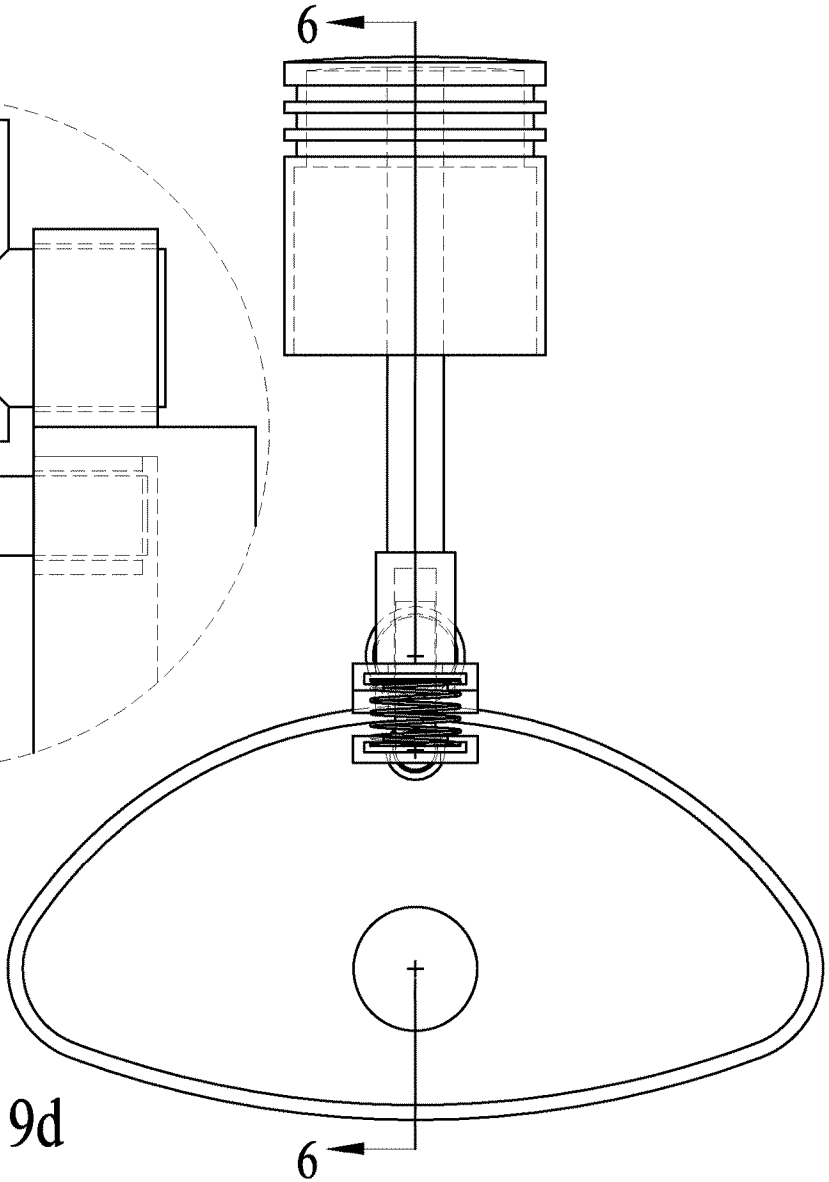
Figure 9C:
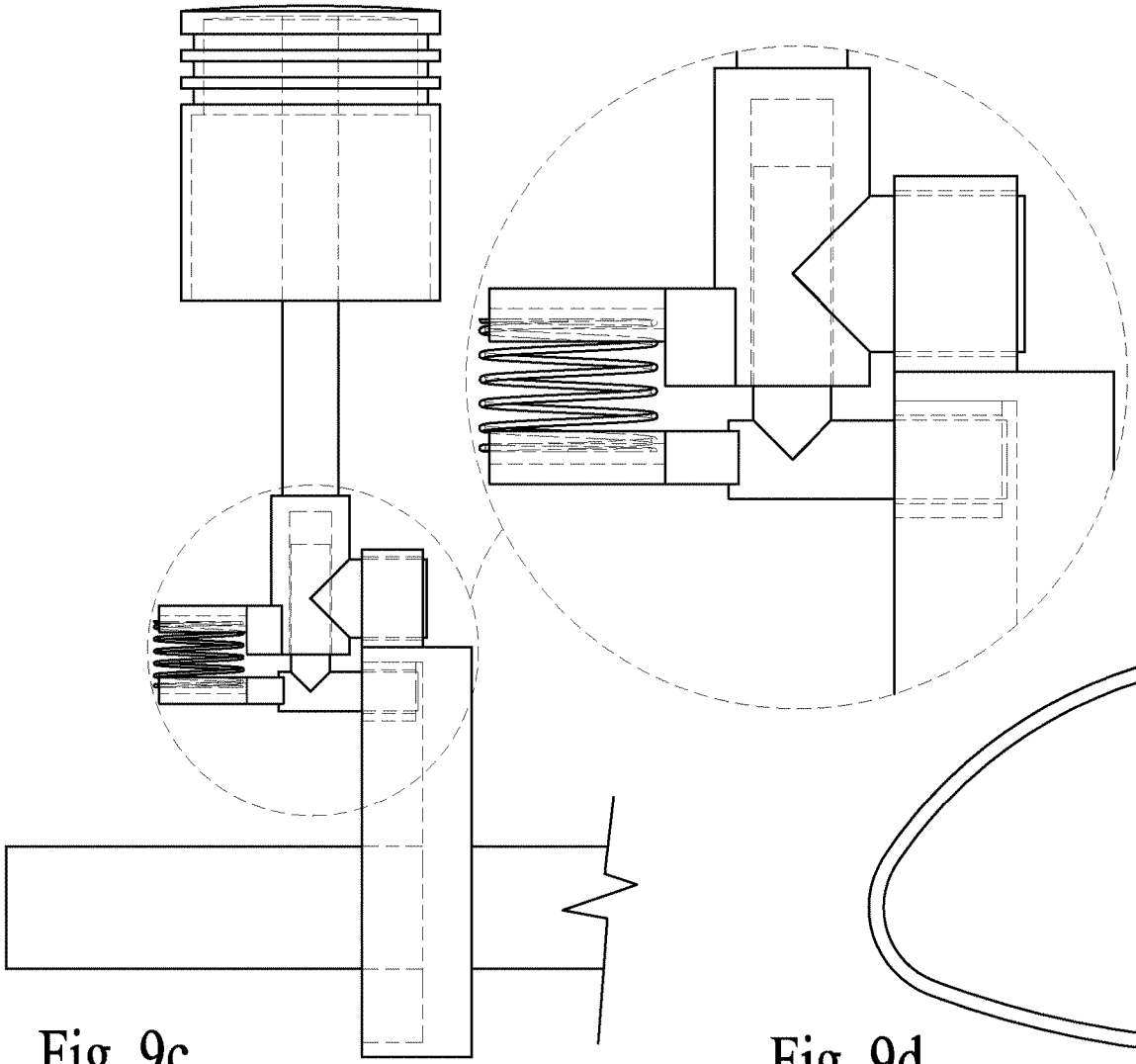

FIG. 9*c* shows the front view of the mechanism said in FIG. 9*b*.

FIG. 9*d* shows the left view of the mechanism said in FIG. 9*b*.

Figure 9E:
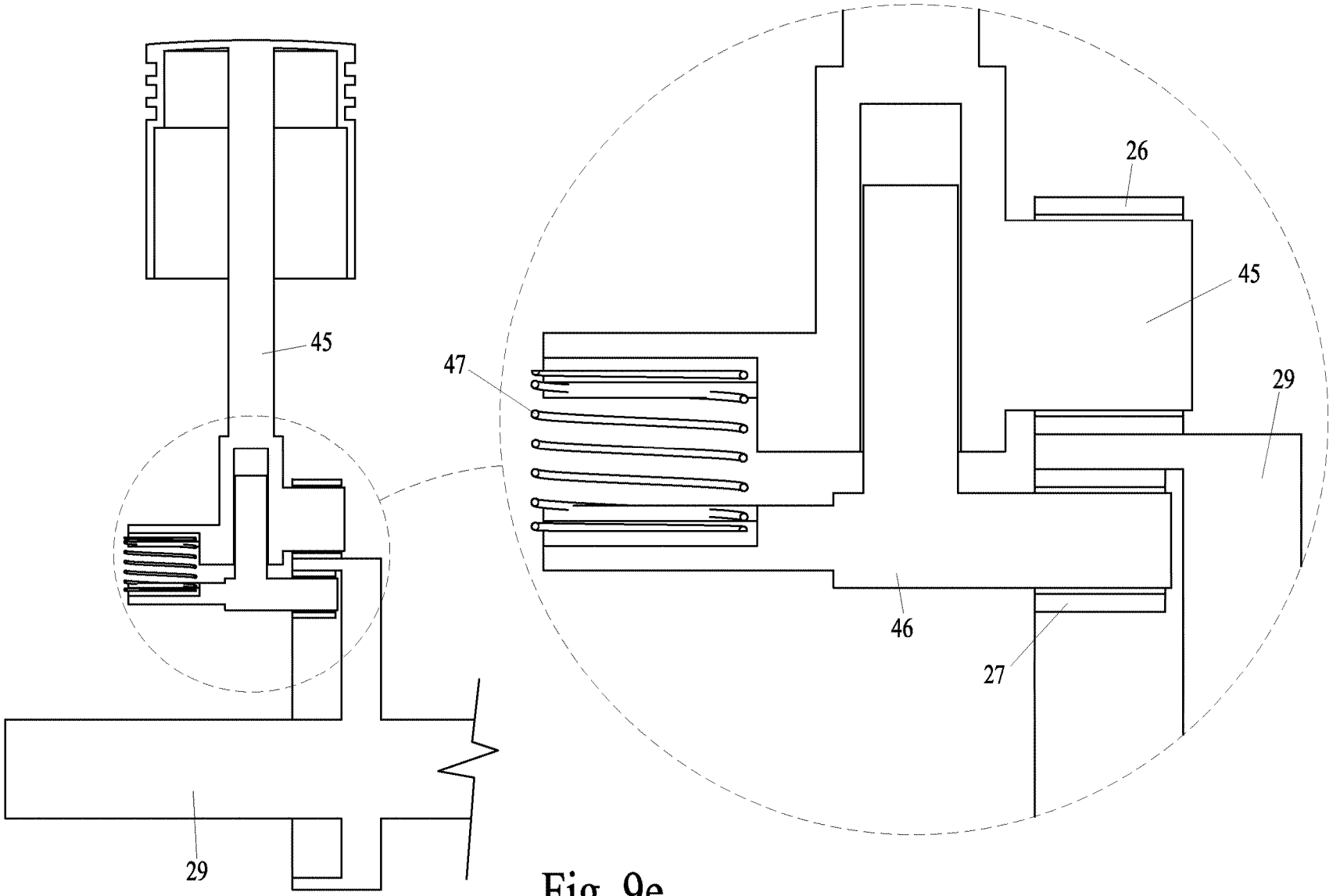

FIG. 9*e* shows the section view of section 6-6 shown in FIG. 9*d*.

Figure 9F:
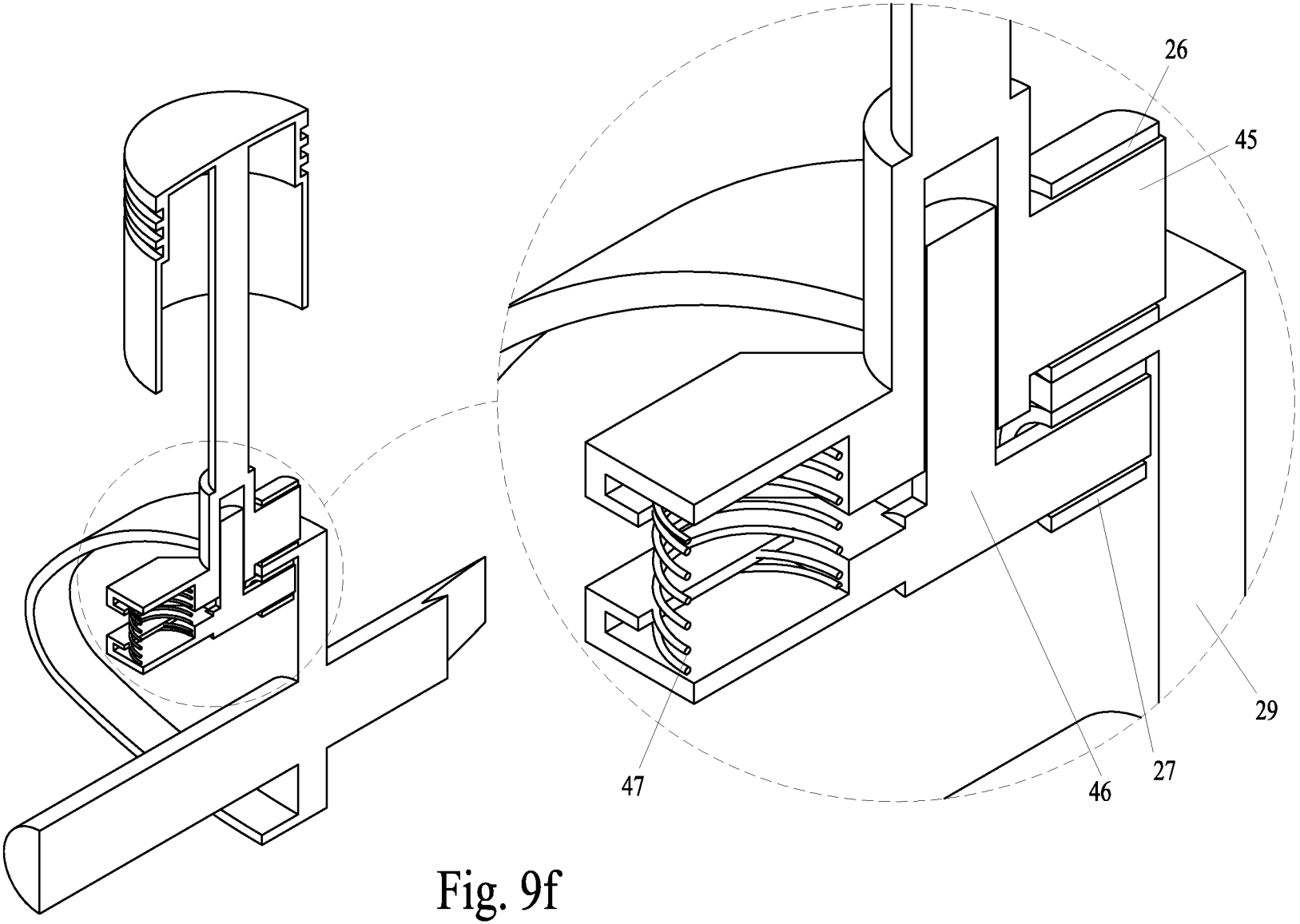

FIG. 9*f* shows the isometric view of the section 6-6 said in FIG. 9*e*.

Figure 9G:
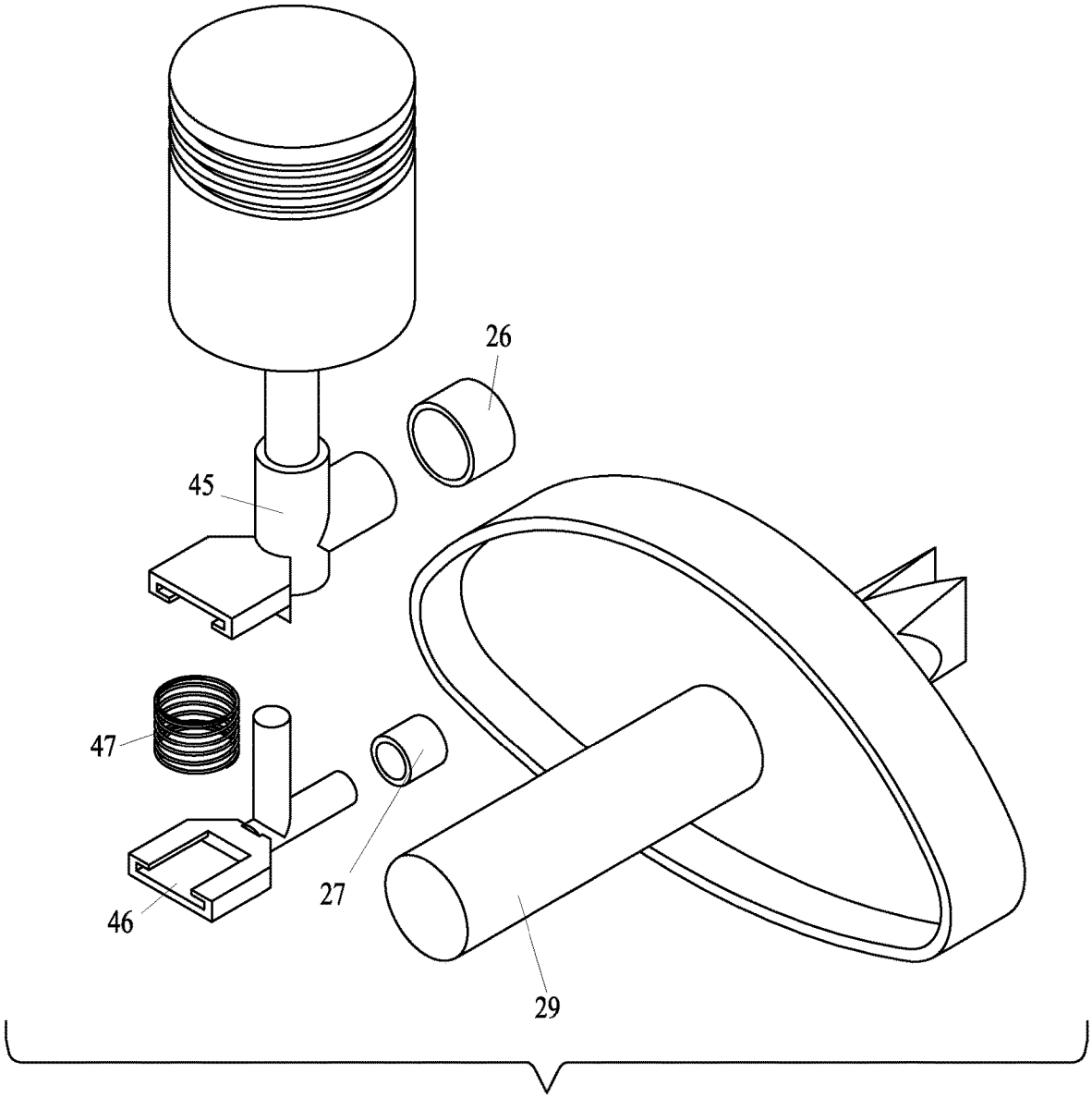

FIG. 9*g* shows the mechanism said in FIG. 9*b* disassembled and all parts labelled.

Figure 10A:
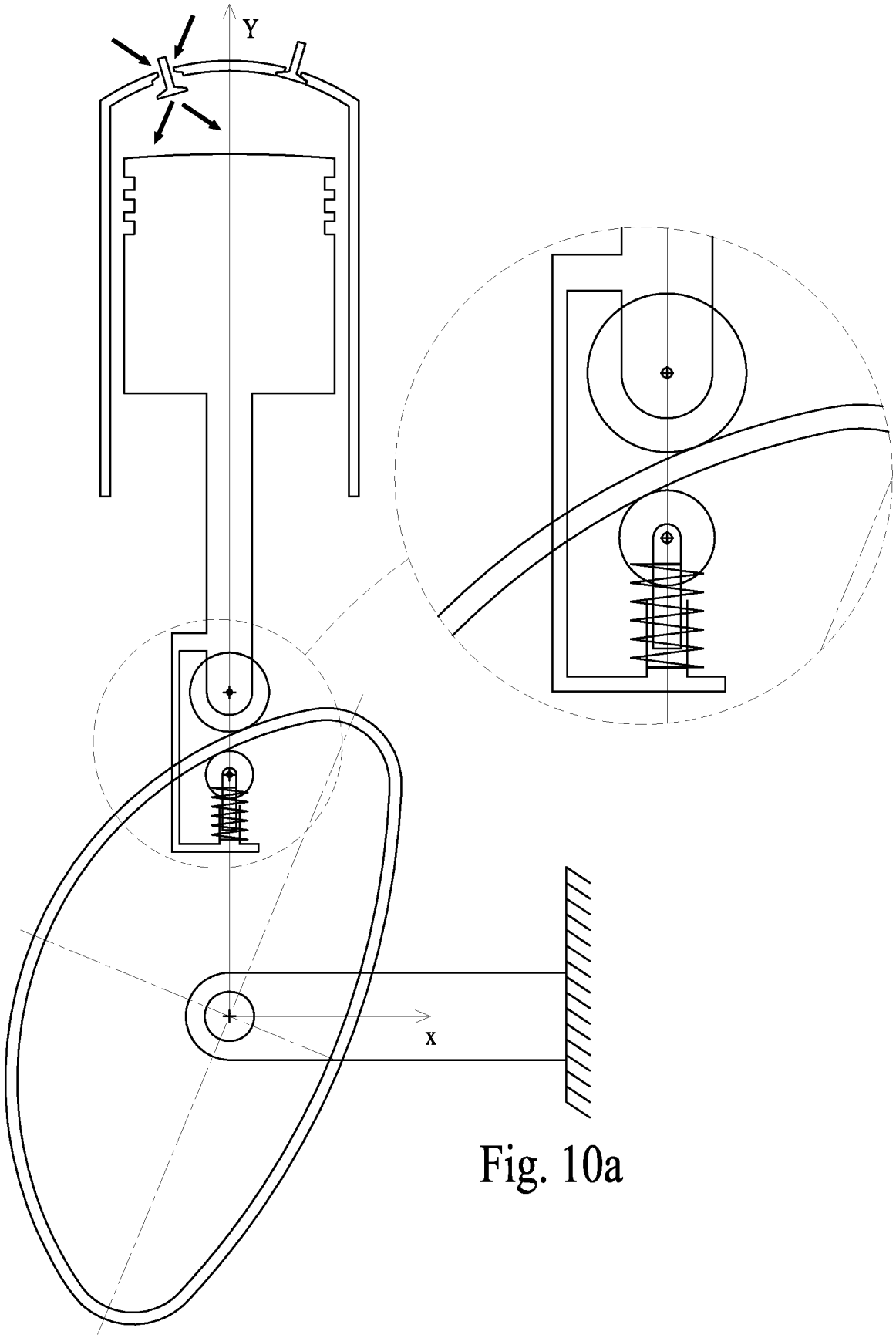

FIG. 10*a* is a simplified geometry for Method 3b with spring under compression applied to engine crankshaft during intake stroke after a 22.5 degrees rotation of the cam from top dead center position.

Figure 10B:
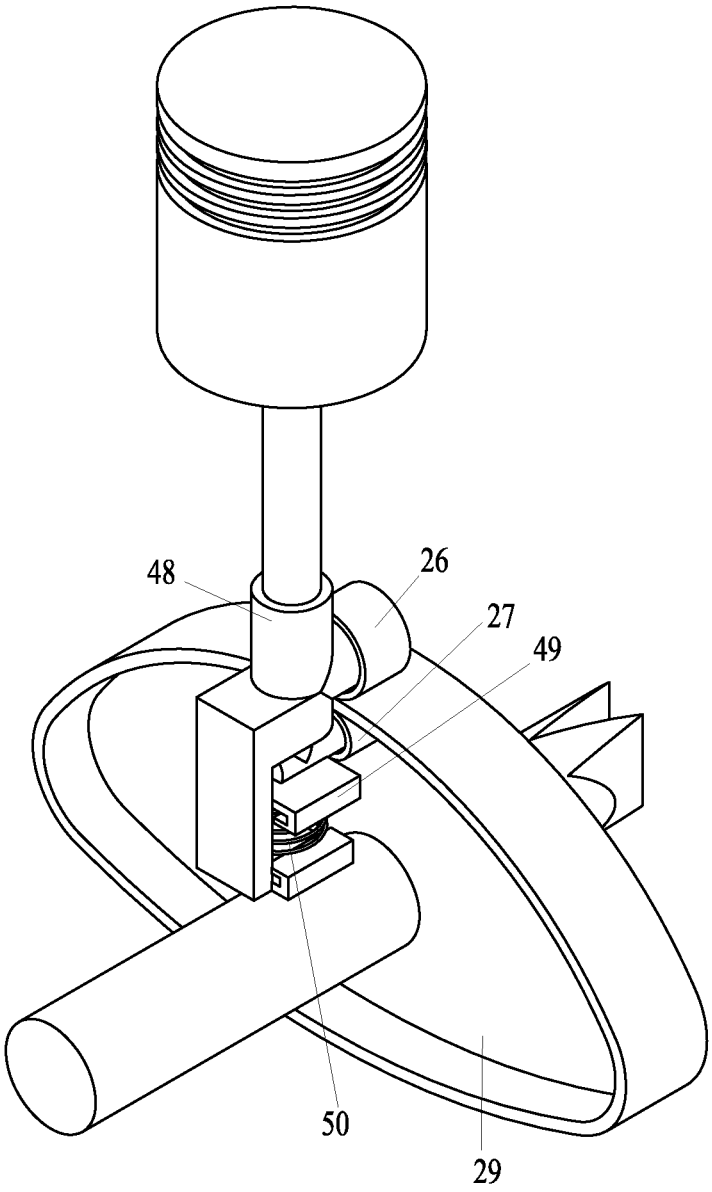

FIG. 10*b* shows the isometric view of a mechanism using Method 3b with spring under compression applied to engine crankshaft with all parts labelled.

Figure 10C:
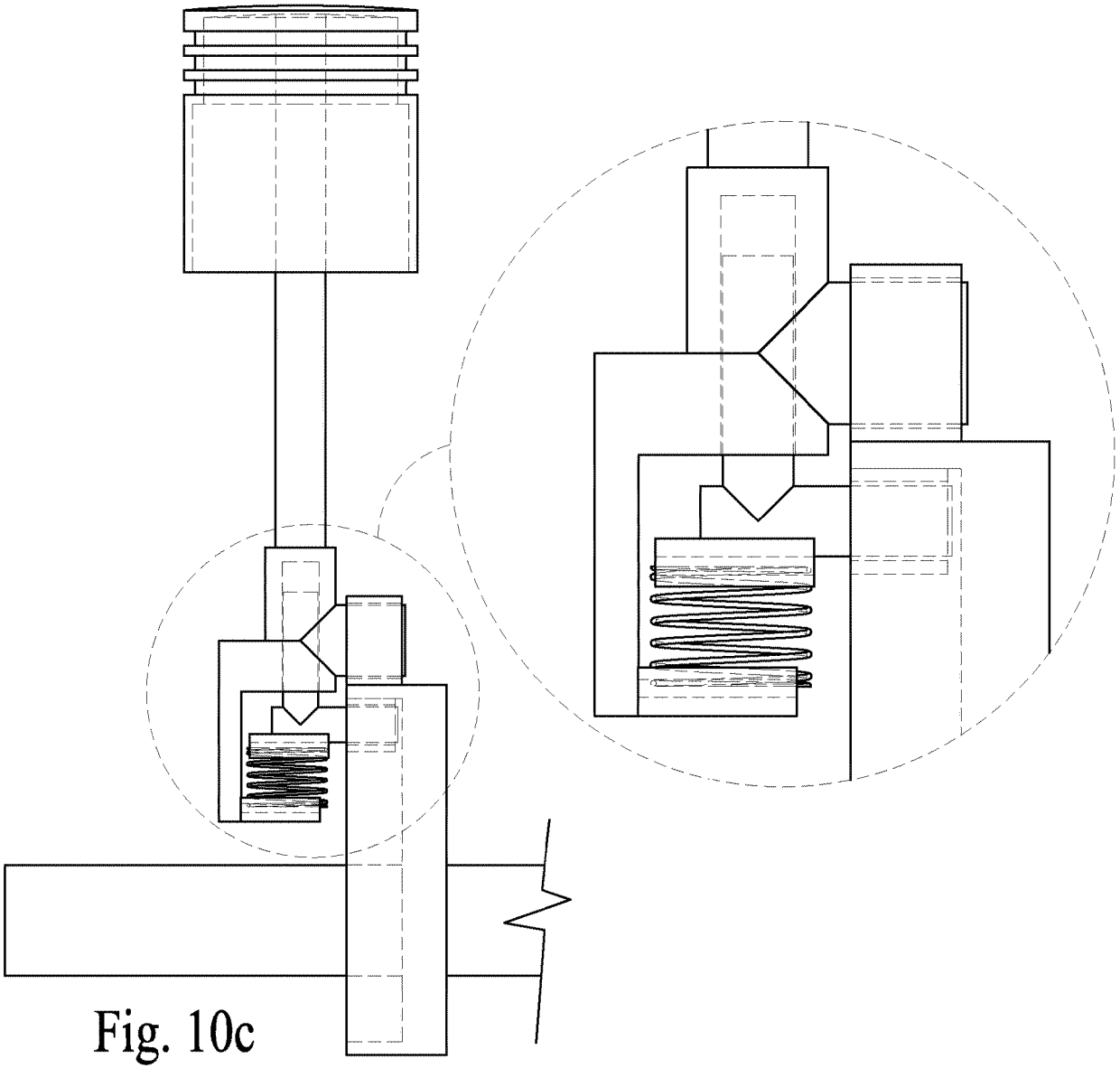

FIG. 10*c* shows the front view of the mechanism said in FIG. 10*b*.

Figure 10D:
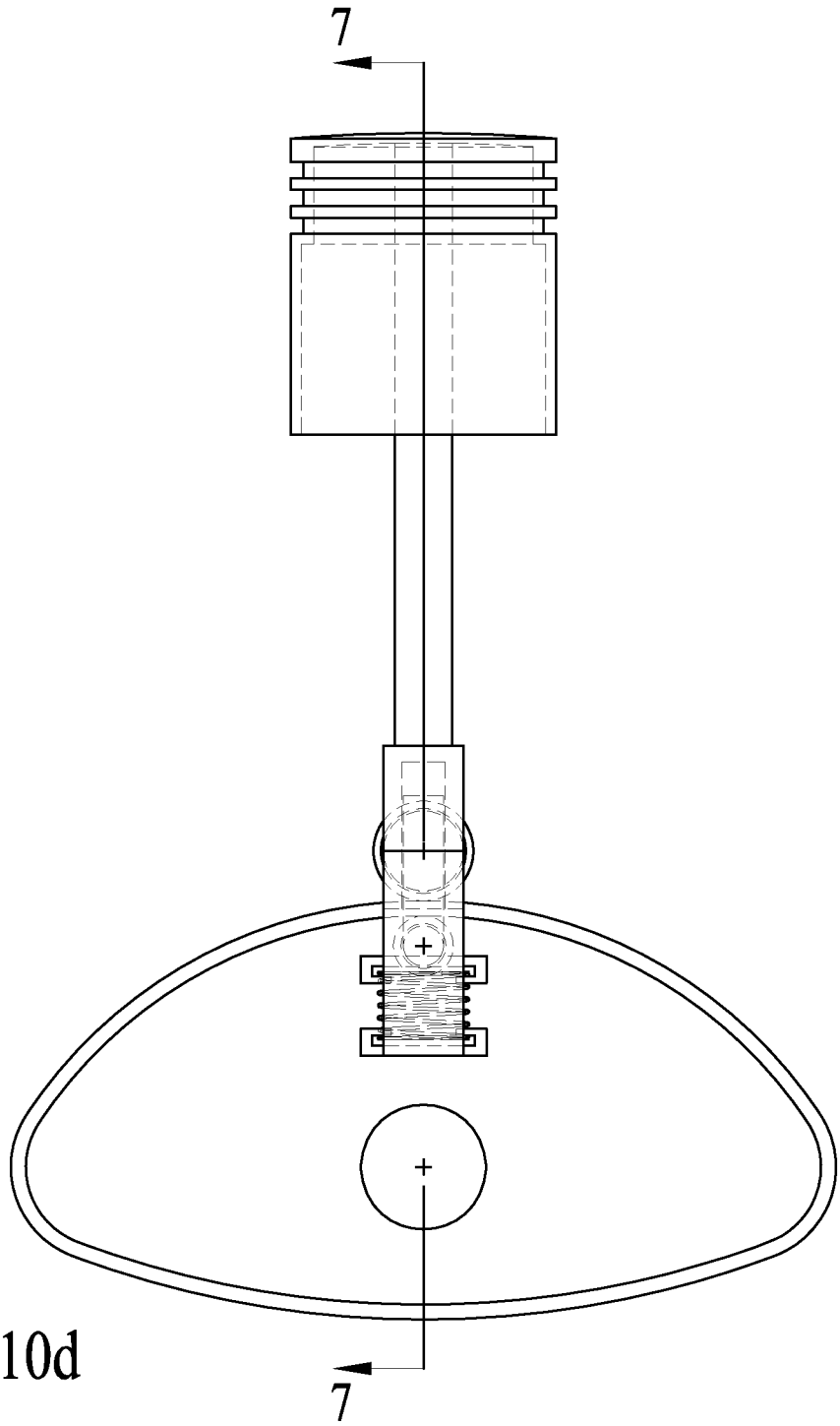

FIG. 10*d* shows the left view of the mechanism said in FIG. 10*b*.

Figure 10E:
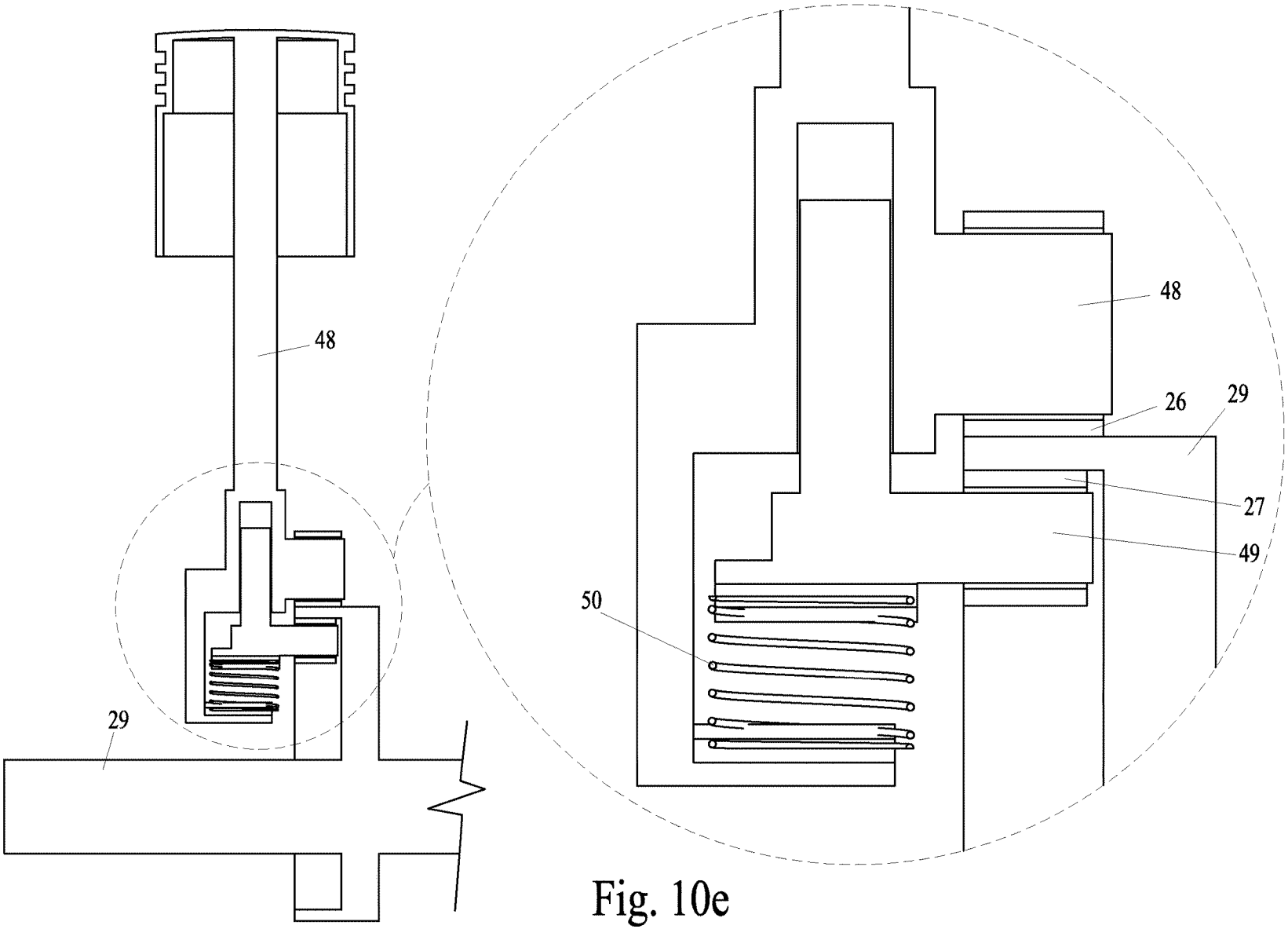

FIG. 10*e* shows the section view of section 7-7 from FIG. 10*d*.

Figure 10F:
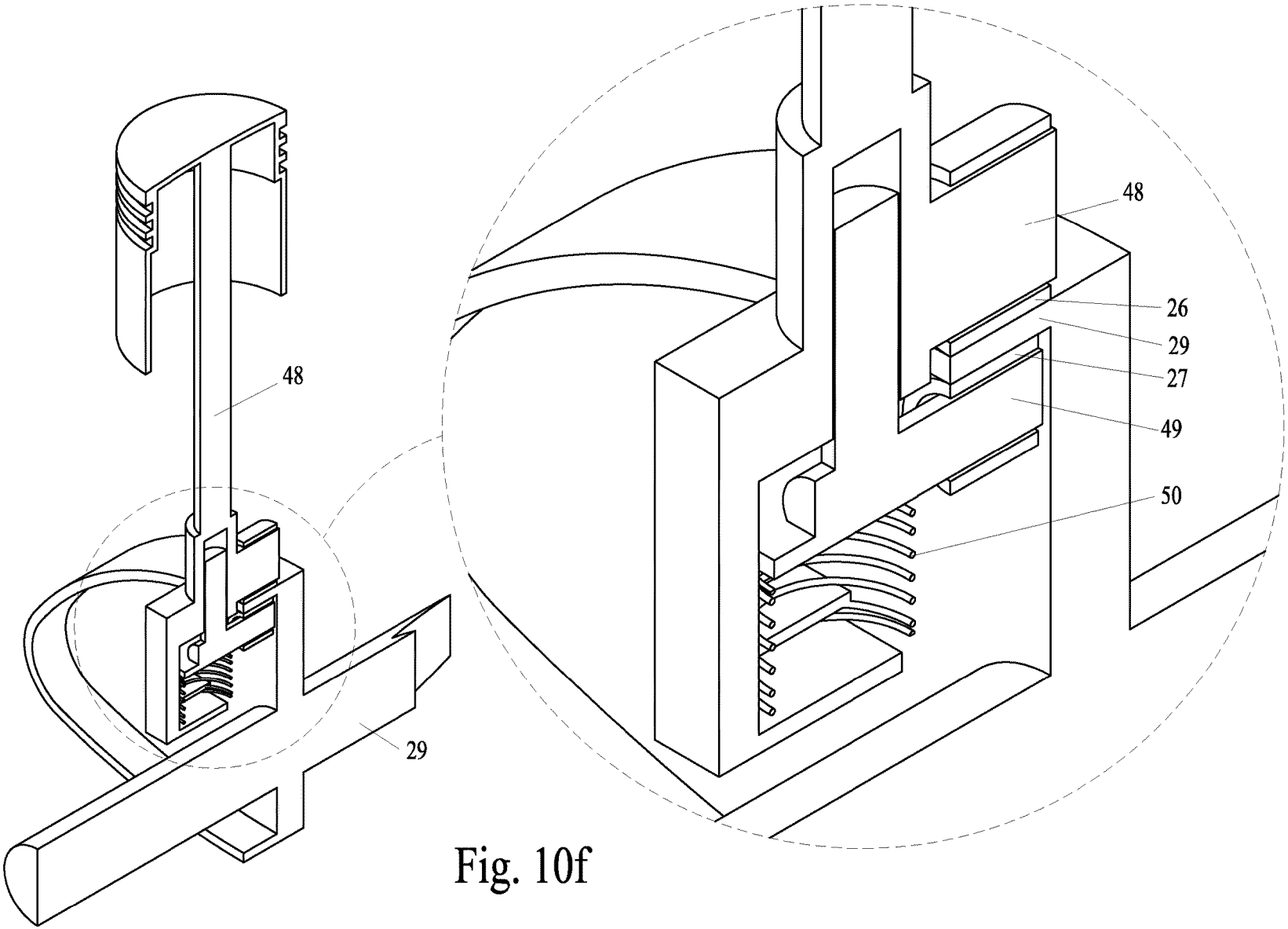

FIG. 10*f* shows the isometric view of the section 7-7 said in FIG. 10*e*.

Figure 10G:
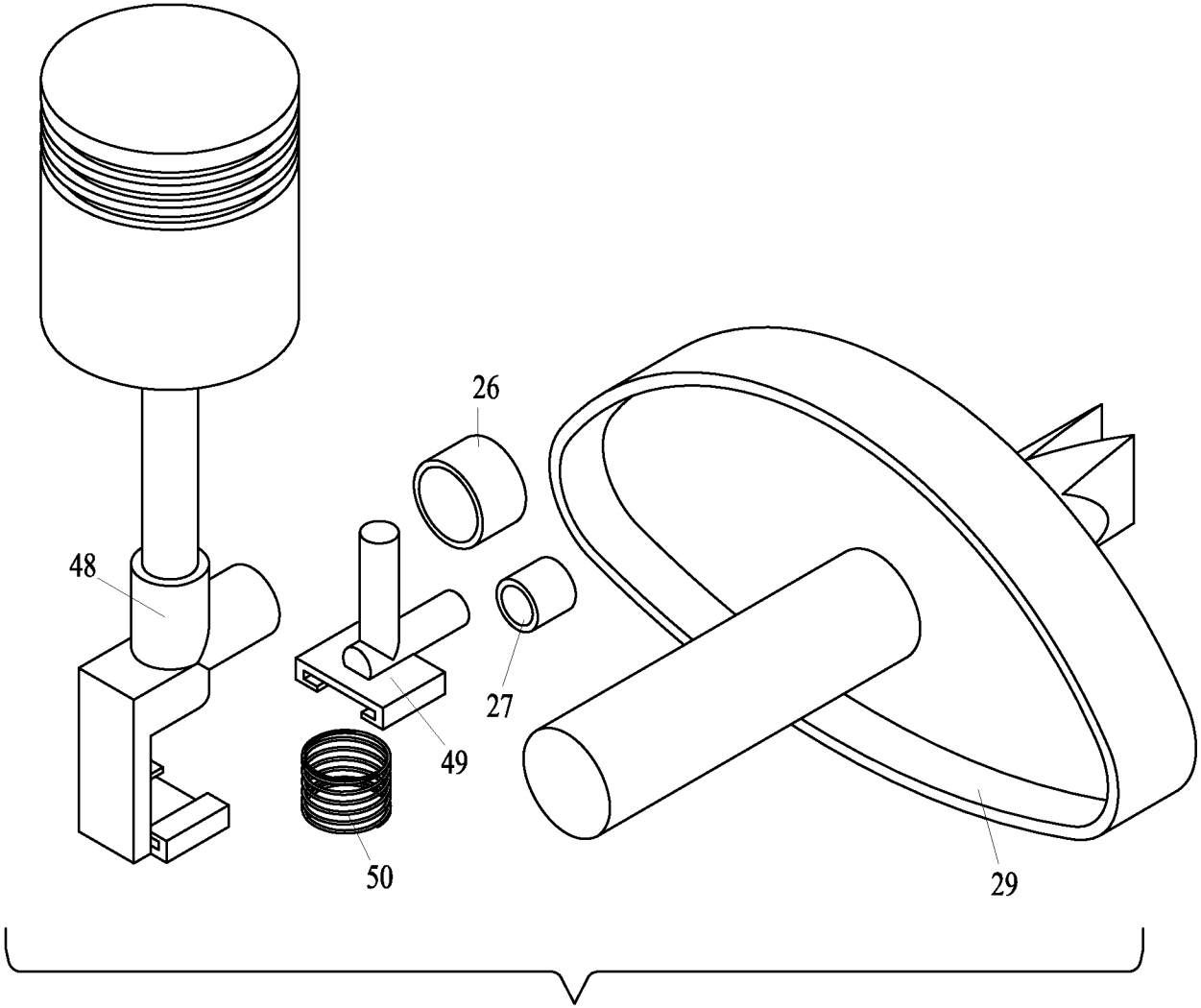

FIG. 10*g* shows the mechanism said in FIG. 10*b* disassembled and all parts labelled.

Figure 11A:
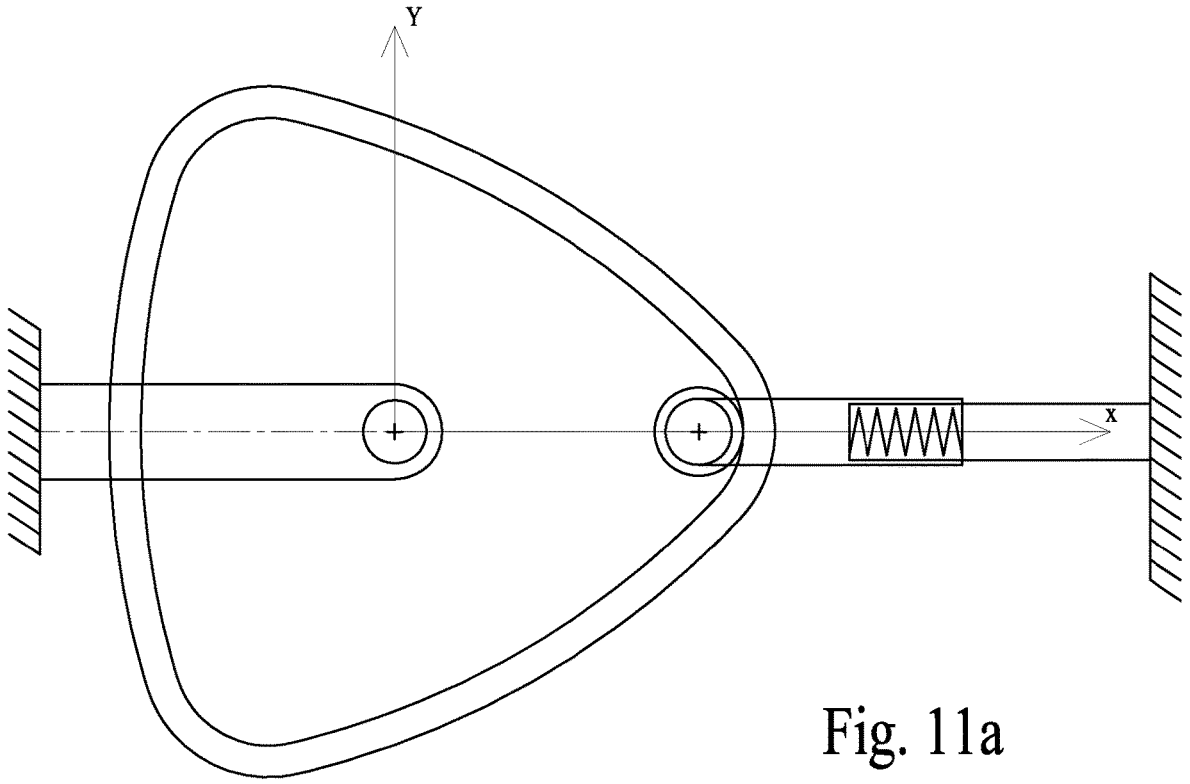

FIG. 11*a* is a simplified geometry for the Fourth Method applied to muffler cap spinner.

Figure 11B:
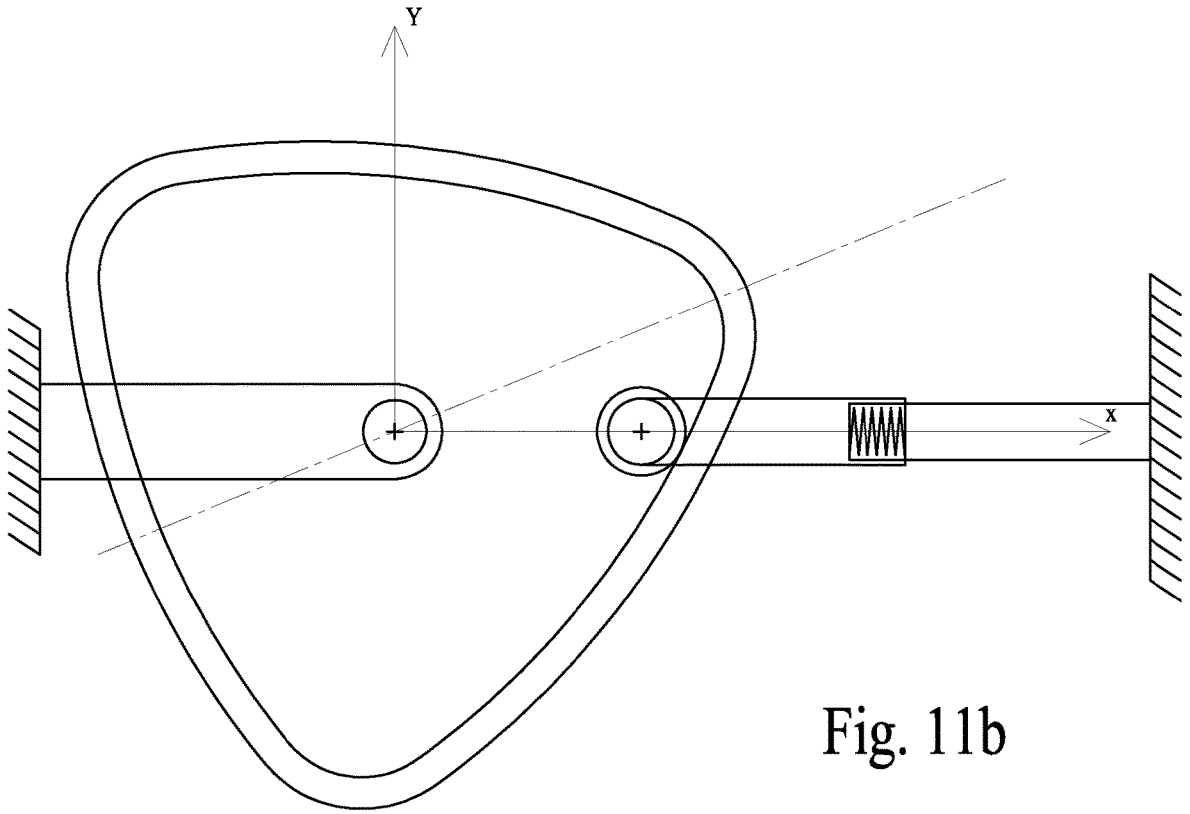

FIG. 11*b* is the simplified geometry said in FIG. 11*a* after a 22.5 degrees rotation of the cam in counter clockwise direction.

Figure 11C:
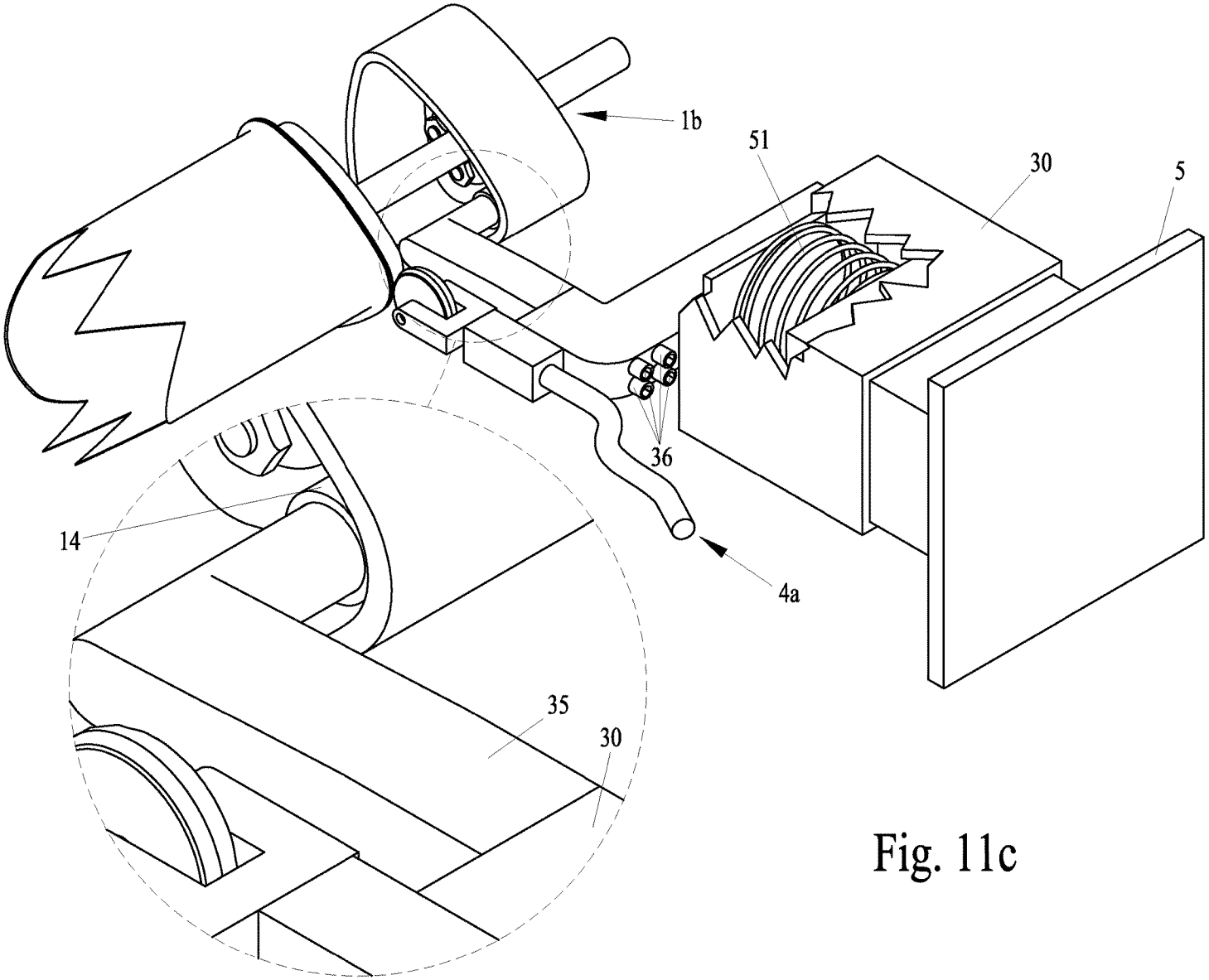

FIG. 11*c* shows the isometric view of a muffler cap spinning mechanism using the Fourth Method.

Figure 11D:
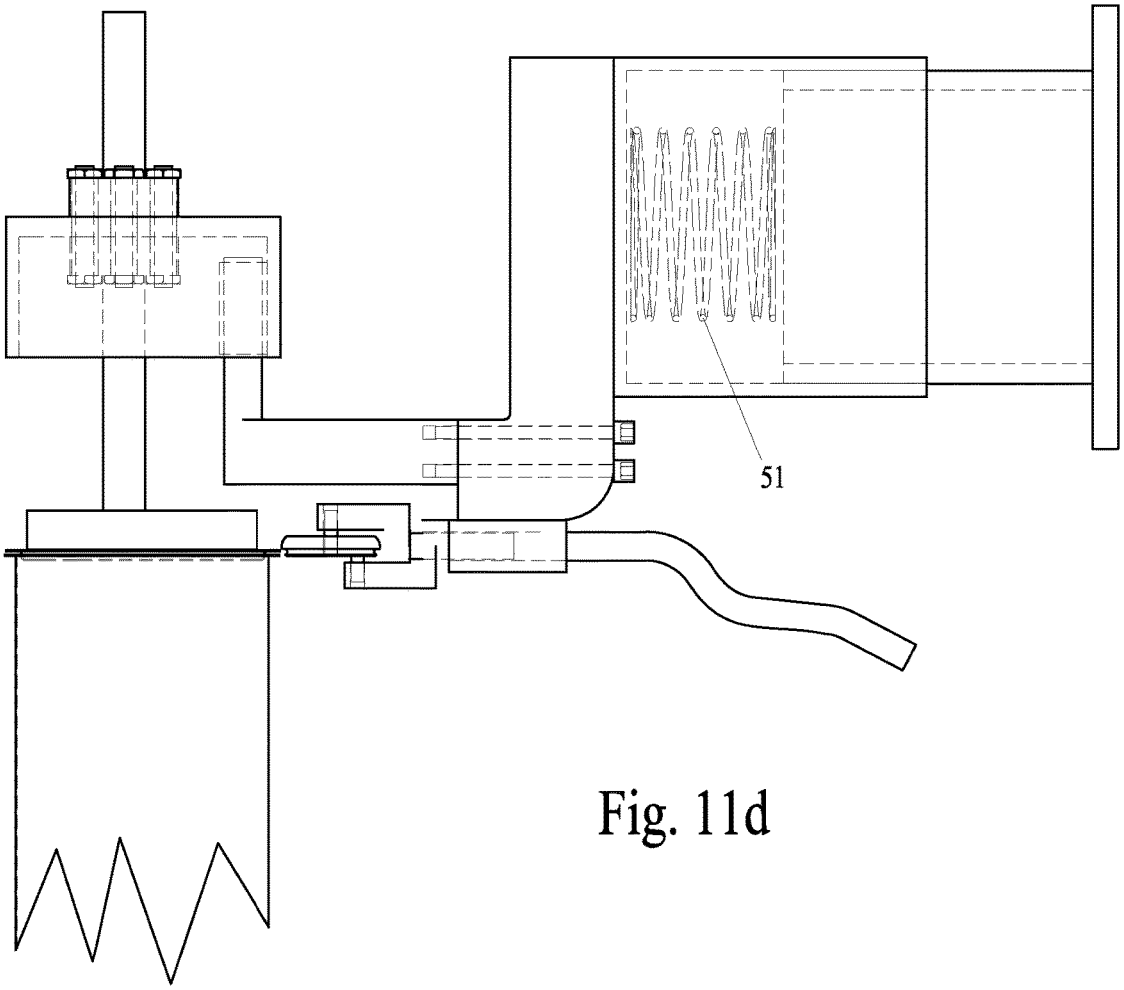

FIG. 11*d* shows the top view of the mechanism said in FIG. 11*c*.

Figure 11E:
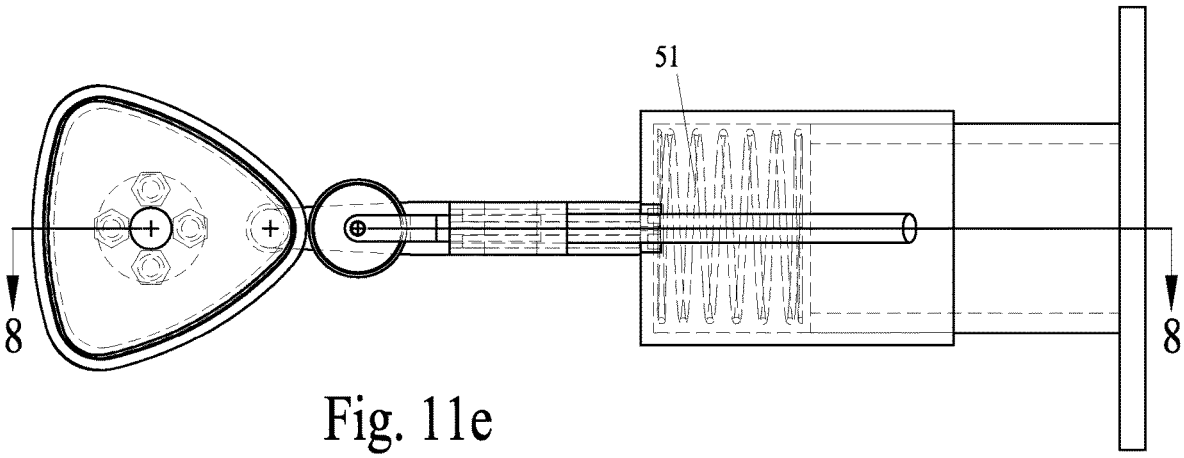

FIG. 11*e* shows the front view of the mechanism said in FIG. 11*c*.

Figure 11F:
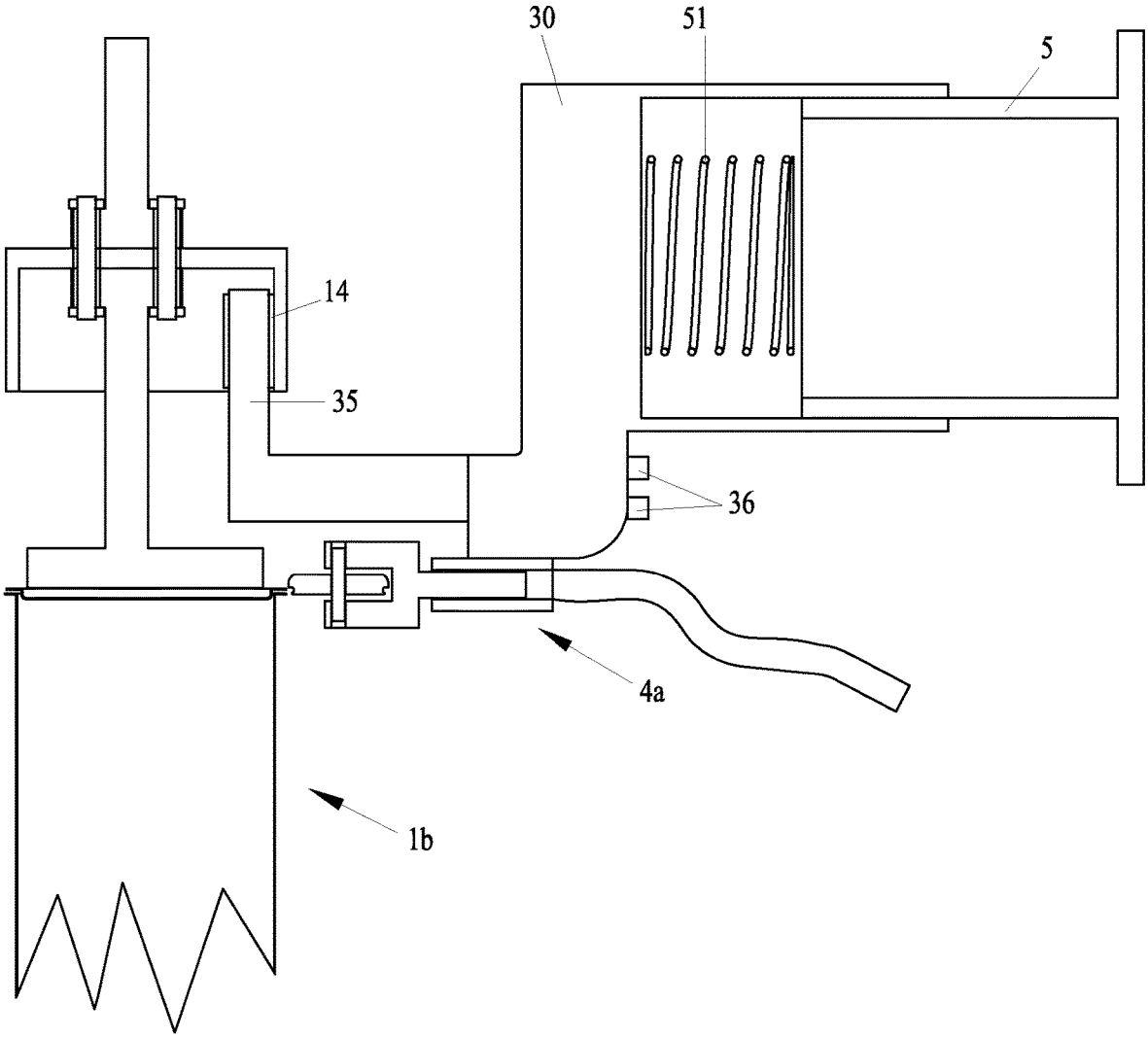

FIG. 11*f* shows the section view 8-8 from FIG. 11*e*.

Figure 11G:
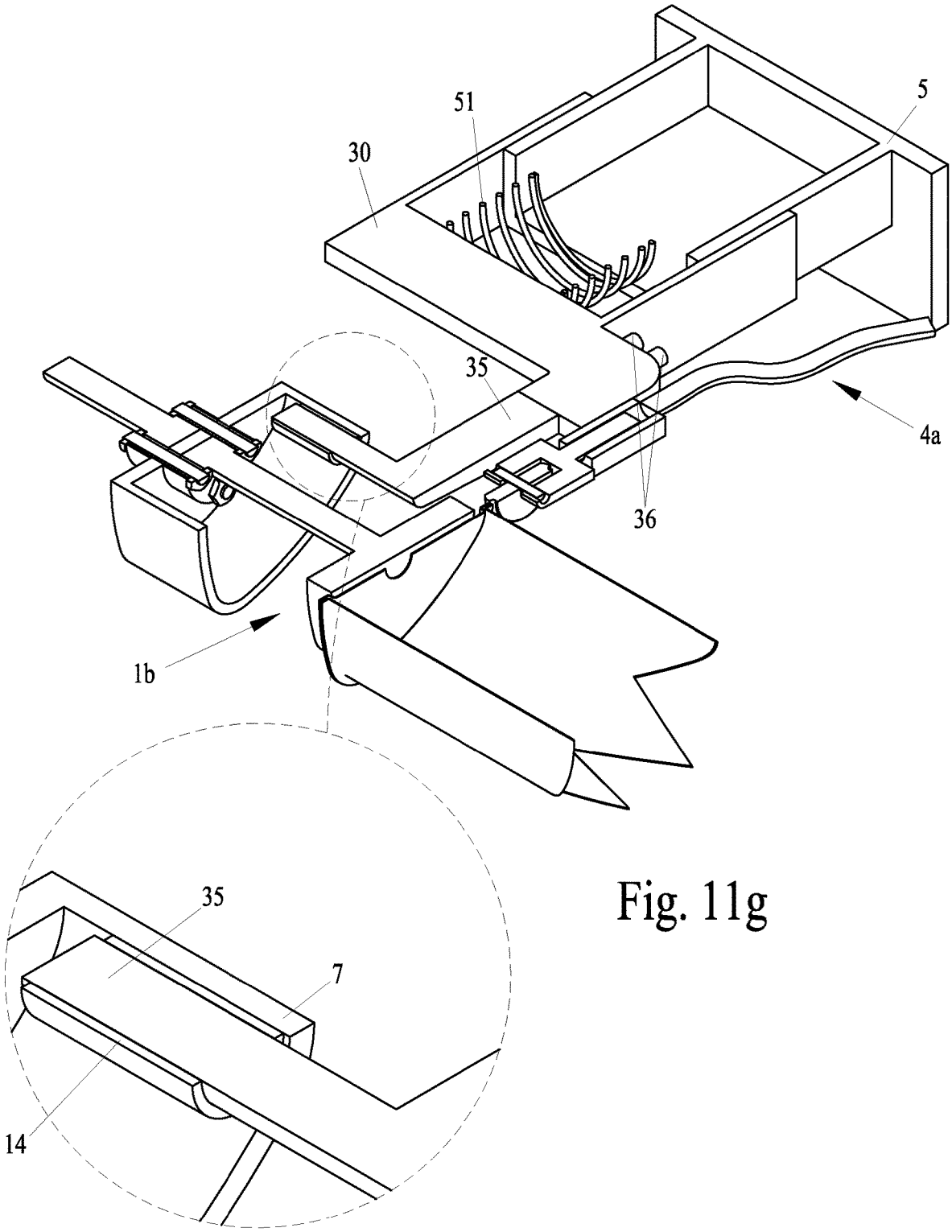

FIG. 11*g* shows the isometric view of the section said in FIG. 11*f*.

Figure 11H:
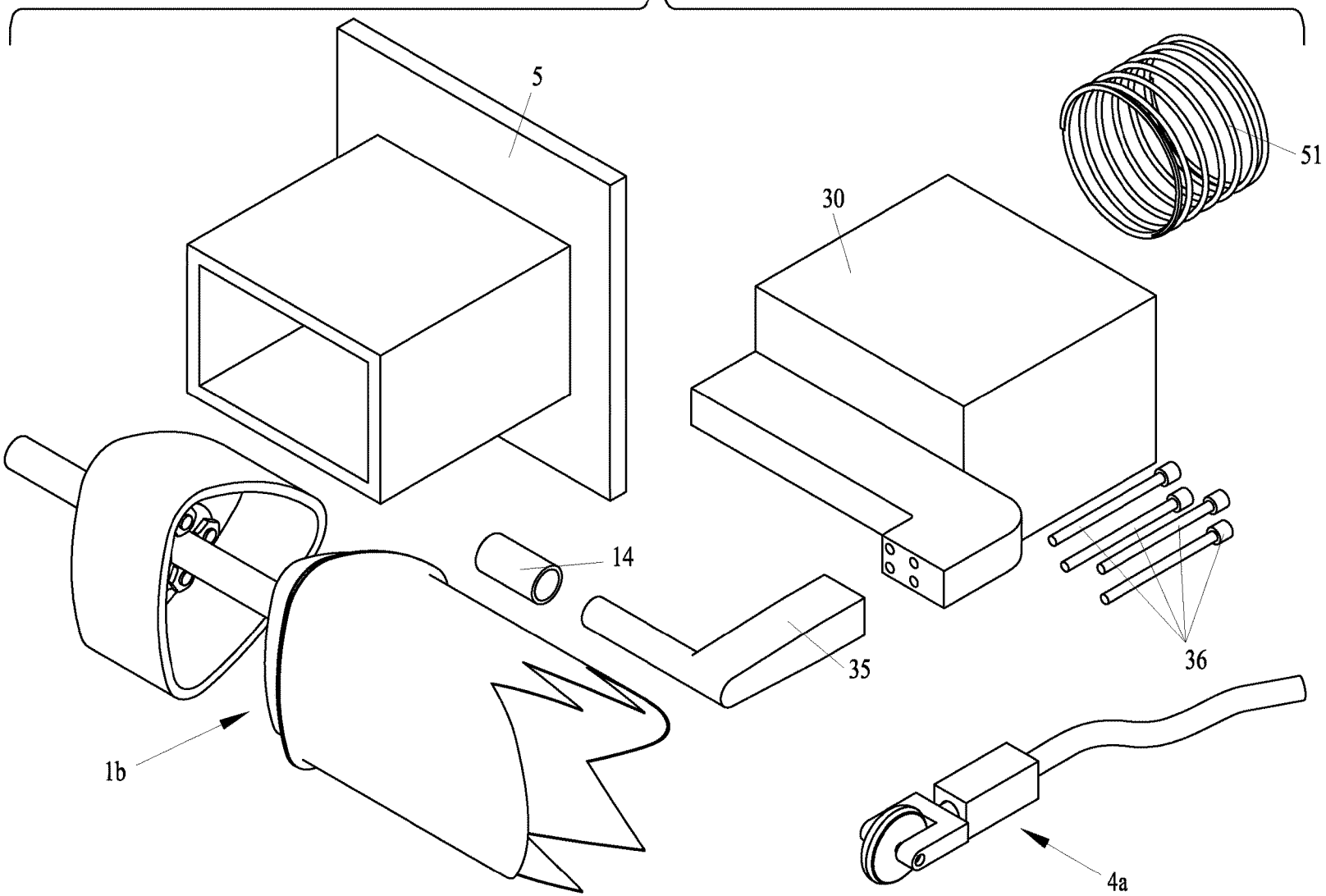

FIG. 11*h* shows the mechanism said in FIG. 11*c* disassembled and all parts labelled.

Figure 12A:
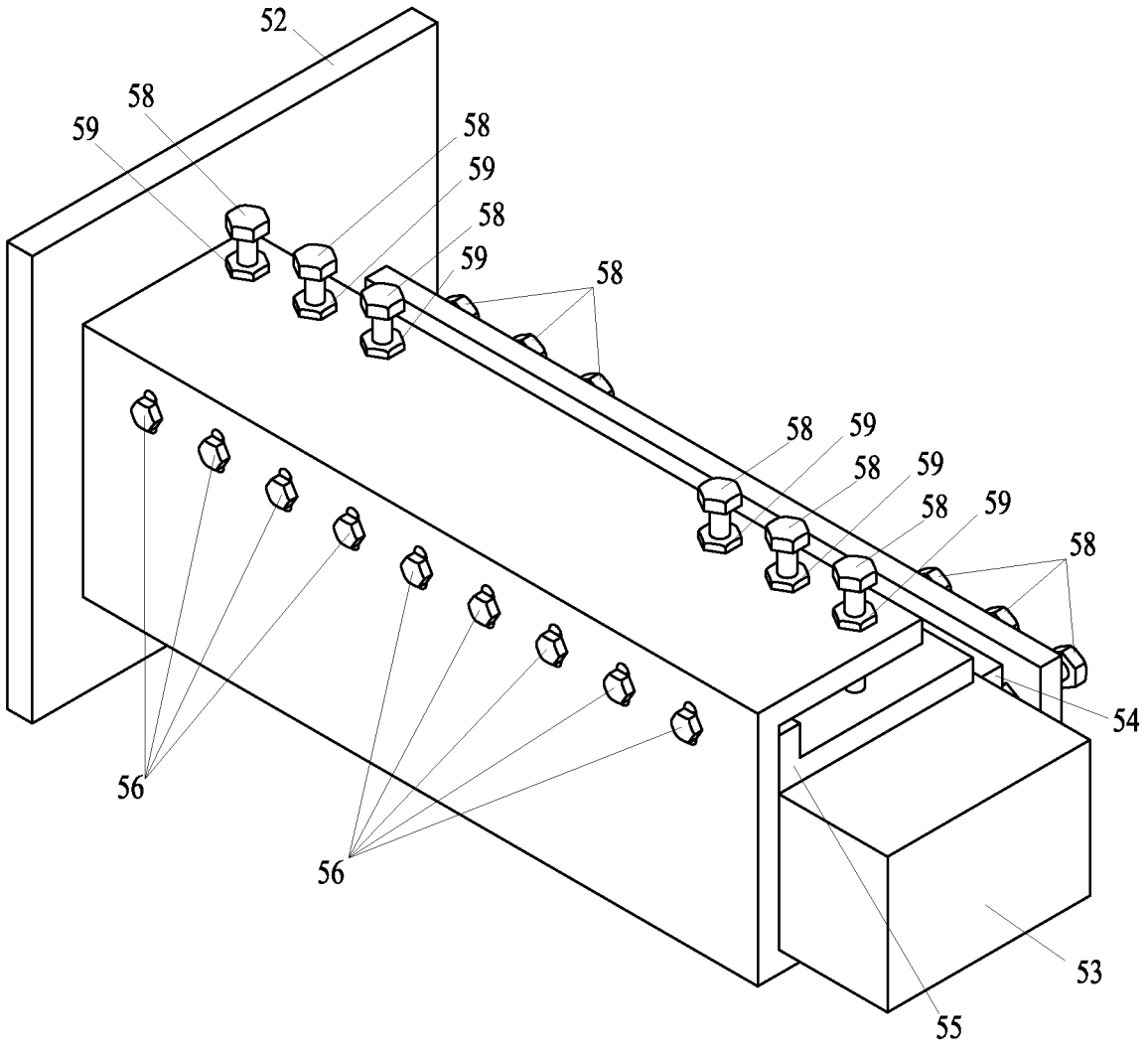

FIG. 12*a* shows an isometric view of a mechanism with an Adjustable Closure for the Sliding Arm.

Figure 12B:
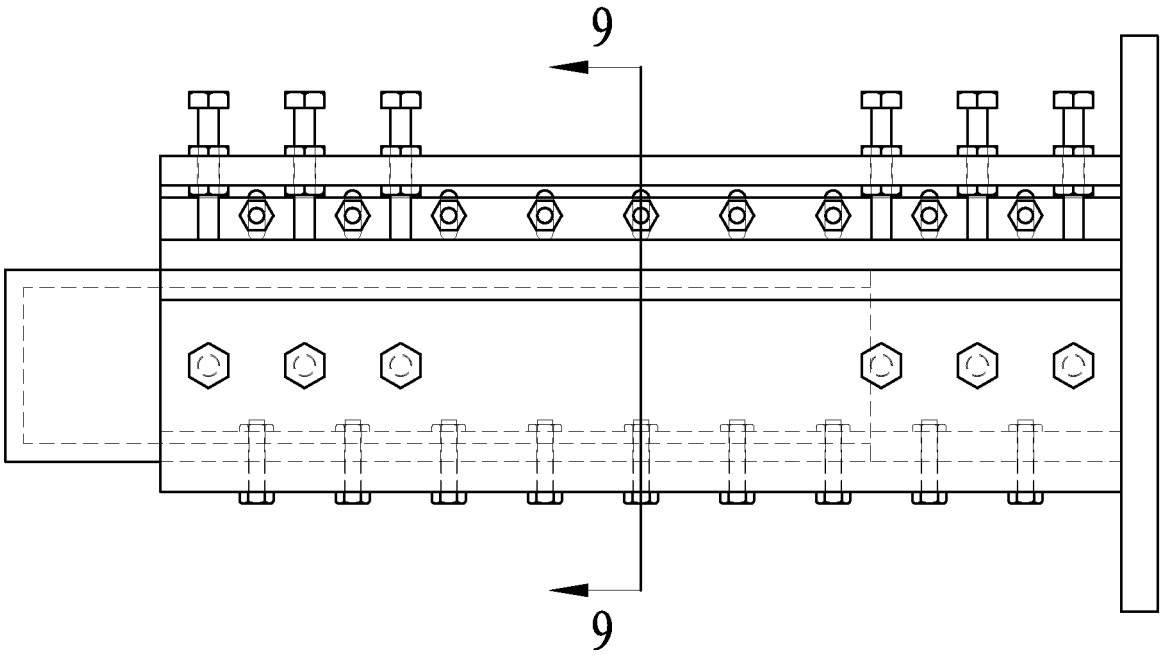

FIG. 12*b* shows the top view of the said mechanism in FIG. 12*a*.

Figure 12C:
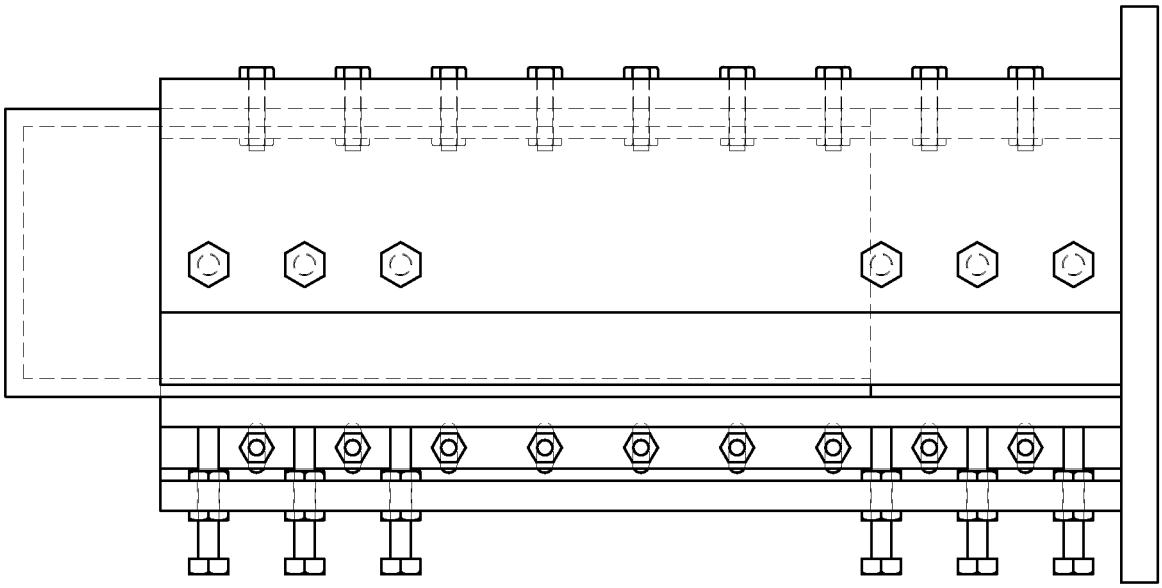

FIG. 12*c* shows the front view of the said mechanism in FIG. 12*a*.

Figure 12D:
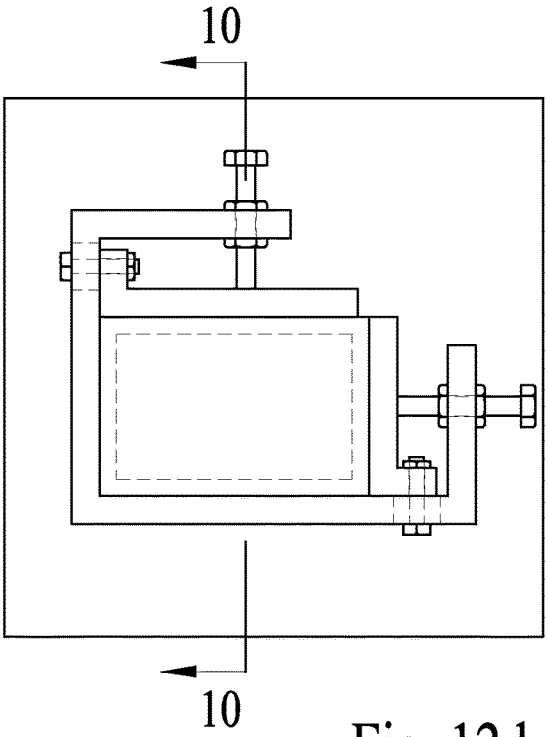

FIG. 12*d* shows the left view of the said mechanism in FIG. 12*a*.

Figure 12E:
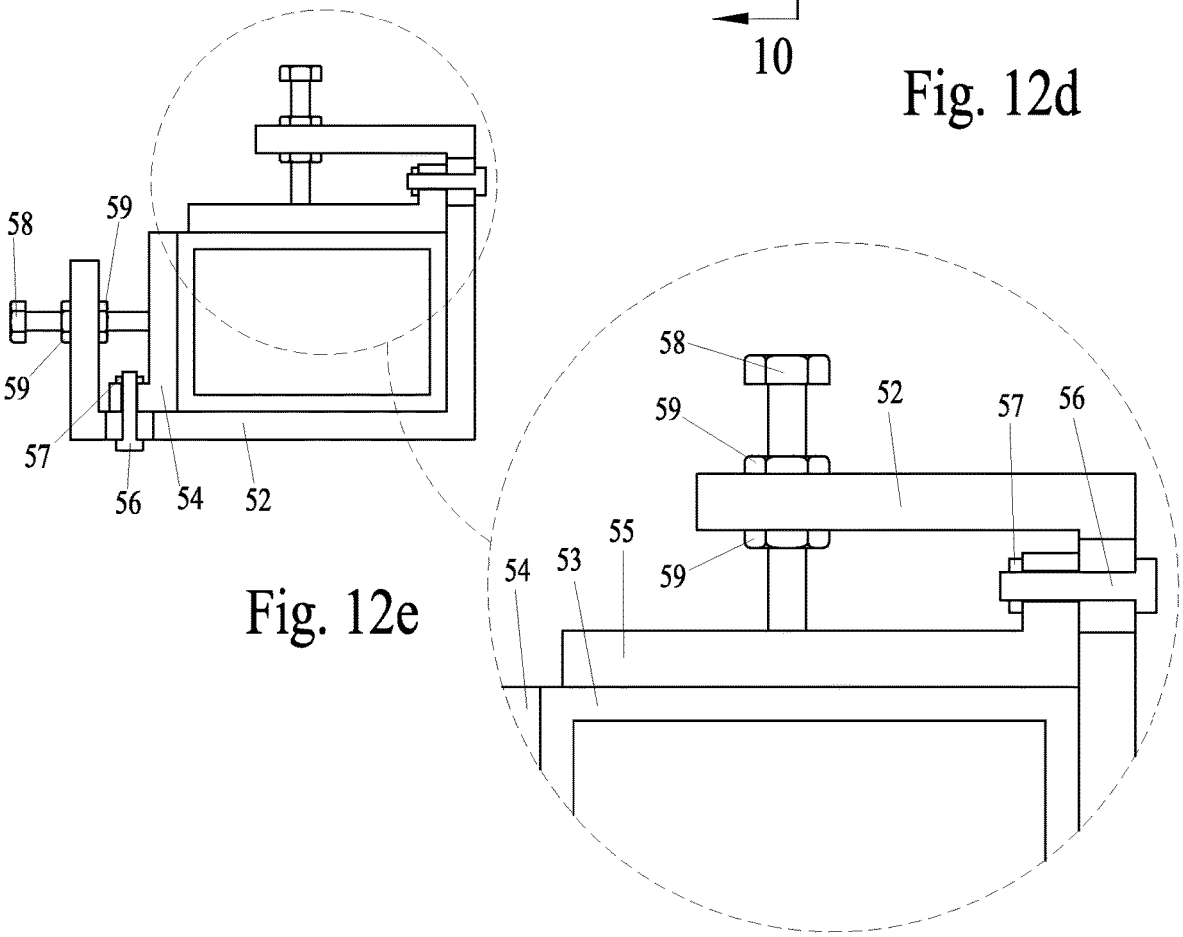

FIG. 12*e* shows the section view of section 9-9 shown in FIG. 12*b*.

Figure 12F:
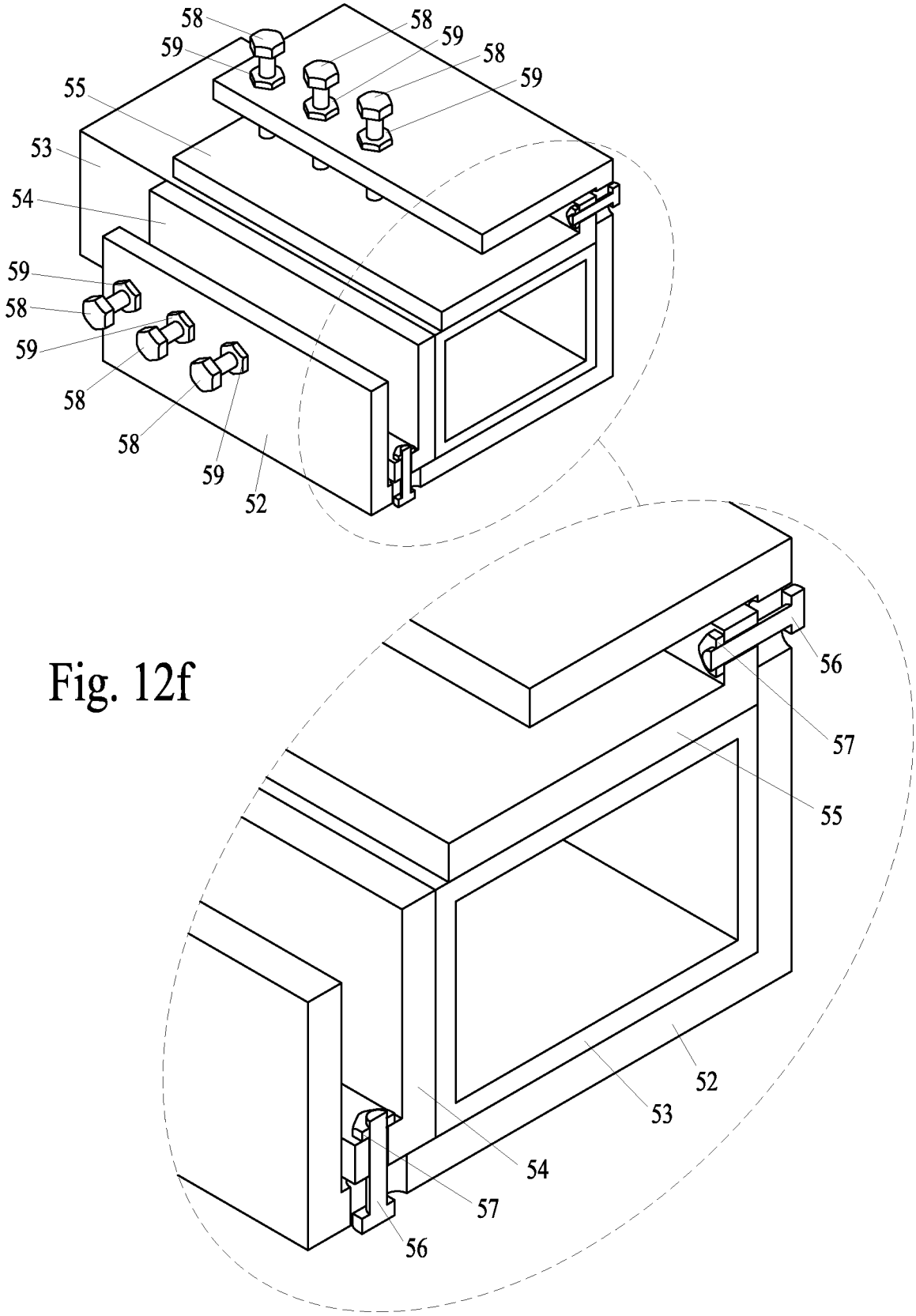

FIG. 12*f* shows the isometric view of section 9-9 shown in FIG. 12*e*.

Figure 12G:
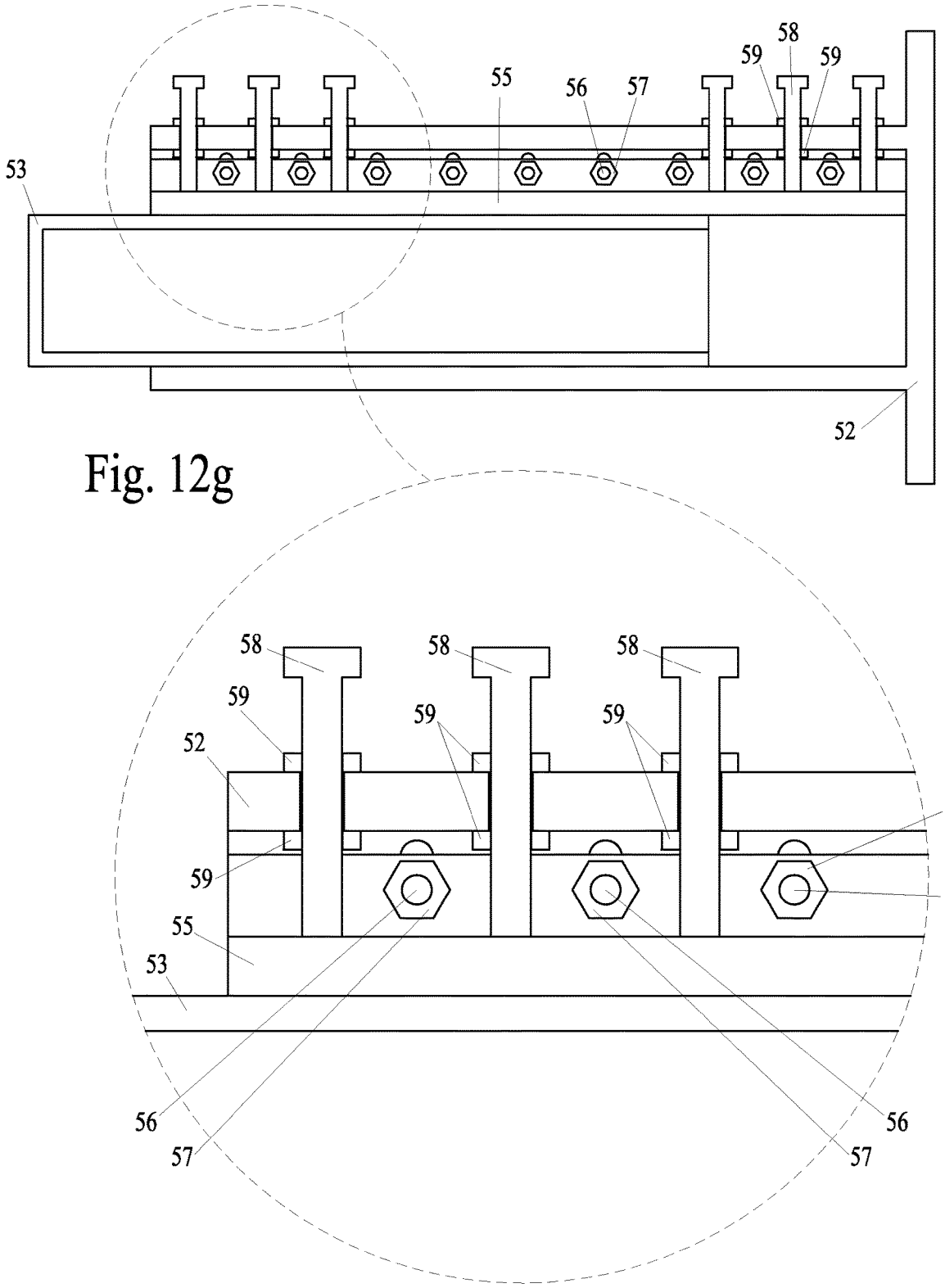

FIG. 12*g* shows the section view of section 10-10 shown in FIG. 12*d*.

Figure 12H:
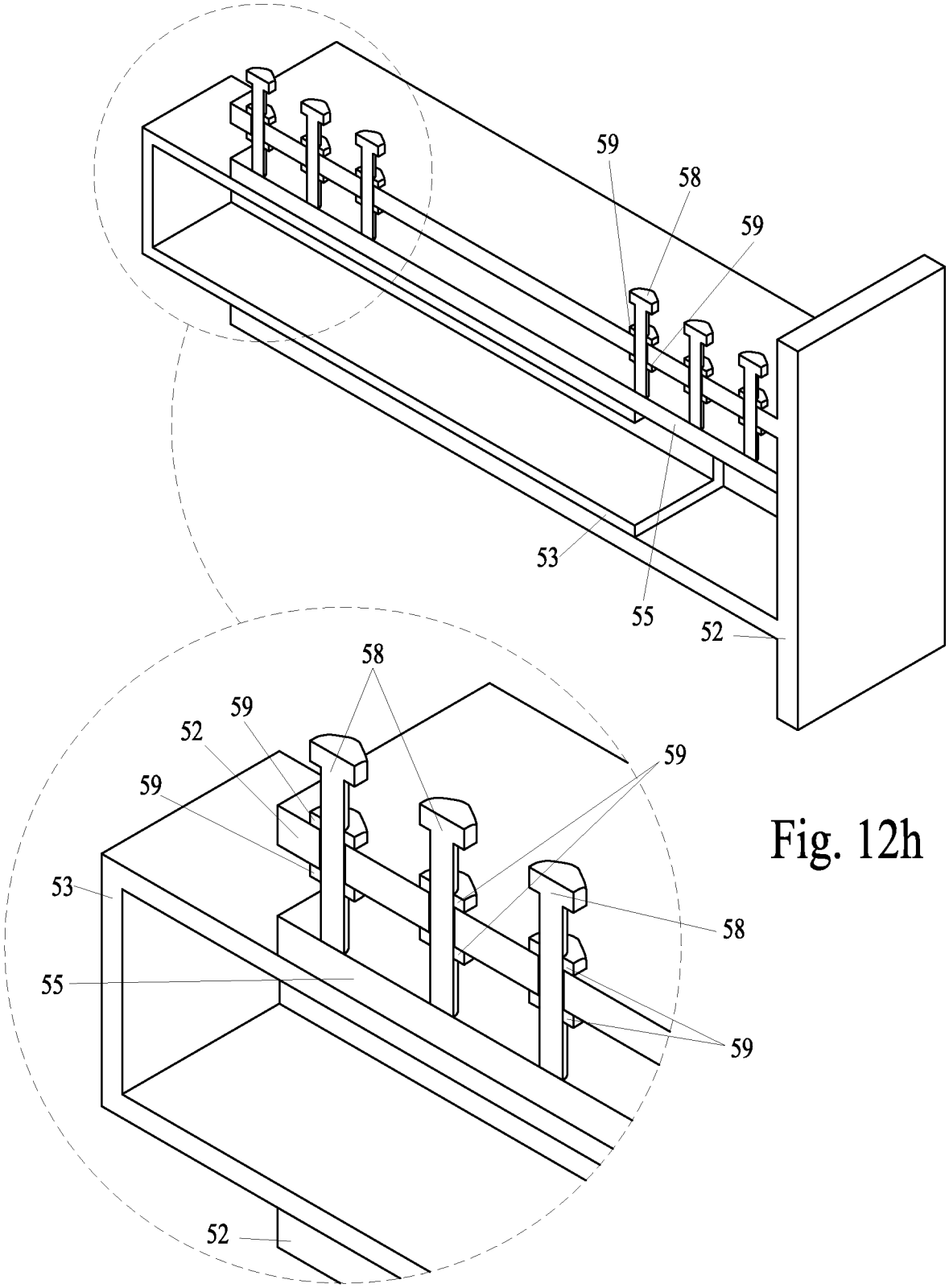

FIG. 12*h* shows the isometric view of section 10-10 shown in FIG. 12*g*.

Figure 12I:
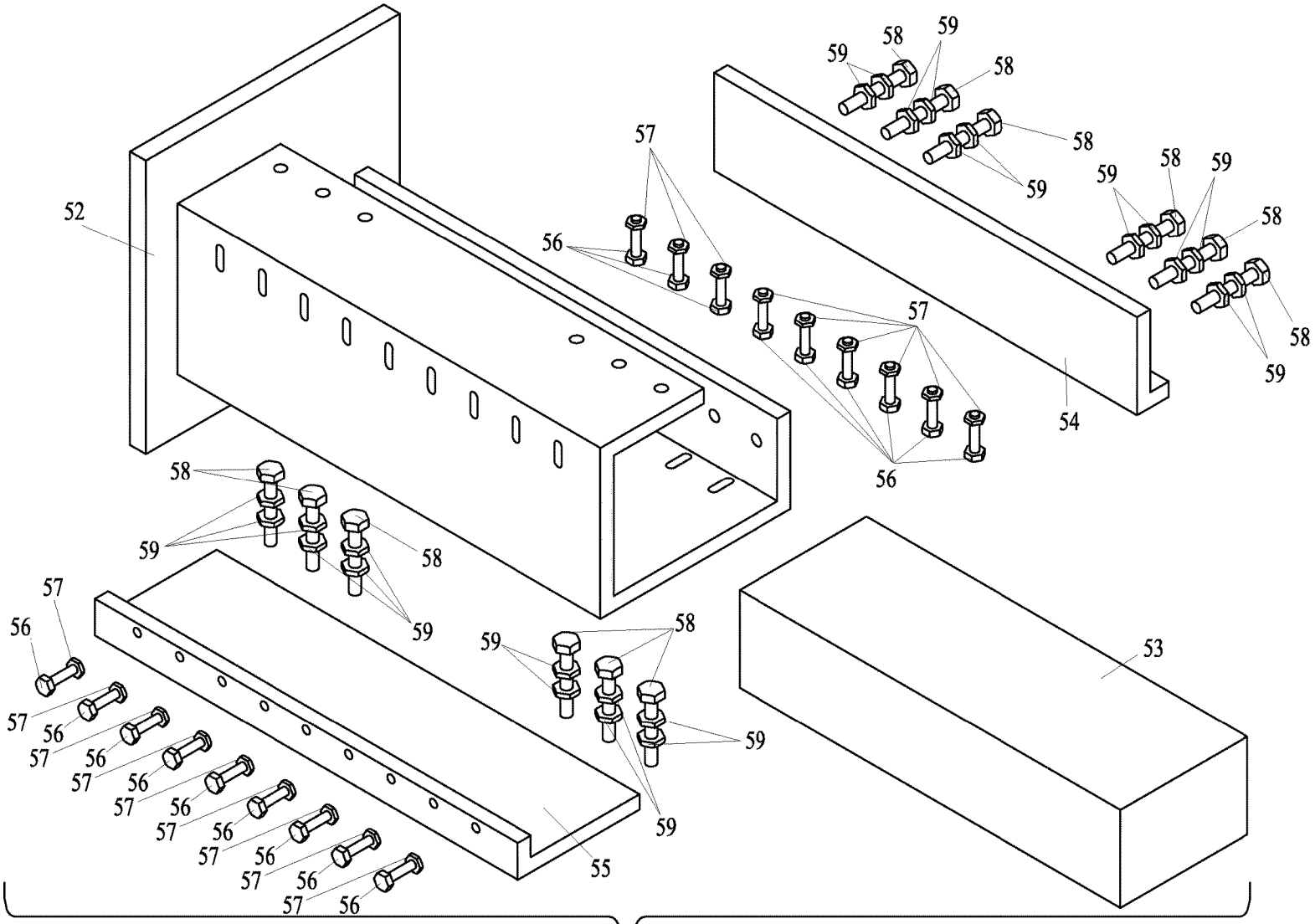

FIG. 12*i* shows an isometric view of the mechanism for an Adjustable Closure for the Sliding Arm said in FIG. 12*a* disassembled and all parts labelled.

Figure 12J:
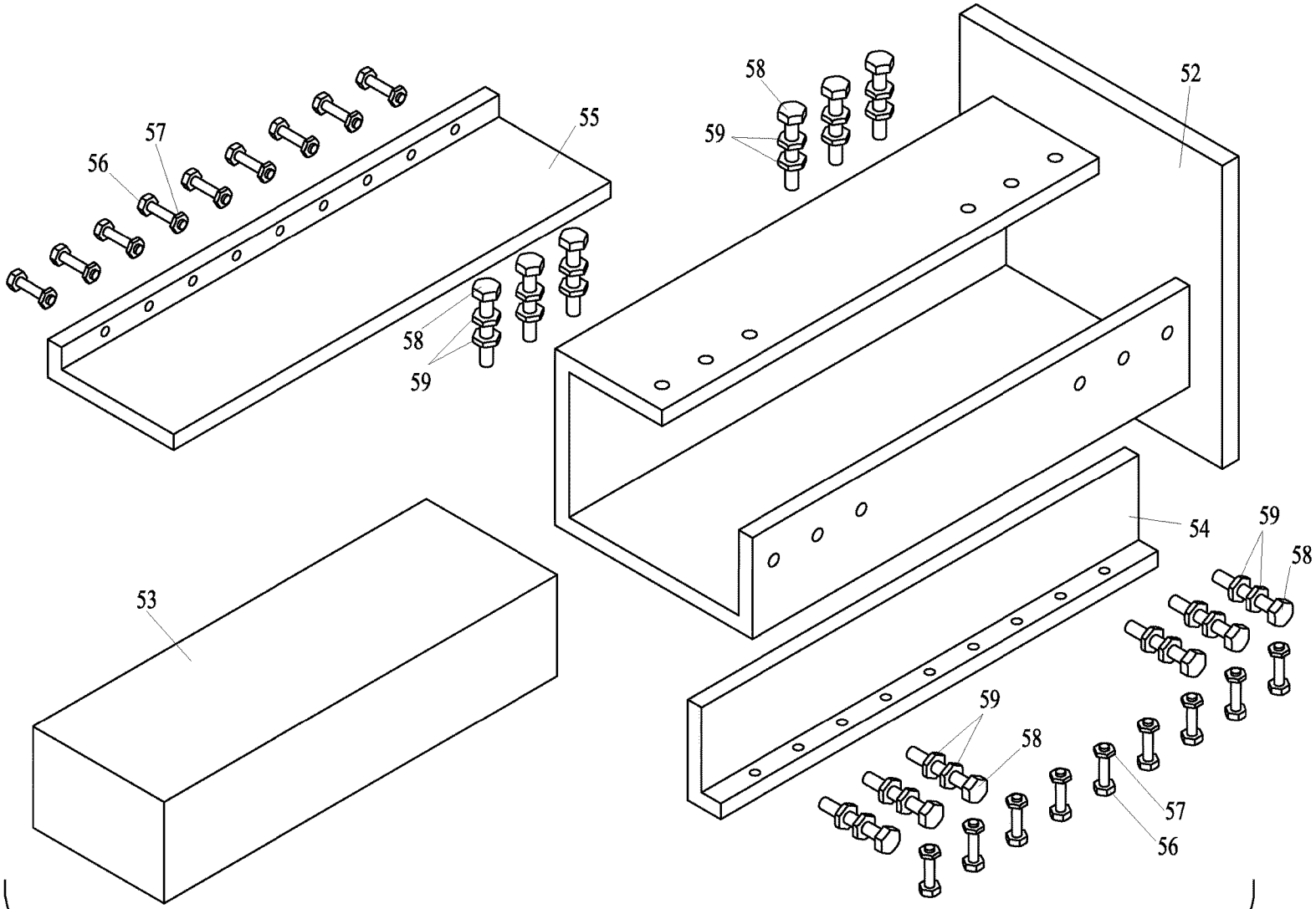

FIG. 12*j* shows an additional isometric view of the mechanism for an Adjustable Closure for the Sliding Arm said in FIG. 12*a* disassembled with some of the parts labelled.

Figure 13A:
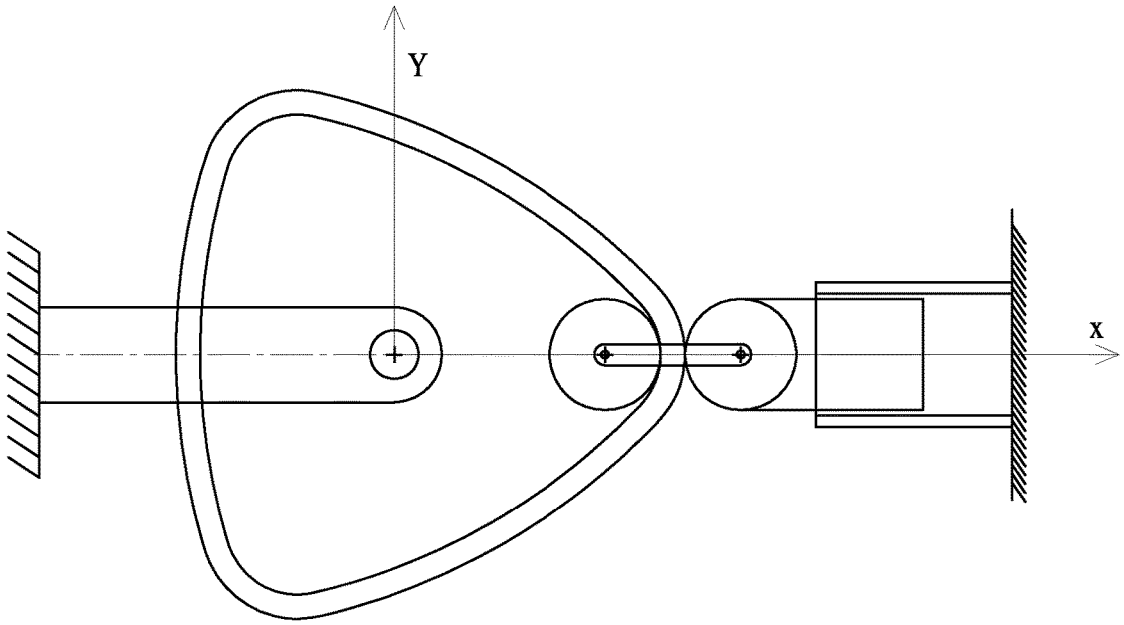

FIG. 13*a* shows a geometric illustration of Option 1 for the use of a solid pin without any bushings or bearings for inside and/or outside the cam pins.

Figure 13B:
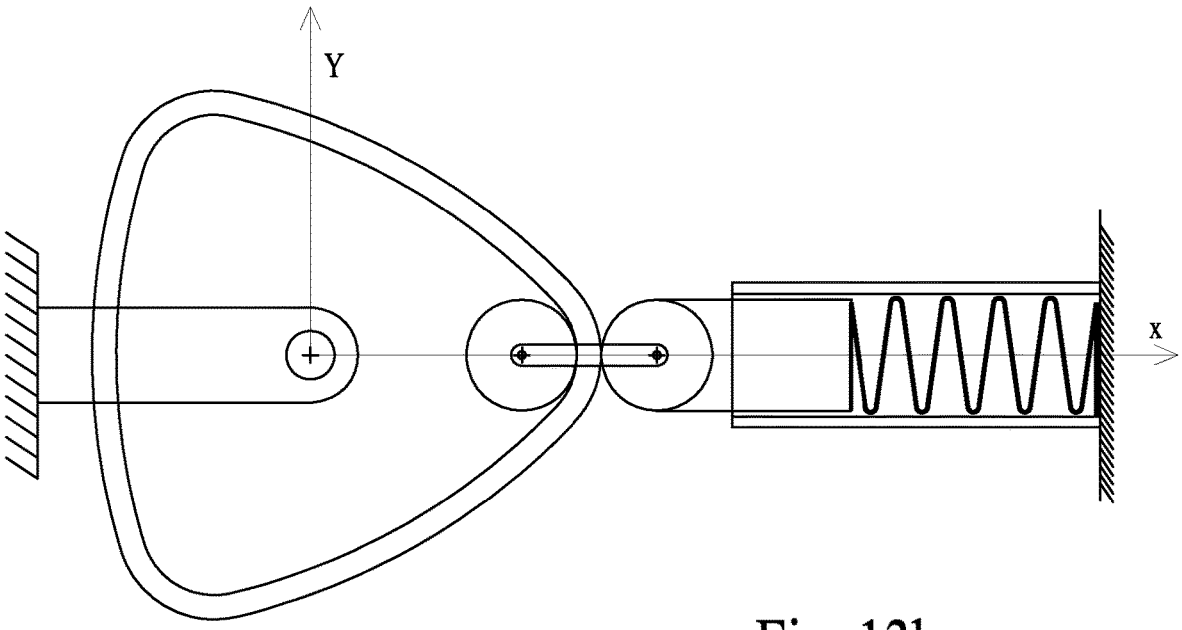

FIG. 13*b* shows a geometric illustration of Option 2 for the use of a spring between the sliding arm and stationary wall attachment for storing the kinetic energy of the system.

Figure 13C:
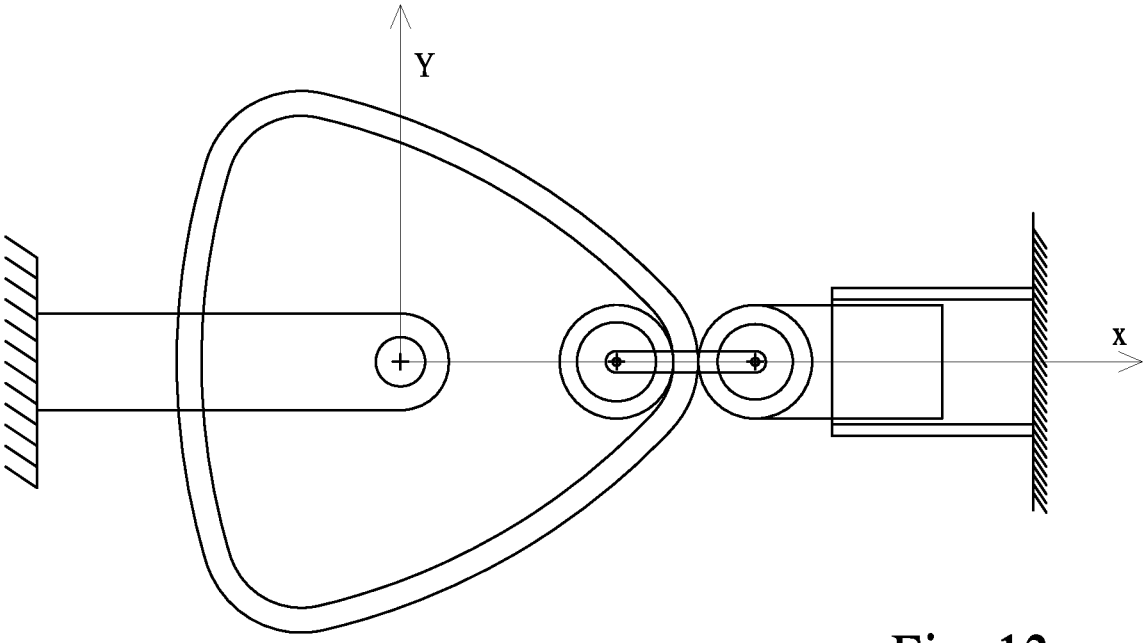

FIG. 13*c* shows a geometric illustration of Option 3 for the use of bushing for the inside and/or outside the cam pins.

Figure 13D:
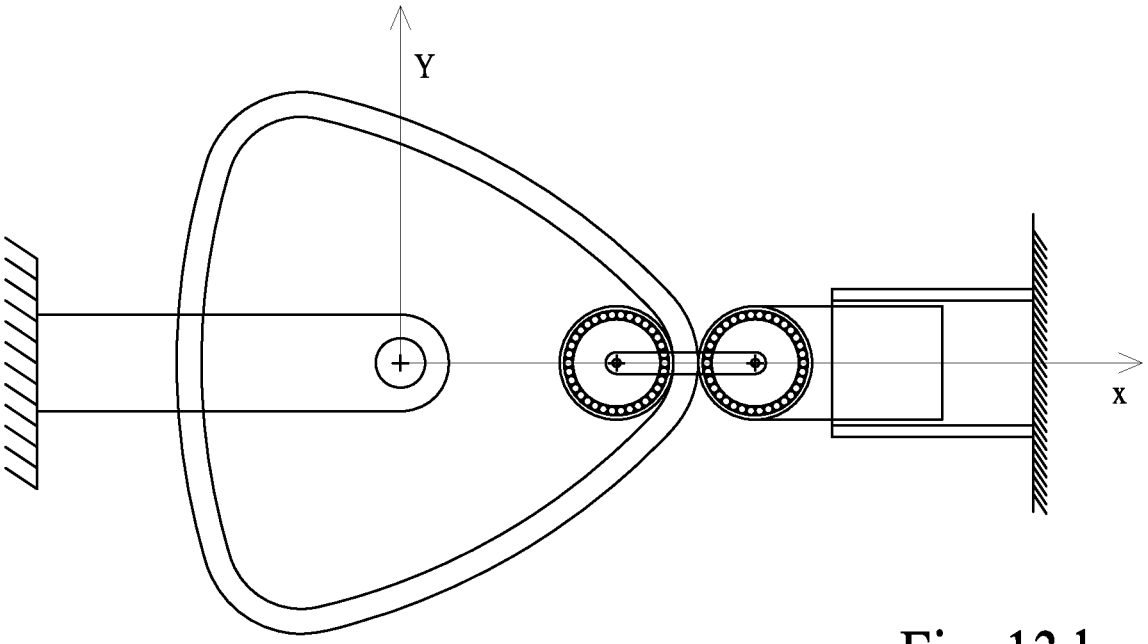

FIG. 13*d* shows a geometric illustration of Option 4 for the use of ball or roller bearings for the inside and/or outside the cam pins and bushings.

Figure 13E:
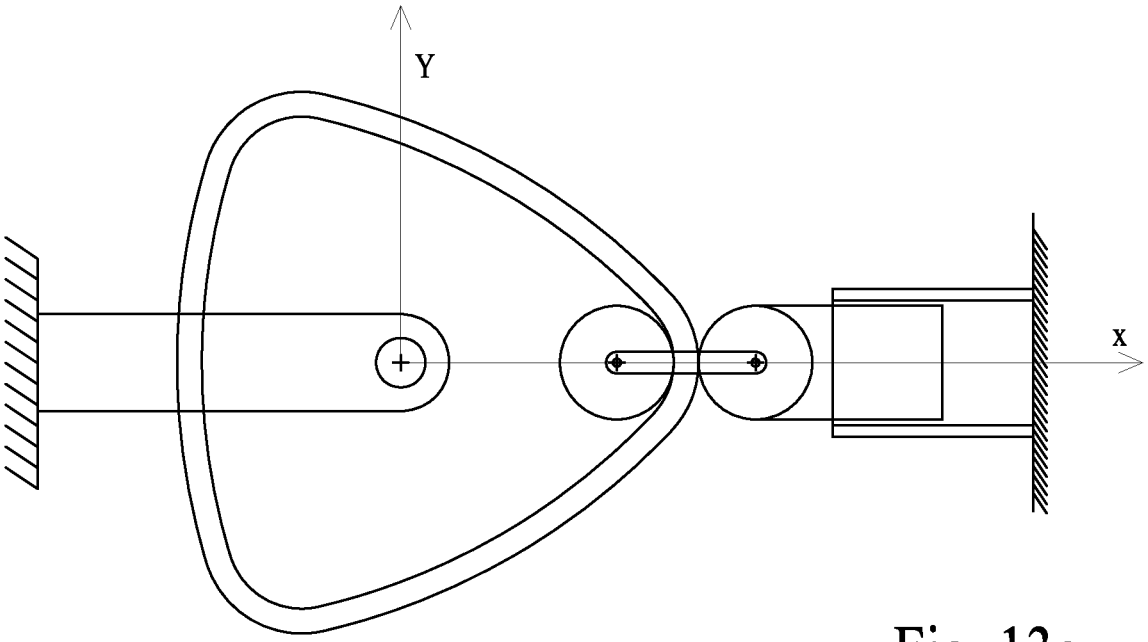

FIG. 13*e* shows a geometric illustration of Option 5 in which the stationary wall attachment is acting as a closure and the sliding arm is placed inside the stationary wall attachment.

Figure 13F:
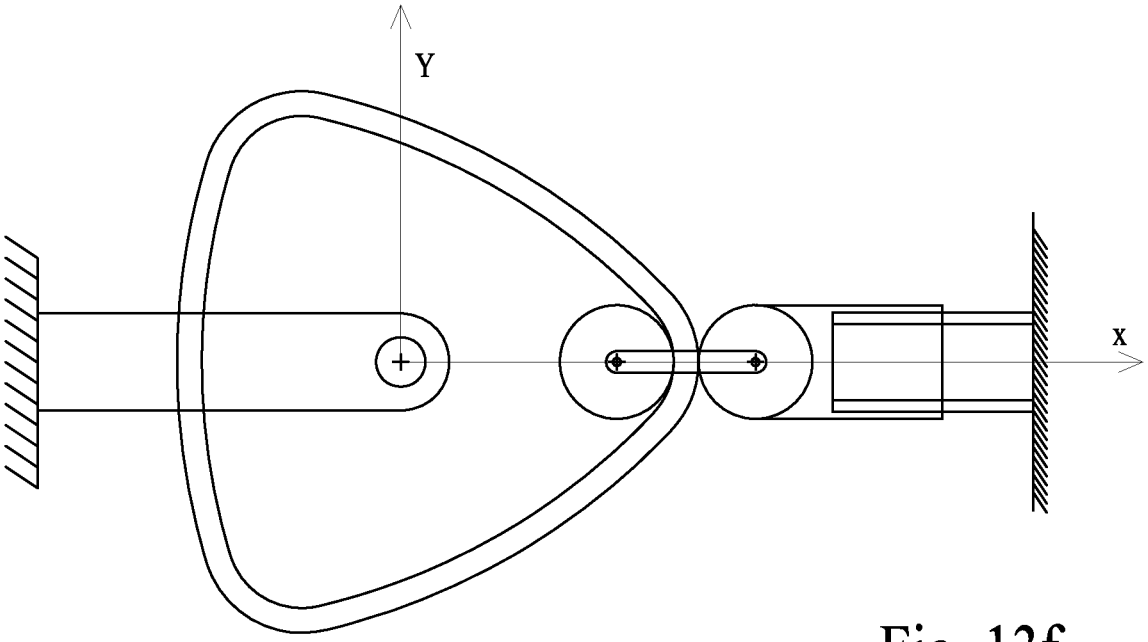

FIG. 13*f* shows a geometric illustration of Option 6 in which the stationary wall attachment being inside the sliding arm and the sliding arm acts as a closure for the stationary wall attachment.

Figure 13G:
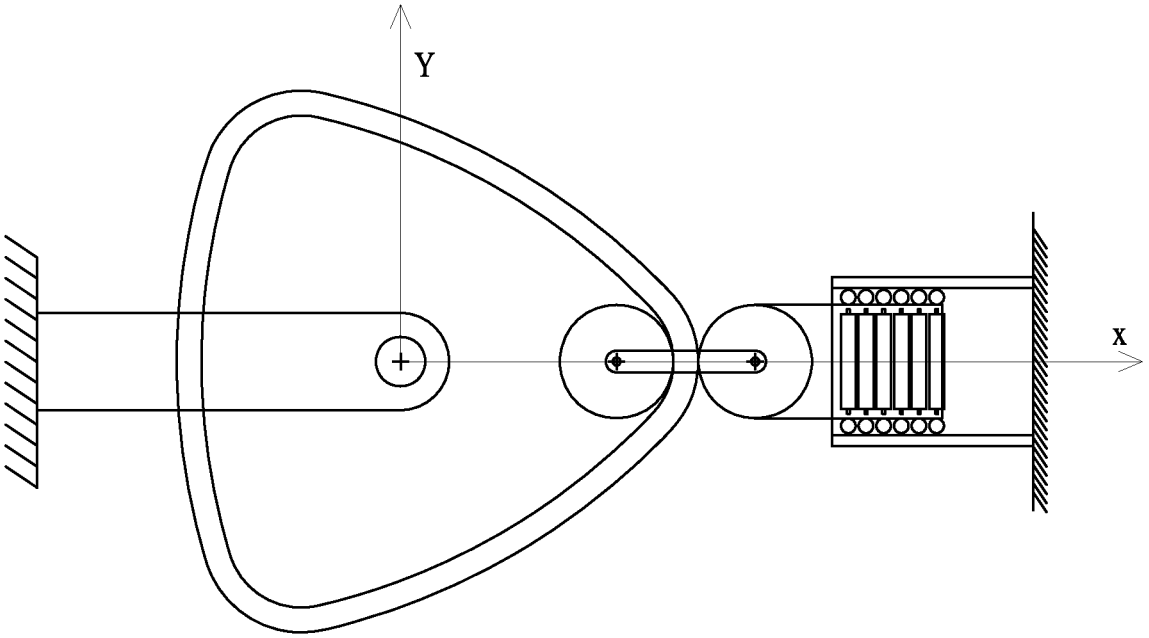

FIG. 13*g* shows a geometric illustration of Option 7 for the use of rollers between the surfaces of stationary wall attachment and sliding arm.

Figure 13H:
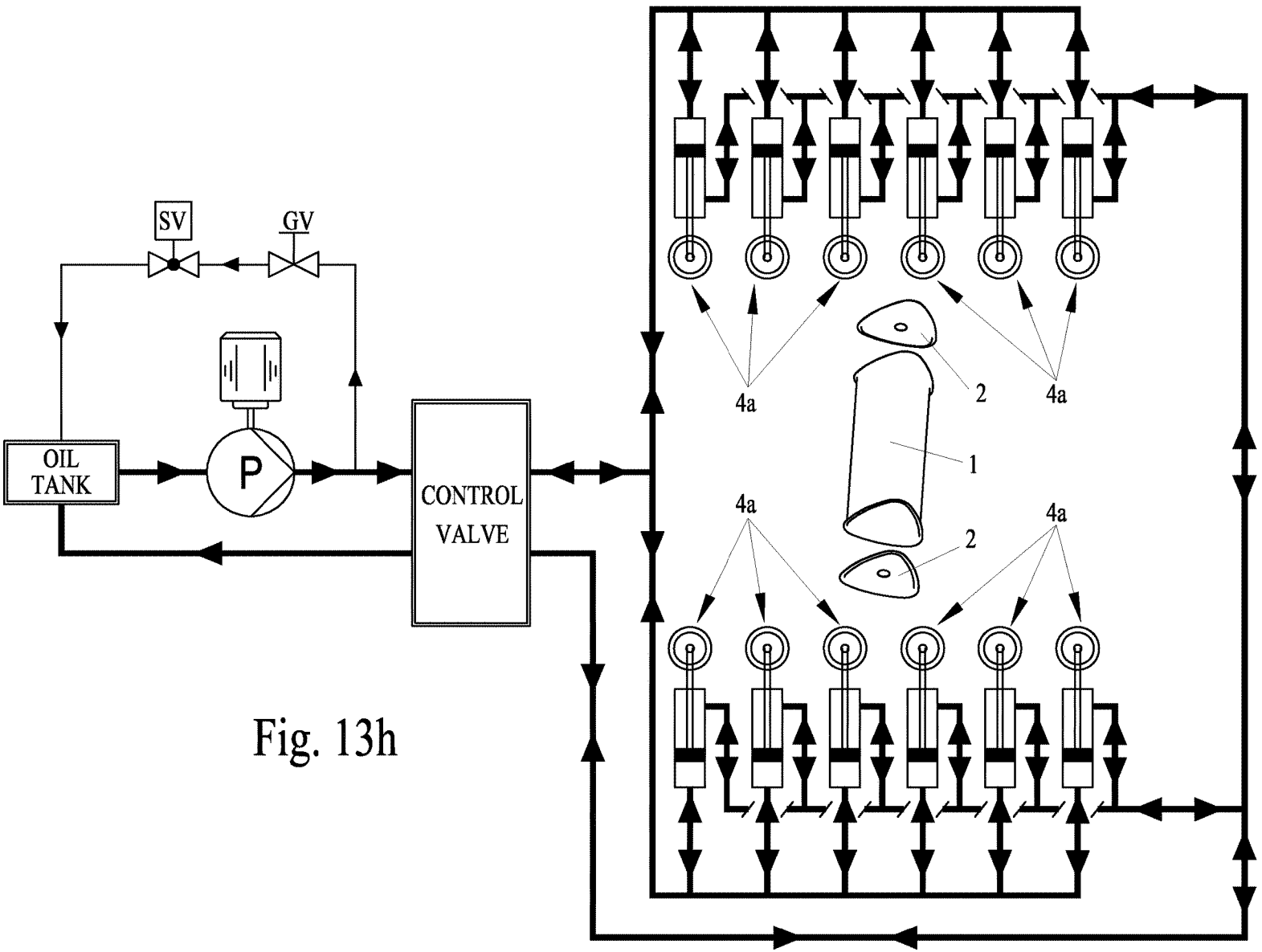

FIG. 13*h* shows a schematic flow diagram of a hydraulic system for muffler cap spinner with multiple rollers related to Option 8.

FIG. 14*a* is a simplified geometry for the Fifth Method applied to muffler cap spinner.

FIG. 14*b* is the simplified geometry said in FIG. 14*a* after a 22.5 degrees rotation of the cam in counter clockwise direction.

FIG. 14*c* shows the isometric view of a muffler cap spinning assembly using the Fifth Method.

FIG. 14*d* shows the top view of the mechanism said in FIG. 14*c*.

FIG. 14*e* shows the front view of the mechanism said in FIG. 14*c*.

FIG. 14*e*1 shows section 11-11 from FIG. 14*e*.

Figure 14F:
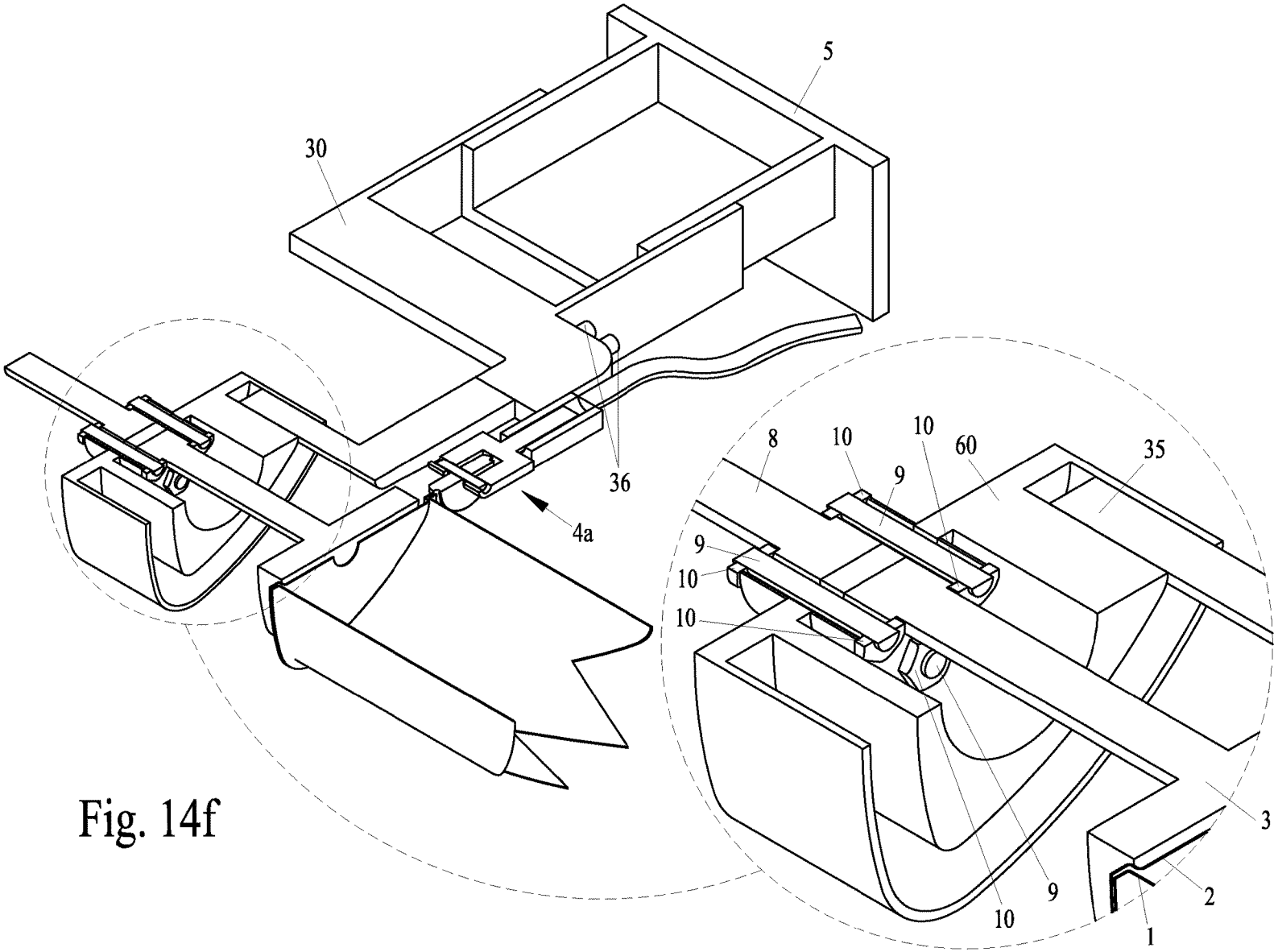

FIG. 14*f* shows the isometric view of section 11-11 said FIG. 14*e*1.

Figure 14G:
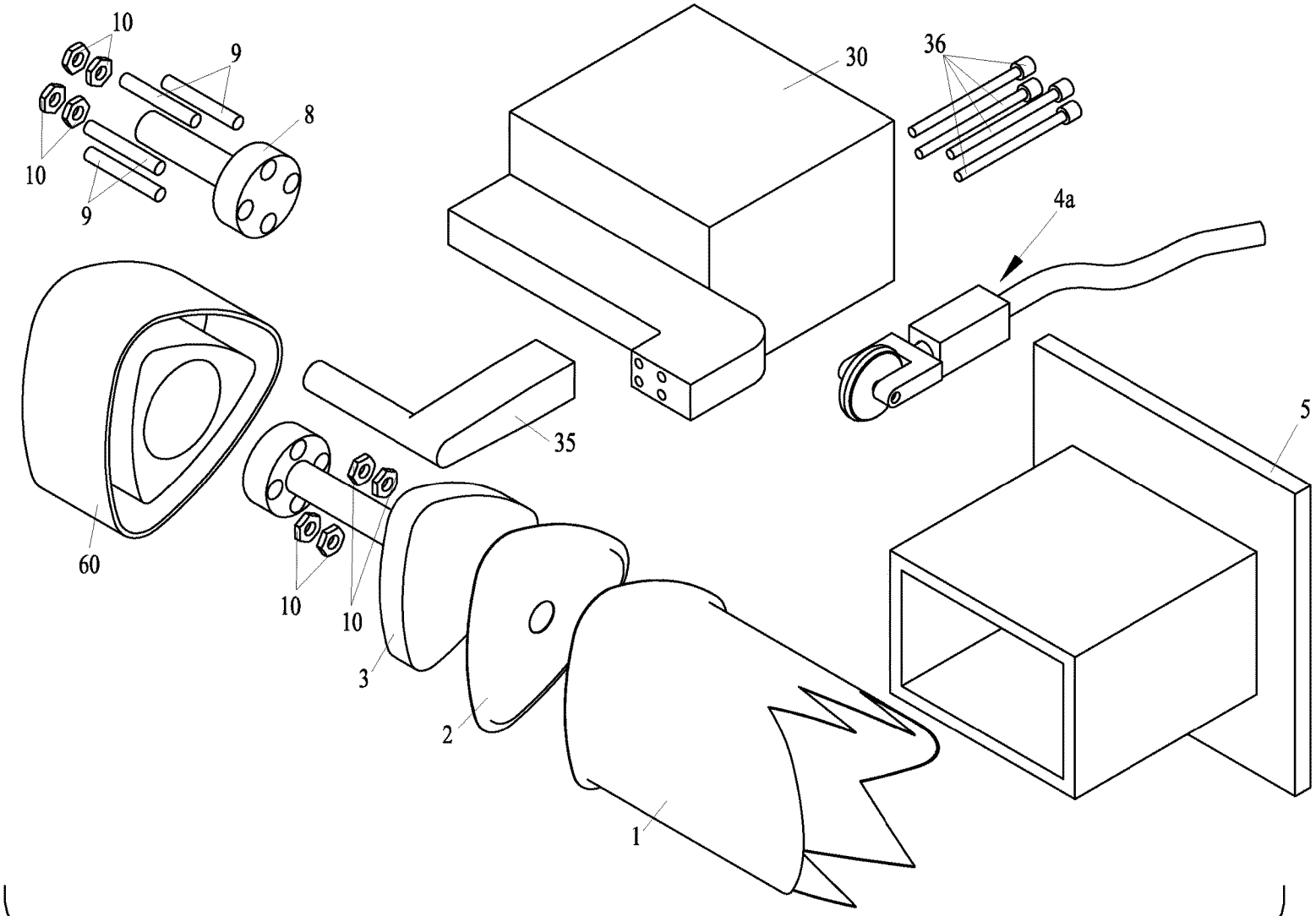

FIG. 14*g* shows the mechanism said in FIG. 14*c* disassembled and all parts labelled.

Figure 15A:
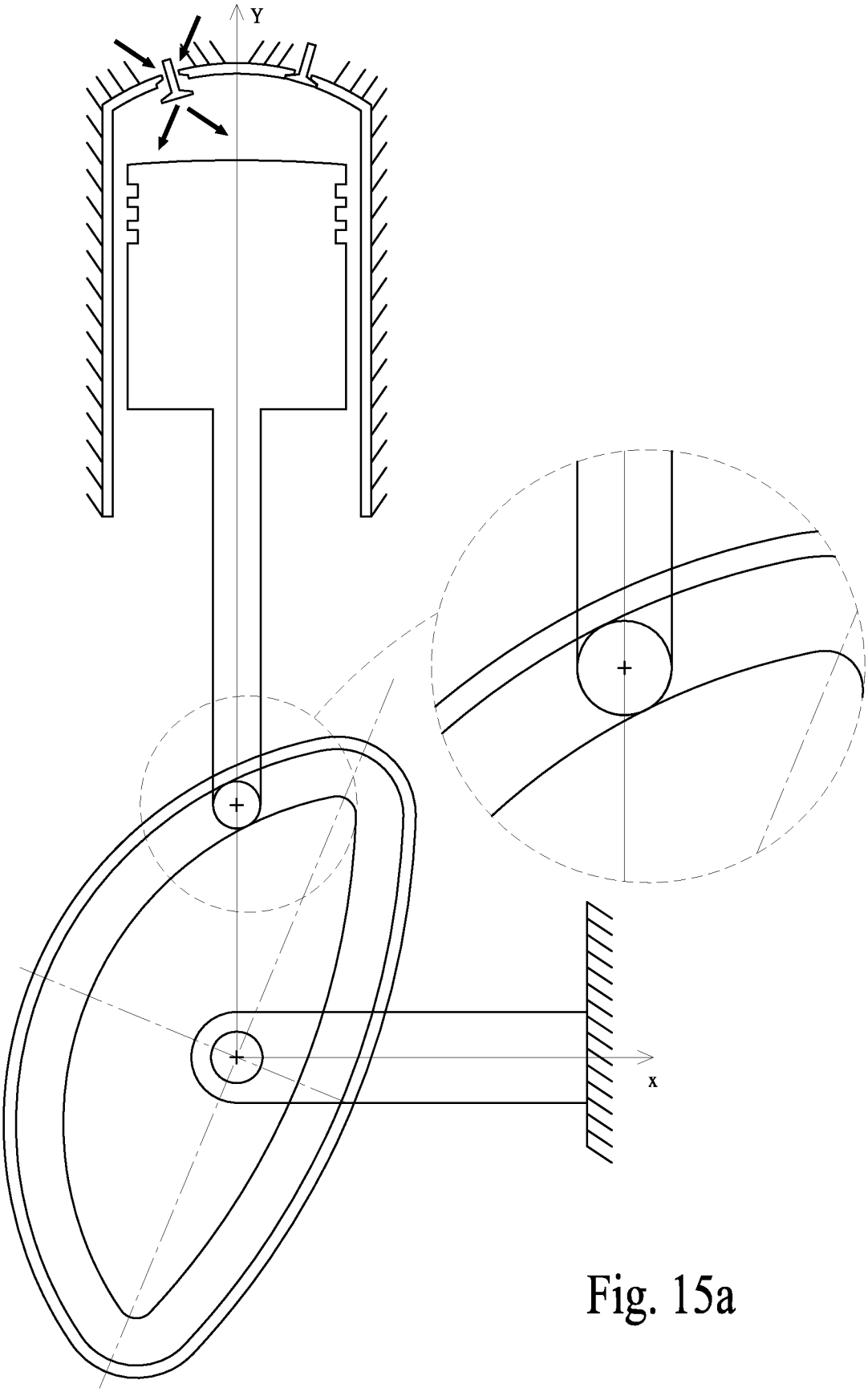

FIG. 15*a* shows the basic geometry of the art using the Fifth Method for engine crankshaft during intake stroke after the crankshaft has rotated 22.5 degrees in clockwise direction from top dead center position.

Figure 15B:
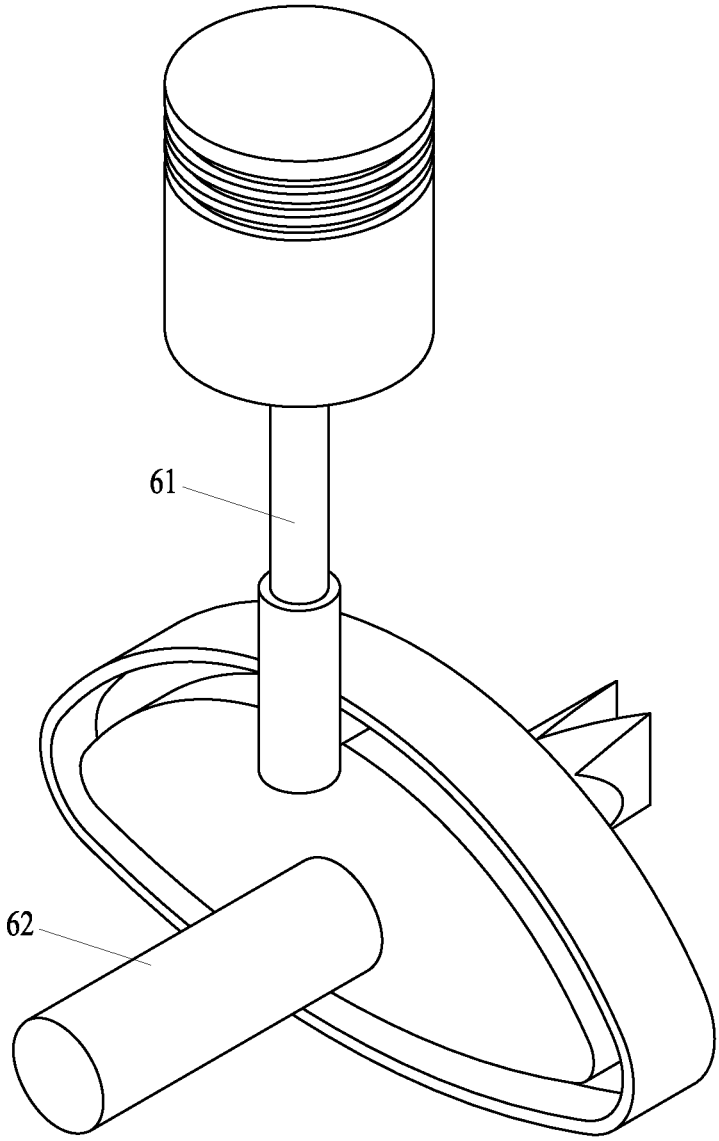

FIG. 15*b* shows the isometric view of a typical mechanism using the Fifth Method for engine crankshaft with all parts labelled.

Figure 15D:
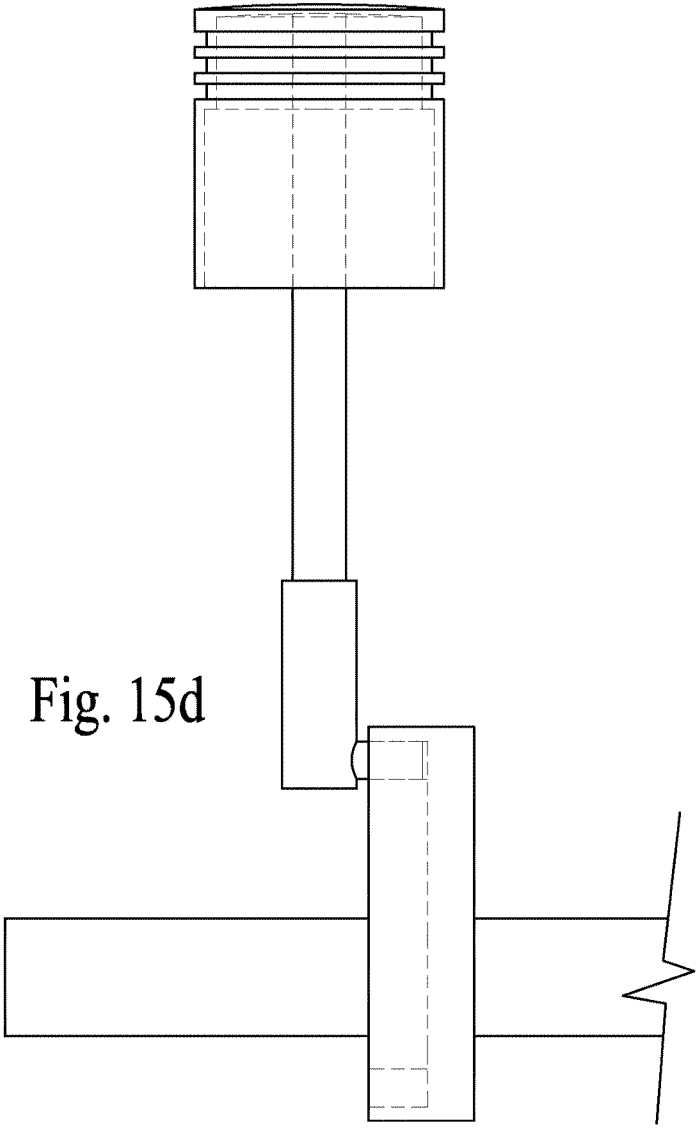
Figure 15C:
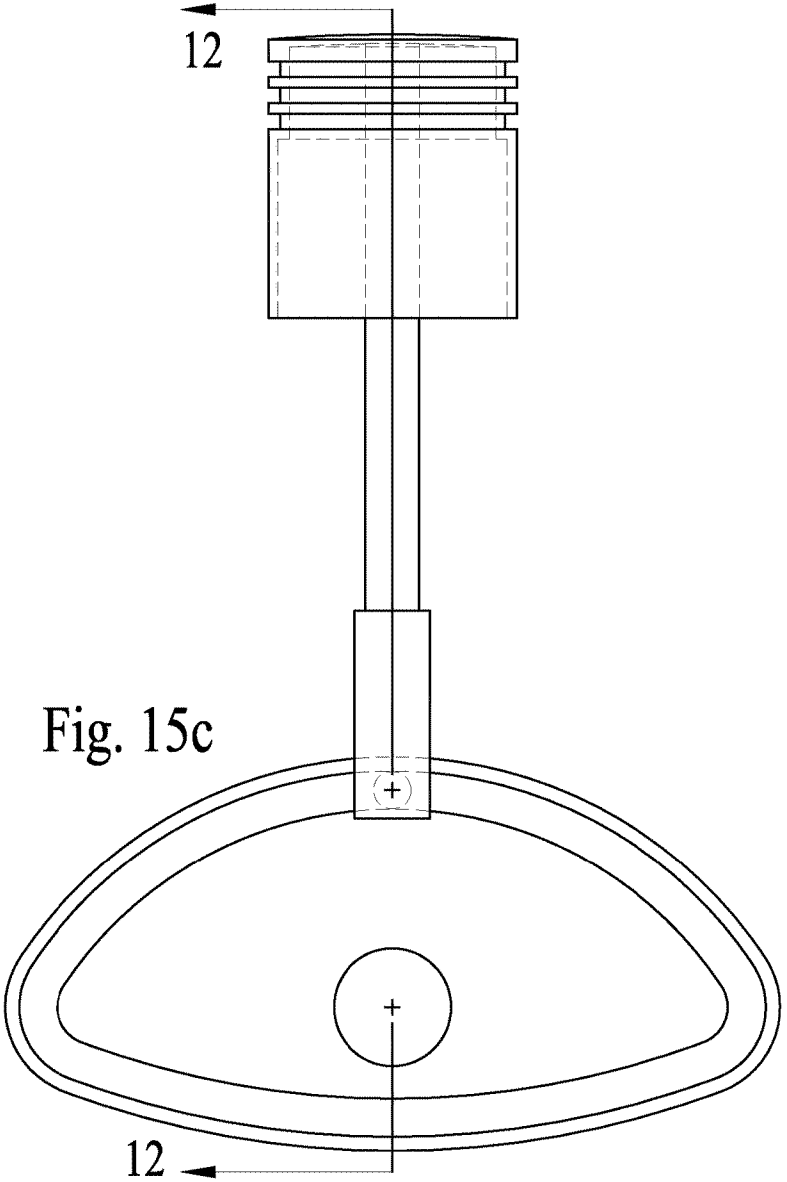

FIG. 15*c* shows the left view of the mechanism said in FIG. 15*b*.

FIG. 15*d* shows the front view of the mechanism said in FIG. 15*b*.

Figure 15E:
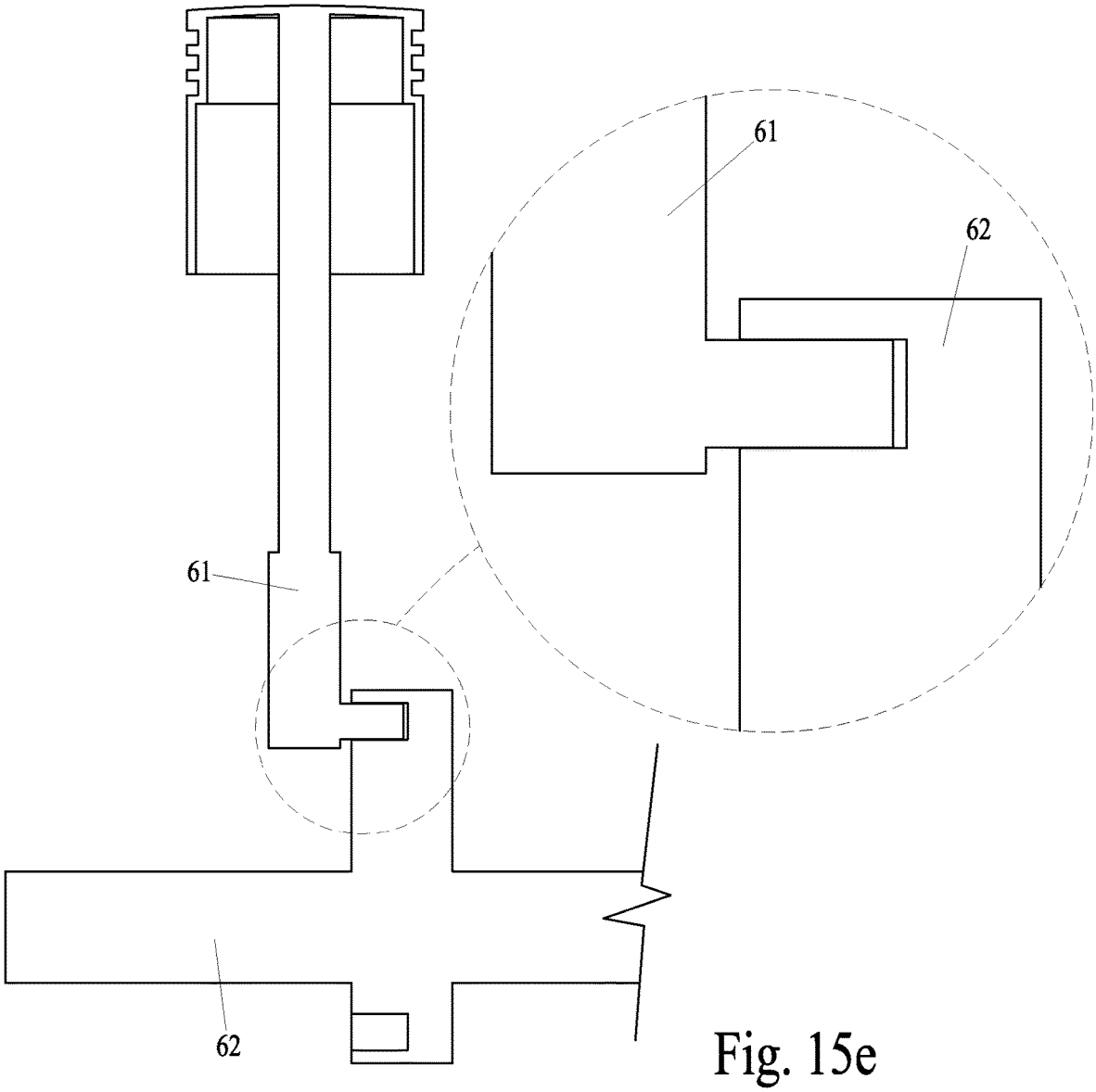

FIG. 15*e* shows the section view of section 12-12 shown in FIG. 15*c*.

Figure 15F:
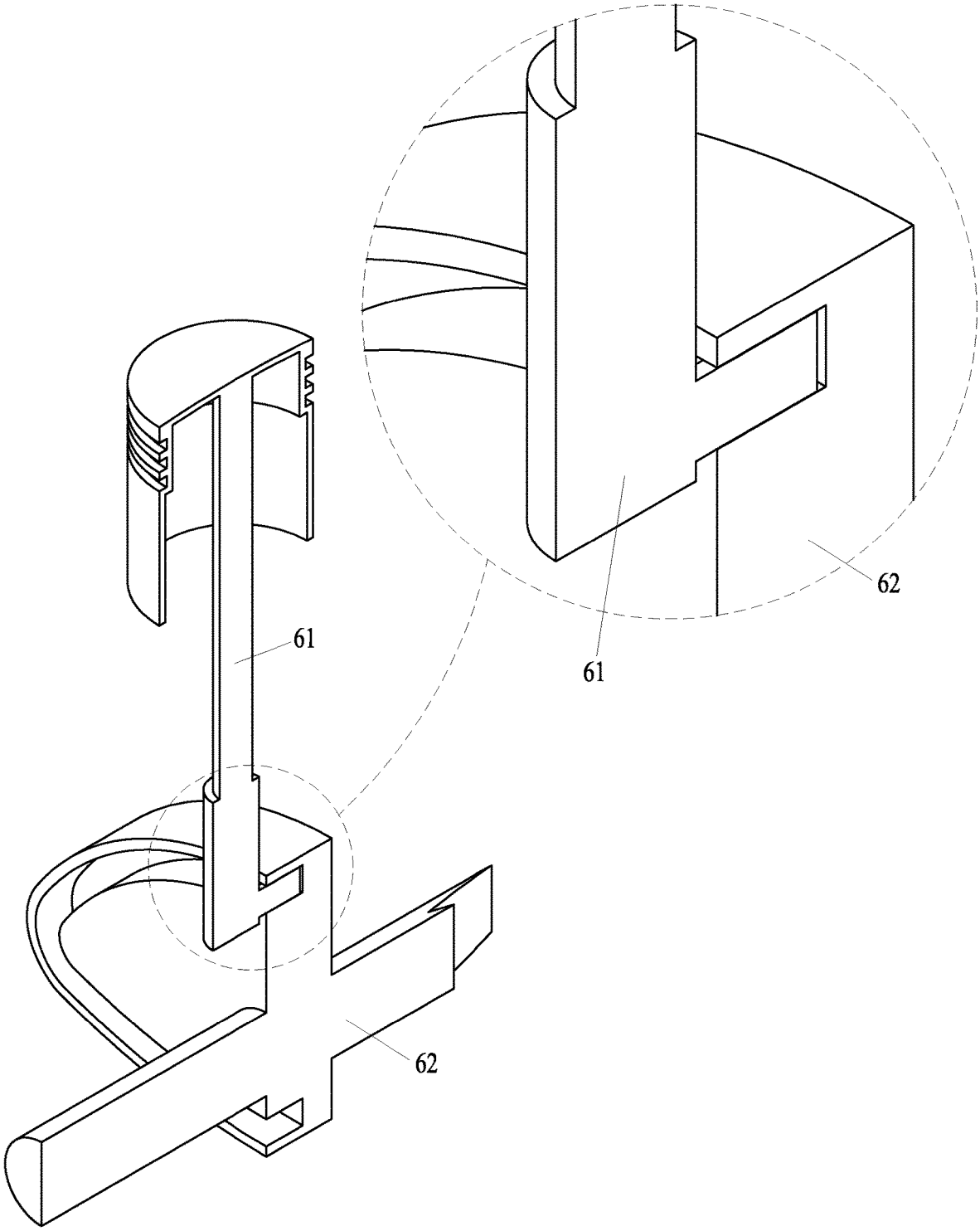

FIG. 15*f* shows the isometric view of the section 12-12 said in FIG. 15*e*.

Figure 15G:
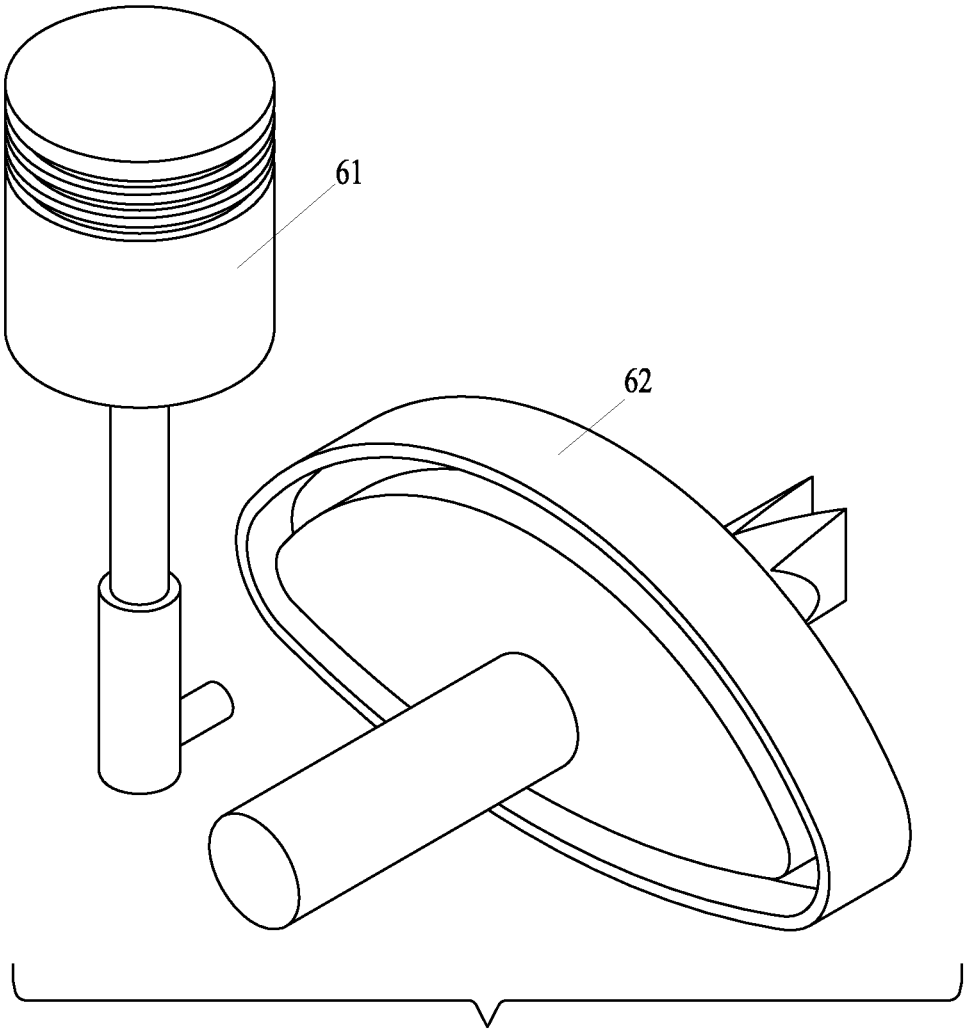

FIG. 15*g* shows the isometric view of the mechanism said in FIG. 15*b* disassembled and all parts labelled.

Figure 16A:
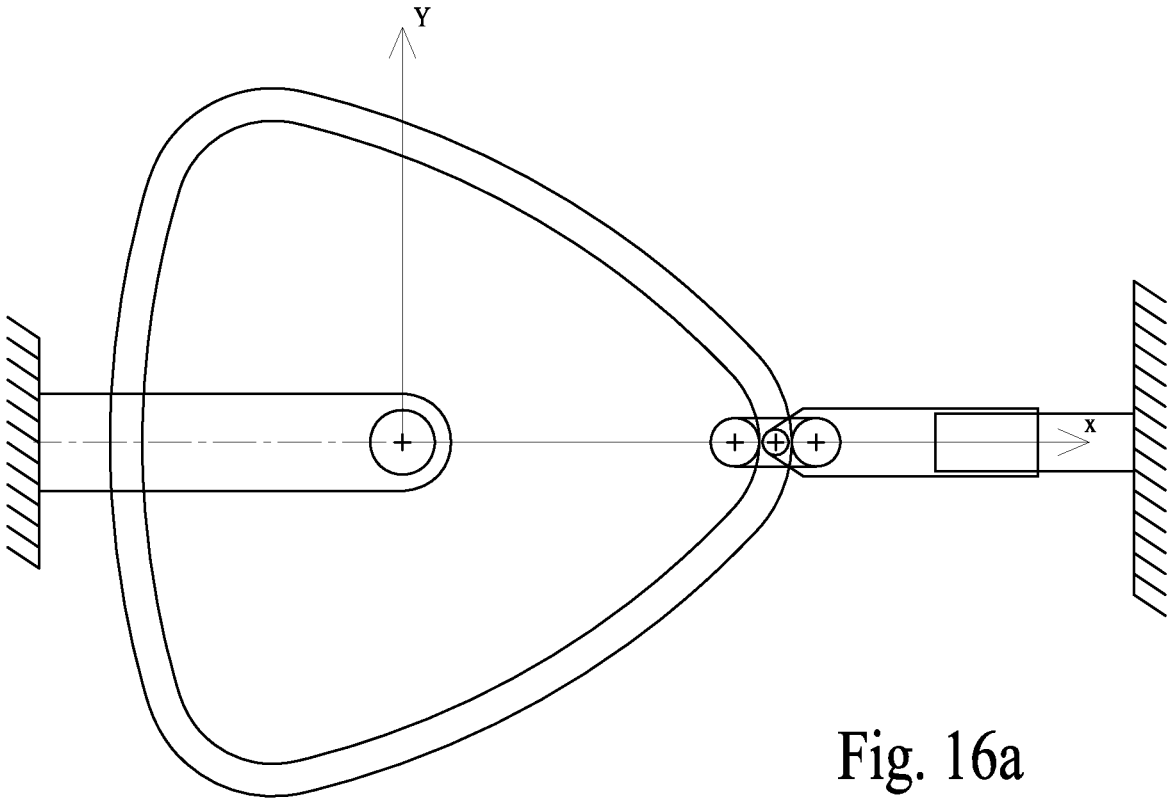

FIG. 16*a* is a simplified geometry for the Sixth Method applied to muffler cap spinner.

Figure 16B:
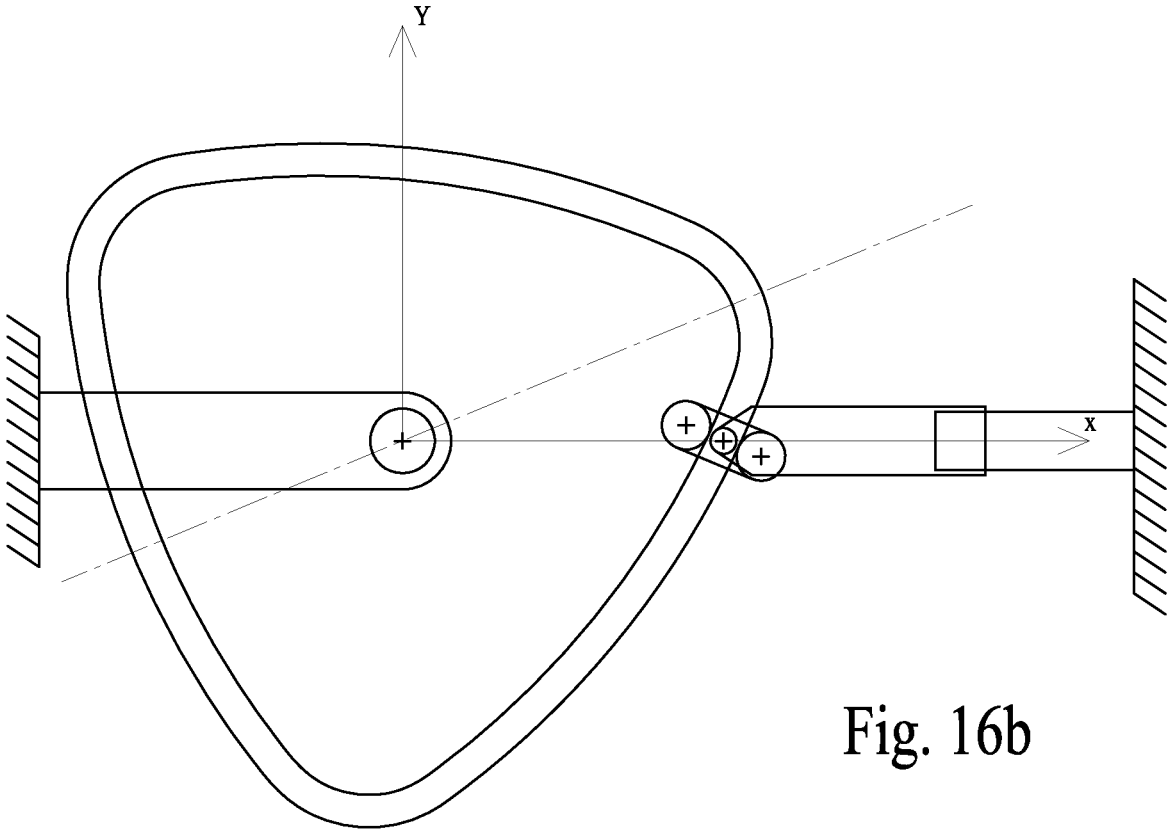

FIG. 16*b* is the simplified geometry said in FIG. 16*a* after a 22.5 degrees rotation of the cam in counter clockwise direction.

Figure 16C:
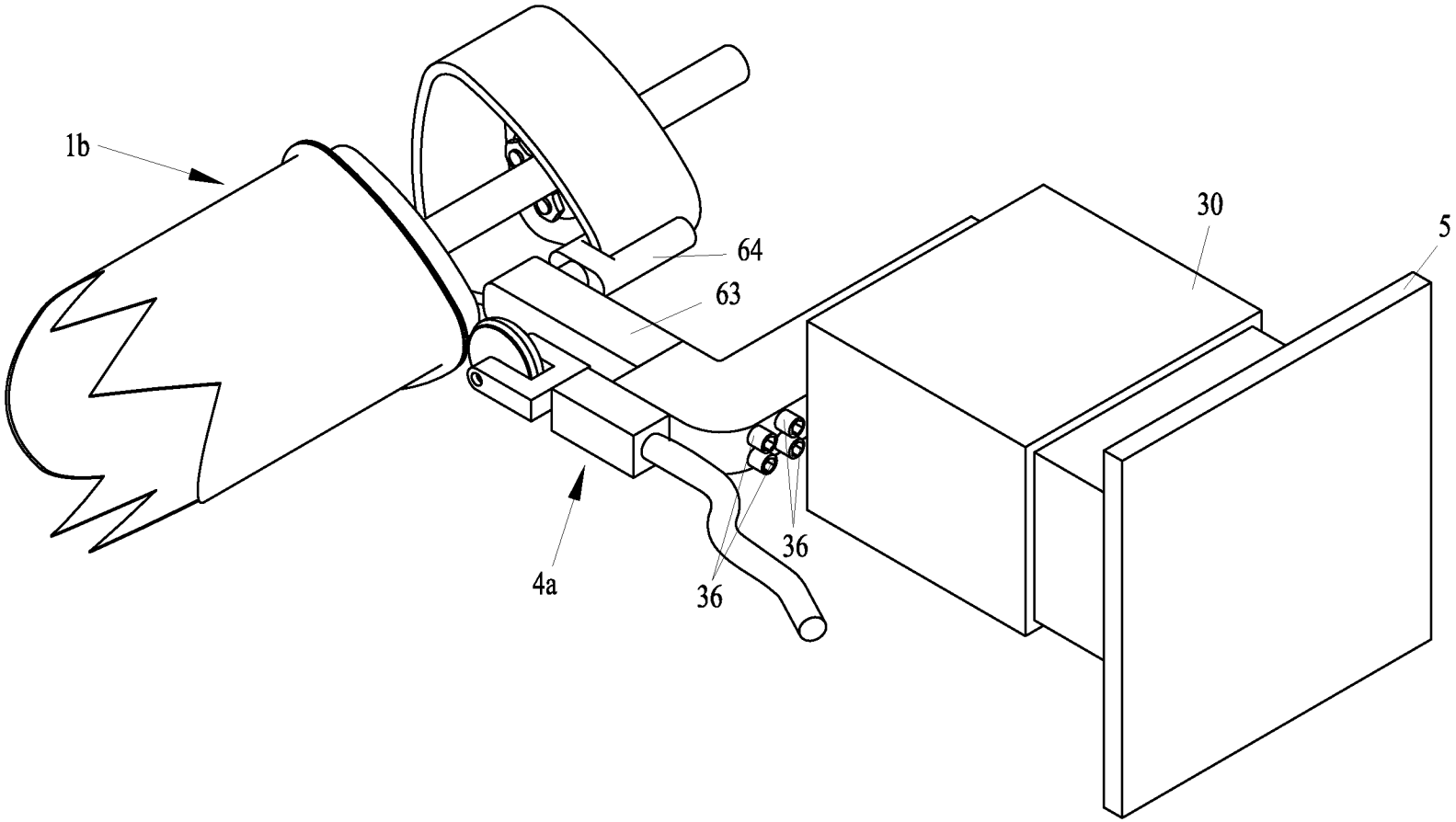

FIG. 16*c* shows the isometric view of a muffler cap spinning mechanism using the Sixth Method.

Figure 16D:
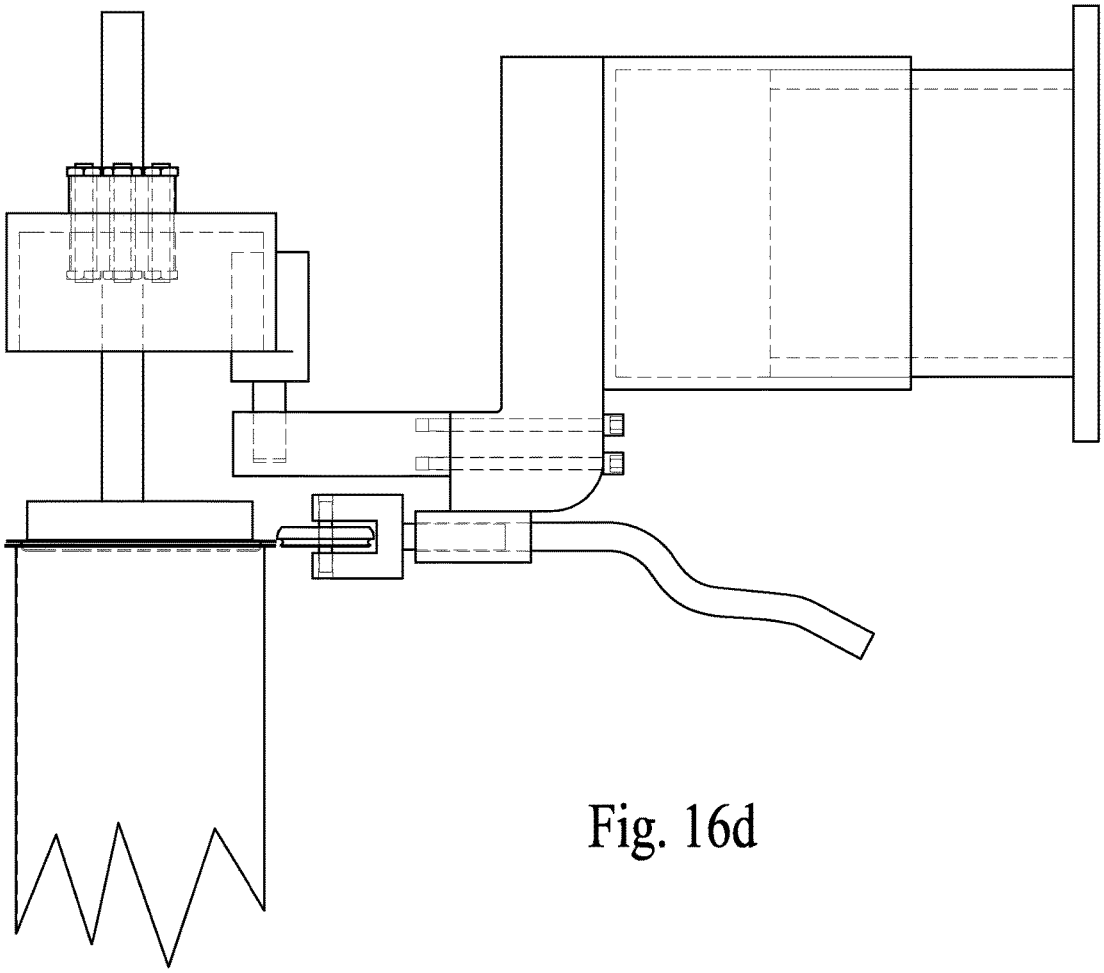

FIG. 16*d* shows the top view of the mechanism said in FIG. 16*c*.

Figure 16E:
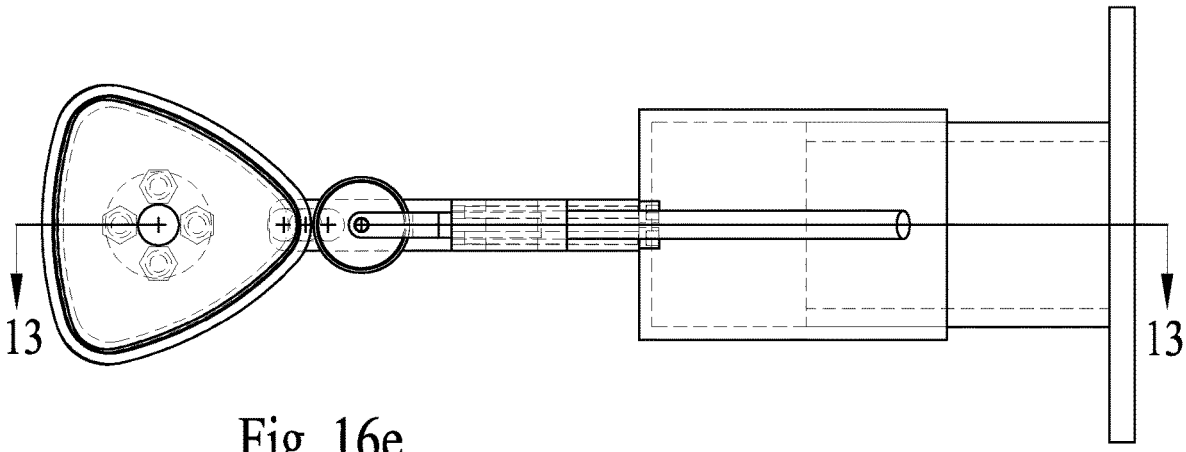

FIG. 16*e* shows the front view of the mechanism said in FIG. 16*c*.

Figure 16F:
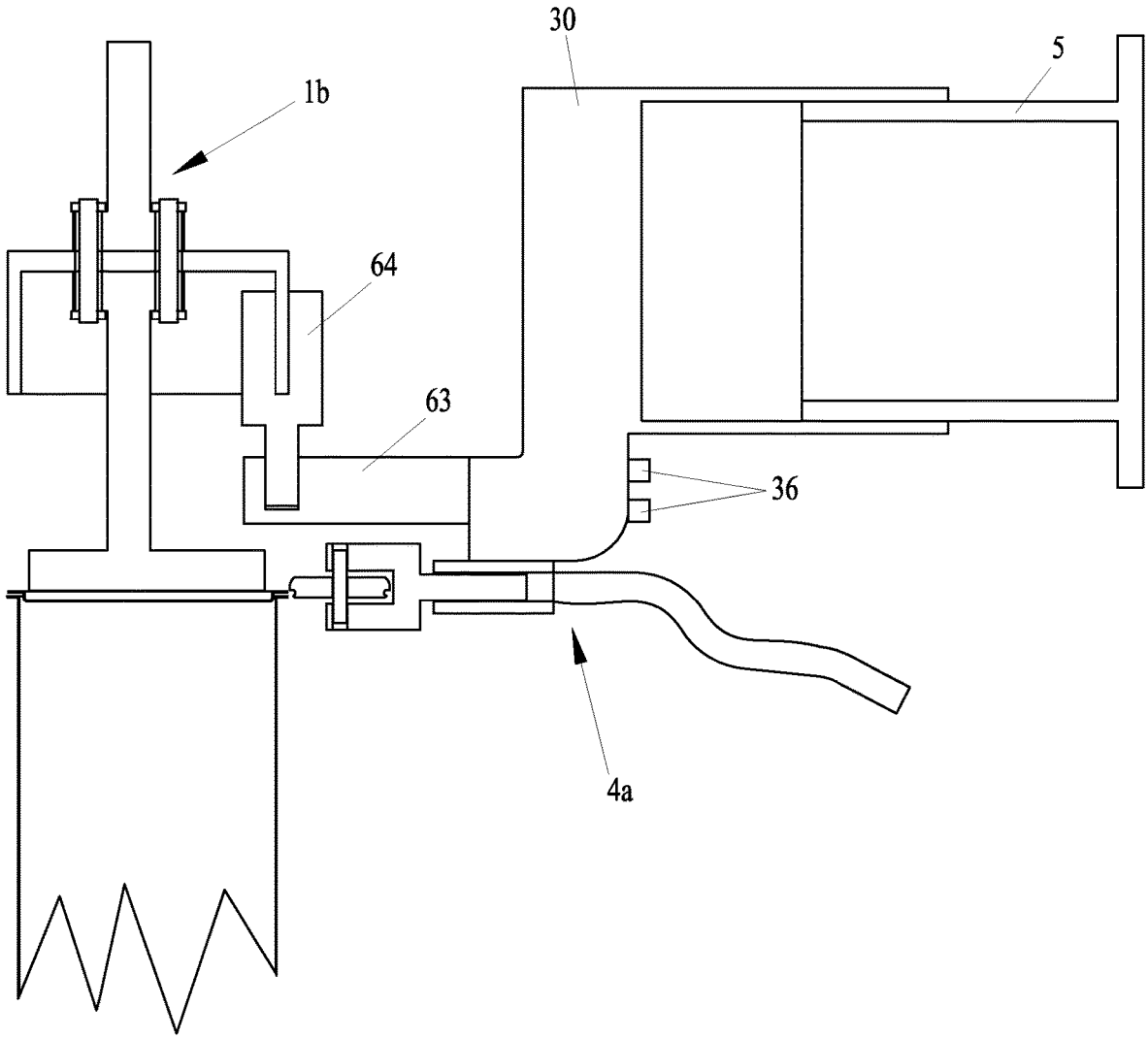

FIG. 16*f* shows section 13-13 from FIG. 16*e*.

Figure 16G:
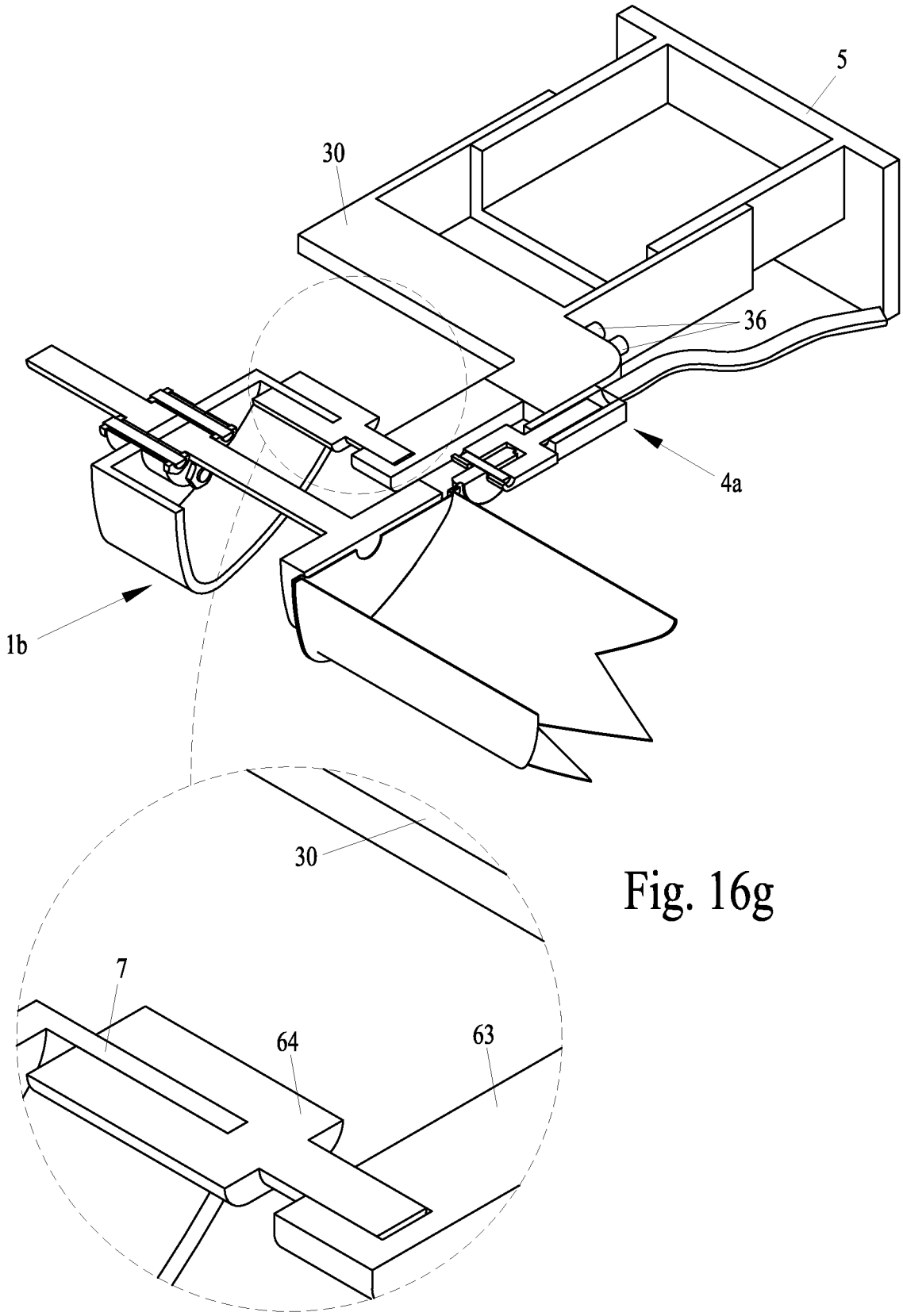

FIG. 16*g* shows the isometric view of section 11-11 said FIG. 14*f*.

Figure 16H:
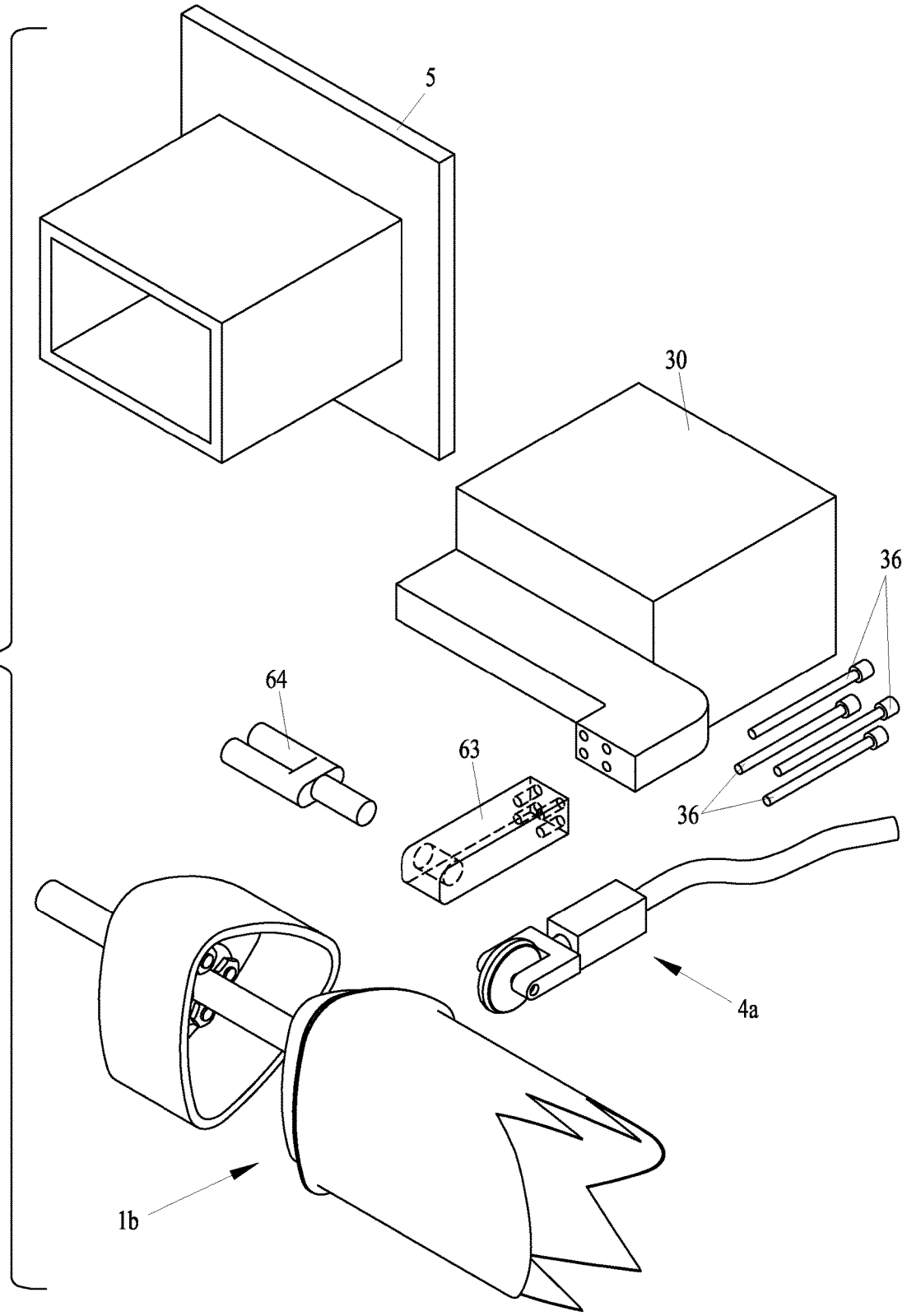

FIG. 16*h* shows the mechanism said in FIG. 16*c* disassembled and all parts labelled.

Figure 17A:
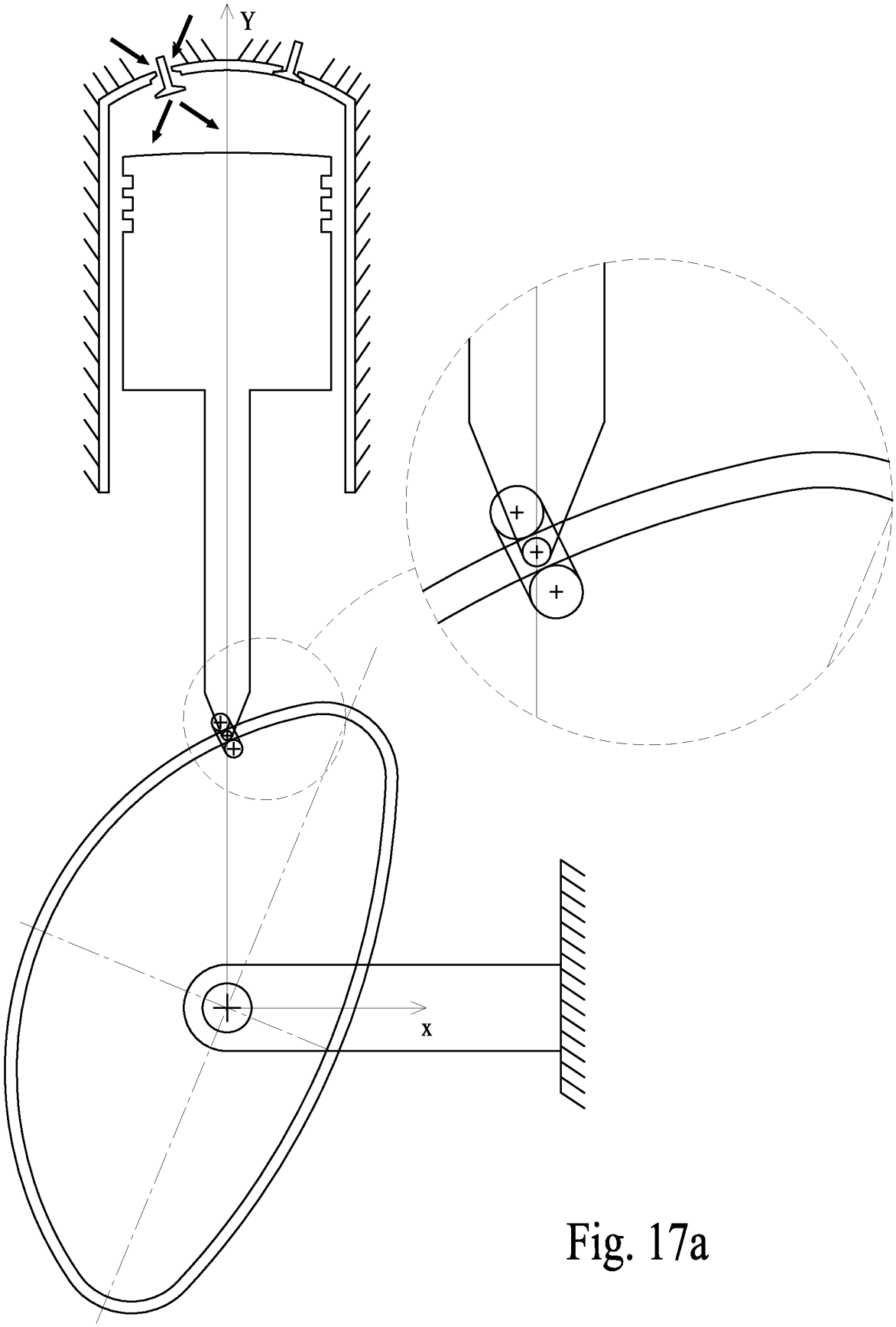

FIG. 17*a* shows the basic geometry of the art using the Sixth Method for engine crankshaft during intake stroke after the crankshaft has rotated 22.5 degrees in clockwise direction from top dead center position.

Figure 17B:
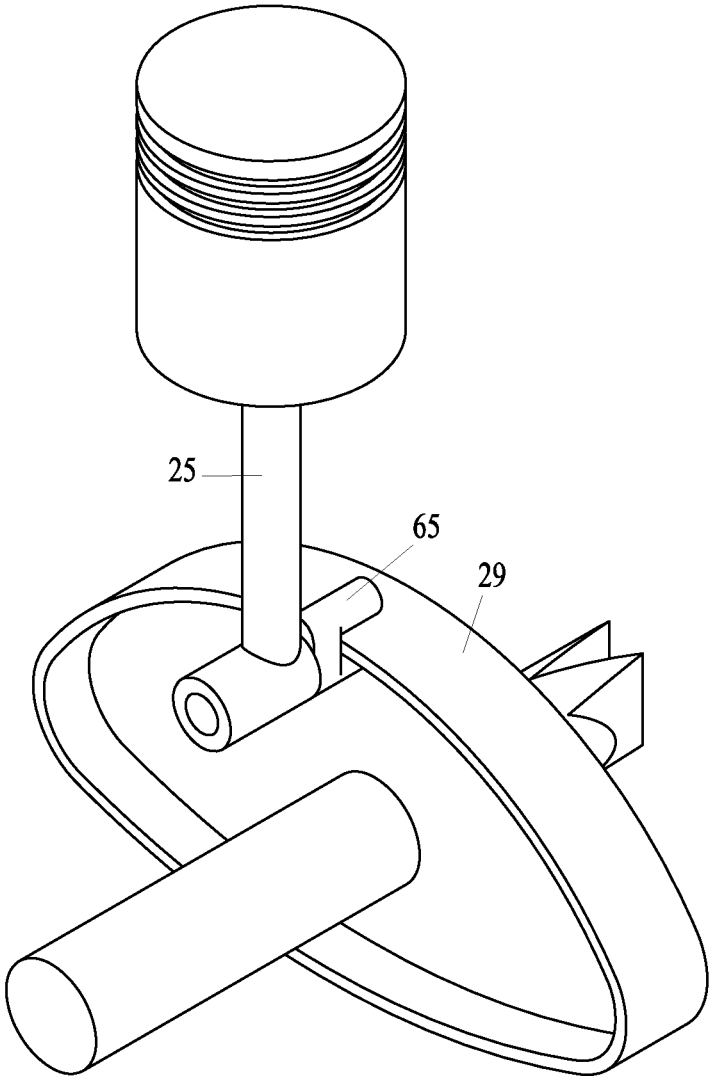

FIG. 17*b* shows the isometric view of a typical mechanism using the Sixth Method for engine crankshaft with all parts labelled.

Figure 17D:
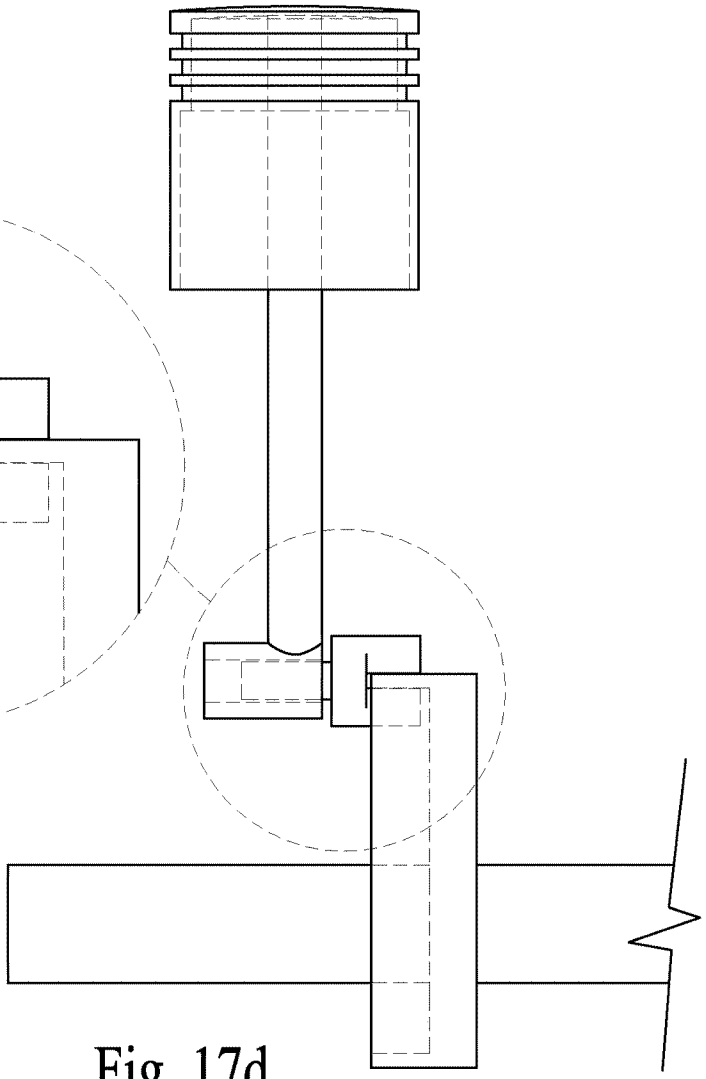
Figure 17C:
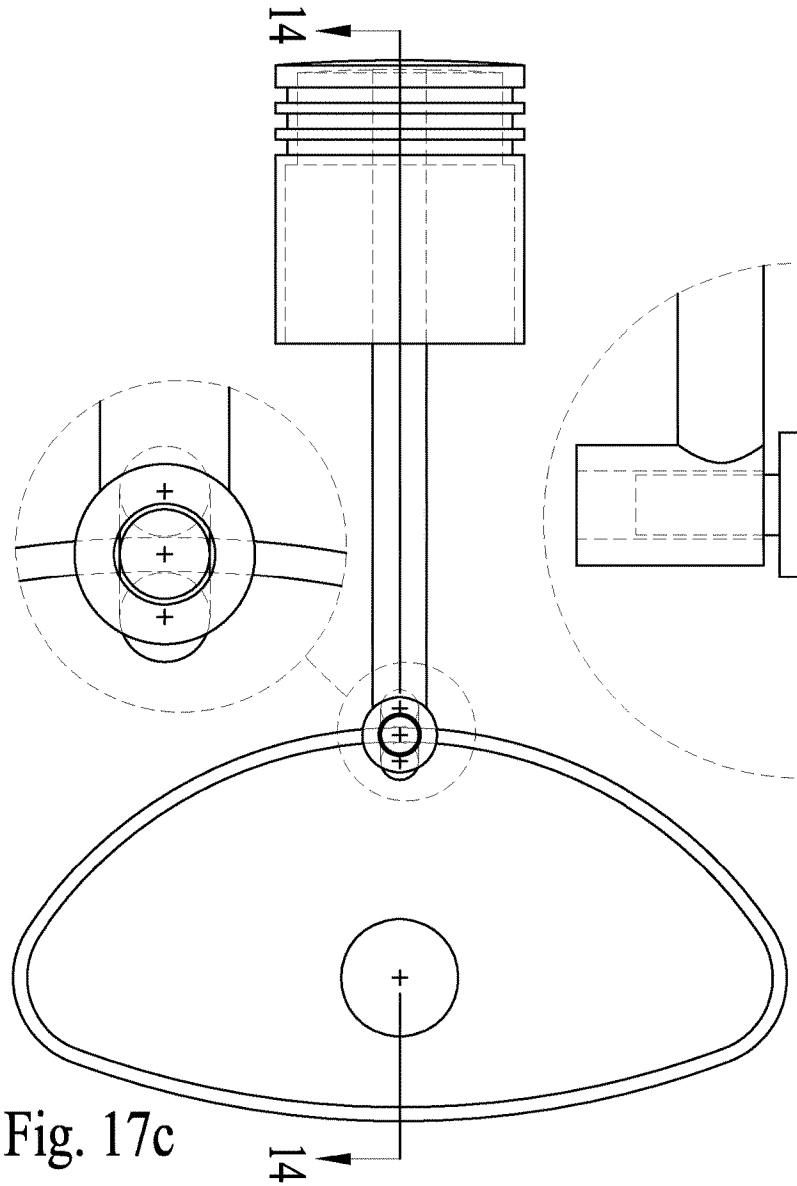

FIG. 17*c* shows the left view of the mechanism said in FIG. 17*b*.

FIG. 17*d* shows the front view of the mechanism said in FIG. 17*b*.

Figure 17E:
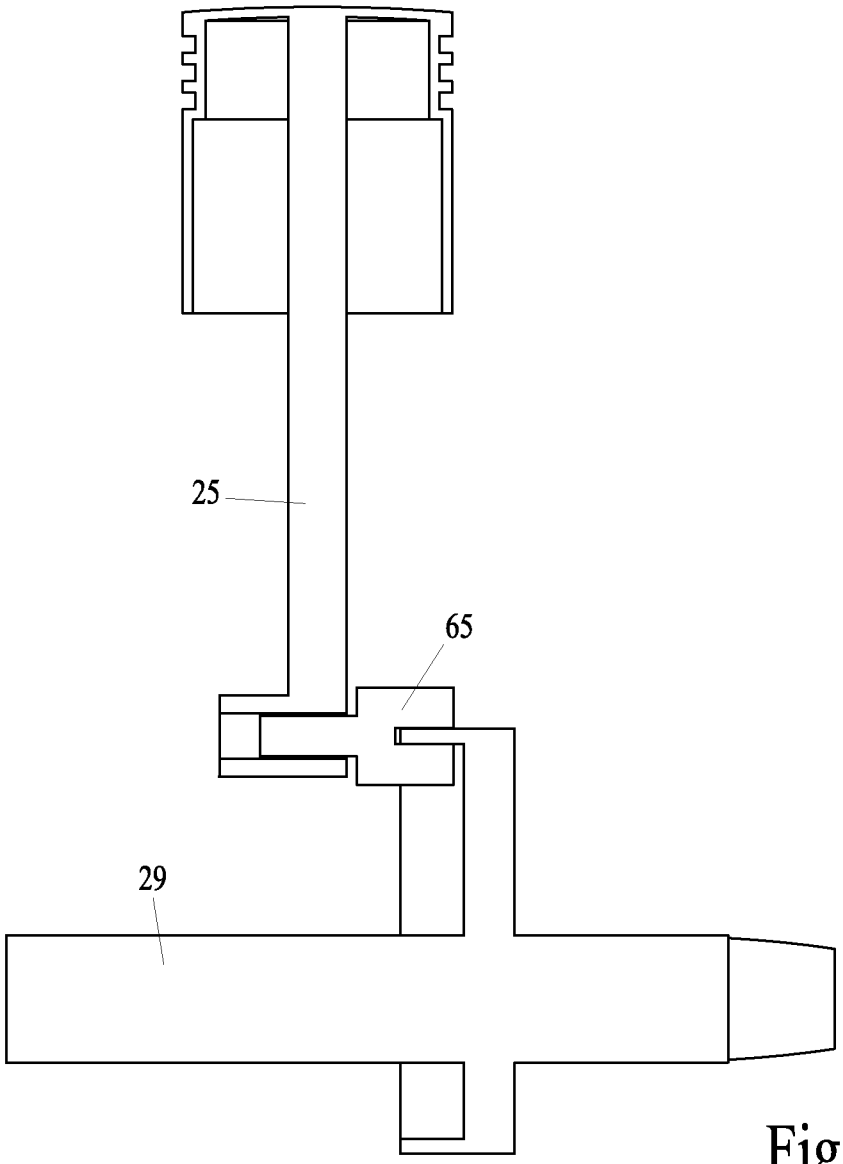

FIG. 17*e* shows the section view of section 14-14 shown in FIG. 17*c*.

Figure 17F:
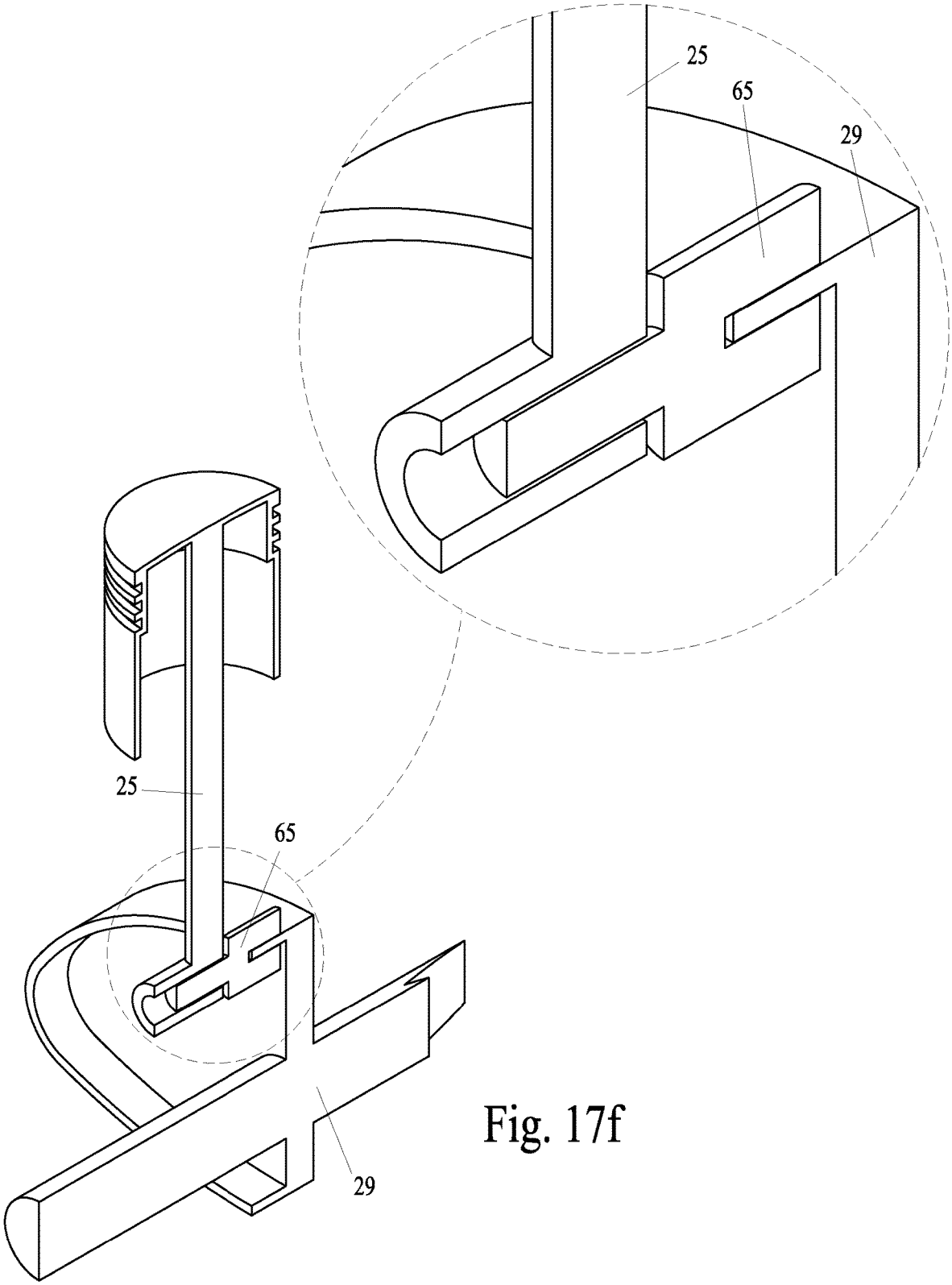

FIG. 17*f* shows the isometric view of the section 14-14 said in FIG. 17*e*.

Figure 17G:
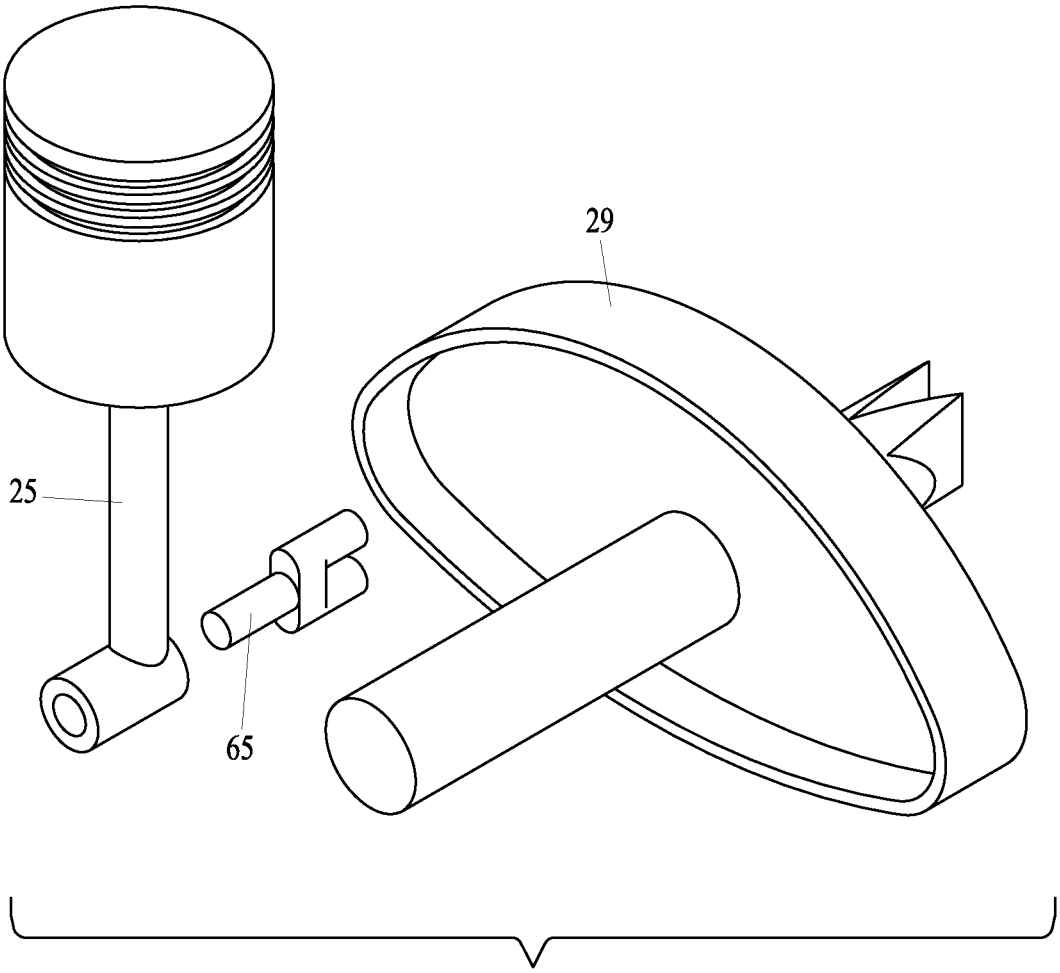

FIG. 17*g* shows the isometric view of the mechanism said in FIG. 17*b* disassembled and all parts labelled.

Figure 18:
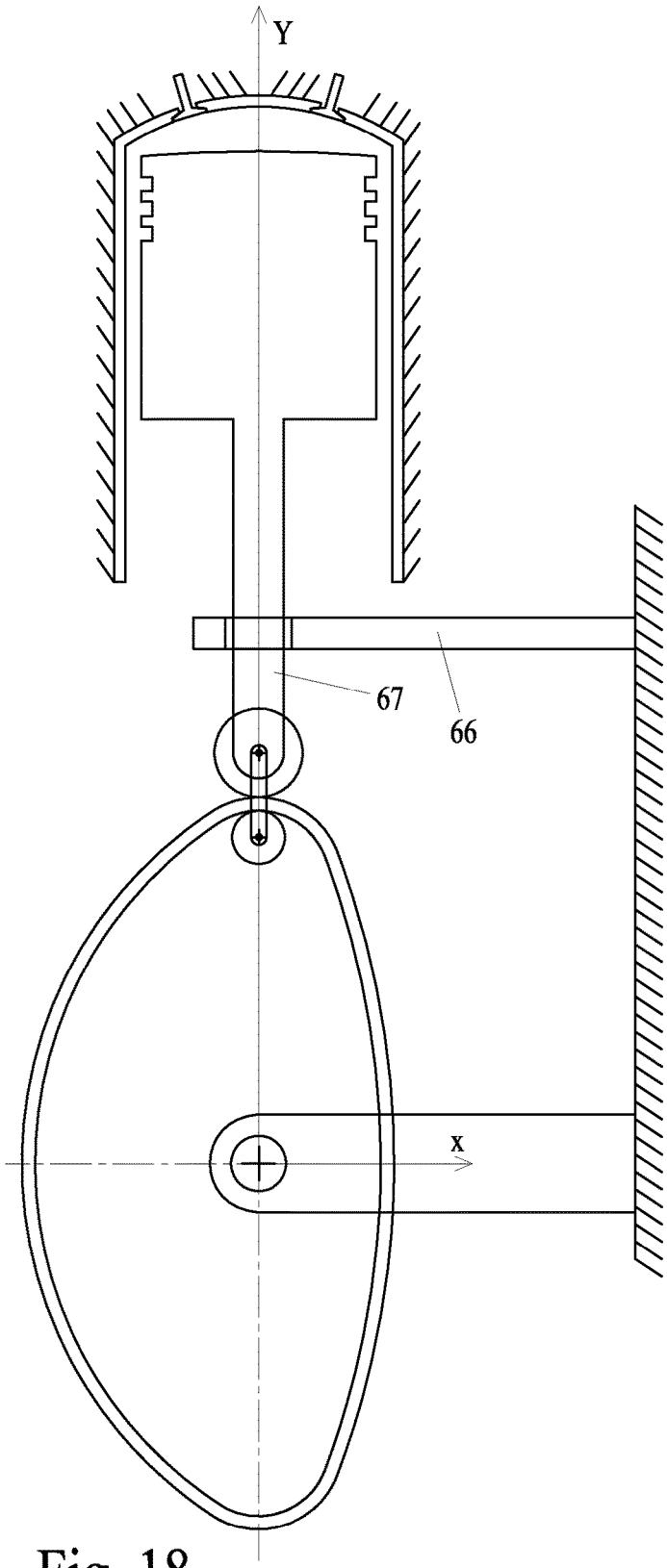

FIG. 18 shows a geometric illustration of Option 10 for engine crankshaft with a stationary wall support for the piston rod.

Figure 18A:
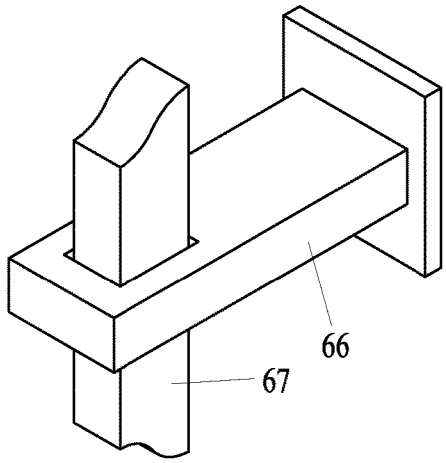

FIG. 18*a* shows an isometric view related to Option 10 for a piston rod with rectangular cross section and a stationary wall support with rectangular hole.

Figure 18B:
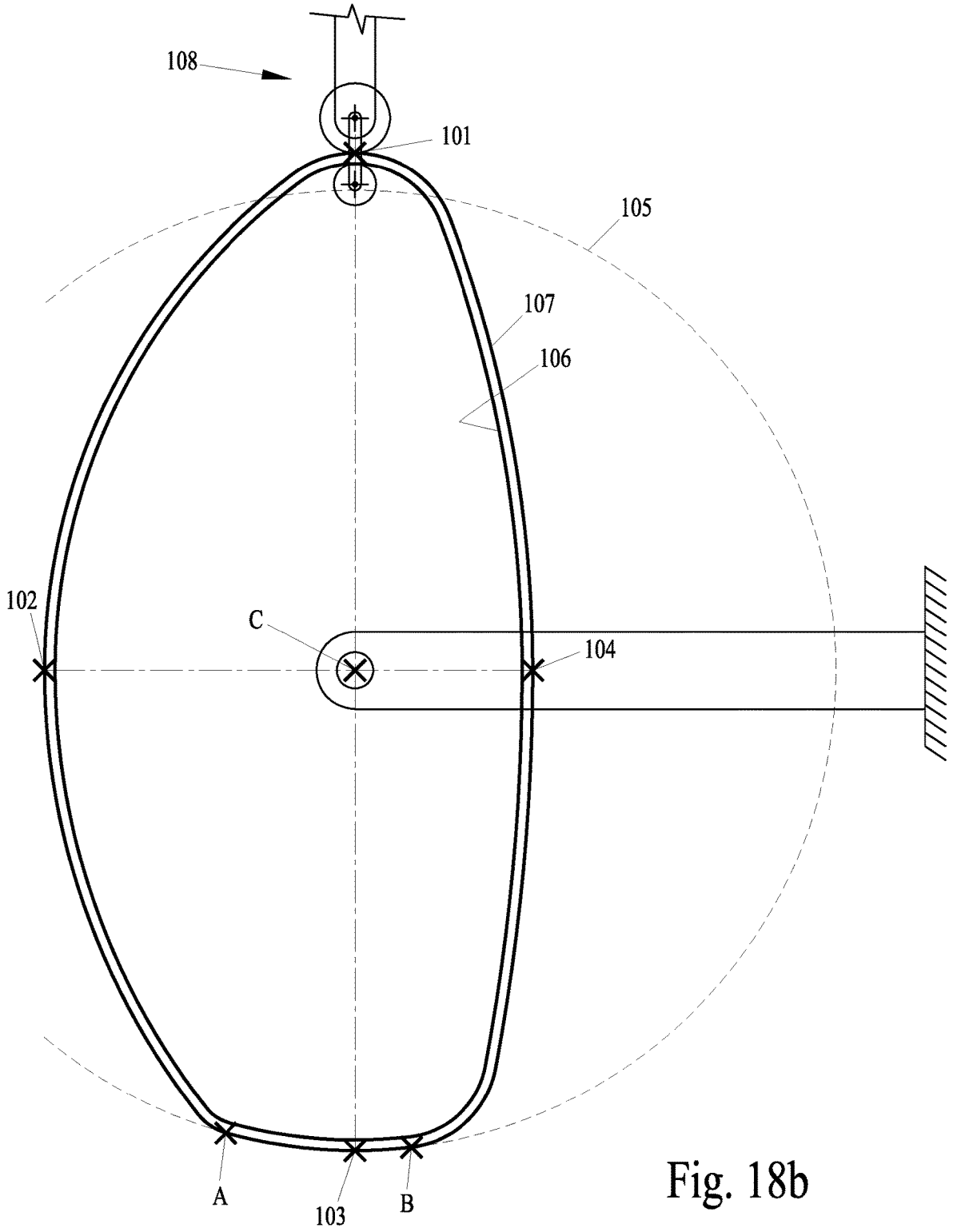

FIG. 18*b* shows a geometric illustration of a crank cam profile for improved combustion at the beginning of intake stroke related to Option 11.

Figure 18C:
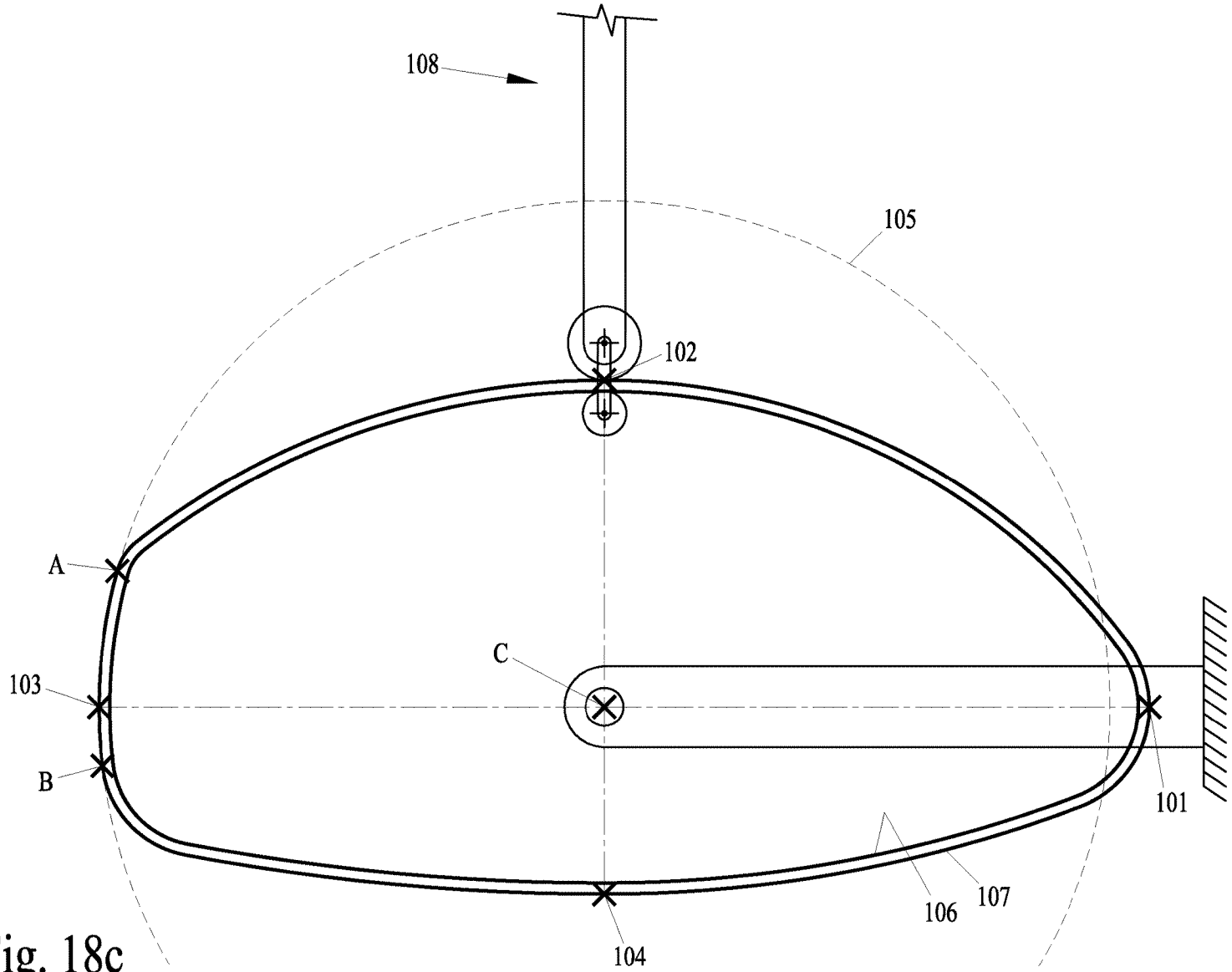

FIG. 18*c* shows a geometric illustration of the crank cam profile said in FIG. 18*b* after 90 degrees rotation of the crank cam in clockwise direction at the beginning of compression stroke.

Figure 18D:
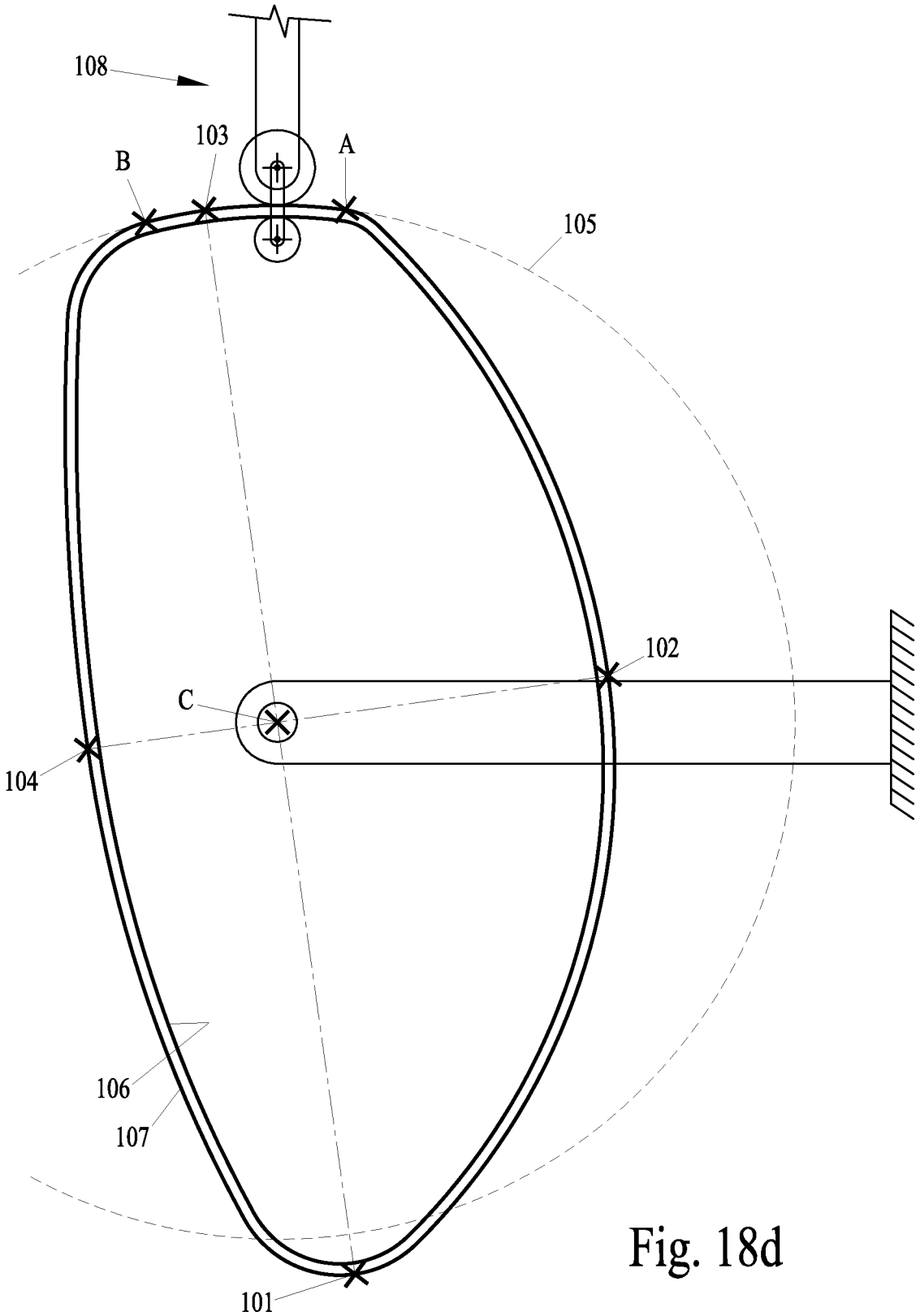

FIG. 18*d* shows a geometric illustration of the crank cam profile said in FIG. 18*b* after 172 degrees rotation of the crank cam in clockwise direction during power stroke.

Figure 18E:
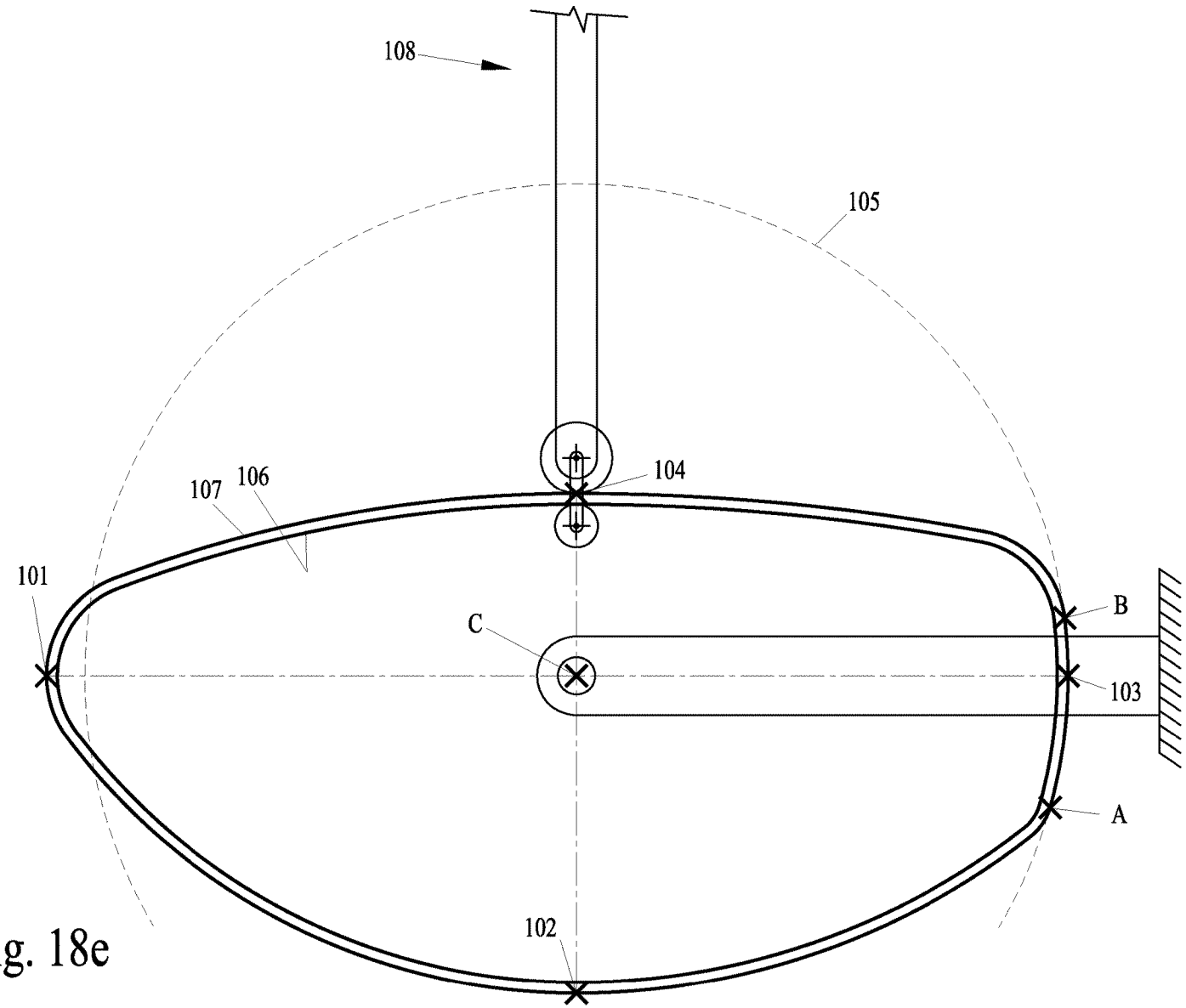

FIG. 18*e* shows a geometric illustration of the crank cam profile said in FIG. 18*b* after 270 degrees rotation of the crank cam in clockwise direction at the beginning of exhaust stroke.

Figure 18F:
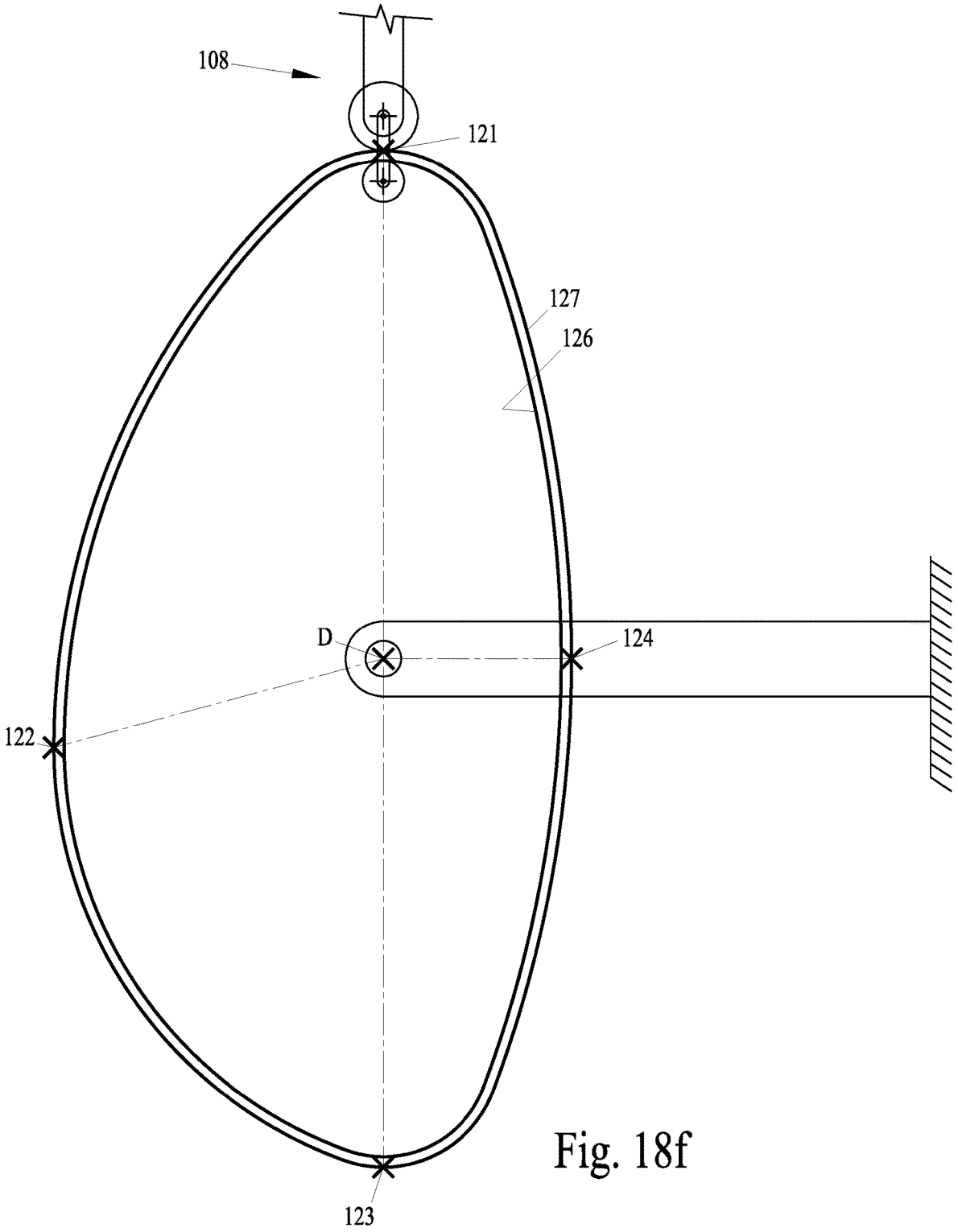

FIG. 18*f* shows a geometric illustration of a crank cam profile for increased time interval for intake stroke related to Option 12 at the beginning of intake stroke.

Figure 18G:
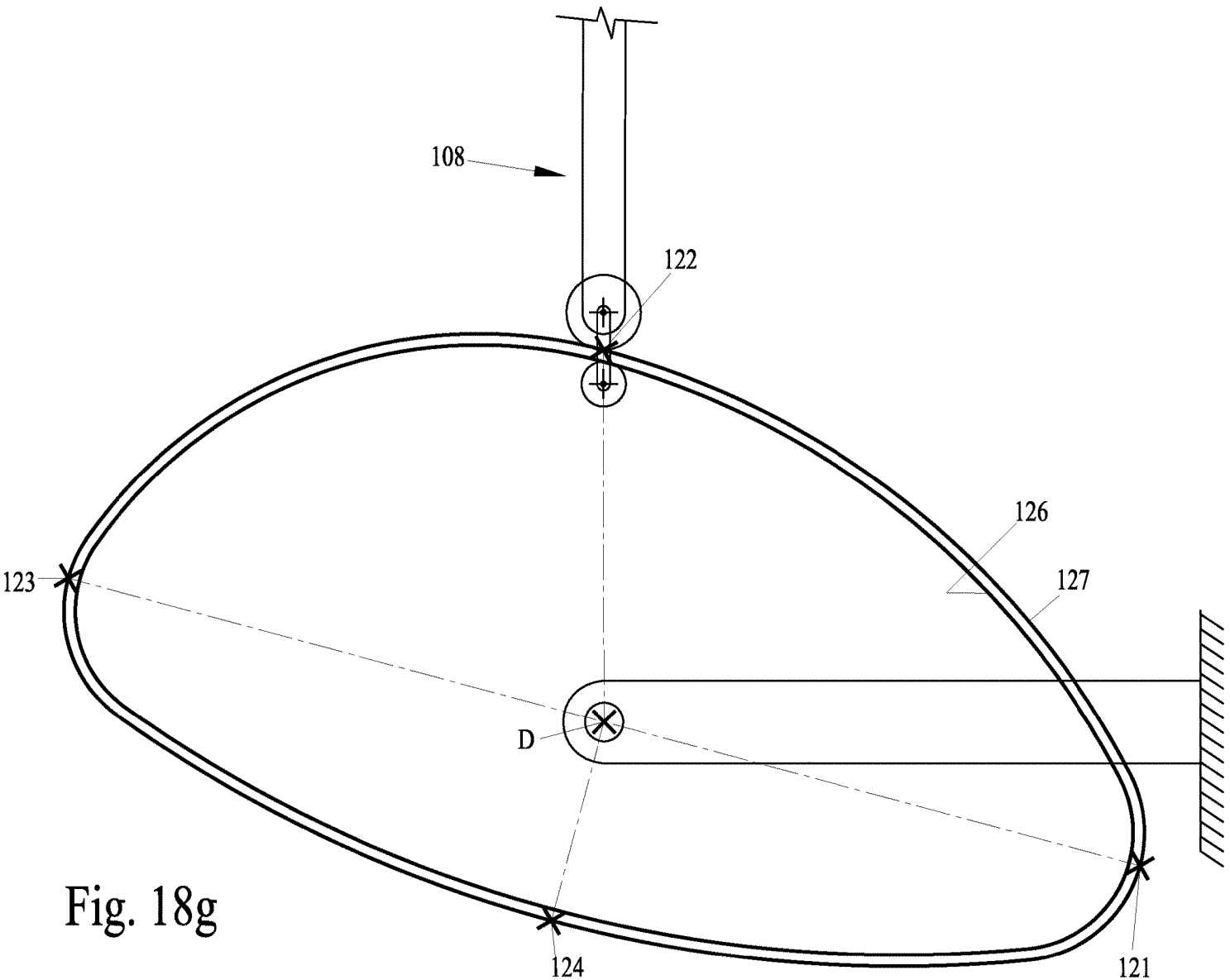

FIG. 18*g* shows a geometric illustration of the crank cam profile said in FIG. 18*f* after 105 degrees rotation of the crank cam in clockwise direction at the beginning of compression stroke.

Figure 18H:
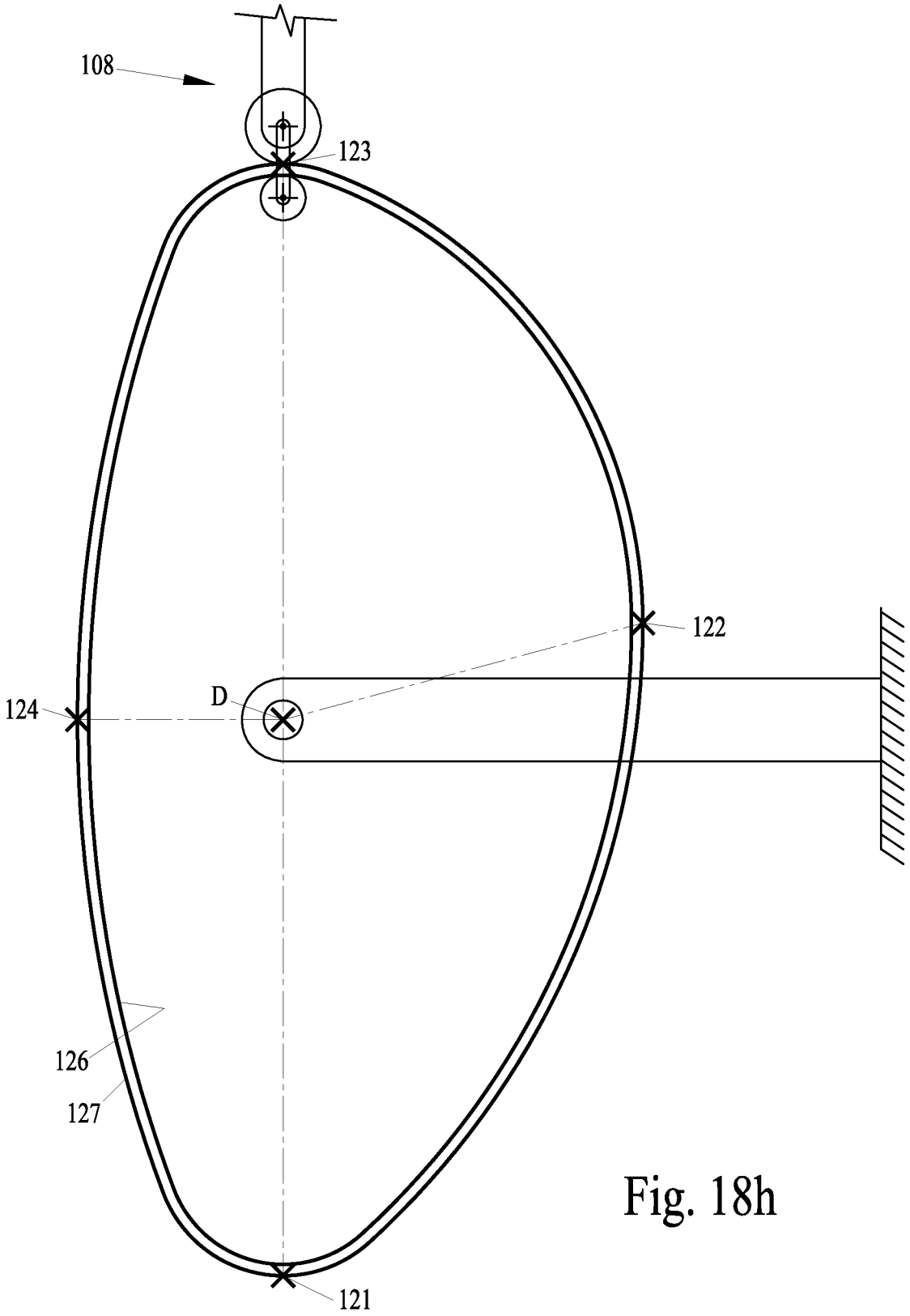

FIG. 18*h* shows a geometric illustration of the crank cam profile said in FIG. 18*f* after 180 degrees rotation of the crank cam in clockwise direction at the beginning of power stroke.

Figure 18I:
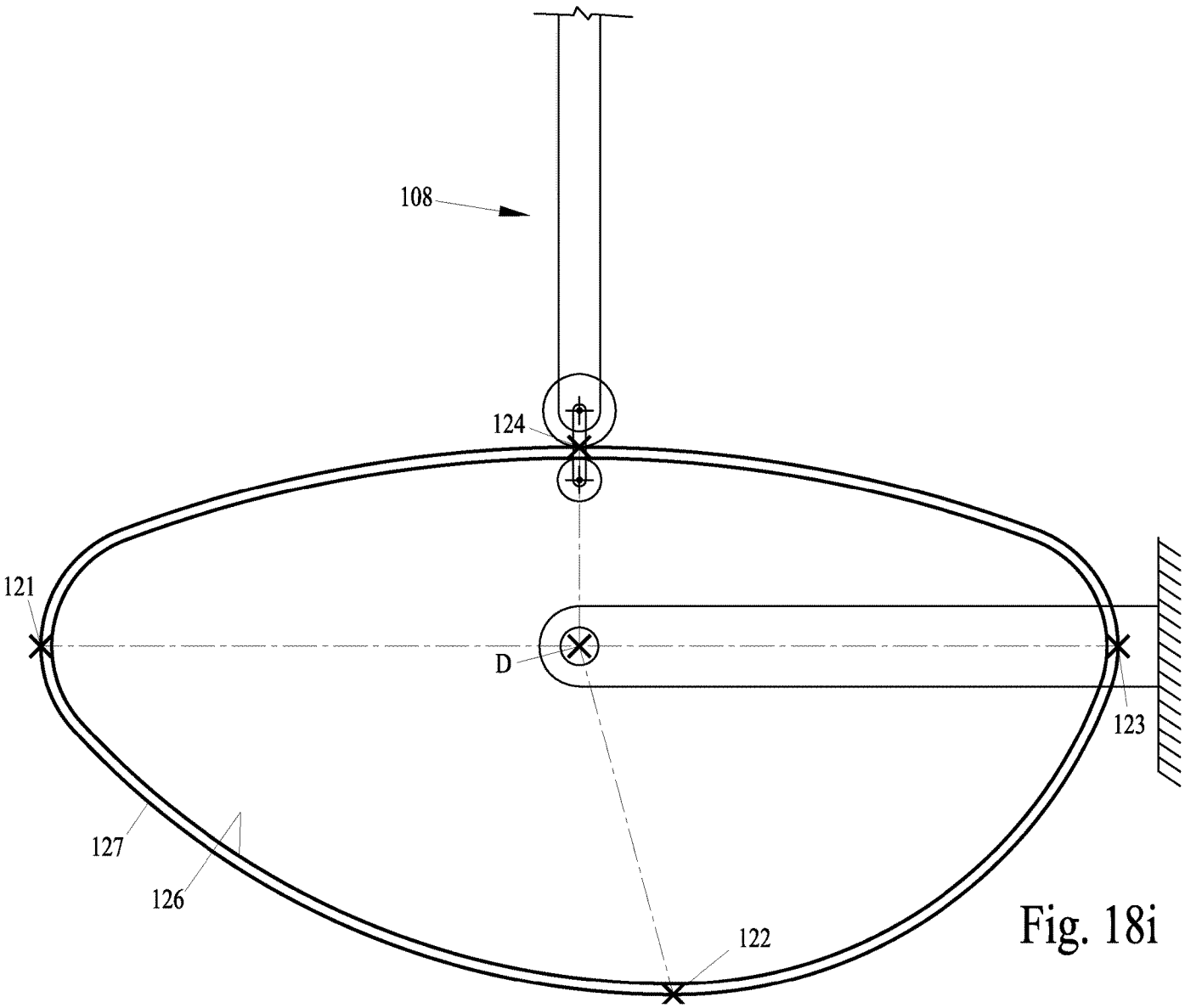

FIG. 18*i* shows a geometric illustration of the crank cam profile said in FIG. 18*f* after 270 degrees rotation of the crank cam in clockwise direction at the beginning of exhaust stroke.

Figure 18J:
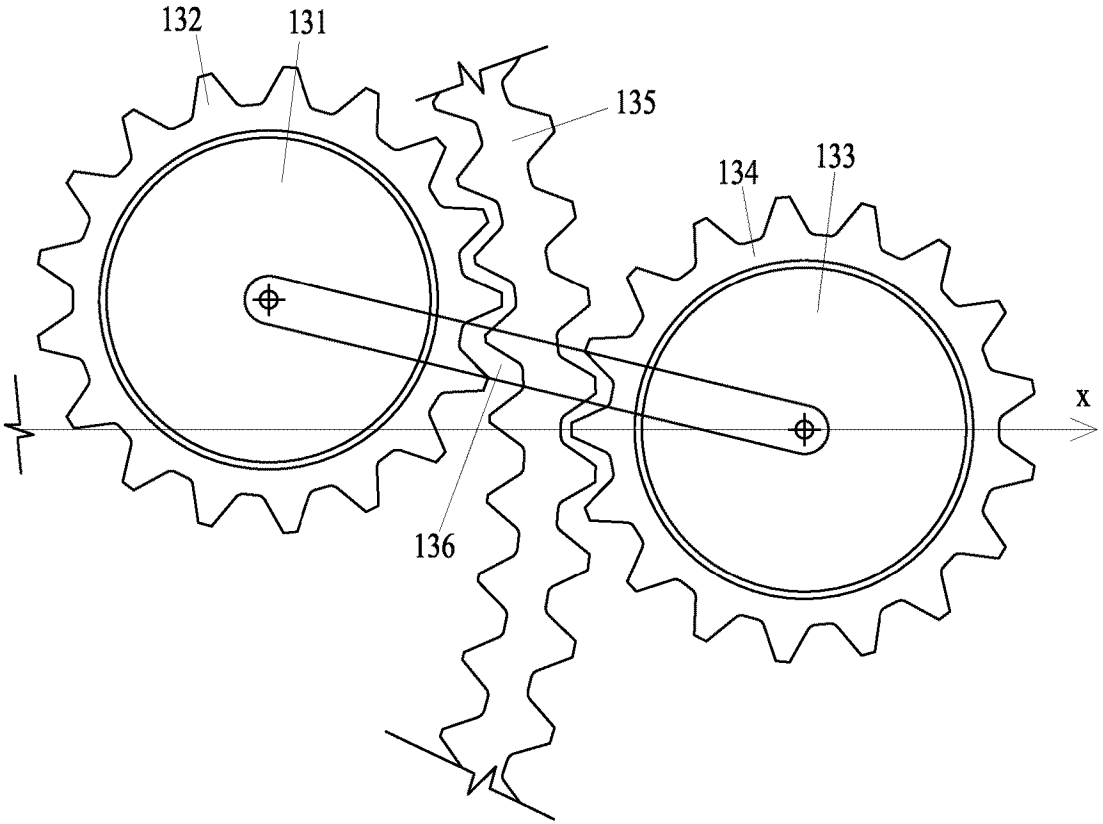

FIG. 18*j* shows a geometric illustration of the bushings and cam weir furnished with gear teeth related to Option 3.

Figure 19A:
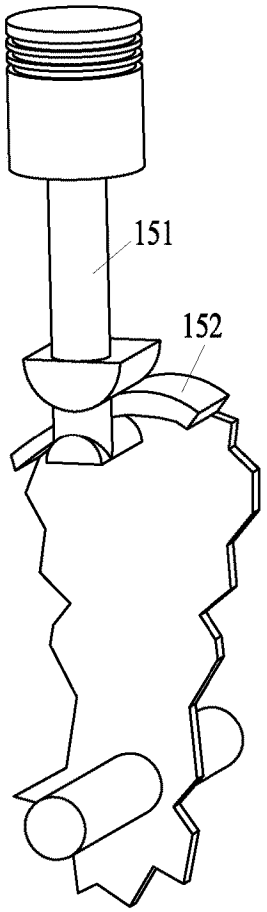

FIG. 19*a* is related to Option 13 and shows an isometric view of a mechanism for engine crankshaft having the thickness of the crank cam's weir variable.

Figure 19D:
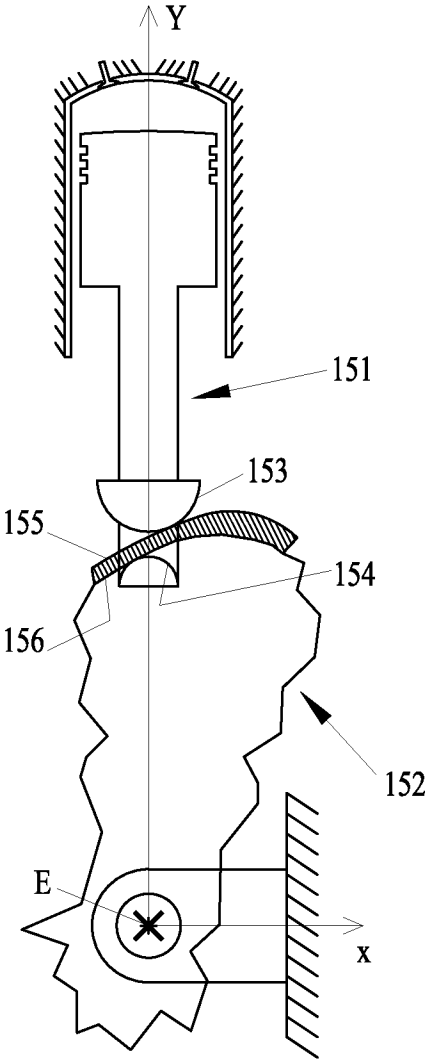
Figure 19C:
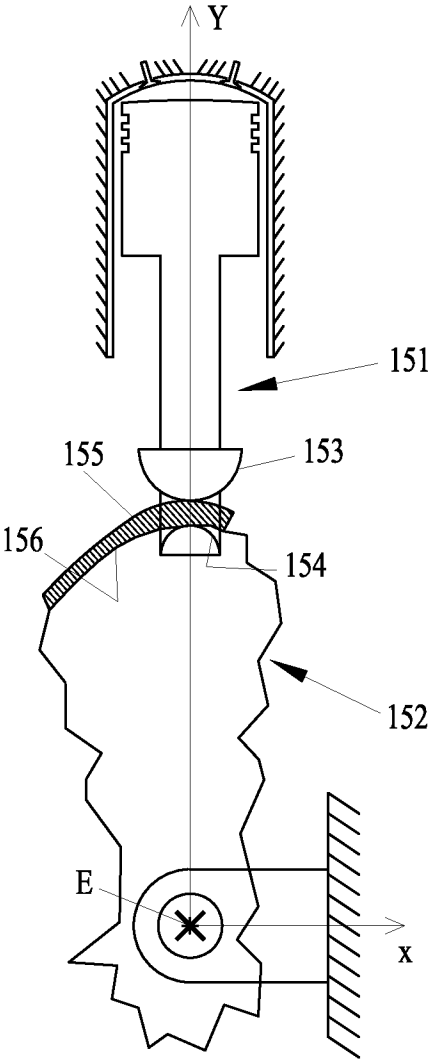
Figure 19B:
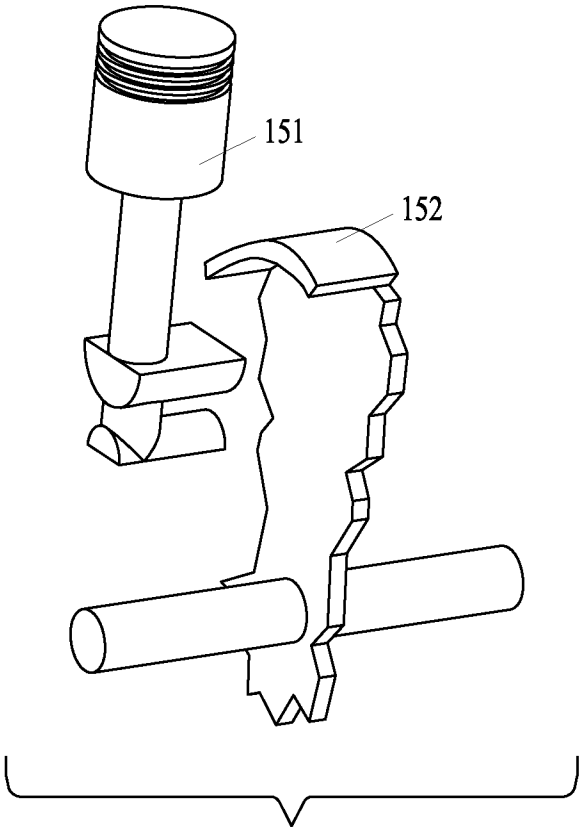

FIG. 19*b* shows the mechanism said in FIG. 19*a* disassembled.

FIG. 19*c* shows the geometric illustration of the mechanism said in FIG. 19*a*.

FIG. 19*d* shows the geometric illustration said in FIG. 19*d* after 15 degrees rotation of the cam in clockwise direction.

DESCRIPTION OF PRIOR ART

Description of Prior Art for Muffler Cap Spinning

There are a few methods of muffler cap spinning being practiced around the world. In these methods first the muffler shell and the cap(s) are placed in predetermined positions by means of other equipment which are not shown in this disclosure. For a pictorial understanding of the concept, reference is made to FIG. 3*j* which shows a simple cap spinning machine. In reality these machines are more complicated than shown, however for the purpose of this disclosure it is sufficient. A more detailed explanation of FIG. 3*j* shall be given later.

After that muffler shell and cap(s) are positioned on the cap spinning machine, a motor will start the operation of seaming. In most of cap spinners, by a method, a non-circular path corresponding to muffler cross section is read from a cam which has a similar cross section as the muffler's cross section, and that path is dictated to a roller which, engages with the cap lip and the muffler shell lip in order to perform the action of attaching the cap to muffler shell. The roller has a grove and as it is forced towards the cap and the shell by a hydraulic cylinder system with considerable force (approximately 5000 pounds force) it starts curling the two lips of said muffler shell and end cap over each other and as a result performing the action of seaming. The roller with the grove is normally called "curler" or "curling roller".

FIGS. 1*a*, 1*b* & 1*c* show the four parts muffler shell 1, muffler cap 2, cap holding nose 3 and roller 4. It is obvious that only half of muffler shell 1 is shown and the mirror image of the same apparatus could be on the opposite side.

FIG. 1*d* shows an isometric view of section 1-1 from FIG. 1*c*. It is an illustration of shell 1, cap 2, cap holding nose 3, roller 4. Holding nose 3 is in close contact with the cap 2 and is driven by a motor and as a result rotates cap 2 and shell 1. Roller 4 will also rotate as a result of contact with cap 2 and shell 1 after it contacts them. The hydraulic system which is connected to roller 4 shall be discussed later.

FIGS. 1*e* & 1*f* show simple section illustrations of the shell 1, cap 2, holding nose 3 and roller 4 before and after engagement of roller 4 respectively. FIG. 1*f* shows how the lip of cap 2 and the lip of shell 1 are rolled over each other in order to secure cap 2 to shell 1. The concept illustrated in FIG. 1*a*, 1*b*, 1*c*, 1*d*, 1*e* & 1*f* are well known to those skilled in the art.

Since small amount of leakage is allowable in muffler industry, perfect seaming is not necessary. In most cap spinners in addition to curling roller, there is a flattening roller (not shown) which, does not have a grove and engages with shell 1 and cap 2 at a different point of contact, normally the opposite side, simultaneously. The flattening roller flattens the curled lips. It is possible to have multiple curling rollers and flattening rollers acting on the same side of the muffler shell at the same time. This will result in faster and better seaming.

Matters which are important to the prior art in muffler cap spinning are vibration, noise, speed of process, ease of manufacturing, weight of the machine and cost.

Inventors Mohamed Gharib and Michael Van Heuran have proposed a cap spinner in Canadian patent No. 2,697,602 (PCT No. PCT/CA2008/001563, Pub No. US2011/0086751 A1, application Ser. No. 12/674,912). The design has novelty; however the suggested method requires a massive mechanism and hydraulic system to follow the non-circular loop. Such machines have a weight between 20,000 to 30,000 pounds and the cost of manufacturing is considerably high. In addition to that due to presence of massive mechanical links, it is difficult to use more than three rollers on either sides of the muffler.

Since in the Methods presented in this disclosure, the sliding arm which holds the roller's hydraulic cylinder follows the path of motion due to a force exerted from inside the hollow cam and not by an external hydraulic system, the overall mechanism is simple and less costly and lighter in weight. The weight of a typical machine would be between 6,000 to 9,000 pounds depending on the number of sliding arms used. Also said Methods allow a much easier use of multiple rollers. The plurality of the rollers not only speeds the process of seaming, it also reduces vibration.

Description of Prior Art for Engine Crankshaft

As far as a typical engine crankshaft is concerned, it does not seem necessary to provide any illustrations of the prior art, since the matter of equal lengths of intake stroke and power stroke is a well known fact in the field. The main issue which is related to this disclosure is the improved fuel efficiency which the crankshaft assemblies suggested in this invention will cause. This is due to the longer length of power stroke than that of intake stoke. Attempts have been made by inventor Glendal R. Dow in U.S. Pat. No. 6,948,450 and No. 7,011,052 to address the same concern. Glendal R. Dow also provides variable compression ratio which does not seem to be a vital necessity.

Unlike ordinary engines in which a complete four stroke cycle is 720 degrees rotation of the crankshaft, for the six Methods suggested in this disclosure for engine crankshaft a complete four stroke cycle is 360 degrees rotation of the crankshaft.

DESCRIPTION OF THE INVENTION

Due to presence of numerous surfaces in most figures, labelling every surface does not seem practical; hence the mechanisms are shown in disassembled mode in one or more figures and every single part is identified with one label. In addition to that, for ease of understanding of the invention several additional views and sections are provided. Some additional labelling of the parts might be seen in some of other views and figures. Most section views are not hatched but an isometric view of the section is provided with parts labelled.

For every Method introduced in this disclosure, first a brief explanation is given about the Method and then the specific apparatus for muffler cap spinner or engine crank shaft is explained in detail with the aid of corresponding drawings. For every apparatus a geometrical illustration of the philosophy of the mechanism is also provided. In order to make the understanding of the invention more clear, in most cases four types of drawings are illustrated for each apparatus. First are the drawings which show the geometric philosophy of the invention. Second are the drawings which show the elevation and end view drawings (top, front, left and right views). Third are the isometric drawings of the apparatus. The fourth are the disassembled drawings in which an apparatus is shown in exploded view.

In most drawings gaps are shown between parts which are in close contact for better distinction between parts. For example a noticeable gap might be seen between an end cap and the muffler shell, a bushing and the pin which holds it or a piston and the cylinder around it. Such gaps might be very small in practical applications, however for the purpose of this disclosure they are exaggerated so that the parts could be clearly distinguished.

As mentioned several geometric presentations are shown in this disclosure in which the parts are not labelled; they are meant for better understanding of the concept of the invention and how the action of reciprocating is performed. Such geometric illustrations are associated with mechanisms which they referred to. Other related figures which show the actual apparatus have the parts labelled.

The shapes of parts presented in this disclosure are only for the purpose of illustration of the philosophy of the invention and are not based on any stress analysis or thermodynamics calculations. In addition to that methods of attachment of some parts to another by nuts and bolts and fasteners are not shown; also the mechanisms are simplified and many parts are not shown since they are not the subject of this invention.

First Method:

In the First Method introduced in this disclosure the weir of a hollow cam with noncircular cross section is held on both sides by two pins. The pin which is outside the cam's weir has one degree of freedom and the pin inside the cam weir has two degrees of freedom. The said two pins are furnished with bushings and are connected by a link. As the cam is rotated by a motor in the case of muffler cap spinner, the rotational motion is reciprocated to linear motion and results in the motion of a sliding arm which has one degree of freedom. The sliding arm follows the motion of the outside the cam's weir pin in the First Method. In the case of engine crankshaft the mechanism works in reverse and the power comes from the sliding arm; that is the piston, and is reciprocated to rotational motion by the connection mechanism.

Application of First Method to Muffler Cap Spinner

FIGS. 2*a*, 2*b* and FIGS. 3*a* to 3*m* (13 figures) are the drawings associated with application of the First Method to muffler cap spinner. FIG. 3*a* is the main figure which shows the isometric view of a mechanism using the First Method for muffler cap spinner. Other figures are meant for more detailed and clear presentation of the said apparatus.

FIGS. 1*g*, 1*h*, 1*i* and 1*j* (4 figures) show the apparatus for muffler shell 1 and cap 2 with parts from the cap spinning machine which are common in other Methods. That apparatus is referred to as numeral 1*b*. With the exception of the nuts 10 and studs 9, all central axes of the parts of numeral 1*b* are collinear and rotate about that axis during seaming action. Detailed explanation of the parts of numeral 1*b* shall be given later.

FIGS. 1*k*, 1*l*, and 1*m* (3 figures) show the apparatus for hydraulic system which hold the roller 4.

This apparatus is referred to as numeral 4*a* and is common in other Methods. This hydraulic apparatus is firmly attached to sliding arm. Detailed explanation of the parts and operation of numeral 4*a* shall be given later.

FIG. 2*a* is a simplified geometry of the First Method applied to muffler cap spinner and FIG. 2*b* is a simplified geometry said in FIG. 2*a* after a cam rotation of 22.5 degrees in counter clockwise direction.

FIG. 3*a* is an isometric view of a typical mechanism using the First Method for muffler cap spinning and FIGS. 3*b* and 3*c* are the top and front views of the said mechanism respectively. FIG. 3*d* is the section view of section 2-2 from FIG. 3*c* and FIG. 3*e* is the isometric view of the same section. FIG. 3*f* shows the mechanism said in FIG. 3*a* disassembled and all parts labelled.

FIG. 2*a* shows the simplified geometry of the First Method Applied to muffler cap spinner. A typical non-circular cam with three round corners is shown. There is one pin and bushing inside the cam weir and one pin and bushing outside the cam weir. As the cam rotates the outside pin and bushing, with only one degree of freedom, move back and forth along X-axis. The bushing and the pin which are inside the cam, in addition to motion in X direction, also have motion in Y direction. This is shown in FIG. 2*b* as the cam has rotated 22.50 degrees in counter clockwise direction. It must be noted that the distance between the centers of the two pins will always remain the same because of the link between them. The two pins and bushings hold the cam weir without any slack. It is also shown that the motion of the outside pin and bushing is then transferred to a sliding arm. By comparing FIG. 2*a* and FIG. 2*b* the movement of sliding arm is apparent. The sliding arm only moves in X direction since the stand which guides it, prevents it from rotation or any other motion. The geometry of this First Method will be more apparent as its application is shown.

FIGS. 3*g* and 3*h* show the option of using an extended cam 20 for the First Method of cap spinning In FIGS. 3*g* and 3*h* only extended cam 20 is labelled.

FIGS. 3*i* and 3*j* show a simplified one arm cap spinner. That is each end of the muffler is engaged with one seaming arm. The platform, stands, frames and motor are labelled but the parts of the cap spinning mechanism itself are not. But the stationary wall attachment 5 is labelled. For the rest of cap spinning Methods shown in this disclosure, the machine mechanism is the same as what is shown in these figures, except the apparatus for the Method is different.

FIGS. 3*k* to 3*m* show a simplified six arms cap spinner. That is each end of the muffler is engaged with six seaming arms. The purpose of these figures is to illustrate how the Methods of this disclosure can support multiple seaming arms. As noted before the more the number of arms the faster and better the action of seaming. With the exception of numeral 1*b*, no other part is identified or labelled, since the objective of the invention is the Methods of cap spinning and not the overall machine.

The mechanism parts for the First Method appear in most of said figures but are shown clearly in exploded view in FIG. 3*f*. They are as described below:

Muffler shell 1. FIGS. 1*g* to 1*j* show this part as a member of numeral 1*b*. (only a portion of shell 1 on one side is shown in most figures; the complete shell 1 is shown in FIG. 3*i* & FIG. 3*j*).

Cap 2. FIGS. 1*g* to 1*j* show this part as a member of numeral 1*b*.

Cap holding nose 3. FIGS. 1*g* to 1*j* show this part as a member of numeral 1*b*. Cap holding nose 3 is a tooling element and is one of the two parts of the mechanism which must be changed once the muffler cross section is changed to a different one. That is for example if a different shape muffler and end cap with oval cross section are to receive end seaming, a cap holding nose corresponding to that shape must be used. The other part which must change is cam 7.

Roller 4. FIGS. 1*k* to 1*m* show this part as a member of numeral 4*a*. A detailed description of numeral 4*a* shall be given later.

Stationary wall attachment 5. This part is attached to frame 22 as shown in FIG. 3*j*. It guides the sliding arm 6.

Sliding arm 6. Notice the stationary wall attachment 5 is inside the sliding arm 6 and the outside pin 12 goes through the end hole of the sliding arm 6. Outside Pin 12 is free to rotate inside the end hole of the sliding arm 6.

Cam 7. FIGS. 1*g* to 1*j* show this part as a member of numeral 1*b*. This cam has similar cross-section as the muffler shell 1. In five of six Methods presented in this disclosure for muffler cap spinner cam 7 is used. The major force which has to compensate with the reaction force from shell 1 and cap 2 against the force exerted by roller 4, is exerted from the inside surface of the cam 7's weir. Cam 7 is a tooling element and is one of the two parts of the mechanism which must be changed once the muffler cross section is changed. That is for example if a different shape muffler with an oval cross section is to receive end seaming, a cam with an oval cross section corresponding to the muffler cross section must be used. The other part which must change is cap holding nose 3. It must be noted that in this version of the cam, the cam is held only from one side. It is possible to have a cam being held from two points (cam shown as extended cam 20 in FIG. 3*g* & FIG. 3*h*).

Cam holding attachment 8. FIGS. 1*g* to 1*j* show this part as a member of numeral 1*b*. It is the attachment that holds the cam 7 from one end and is connected to motor 24 from the other end. Cam holding attachment 8 is held by stand 21. This is shown in FIG. 3*j*. The motor power is transferred to the cam 7 via cam holding attachment 8.

Studs 9. FIGS. 1*g* to 1*j* show studs 9 as members of numeral 1*b*. Quantity of four studs 9 and quantity of eight nuts 10 are used to connect cam 7, holding nose 3 and cam holding attachment 8.

Nuts 10. FIGS. 1*g* to 1*j* show nuts 10 as members of numeral 1*b*. Quantity of eight nuts 10 and quantity of four studs 9 and are used to connect cam 7, holding nose 3 and cam holding attachment 8.

Outside bushing 11. It goes around outside pin 12. The outside surface of this bushing 11 is in close contact with outside surface of the cam 7.

Outside pin 12. This item supports outside bushing 11. Notice one end of this item goes inside the hole at front end of the sliding arm 6. Outside pin 12 is free to rotate about its central axis.

Inside pin 13. This pin as shown has two threaded studs. These studs and the quantity of four nuts 15 hold outside pin 12. This inside pin 13 holds inside bushing 14, which is the bushing inside the cam 7's weir.

Inside bushing 14. This bushing is inside cam 7's weir and is supported by inside pin 13 and its outside surface is in close contact with the inside surface of the cam 7's weir. The outside diameter of this bushing must be less than the smallest radius of the inside profile of the cam 7 for the First Method and the other Methods presented hereafter.

Nuts 15. Quantity of four nuts 15 which connect the studs of inside pin 13 to outside pin 12.

Items 16 to 19 are the simplified parts of the actual hydraulic mechanism which performs the action of end seaming with the use of roller 4. FIGS. 1*k* to 1*m* show these parts as members of numeral 4*a*.

As mentioned above it is already a known art as to how to perform the action of seaming and is not the subject of this invention. However a brief explanation, after description of parts, shall be given.

Pin 16. This pin connects the roller 4 to hydraulic cylinder hook 17.

Hydraulic cylinder hook 17. The hydraulic cylinder hook 17 is connected to a double acting piston (piston not shown) and is the element which pushes the roller 4 towards or away from the muffler shell 1 and cap 2; thus performing the action of seaming. The double acting piston (piston not shown) is inside the hydraulic cylinder 18.

Hydraulic cylinder 18. This Hydraulic cylinder 18 is attached firm to the sliding arm 6. The method of attachment is not shown in any of the figures.

Hydraulic hose 19. This hydraulic hose 19 carries the pressurized oil to and out from hydraulic cylinder 18. In reality there must be two lines but for simplicity the one hose 19 represents a double line hydraulic hose.

As muffler shell 1 and cap 2 are placed at the proper position, the holding nose 3 will hold them in place. There could be the mirror image of the same mechanism on the other end of the muffler shell 1. As cam 7 rotates by the torque generated by a motor, the sliding arm 6 follows the path of motion from noncircular loop and since hydraulic cylinder 18 is attached firmly to sliding arm 6, as a result hydraulic assembly referenced as numeral 4*b* will keep the roller 4 at desired position relative to lips of shell 1 and cap 2. Then pressurized oil pushes the hydraulic cylinder hook 17 and the roller 4 is moved against the muffler cap 2 and muffler shell 1 lips; as a result the action of seaming takes place. The hydraulic pump and the associated controls are not shown. This concept is true about all of the six Methods presented in this disclosure, except the shape of the sliding arm or the cam may differ in some Methods.

Extended cam 20. This is an extended cam which allows the double use of the mechanism and reduces stresses in parts. FIG. 3*g* & FIG. 3*h* show how this version of the cam is engaged from two sides by the sliding arm 6. This will reduce the stresses on the pin 13 and as a result smaller pin diameter could be used. Cam 7 and extended cam 20 could be compared from top views shown in FIGS. 3*b* and 3*g*. It is possible to use this extended cam 20 for other cap spinning Methods presented in this disclosure.

Parts 21 to 24 are only presented for the purpose of illustration of a simple cap spinning machine and are not intended for the actual aim of the invention. These parts are labelled in FIGS. 3*i* and 3*j*. They are as follows:

Stand 21. Quantity of two stand 21 holding cam holding attachments 8. They are shown on FIG. 3*i* & FIG. 3*j*.

Frame 22. Quantity of two frames 22 holding the two stands 21. They are shown on FIG. 3*i* & FIG. 3*j*.

Platform 23. This platform holds the two frames 22. It is shown on FIG. 3*i* & FIG. 3*j*.

Motor 24. Driving motor which rotates the mechanism. It is shown on FIG. 3*i* & FIG. 3*j*.

Figures FIG. 3*k*, FIG. 3*l* & FIG. 3*m* show a simple six arms cap spinning machine. These figures are only meant to provide a pictorial image of how a multi-arm machine for cap spinning may look like and for that reason parts are not labelled. As noted before in cap spinning technology, the more the number of roller 4 and/or flattening roller, the better and faster the action of seaming will be. In addition to that plurality of the rollers will decrease vibration. In fact due to simplicity of Methods introduced in this disclosure, one of the objectives is to provide several points of engagement of rollers 4 and/or flattening rollers with cap 2 and shell 1 for the reasons mentioned. Since some of the muffler cross-sections are small, the interference of the rollers (curler or flattener) and the pins 13 inside the cam, can become a problem in the case of multiple arms machines. In such cases, it is possible to engage some of the arms and disengage some. For example, in the case of six arms machine, three arms could engage and three arms not used.

Application of First Method to Engine Crankshaft

FIGS. 4*a* to 4*k* (11 figures) are the drawings associated with application of the First Method to engine crank shaft. FIG. 4*f* is the main figure which shows the isometric view of a mechanism using the First Method for engine crankshaft. Other figures are meant for more detailed and clear presentation of the said apparatus.

By applying the First Method to a cam with special geometry, it is possible to have a crankshaft with uneven lengths for intake and power strokes; that is in this case a power stroke which is longer than the intake stroke. It is not the scope of this disclosure to address the thermodynamics aspect of the engine combustion in depth, however this must be mentioned that this invention will allow the engine to use the hot and pressurized gas which is still available at the end of power stroke of a normal engine cycle, and will permit the piston to go further down the cylinder to produce more power than normal. The basic geometry of the First Method applied to engine crankshaft is presented in FIG. 4*e*.

FIG. 4*e* shows the basic geometry of the art using the First Method for engine crankshaft during intake stroke after the crankshaft has rotated 22.5 degrees in clockwise direction from top dead center. The mechanism works similar to that of cap spinner for the First Method, except it is working in reverse. That is the power is coming from a linear sliding arm, in this case the piston, and is converted to rotational motion by using a cam with special geometry which suites the thermodynamics of the combustion engine.

FIGS. 4*a*, 4*b*, 4*c* and 4*d* show the basic geometry of the invention at the end of intake, compression, power and exhaust strokes respectively. In the said four figures the X-axis for all figures are aligned so that the position of the piston could be compared. In particular the positions of top of piston in figures FIG. 4*a* and FIG. 4*c* are marked by large arrows for comparison such that it is clear that the piston has traveled a longer distance in power stroke compare to that of intake stroke. It could be seen that a complete four stroke cycle for this crankshaft is 360 degrees rotation of the crank cam and the angular interval between the consecutive dead centers is 90 degrees.

FIG. 4*f* is the isometric view of the mechanism using the First Method for engine crank shaft. FIG. 4*k* shows the exploded view of the mechanism said in FIG. 4*f*. In both of these two figures all parts are labelled.

FIGS. 4*g* and 4*h* show left and front end views of the mechanism said in FIG. 4*f* respectively. The point of contact of pins and bushings with the crank cam's weir is enlarged for better viewing.

FIG. 4*i* is the section view of section 15-15 from FIG. 4*g* and FIG. 4*j* is the isometric view of the same section.

Referring to FIGS. 4*f* and 4*k* the mechanism parts are as described below:

Piston 25. This piston 25 is the equivalent of the sliding arm 6 in the cap spinner used for this First Method except it works in reverse and the power comes from piston 25. It must be noted that the piston 25 and the rod coming out from the bottom of it and the pin at the bottom of the rod, which holds outside bushing 26 and double pin 28, are all one solid piece as shown in FIG. 4*k*. Piston 25 holds outside bushing 26 and double pin 28; it is guided inside a cylinder which is not shown. The rod of this piston 25 could be supported by a stationary wall support which is discussed in Option 10 (FIGS. 18 and 18*a*).

Outside bushing 26. This is the bushing which is outside crank cam 29's weir and is held by the pin at bottom of piston 25. The outside surface of this bushing 26 is in close contact with outside surface of crank cam 29's weir. The central axis of this bushing 26 has one degree of freedom and its motion is in Y direction only (see FIGS. 4*a* to 4*e*).

Inside bushing 27. This inside bushing 27 is held by one of the pins of double pin 28 and the outside surface of this inside bushing 27 is in close contact with inside surface of crank cam 29's weir. The central axis of inside bushing 27 moves in both X and Y directions with two degrees of freedom (see FIGS. 4*a* to 4*e*).

Double pin 28. This double pin 28 holds inside bushing 27 by one pin and the other pin of this double pin 28 is held by the bottom hole of piston 25. Comparing this apparatus to the mechanism which was described in cap spinner for First Method, this double pin 28 replaces the inside pin 13, outside pin 12 and the quantity of four nuts 15 which were described for cap spinning mechanism. It is possible to use this double pin 28 for the cap spinner or use the said parts utilized for the cap spinner for this mechanism.

Crank cam 29. This is the actual crankshaft which has a center shaft and the cam and the two are one solid piece. The geometry of this crank cam 29 shall be determined by the thermodynamics of the combustion engine and associated stress analysis. Crank cam 29 has four quadrants; they correspond to the position of the piston at top and bottom dead centers. A complete four stroke cycle is 360 degrees rotation of crank cam 29. It is obvious that crank cam 29 shown here is only for one piston; a multi cylinder engine will employ needed number of such cams with the center shaft going through them. Just like any other crankshaft, the two ends of this crank cam 29 are secured in holes in engine body and is only free to rotate (engine block not shown). The contribution of the geometry of the profile of this crank cam 29 to the intention of the invention was explained and illustrated in FIGS. 4*a* to 4*d*.

Those skilled in the art can see, the inside bushing 27 will experience stress only during intake stroke. During other three stokes, it is the outside bushing 26 which, carries the force excreted by the piston 25. As the engine operates and goes through the four strokes, the distance between central axis of outside bushing 26 and central axis of inside bushing 27 will always remain the same due to double pin 28. The outside surfaces of outside bushing 26 and inside bushing 27 are in close contact with the outside and inside surfaces of the crank cam 29's weir respectively. There shall be no slack between said surfaces.

Like other engines the crank cam 29 rotates through dead center points due to inertia of a flywheel which is not shown in these figures. It is also possible to have a similar double engagement with the crank cam 29, as it was explained for extended cam 20 for the muffler cap spinner mechanism, since it is a reasonable way of balancing the forces and reducing the stresses on the parts. The said concepts are true about all six Methods presented in this disclosure for engine crank shaft.

The above brings the description of the First Method and its application to cap spinning technology and engine crankshaft to an end.

Second Method:

In the Second Method introduced in this disclosure the weir of a hollow cam with noncircular cross section is held on both sides by two pins. The pin which is inside the cam's weir has one degree of freedom and the pin outside the cam weir has two degrees of freedom. The said two pins are furnished with bushings and are connected by a link. As the cam is rotated by a motor in the case of muffler cap spinner, the rotational motion is reciprocated to linear motion and results in the motion of a sliding arm which has one degree of freedom. The sliding arm follows the motion of the inside the cam's weir pin in the Second Method. In fact the Second Method is similar to the First Method except the bushing and the pin which swing, are outside the cam weir, where in the First Method it was the inside bushing and pin which were swinging with two degrees of freedom. In the case of engine crankshaft the mechanism works in reverse and the power comes from the sliding arm; that is the piston, and is reciprocated to rotational motion by the mechanism.

Application of Second Method to Muffler Cap Spinner

FIGS. 5*a*, 5*b* and FIGS. 6*a* to 6*g* (9 figures) are the drawings associated with application of the Second Method to muffler cap spinner. FIG. 6*a* is the main figure which shows the isometric view of a mechanism using the Second Method for muffler cap spinner. Other figures are meant for more detailed and clear presentation of the said apparatus.

FIG. 5*a* shows the simplified geometry of the Second Method applied to muffler cap spinner with no parts labelled. A typical cam with three round corners is shown. There is one pin and bushing inside the cam and one pin and bushing outside the cam. As the cam rotates, the central axes of the inside pin and bushing, with only one degree of freedom, move back and forth along X-axis. The central axes of the bushing and the pin which are outside the cam's weir, in addition to motion in X direction, also have motion in Y direction. This is shown in FIG. 5*b* as the cam has rotated 22.50 degrees in counter clockwise direction. The distance between the centers of the two pins will always remain the same because of the link between them. The two pins and bushings hold the cam's weir without any slack. The sliding arm only moves in X direction since the stand that guides it, stops it from rotation or any other motion.

FIGS. 6*a* to 6*g* show the drawings associated with an apparatus using the Second Method for muffler cap spinning FIG. 6*a* shows the mechanism in isometric view; most of the parts are labelled on this view. FIGS. 6*b* and 6*c* are the top and front views of the mechanism said in FIG. 6*a* respectively.

FIG. 6*d* is section 3-3 from FIG. 6*c* and FIG. 6*e* is the isometric view of the same section. On these two figures all of the parts which are cut by the section 3-3 are labelled.

FIGS. 6*f* and 6*g* show two isometric views of the mechanism said in FIG. 6*a* disassembled. These two figures have all parts with appropriate quantity labelled.

The common parts between this Second Method mechanism for cap spinner, and those of First Method have already been described; the parts which are specific to this cap spinning mechanism using the Second Method, and are new, are as follows:

Sliding arm 30. This is the sliding arm for this Second Method and is different from the sliding arm 6 from the First Method. It has four holes which allow inside pin 35 to be bolted to the sliding arm 30 by using quantity of four bolts 36.

Holder bushing 31. This holder bushing 31 fits in inside pin 35. This bushing has an arm with quantity of four threaded holes which hold the outside pin 32 by quantity of four bolts 34 and quantity of eight nuts 33. The said four holes could be seen on the isometric view of FIG. 6*g*. Holder bushing 31 can rotate on inside pin 35 around axil of inside pin 35 in order to allow outside pin 32 and outside bushing 11 adjust their positions due to rotation of cam 7.

Outside pin 32. This outside pin 32 is outside cam 7's weir and holds the outside bushing 11. This outside pin 32 is held by holder bushing 31 and quantity of four bolts 34 and quantity of eight nuts 33.

Nuts 33. Quantity of eight nuts 33 connecting outside pin 32 to holder bushing 31 with the use of four bolts 34.

Bolts 34. Quantity of four bolts 34 connecting outside pin 32 to holder bushing 31 with the use of quantity of eight nuts 33. Quantity of four bolts 34 are screwed into holder bushing 31.

Inside pin 35. This inside pin 35 is inside the cam 7's weir and has an extension arm which is connected to the sliding arm 30 by quantity of four bolts 36. There are four threaded holes on the extension arm of inside pin 35 which are shown on FIG. 6*g*. This inside pin 35 holds inside bushing 14 and holder bushing 31.

Connecting bolts 36. Quantity of four connecting bolts 36 connecting the sliding arm 30 to the inside pin 35.

It is possible to use the extended cam 20 which was used in the First Method for the Second Method. Since the associated drawings and figures for the said extended cam 20 were already illustrated for the First Method in FIGS. 3*g* and 3*h*, the repetition is avoided here. In addition to that the presentations for the actual cap spinning machine using the Second Method shall not be repeated since the concept is the same as the First Method for cap spinner and were shown in FIGS. 3*i* to 3*m*.

Application of Second Method to Engine Crankshaft

FIG. 7 and FIGS. 7*a* to 7*f* (7 figures) are the drawings associated with application of Second Method to engine crankshaft. FIG. 7*a* is the main figure which shows the isometric view of a mechanism using the Second Method for engine crankshaft. Other figures are meant for more detailed and clear presentation of the said apparatus.

FIG. 7 is the basic geometry of the mechanism during the intake stroke after the crank cam has rotated 22.5 degrees in clockwise direction from top dead center position. FIG. 7*a* shows the isometric view of a typical apparatus using the Second Method for engine crankshaft; all parts all labelled in this figure.

FIGS. 7*b* and 7*c* show the front and right views of the mechanism said in FIG. 7*a* respectively. The hidden lines are shown in these figures and details of point of contact of bushings with crank cam's weir are enlarged.

FIG. 7*d* shows the section view of section 15-15 from FIG. 7*c* and FIG. 7*e* shows the isometric view of the same section 15-15. All mechanism parts are labelled on these two figures.

FIG. 7*f* shows the isometric view of the mechanism said in FIG. 7*a* disassembled. This figure has all parts labelled.

The geometric configurations for the four top and bottom dead centers of the four stroke cycle were already described for the First Method in FIGS. 4*a* to 4*d*. In the Second Method since the crank cam 29 is the same as the First Method, the positions of the piston 37 are the same for the corresponding dead centers. The only thing which is different is the connection mechanism which connects the piston 37 to crank cam 29.

The crank cam 29, the outside bushing 26 and the inside bushing 27 are the same as that of First Method. The new parts for this mechanism are as follows:

Piston 37. This piston 37 has a pin at bottom end to hold inside bushing 27 and holder bushing 38. This piston 37 has a pin, a connecting rod and the top piston section and all three are one solid piece.

Just like the First Method the rod of this piston 37 could be supported by a stationary wall support which is discussed in Option 10 (FIGS. 18 and 18*a*).

Holder bushing 38. This holder bushing 38 has a pin that holds outside bushing 26 and is held by the pin at the bottom of piston 37.

In this mechanism the central axis of inside bushing 27 has only one degree of freedom and the outside bushing 26 has two degree of freedom and swings as the crank cam 29 rotates.

This brings the description of the Second Method and its application to cap spinning technology and engine crankshaft to an end.

Third Method:

In the Third Method introduced in this disclosure the weir of a hollow cam with non-circular cross section is held on both sides by two pins. Both pins have one degree of freedom and none of the pins swings. The said two pins are furnished with bushings and are connected by a link. A spring under compression is used to keep the said pins and bushings in close contact with cam's weir. As the cam is rotated by a motor in the case of muffler cap spinner, the rotational motion is reciprocated to linear motion and results in the motion of a sliding arm which has one degree of freedom. For muffler cap spinner the spring pushes the outside the cam's weir pin and bushing against the outside surface of the cam's weir.

In the case of engine crankshaft the mechanism works in reverse and the power comes from the sliding arm; that is the piston, and is reciprocated to rotational motion by the mechanism. For the engine crankshaft, it is the inside the cam's weir pin and bushing which are forced against the inside surface of the cam's weir. There shall be two versions of the mechanism for engine crankshaft; one by a spring under tension and another version with spring under compression.

Application of Third Method to Muffler Cap Spinner

FIGS. 8*a* to 8*l* (12 figures) are the drawings associated with the application of the Third Method to muffler cap spinner. FIGS. 8*c* and 8*d* are the main figures which show two isometric views of a mechanism using the Third Method for muffler cap spinner. Other figures are meant for more detailed and clear presentation of the said apparatus.

FIG. 8*a* is the basic geometry for Third Method applied to muffler cap spinner and FIG. 8*b* is the same geometry said in FIG. 8*a* after a cam rotation of 22.5 degrees in counter clockwise direction.

FIGS. 8*c* and 8*d* are two isometric views of a mechanism using the Third Method for muffler cap spinner. FIG. 8*e* and FIG. 8*f* are the top and front views of the mechanism said in FIG. 8*c* respectively.

FIG. 8*g* is the section view 4-4 from FIG. 8*e* and FIG. 8*h* is the isometric view of the same section. Parts which are cut by the section are labelled in these figures.

FIG. 8*i* is the section view 5-5 from FIG. 8*f* and FIG. 8*j* is the isometric view of the same section. Parts which are cut by the section are labelled in these figures.

FIG. 8*k* is the mechanism said in FIG. 8*c* disassembled and all parts labelled. FIG. 8*l* is an additional isometric view of the mechanism said in FIG. 8*c* disassembled and all parts labelled. These two figures have all parts with the appropriate quantity of parts labelled.

Referring to FIG. 8*a* & FIG. 8*b*, in this Third Method for muffler cap spinner there is no swinging pin and the centers of both pins, inside and outside the cam's weir, are always on X-axis and the distance between the centers of the said pins varies as the cam rotates. The outside the cam's weir pin is pushed against the outside surface of the cam's weir by a spring which, at all times is under compression. FIG. 8*b* shows the geometry shown in FIG. 8*a* after 22.5 degrees rotation of the cam in counter clockwise direction. Also the spring, which is under compression at all times, changes length as the cam rotates. The purpose of the outside pin and bushing is only to keep the inside bushing always flushed with the inside surface of the cam weir when the mechanism is not performing the action of seaming. This is because there are moments in which the roller 4 is not engaged in seaming action, as a result the inside pin may hit the inside surface of the cam suddenly as the next engagement starts. To avoid such impact, tight contact between these parts is necessary. In fact this is the reason for the use of outside pin and bushing for the first three Methods presented in this disclosure for muffler cap spinner.

Parts which are common with previous mechanisms have been described already. The new parts associated with this Third Method for muffler cap spinner are as follows:

Outside pin 39. This outside pin 39 holds the outside bushing 40. It must be noted that this outside pin 39 has an extended arm which goes into the slot of the sliding arm 41; the slot in the sliding arm 41 guides the arm of this outside pin 39. The slot of sliding arm 41 which accommodates the arm of outside pin 39 is shown in FIG. 8*l*.

Outside bushing 40. This outside bushing 40 is held by outside pin 39. This outside bushing 40's outside surface is in close contact with the outside surface of the cam 7's weir.

Sliding arm 41. This sliding arm 41 is different from the arms in the past two Methods. It has a slot to support and guide the arm of the outside pin 39. The slot of sliding arm 41 which accommodates the arm of outside pin 39 is shown in FIG. 8*l*.

Connecting bolts 42. Quantity of two bolts which, each is connected tight to sliding arm 41 at one end by two nuts 44 and it is loose at the other end where the outside pin 39 is, and holds a third nut 44 at opposite end. The outside pin 39 must be able to move back and forth sliding inside the sliding arm 41's slot. The purpose of these bolts 42 and nuts 44 is, when the cam 7 is being changed, the outside pin 44 is not pushed away by spring 43. In addition to FIGS. 8*k* and 8*l*, connecting bolts 42 are shown on the detail portion of FIG. 8*g* for more clarification.

Spring 43. This spring 43 is between sliding arm 41 and outside pin 39. This spring 43 is under compression at all times.

Nuts 44. Quantity of six nuts 44 screwed as shown on the two connecting bolts 42. These nuts 44 are shown on the detail portion of FIG. 8*g* for more clarification. Each of connecting bolts 42 accommodates three of these nuts 44. On each connecting bolts 42 there are two of nuts 44 at one end for connection to sliding arm 41 and one nut 44 for limiting the motion of spring 43 at the other end of connecting bolt 42.

It is possible to use the extended cam 20 which was used in the First Method for the Third Method. Since the associated drawings and figures for the said extended cam 20 were already illustrated for the First Method in FIGS. 3*g* and 3*h*, the repetition is avoided here. In addition to that the presentations for the actual cap spinning machine using the Third Method shall not be repeated since the concept is the same as the First Method for cap spinner and were shown in FIGS. 3*i* to 3*m*.

Application of Third Method to Engine Crankshaft

There shall be two ways of applying the Third Method to engine crankshaft application. These two Methods are one with a spring under tension (Method 3a) and another with a spring under compression (Method 3b). For both drawings and explanation shall be provided; they are as follows:

Method 3a

Method 3a shall be regarded as the first way of applying the Third Method to engine crankshaft. FIGS. 9*a* to 9*g* (7 figures) are the drawings associated with application of Method 3a to engine crankshaft. FIG. 9*b* is the main figure which shows the isometric view of a mechanism using Method 3a for engine crankshaft. Other figures are meant for more detailed and clear presentation of the said apparatus.

FIG. 9*a* shows the simplified geometry of Method 3a for engine crankshaft during intake stroke after a 22.5 degrees rotation of the cam in clockwise direction from top dead center position.

FIG. 9*b* shows the isometric view of a mechanism using Method 3a for engine crankshaft. FIGS. 9*c* and 9*d* show the front and left views of the mechanism said in FIG. 9*b* respectively.

FIG. 9*e* shows the section view of section 6-6 shown in FIG. 9*d* and FIG. 9*f* shows the isometric view of the same section. All mechanism parts are labelled on these two figures.

FIG. 9*g* shows the mechanism said in FIG. 9*b* disassembled and all parts labelled.

As the crank cam rotates the central axes of the two pins and bushings outside and inside the cam's weir, are always on Y-axis (as shown in FIG. 9*a*) and the outside surfaces of the bushings are in close contact with outside and inside surfaces of the cam's weir. The tension force of the spring will avoid any slack between the said surfaces during the operation of the crankshaft. The distance between the central axils of the said two pins varies as the piston operates and the linear motion is reciprocated to rotational motion by the connection mechanism and as a result crank cam would rotate.

Parts which are common with previous mechanisms have been described already. The new parts associated with this Method 3a for engine crankshaft are as follows:

Piston 45. This piston 45 at bottom end has one pin to accommodate outside bushing 26, a spring holder to hold spring 47 and a hole to guide one of the pins of double pin 46. The hole is shown on section views of FIGS. 9*e* and 9*f*. The said pin for holding outside bushing 26, the spring holder and the piston and the piston rod are all one piece.

Double pin 46. This double pin 46 has two pins; one holds the inside bushing 27 and the second pin is inside the hole at the bottom of piston 45. The pin which is inside the bottom hole of the piston 45 is shown here with circular cross-section; however in order to keep this pin in the right orientation a rectangular cross-section for the said pin and hole at the bottom of piston 45 is recommended. This double pin 46 also has a spring holder for holding spring 47.

Spring 47. This spring 47 is always under tension and the minimum force it induces must be more than the sum of at least three forces. The first force is the force required to accelerate the piston 45 downwards during intake stroke at maximum engine revolution. The second force is the maximum friction force which, the piston 45 will experience by contacting the cylinder body and other frictional forces. The third force is the maximum suction force induced on the piston 45 during the intake stroke.

It has already been explained that the geometry of the cam shaft 29 will result in longer power stroke than intake stroke. In Method 3a during compression, power and exhaust strokes the piston 45 is under force acting downwards due to presence of compressed gas in the cylinder. During the said three strokes the piston 45 is being forced down and as a result the outside bushing 26 experiences the force. It is only during the intake stroke that the inside bushing 27 will be under significant stress. During all four strokes the spring 47 is under tension and the force this spring 47 induces must be at all times greater than sum of all forces acting on the piston 45 during intake stroke as was explained for the description of spring 47.

The geometric configurations for the four top and bottom dead centers of the four stroke cycle were already described for the First Method in FIGS. 4*a* to 4*d*. In Method 3a since the crank cam 29 is the same as the First Method, the positions of the piston 45 are the same for the corresponding dead centers. The only thing which is different is the connection mechanism which connects the piston 45 to crank cam 29.

Method 3b

Method 3b shall be regarded as the second way of applying the Third Method to engine crankshaft. FIGS. 10*a* to 10*g* (7 figures) are the drawings associated with application of Method 3b to engine crankshaft. FIG. 10*b* is the main figure which shows the isometric view of a mechanism using Method 3b for engine crankshaft. Other figures are meant for more detailed and clear presentation of the said apparatus.

FIG. 10*a* is a simplified geometry for Method 3b applied to engine crankshaft during intake stroke after a 22.5 degrees rotation of the cam in clockwise direction from top dead center position.

FIG. 10*b* shows the isometric view of a mechanism using Method 3b for engine crankshaft with all parts labelled. FIGS. 10*c* and 10*d* show the front and left views of the mechanism said in FIG. 10*b* respectively.

FIG. 10*e* shows the section view of section 7-7 from FIG. 10*d* and FIG. 10*f* is the isometric view of the same section 7-7. All the parts are labelled on these two figures. FIG. 10*g* shows the mechanism said in FIG. 10*b* disassembled and all parts labelled.

As the cam rotates the two central axes of the two pins and two bushings outside and inside the cam's weir are always on Y-axis (as shown in FIG. 10*a*) and the outside surfaces of the bushings are in close contact with outside and inside surfaces of the cam's weir. The compression force of the spring will avoid any slack between the said surfaces during the operation of the crankshaft. The distance between the centers of the said two pins varies as the piston operates and the linear motion is reciprocated to rotational motion by the connection mechanism and as a result crank cam would rotate.

Parts which are common with previous mechanisms have been described already. The new parts associated with Method 3b for engine crankshaft are as follows:

Piston 48. This piston 48 at bottom end has one pin to accommodate outside bushing 26, a spring holder to hold one end of spring 50 and a hole to guide one of the pins of double pin 49. The hole is shown on section views of FIGS. 10*e* and 10*f*. All of the said pin and the spring holder and the piston and the piton rod are one solid piece.

Double pin 49. This double pin 49 has two pins; one holds the inside bushing 27 and the second pin is inside the hole at the bottom of piston 48. The pin which is inside the bottom hole of the piston 48 is shown here with circular cross-section; however in order to keep this pin in the right orientation a rectangular cross-section for the pin and the hole at the bottom of piston 48 is recommended. This double pin 49 also has a spring holder for holding spring 50.

Spring 50. This spring 50 is always under compression and the minimum force it induces must be more than the sum of at least three forces. The first force is the force required to accelerate the piston 48 downwards during intake stroke at maximum engine revolution. The second force is the maximum friction force which, the piston 48 will experience by contacting the cylinder body and other frictional forces. The third force is the suction force induced on the piston 48 during the intake stroke.

In Method 3b the spring 50 is always under compression and it keeps the inside bushing 27 and outside bushing 26 in close contact with the outside and inside surfaces of the crank cam 29's weir.

The geometric configurations for the four top and bottom dead centers of the four stroke cycle were already described for the First Method in FIGS. 4*a* to 4*d*. In Method 3b since the crank cam 29 is the same as the First Method, the positions of the piston 48 are the same for the corresponding dead centers. The only thing which is different is the connection mechanism which connects the piston 48 to crank cam 29.

The above was the description of the Third Method and its application to muffler cap spinner and engine crankshaft. The description and illustrations of the Third Method and its application to muffler cap spinner and engine crankshaft comes to an end at this point.

Fourth Method:

The Fourth Method introduced in this disclosure is applied only to muffler cap spinner. In the Fourth Method introduced in this disclosure the weir of a hollow cam with non-circular cross section is contacted from inside by a pin which is connected to a sliding arm. The said pin is furnished with bushing and has one degree of freedom. A spring under tension is used to keep the said pin and bushing in close contact with inside surface of the non-circular cam's weir during the times when action of seaming is not performed. As the cam is rotated by a motor, the rotational motion is reciprocated to linear motion and results in the motion of a sliding arm which has one degree of freedom.

Application of Fourth Method to Muffler Cap Spinner

FIGS. 11*a* to 11*h* (8 figures) are the drawings associated with the application of the Fourth Method to muffler cap spinner. FIG. 11*c* is the main figure which shows the isometric view of a mechanism using the Fourth Method for muffler cap spinner. Other figures are meant for more detailed and clear presentation of the said apparatus.

FIG. 11*a* is a simplified geometry of the Fourth Method applied to muffler cap spinner and FIG. 11*b* is the same geometry after a 22.5 degrees rotation of the cam in counter clockwise direction.

FIG. 11*c* shows the isometric view of a muffler cap spinning assembly using the Fourth Method. FIG. 11*d* and 11*e* are the top and front views of the mechanism said in FIG. 11*c* respectively.

FIG. 11*f* shows the section view 8-8 from FIG. 11*e* and FIG. 11*g* is the isometric view of the same section. Parts are labelled in these figures.

FIG. 11*h* shows the mechanism said in FIG. 11*c* disassembled and all parts labelled.

Parts which are common with previous mechanisms have been described already. There is only one new part associated with this Fourth Method and it is:

Spring 51. This spring 51 is attached from one end to the sliding arm 30 and from the other end to the stationary wall attachment 5; the means of attachment is not shown. The spring 51 is under tension at all times and pulls the sliding arm 30 away from the cam 7 and towards the stationary wall attachment 5. It must be realized that the force needed for the action of seaming is excreted by the hydraulic system and not spring 51. Spring 51 could also act as a means of storing the kinetic energy of the system in order to avoid vibration; this matter is discussed in Option 2.

In the Fourth Method there is an inside pin 35 and inside bushing 14 but there are no outside the cam's weir pin and bushing. In FIGS. 11*a* and 11*b* it is shown that the pin inside the cam moves with only one degree of freedom along X-axis as the cam is rotated. The spring 51 under tension keeps the inside pin 35, inside bushing 14 and the cam 7's weir in close contact during the time that roller 4 is not engaged in action of seaming. The purpose of the spring 51 is similar to that of spring 43 in the Third Method for cap spinner.

The mechanism in this Fourth Method, could also utilize the extended cam 20 as shown in the previous three Methods. That is each arm can engage the extended cam 20 from two points. Since the drawings for the use of extended cam 20 are already shown for the First Methods, the illustrations for this matter are avoided. For this Fourth Method it is also possible to have machines with frame and multiple arms as shown in FIGS. 3*i* to 3*m*, as described for the First Method.

This brings the description of the Fourth Method and its application to cap spinning technology to an end.

Fifth Method:

In the Fifth Method introduced in this disclosure a cam which has a groove corresponding to the desired non circular profile, is used. The said groove accommodates a pin which has one degree of freedom. The said pin which is confined inside the said groove is connected to a sliding arm. As the cam is rotated by a motor in the case of muffler cap spinner, the rotational motion is reciprocated to linear motion and results in the motion of a sliding arm which has one degree of freedom. The sliding arm follows the motion of the said pin.

In the case of engine crankshaft the mechanism works in reverse and the power comes from the sliding arm; that is the piston, and is reciprocated to rotational motion by the mechanism.

Application of Fifth Method to Muffler Cap Spinner

FIGS. 14*a* to 14*e* and FIGS. 14*e*1, 14*f* and 14*g* (8 figures) are the drawings associated with the application of the Fifth Method to muffler cap spinner. FIG. 14*c* is the main figure which shows the isometric view of a mechanism using the Fifth Method for muffler cap spinner. Other figures are meant for more detailed and clear presentation of the said apparatus.

FIG. 14*a* is a simplified geometry of the Fifth Method for muffler cap spinner and FIG. 14*b* is the same geometry after a 22.5 degrees rotation of the cam in counter clockwise direction.

FIG. 14*c* is the isometric view of a muffler cap spinning mechanism using the Fifth Method. FIGS. 14*d* and 14*e* are the top and front views of the mechanism said in FIG. 14*c* respectively.

FIG. 14*e*1 is the view of section 11-11 from FIG. 14*e* and FIG. 14*f* is the isometric view of the same section. FIG. 14*g* is the mechanism said in FIG. 14*c* disassembled and all parts labelled.

Parts which are common with previous mechanisms have been described already. There is only one new part associated with this Fifth Method and it is:

Grooved cam 60. This grooved cam 60 has a groove similar to the desired profile. As the grooved cam 60 is rotated by a motor, the inside pin 35 moves only in X-direction (for X-direction see FIGS. 14*a* and 14*b*) and translates the rotational motion to sliding arm 30 in linear form. Although in the illustrations of the Fifth Method the outside surface of grooved cam 60 has similar shape as the groove profile, however that is not a necessity and only the profile of the groove of the cam 60 is important and must be the same as the muffler cross section profile. It is possible to furnish pin 35 which is confined inside the groove of grooved cam 60 with bushing.

The mechanism in this Fifth Method, could also utilize an extended grooved cam similar to the concept said for extended cam 20 as was shown in the First Method. That is each arm can engage the grooved extended cam from two points. Since the drawings for the use of extended cam were already shown for the First Methods, the illustrations for this matter are avoided. For this Fifth Method it is also possible to have machines with frame and multiple arms as shown in FIGS. 3*i* to 3*m*, as described for the First Method.

Application of Fifth Method to Engine Crankshaft

FIGS. 15*a* to 15*g* (7 figures) are the drawings associated with application of the Fifth Method to engine crankshaft. FIG. 15*b* is the main figure which shows the isometric view of a mechanism using the Fifth Method for engine crankshaft. Other figures are meant for more detailed and clear presentation of the said apparatus.

FIG. 15*a* is a simplified geometry for the Fifth Method applied to engine crankshaft during intake stroke after a 22.5 degrees rotation of the cam in clockwise direction from top dead center position.

FIG. 15*b* shows the isometric view of a mechanism using the Fifth Method applied to engine crankshaft with all parts labelled. FIGS. 15*c* and 15*d* show the left and front views of the mechanism said in FIG. 15*b* respectively.

FIG. 15*e* shows the section view of section 12-12 from FIG. 15*c* and FIG. 15*f* is the isometric view of the same section 12-12. All the parts are labelled on these two figures; and FIG. 15*g* shows the mechanism said in FIG. 15*b* disassembled and all parts labelled.

This assembly has two parts and they are:

Piston 61. This piston 61 has a bottom pin, top piston and a connecting rod and the three are one solid piece. As piston 61 moves on Y-axis (see FIG. 15*a*) along the cylinder, the pin at the bottom of this piston 61 which is confined in the groove of crank cam 62, has close contact with the surfaces of the groove of crank cam 62. For compression, power and exhaust strokes, force is exerted from piston 61's pin on the surface of the groove which is closer to center of crank cam 62. It is only during intake stroke that the outer surface of the groove of crank cam 62 exerts force on the pin of piston 61. It is possible to furnish the pin at end of piston 61 which is confined inside the groove of crank cam 62 with bushing.

Crank cam 62. This is the actual crankshaft which has a center shaft and a cam and the two are one solid piece. The cam has a groove which its geometry corresponds to the thermodynamics requirement of the combustion engine. But for this case the profile of the groove of crank cam 62 is the same as the profile of crank cam 29's weir. Although in this illustration the outer edge of the cam has similar shape to that of the groove, however it is only the profile of the groove which matters and the outer edge of the cam can have a different profile. Crank cam 62 has four quadrants; they correspond to the positions of the piston at two top and two bottom dead centers. It is obvious that crank cam 62 shown here is only for one piston; a multi cylinder engine will employ needed number of such cams with the center shaft going through them. Just like any other crankshaft, the two ends of this crank cam 62 are secured in holes in engine body and is only free to rotate.

The geometric configurations for the four top and bottom dead centers of the four stroke cycle were already described for the First Method in FIGS. 4*a* to 4*d*. In the Fifth Method since the groove of crank cam 62 has the same profile as crank cam 29's weir, the positions of the piston 61 are the same for the corresponding dead centers. The only thing which is different is the connection mechanism which connects the piston 61 to crank cam 62.

This brings the description of the Fifth Method and its application to cap spinning technology and engine crankshaft to an end.

Sixth Method:

In the Sixth Method introduced in this disclosure a triple pin is used for connecting the sliding arm to non-circular cam. Two pins of this triple pin are on either sides of the cam's weir and the third pin is connected to sliding arm. In the First Method the pin inside the cam was swinging and had two degrees of freedom while the pin outside the cam's weir had only one degree of freedom. In the case of Second Method the concept was reversed. In the Sixth Method both inside and outside the cam's weir pins on both sides of the cam's weir swing and have two degrees of freedom and only the central axis of the middle pin which is the third pin and is connected to sliding arm has one degree of freedom.

As the cam is rotated by a motor in the case of muffler cap spinner, the rotational motion is reciprocated to linear motion and results in the motion of a sliding arm which has one degree of freedom. The sliding arm follows the motion of the said third pin.

In the case of engine crankshaft the mechanism works in reverse and the power comes from the sliding arm, that is the piston, and is reciprocated to rotational motion by the mechanism.

Application of Sixth Method to Muffler Cap Spinner

FIGS. 16*a* to 16*h* (8 figures) are the drawings associated with the application of the Sixth Method to muffler cap spinner. FIG. 16*c* is the main figure which shows the isometric view of a mechanism using the Sixth Method for muffler cap spinner. Other figures are meant for more detailed and clear presentation of the said apparatus.

FIG. 16*a* is a simplified geometry of the Sixth Method for muffler cap spinner and FIG. 16*b* is the same geometry after a 22.5 degrees rotation of the cam in counter clockwise direction.

FIG. 16*c* is the isometric view of a muffler cap spinning mechanism using the Sixth Method. FIGS. 16*d* and 16*e* are the top and front views of the mechanism said in FIG. 16*c* respectively.

FIG. 16*f* is the view of section 13-13 from FIG. 16*e* and FIG. 16*g* is the isometric view of the same section. FIG. 16*h* is the mechanism said in FIG. 16*c* disassembled and all parts labelled.

Parts which are common with previous mechanisms have been described already. The new parts associated with this Sixth Method are:

Connection Arm 63. This connection arm 63 is connected to sliding arm 30 by four bolts 36 from one end and has a hole which holds one of the pins of triple pin 64 from the other end.

Triple Pin 64. This triple pin 64 has three pins and has a Y shape. One pin fits inside the hole at one end of connection arm 63 and two other pins which are on either sides of cam 7's weir. The outside surfaces of these two pins are always tangent to outside and inside surfaces of the cam 7's weir.

For the purpose of this illustration the center of the pin which fits inside the hole of connection arm 63 is at the middle of the two other pins. However, it could be anywhere between the centers of the said two pins or outside the said interval given it does not create locking problem of the mechanism. In fact if it aligns with the pin inside cam 7's weir, the mechanism is a copy of Second Method for muffler cap spinner and if it aligns with the pin outside the cam 7's weir, then the mechanism is similar to that of First Method. Also it has to be noted that the diameter of the three pins for this triple pin 64 could differ from one another. It is possible to furnish all or some of the pins of triple pin 64 with bushing.

As cam 7 rotates by the torque generated by motor, the sliding arm 30 follows the path of motion from non-circular loop. As a result hydraulic assembly referenced as numeral 4*b* which is attached to sliding arm 30 will keep the roller 4 at desired position relative to lips of shell 1 and cap 2.

The mechanism in this Sixth Method, could also utilize an extended cam similar to the concept said for extended cam 20 as was shown in the First Method. That is each arm can engage the extended cam from two points. Since the drawings for the use of extended cam were already shown for the First Methods, the illustrations for this matter are avoided. For this Sixth Method it is also possible to have machines with frame and multiple arms as shown in FIGS. 3*i* to 3*m*, as described for the First Method.

Application of Sixth Method to Engine Crankshaft

FIGS. 17*a* to 17*g* (7 figures) are the drawings associated with application of the Sixth Method to engine crankshaft. FIG. 17*b* is the main figure which shows the isometric view of a mechanism using the Sixth Method for engine crankshaft. Other figures are meant for more detailed and clear presentation of the said apparatus.

FIG. 17*a* is a simplified geometry for the Sixth Method applied to engine crankshaft during intake stroke after a 22.5 degrees rotation of the cam in clockwise direction form top dead center position.

FIG. 17*b* shows the isometric view of a mechanism using the Sixth Method for engine crankshaft with all parts labelled. FIGS. 17*c* and 17*d* show the left and front views of the mechanism said in FIG. 17*b* respectively.

FIG. 17*e* shows the section view of section 14-14 from FIG. 17*c* and FIG. 17*f* is the isometric view of the same section 14-14. All the parts are labelled on these two figures. FIG. 17*g* shows the mechanism said in FIG. 17*b* disassembled and all parts labelled.

This assembly comprises of three parts; two of which, crank cam 29 and piston 25 were already explained. Piston 25 was used for the First Method applied to engine crankshaft and is used here again. The new part is:

Triple Pin 65. This triple pin 65 has the same function as triple pin 64 for cap spinner said for the Sixth Method earlier. It has a Y shape and has three pins. One pin fits inside bottom hole of piston 25 and the other two pins are on either sides of crank cam 29's weir. The outside surfaces of these two pins are always tangent to outside and inside surfaces of the crank cam 29's weir. For the purpose of this illustration the center of the pin which fits inside the bottom hole of piston 25 is at the middle of the two other pins. However, it could be anywhere between the centers of the said two pins. In fact if it aligns with the pin inside crank cam 29's weir, the mechanism is a copy of Second Method said for engine crankshaft and if it aligns with the pin outside the crank cam 29's weir, then the mechanism is similar to that of First Method. It is also possible to have the location of the said pin outside the interval between the centers of the two other pins given it does not create any locking of the mechanism. In addition to that it has to be noted that the diameter of the three pins for this triple pin 65 could differ from one another. In addition to that it is possible to furnish all or some of the pins of triple pin 65 with bushing.

As the piston 25 moves up and down the cylinder, the crank cam 29 rotates and reciprocates the linear motion to rotational motion. As the crank cam 29 rotates, triple pin 65 will adjust its position to an appropriate configuration to compensate for the continuous change of configuration.

The geometric configurations for the four top and bottom dead centers of the four stroke cycle were already described for the First Method in FIGS. 4*a* to 4*d*. In the Sixth Method since the crank cam 29 is the same as the First Method, the positions of piston 25 are the same for the corresponding dead centers. The only thing which is different is the connection mechanism which connects the piston 25 to crank cam 29.

This brings the description of the Sixth Method and its application to cap spinning technology and engine crankshaft to an end.

Adjustable Closure for the Sliding Arm

It has been shown hitherto for the cap spinning mechanisms presented in this disclosure the need for a closure which can guide and support the sliding arm. In order to avoid any gaps between the surfaces of the sliding arm and its closure, an Adjustable Closure for the Sliding Arm is presented. For this feature, the stationary wall attachment which holds the sliding arm inside it is adjustable; thus avoiding any slacks between the surfaces.

FIGS. 12*a* to 12*j* (10 figures) are the drawings associated with the Adjustable Closure for the Sliding Arm. FIG. 12*a* is the main figure which shows the isometric view of this mechanism. Other figures are meant for more detailed and clear presentation of the said apparatus.

FIG. 12*a* shows an isometric view of a mechanism with an Adjustable Closure for the Sliding Arm. FIGS. 12*b*, 12*c* and 12*d* are the top, front and left views of the mechanism said in FIG. 12*a* respectively.

FIG. 12*e* shows the section view of section 9-9 from FIG. 12*b* and FIG. 12*f* is the isometric view of the same section.

FIG. 12*g* shows the section view of section 10-10 from FIG. 12*d* and FIG. 12*h* is the isometric view of the same section.

FIG. 12*i* shows an isometric view of the mechanism for an Adjustable Closure for the Sliding Arm said in FIG. 12*a* disassembled and all parts labelled and FIG. 12*j* is an additional isometric view of the same disassembled mechanism.

The parts for Adjustable Closure for the Sliding Arm are as follows:

Frame 52. This frame 52 is attached to the frame of the machine from one end and allows the sliding arm 53, to move back and forth at the other end. It replaces the stationary wall attachment 5.

Sliding arm 53. This is a general presentation of a sliding arm; any of the said sliding arms for the six Methods which were shown in this disclosure could replace it.

Adjustable 54. This adjustable 54 is bolted to frame 52 by positioning bolts 56 and positioning nuts 57. The position of this adjustable 54 can be adjusted due to presence of slots on the body of frame 52. This adjustable 54 will impose one constraint on sliding arm 53. The size and geometry of this adjustable 54 depends on every specific application.

Adjustable 55. This adjustable 55 is bolted to frame 52 by positioning bolts 56 and positioning nuts 57. The position of this adjustable 55 can be adjusted due to presence of slots on the body of frame 52. This adjustable 55 will impose the second constraint on sliding arm 53. The size and geometry of this adjustable 55 depends on every specific application.

Positioning Bolts 56. Quantity of eighteen positioning bolts 56 which tighten the adjustable 54 and adjustable 55 to frame 52 by quantity of eighteen positioning nuts 57. The number of these positioning bolts 56 and their location can vary depending on the application. In this case quantity of nine positioning bolts 56 are used for each of adjustable 54 and adjustable 55.

Positioning Nuts 57. Quantity of eighteen positioning nuts 57 which, tighten the adjustable 54 and adjustable 55 to frame 52 with positioning bolts 56. For every positioning bolt 56 there is one positioning nut 57.

Minor Adjustment Bolts 58: Quantity of twelve minor adjustment bolts 58 which keep the surfaces of the adjustable 54 and adjustable 55 with the outside surfaces of sliding arm 53 and frame 52 in close contact. They are tightened to frame 52 by minor adjustment nuts 58. These minor adjustment bolts 58 are meant for minor adjustments. The tip of these minor adjustment bolts 58 hold the adjustable 54 and adjustable 55 in a desirable position with respect to the sliding arm 53. The number of these minor adjustment bolts 58 and their location can vary depending on the application.

Minor Adjustment Nuts 59: Quantity of twenty four minor adjustment nuts 59 which connect minor adjustment bolts 58 to frame 52. For every minor adjustment bolt 58 there are two minor adjustment nuts 59.

The above brings the description and illustrations of Adjustable Closure for the Sliding Arm to an end.

Possible Options of the Mechanisms:

All the mechanisms illustrated thus far for muffler cap spinner and engine crankshaft, could utilize optional features which may enhance the operation of the mechanisms. Options 1 to 8 are associated to muffler cap spinning and Options 9 to 12 are about engine crank shaft.

Possible Options for Muffler Cap Spinner:

The Options are shown only for the First Method but could be used for any of the six Methods where applicable. They are as follows:

Option 1: the use of solid pin without any bushings and bearings for inside and/or outside the cam's weir pins. A geometrical illustration of that is shown in FIG. 13*a*. As shown the cam's weir is held by two pins on either side and the said pins are not furnished with any bushings or bearings.

Option 2: the use of a spring between the sliding arm and stationary wall attachment 5 for storing the kinetic energy of the system. A geometrical illustration of that is shown in FIG. 13*b*. The spring could be either under tension or compression depending on the Method. For the mechanism illustrated in the Fourth Method for muffler cap spinner, spring 51 which is under tension and a part of the mechanism, serves this purpose. The main reason that most cap spinners have vibration problem is that the kinetic energy which motor induces into the mechanism and partly used to for the action of seaming, is not stored by any means.

Option 3: the use of bushing for the inside and/or outside cam's weir pins. A geometrical illustration of that is shown in FIG. 13*c*. Most of the illustrations of this disclosure have used this Option (in illustrations of the Fifth and Sixth Method bushings are not used for the said pins). As shown the two pins on either sides of the cam's weir are furnished with bushings.

In addition to that it is possible to furnish the outside surfaces of the said bushings and the inside and outside surfaces of the cam's weir with gear teeth. A geometrical illustration of this concept is shown in FIG. 18*j*. In FIG. 18*j* a fictitious section is shown which only the point of contact of the pins and bushings with the cam's weir is illustrated. On one side of cam 135's weir a 131 inside the cam pin, is held inside 132 bushing which its outside surface has gear teeth. The said gear teeth are engaged with the teeth of cam's 135. On the opposite side of the cam 135's weir a 133 outside the cam pin is held inside 134 bushing which its outside surface has gear teeth and are engaged with the teeth of cam's 135's weir. A link 136 connects the said pins. The use of gear teeth as shown will help the mechanisms presented in this disclosure to avoid possible locking problem.

Option 4: the use of ball or roller bearings for the inside and/or outside the cam's weir pins and bushings. A geometrical illustration of that is shown in FIG. 13*d*.

Option 5: the stationary wall attachment acting as a closure and the sliding arm is placed inside the stationary wall attachment. A geometrical illustration of that is shown in FIG. 13*e*. The Adjustable Closure for the Sliding Arm presented earlier is of this nature.

Option 6: the stationary wall attachment is inside the sliding arm and the sliding arm acts as a closure for the stationary wall attachment. A geometrical illustration of that is shown in FIG. 13*f*. All the mechanisms of the six Methods presented for muffler cap spinner used this Option.

Option 7: the use of rollers between the surfaces of stationary wall attachment and sliding arm. A geometrical illustration of that is shown in FIG. 13*g*.

Option 8: A well known problem in cap spinning industry is the fact that when multiple rollers 4 engage on one side of the muffler with a shell 1 lip and a cap 2 lip, one of rollers reaches the target first and they all do not touch the said lips at the same time. The delay might be a fraction of a second, but due to a large force (approximately 5000 pounds force) exerted by one of the rollers 4 which touches the said lips first, it will cause slight bending of the apparatus which was referred to as numeral 1*b*. As a result it will cause slight misalignment of the groove of other rollers 4 with the shell 1 lip and the cap 2 lip at other points of engagement or may cause undesirable bending of the said lips. For example considering the cap spinning machine shown in FIGS. 3*k* to 3*m*; each side of the muffler is engaged with six rollers 4. If one of the rollers 4 reaches the target first, it may cause the said misalignment. It has to be also noted that this problem is not restricted to cases with non-circular cross sections.

In order to solve the said problem a schematic flow diagram is presented in FIG. 13*h*. A typical muffler shell 1 and two caps 2 are encountering twelve rollers 4 (roller 4 is a part of numeral 4*a*, see three FIGS. 1*k*, to 1*m*). That is each side engages with six rollers 4. The main hydraulic line is shown with heavy line coming from Oil Tank and going to pump P and after that to Control Valve which is shown as a box. As is well known the Control Valve controls the direction of the oil flow into the hydraulic apparatus 4*a*. The return hydraulic oil from apparatus 4*a* is sent back to the Oil Tank from Control Valve.

A much smaller than the main line as by pass line is shown by thinner line than the main line; it is taken immediately after the discharge of pump P and sent back to the Oil Tank. The said line is between pump P discharge and Control Valve. For example if the main line is ¾" in diameter, the bypass could be ⅛" in diameter. This line can also go to pump P inlet; that is between the Oil Tank and pump P inlet. There are a globe valve GV and a solenoid valve SV which is normally closed (N.C.) on the bypass line.

As the operation of seaming starts, let's say for example all rollers 4 will reach their target before one second. If during a period longer than that, say 1.3 seconds, the solenoid valve SV which is normally closed, opens, the pressure in the discharge line significantly drops. For example it will drop from 3000 psi to 150 psi. As a result the rollers 4 will be pushed forwards the said lips with a much smaller force than normal. The rollers 4 will still reach the target at different times, however the force which pushes them is a lot less than the full force since the said bypass line will drop the pressure in the discharge line of pump P. Of course it is understood that the solenoid valve SV is only open during the said 1.3 seconds time and after that for the rest of the operation it shall be closed. The duration of the said opening time could be controlled from the electrical controls which are not shown. In fact there are other electrical controls involved which are neither shown nor mentioned since it is not the objective of the invention. In addition to that illustration of items such as strainer, pressure gauge or filter is also avoided because of the same reason. It is only the technique of the use of said by the pass line and the said solenoid and globe valves which is under consideration.

The purpose of the globe valve GV is to control the pressure on discharge of the pump P during the said interval; that is, during the said 1.3 seconds. By adjusting the globe valve GV the desired pressure on the main line during the said interval is obtained. It shall be set at the desired setting and will not be readjusted again. As a result of large reduction of the force exerted by rollers 4 the chance of occurrence of the said bending problem will reduce significantly.

Another way of solving the said problem is to avoid the bypass line and to have variable speed drive for pump P motor. That is for the said interval the pump should run with smaller speed than normal, to reduce the pressure of the main line.

Possible Options for Engine Crankshaft:

Option 9: the use of bushings and/or bearings for the pins inside and/or outside the crank cam's weir. Since geometric illustrations of this concept were provided for cap spinner in Option 3 and Option 4 and the concepts are the same, here such figures and explanations are avoided.

Option 10: the use of stationary wall support for the piston rod in order to reduce stresses on piston rod. FIGS. 18 and 18*a* are the drawings associated with this Option. FIG. 18 shows a geometric illustration of a stationary wall support 66 for the piston 67's rod. The support 66 is connected to engine body from one end and has a hole at the other end and the piston 67's rod moves up and down through the said hole. In the illustrations of this disclosure the piston rod for all pistons is shown to have a circular cross section; however it is more appropriate to have a rectangular cross section for the piston rod and the said hole in the stationary wall support 66. This is shown as an isometric view in FIG. 18*a*. In FIG. 18*a* only a small portion of piston 67's rod and the support 66 is shown. A rectangular cross section for the said rod and hole will keep the piston and the pin(s) at its bottom in desired orientation.

Option 11: a crank cam profile for efficient combustion. FIGS. 18*b* to 18*e* (4 figures) are the drawings associated with Option 11. They represent four positions of the crank cam at four dead center positions. In Option 11 only the geometric profile of the crank cam is under consideration. A general presentation of the positions of the piston at four dead centers was already shown in FIGS. 4*d*, 4*a*, 4*b* and 4*c*. The four FIGS. 18*b*, 18*c*, 18*d* and 18*e* show the same positions of piston and crank cam in FIGS. 4*d*, 4*a*, 4*b* and 4*c* respectively. The only thing which is different is the geometry of the cam profile. The piston and the cylinder are not shown in FIGS. 18*b* to 18*e* since the cam profile is enlarged for a more clear presentation of the geometry of the cam and each of these four FIGS. 18*b*, 18*c*, 18*d* and 18*e* must be considered with association with corresponding figure from the four FIGS. 4*d*, 4*a*, 4*b* and 4*c* respectively.

In ordinary crankshafts the presence of piston at any of top or bottom dead centers is instantaneous; that is as soon as piston reaches the dead center point it immediately starts moving in the opposite direction. The objective of Option 11 and the associated geometric illustrations is to provide more time than normal for the piston at the position of top dead center at the end of compression stroke and beginning of power stroke. This will result in more time for combustion of the fuel and better fuel efficiency and less emission gases compared to those of ordinary engines.

In order to address this matter, a crank cam with a special geometry is suggested. FIG. 18*b* shows a geometric profile for crank cams discussed for this invention (see FIG. 4*d* for corresponding position of the piston). A crank cam profile comprising of two loops referred to as numerals 106 and 107 is shown. Loop 107 is offset from loop 106 by a distance needed for the design. This profile could apply to any of the two crank cams 29 and 62 presented in this disclosure. For crank cam 29, loop 106 refers to inside surface of the cam's weir and loop 107 to outside surface of the same. For crank cam 62 the two loops 106 and 107 refer to inside and outside surfaces of the groove respectively.

The position of a connecting mechanism referred to as numeral 108 (inside and outside pins and bushings, piston and connection link) with respect to the said crank cam is shown on top of FIG. 18*b* (only the bottom portion of the connecting mechanism is shown and the full length of the piston rod and piston and cylinder are not shown). The connecting mechanism 108 could be any of the six Methods described in this disclosure for engine crankshaft, but for the purpose of this illustration the connecting mechanism of the First Method is shown as an example. That is numeral 108 is comprised of numerals 25, 26, 27, 28. It is obvious that piston 25 slides inside a cylinder which is not shown.

The crank cam profile which is presented by two loops 106 and 107 replaces the crank cam which was referred to as numeral 29 in the First Method.

Seven points are marked by heavy X on FIG. 18*b*. Point C is the center of the said crank cam. Other six points are marked on the cam profile on loop 107 by heavy X; they are points 101, 102, 103, 104, A and B. The four points 101, 102, 103 and 104 are like the four quadrants of loop 107. The center line which goes through points 101 and 103 is perpendicular to the center line which goes through points 102 and 104 and both said center lines pass through point C. For completing a four stroke cycle, as the piston operates and the crank cam rotates, points 101, 102, A, 103, B, 104 and 101 in order, pass through the position where the connecting mechanism 108 is located. It must be noted that points A, 103 and B are on circle 105 with its center located at point C. Circle 105 serves as construction geometry. The direction of rotation of the cam is clockwise.

It has been already shown that a complete four stroke cycle for these crankshafts is a 360 degrees rotation of the crank cam and starts and end at point 101. All the curves making up the profiles of the two said loops are tangent to each other at the points of intersection. That is the transition of all points on the profile through the connection mechanism 108 is smooth.

When point 101 reaches connection mechanism 108, it corresponds to top dead center position of piston at end of exhaust and beginning of intake stroke. FIG. 18*b* shows this position.

As cam rotates 90 degrees and point 102 reaches connection mechanism 108, it corresponds to position of piston at bottom dead center at end of intake and start of compression stroke. FIG. 18*c* shows this position (see FIG. 4*a* for corresponding position of the piston). That is FIG. 18*c* is the geometry shown in FIG. 18*b* after 90 degrees rotation of crank cam in clockwise direction.

Now reference is made to FIG. 18*d*. FIG. 18*d* is the same crank cam profile said in FIG. 18*b* after a cam rotation of 172 degrees (see FIG. 4*b* for corresponding position of the piston; in FIG. 4*b* the cam has rotated 180 degrees but the position of the piston is the same). The compression stroke is completed when point A reaches connection mechanism 108. After the crank cam finishes compression stroke, points A, 103 and B, in order, pass through connection mechanism 108. FIG. 18*d* shows the position of the connection mechanism 108 somewhere between points A and 103. During the time that the three points A, 103 and B are passing through the connection mechanism 108, the position of piston stays at top dead center and power stroke starts as soon as point A reaches connection mechanism 108. As the FIG. 18*d* shows, points A, 103 and B are on the same circle referred to as numeral 105 and shown by dash line with its center at point C. Points A, 103 and B have the same distance from the crank cam center C. It is clear that point A reaches the connection mechanism 108 before 180 degrees rotation of the cam and point B passes through the same after 180 degrees. Point 103 passes through the same at exactly 180 degrees rotation of the cam. Therefore as the arc presented by three points A, 103 and B, passes through the connecting mechanism 108, the piston stays at top dead center during that time interval and the presence of the piston at the corresponding top dead center is not instantaneous. The ignition for this mechanism can start when point A reaches connection mechanism 108 and the fuel air mixture stays under intense pressure of top dead center during the time interval which points A, 103 and B are passing through connection mechanism 108. This will result in better than normal combustion and emission control.

When point 104 reaches connection mechanism 108, it corresponds to end of power and beginning of exhaust stroke. FIG. 18*e* shows this position (see FIG. 4*c* for corresponding position of the piston). FIG. 18*e* is the same profile said in FIG. 18*b*, after a crank cam rotation of 270 degrees in clockwise direction.

After another 90 degrees rotation of the cam once again point 101 reaches the connection mechanism 108 and the burnt gas is exhausted and the four stroke cycle is complete; this was already shown in FIG. 18*b*.

It could be realized by those skilled in the art that for this profile the duration of time for intake and exhaust strokes are the same, since each of them takes 90 degrees rotation of the crank cam. While the compression stroke takes the shortest amount of time and the power stroke has the longest duration of the time of the four strokes.

It must be noted that for these geometric illustrations in FIGS. 18*b* to 18*e*, point 101 is outside the circle 105. But depending on the thermodynamics requirements of the combustion engine, point 101 could be either inside, outside or on the said circle 105.

It has been said before in this disclosure and once again is repeated that the distance between point 102 and point C, the center of the cam, is more than the distance between point 104 and the said center point C. This was the main objective of the invention and allows the piston to travel a longer distance than normal during the power stroke.

Option 12: a crank cam profile for unequal time intervals for any of the four strokes. FIGS. 18*f* to 18*i* (4 figures) are the drawings associated with Option 12. They represent four positions of the crank cam at four dead center positions. In Option 12 only the geometric profile of the crank cam is under consideration. A general presentation of the positions of the piston at four dead centers was already shown in FIGS. 4*d*, 4*a*, 4*b* and 4*c*. The four FIGS. 18*f*, 18*g*, 18*h* and 18*i* show the same positions of piston and crank cam in FIGS. 4*d*, 4*a*, 4*b* and 4*c* respectively. The only thing which is different is the geometry of the cam profile. The piston and cylinder are not shown. The piston and the cylinder are not shown in FIGS. 18*f* to 18*i* since the cam profile is enlarged for a more clear presentation of the geometry of the cam and each of these four FIGS. 18*f*, 18*g*, 18*h* and 18*i* must be considered with association with corresponding figure from the four FIGS. 4*d*, 4*a*, 4*b* and 4*c* respectively.

Another issue which must be brought to attention is that with the use of such crank cams presented in this disclosure for engine crankshaft, it is possible to have different time intervals for each of the four strokes for a four stroke cycle engine. In ordinary engines the time it takes for each stroke is one fourth of the time it takes for the completion of a four stroke cycle. That is the amount of time it takes for each stroke is 25% of the total time for the cycle. It was already shown in Option 11 that the duration of time for power stroke was the longest and that of compression stroke the shortest of the four strokes. In Option 12 it will be illustrated that the duration of time for any of the strokes could be changed to a desired value by changing the location of the quadrants of the profile of the crank cam.

For example let's say it is needed to increase the duration of time for the intake stroke and decrease the same for compression stroke due to a certain thermodynamics consideration. FIG. 18*f* shows the basic geometry of a crank cam profile for the said purpose (see FIG. 4*d* for corresponding position of the piston). A crank cam profile comprising of two loops referred to as numerals 126 and 127 is shown. Loop 127 is offset from loop 126 by a distance needed for the design. This profile could apply to any of the two crank cams 29 and 62 presented in this disclosure. For crank cam 29, loop 126 refers to inside surface of the cam's weir and loop 127 to outside surface of the same. For crank cam 62 the two loops 126 and 127 refer to inside and outside surfaces of the groove respectively.

The position of a connecting mechanism referred to as numeral 108 (the connection mechanism is comprised of inside and outside pins and bushings, piston and connection link) with respect to the crank cam is shown on top of FIG. 18*f* (only the bottom portion of the connecting mechanism is shown and the full length of the piston rod and piston and cylinder are not shown). The connecting mechanism 108 could be the parts for any of the six Methods described in this disclosure, but for the purpose of this illustration the connecting mechanism of the First Method is shown. Numeral 108 was already described in Option 11.

The crank cam profile which is presented by two loops 126 and 127 replaces the crank cam which was referred to as numeral 29 in the First Method.

Five points are marked by heavy X on FIG. 18*f*. Point D is the center of the crank cam. Other four points are marked on the cam profile on loop 127 by heavy X; they are points 121, 122, 123 and 124. The four points 121, 122, 123 and 124 are like the four quadrants of loop 127. The center line which goes through points 121 and 123 is perpendicular to the center line which goes through points D and 124. But the centerline which goes through points 122 and D is not perpendicular to the center line which goes through points 121 and 123.

As the piston operates the crank cam rotates and points 121, 122, 123, 124 and 121 in order, pass through the position where the connecting mechanism 108 is, in order to complete a four stroke cycle. The direction of rotation of the cam is clockwise and a complete four stroke cycle is 360 degrees rotation of the crank cam.

When point 121 reaches connection mechanism 108, the piston is at the position of top dead center at end of exhaust and beginning of intake stroke. This position is shown in FIG. 18*f* (see FIG. 4*d* for corresponding position of the piston).

After point 121 passes through the connection mechanism 108, the crank cam must rotate 105 degrees in order for point 122 to reach connection mechanism 108. This is shown in FIG. 18*g* and it corresponds to position of piston at bottom dead center at end of intake and beginning of compression stroke (see FIG. 4*a* for corresponding position of the piston; it must be noted that in FIG. 4*a* the crank cam has rotated 90 degrees from the configuration shown in FIG. 4*d*). FIG. 18*g* is the same geometry shown in FIG. 18*f* after 105 degrees rotation of the crank cam.

After point 122 passes through the connection mechanism 108, it takes 75 degrees rotation of the cam for point 123 to reach connection mechanism 108. Once point 123 reaches connection mechanism 108, it corresponds to the position of piston at top dead center at end of compression and beginning of power stroke. This is shown in FIG. 18*h* (see FIG. 4*b* for corresponding position of the piston; it must be noted that in FIG. 4*ba* the crank cam has rotated 90 degrees from the configuration shown in FIG. 4*a*). FIG. 18*h* is the same geometry shown in FIG. 18*f* after 180 degrees rotation of the crank cam.

After point 123 passes through the connection mechanism 108, it takes 90 degrees rotation of the crank cam for point 124 to reach connection mechanism 108. Once point 124 reaches connection mechanism 108, it corresponds to the position of piston at bottom dead center at end of power and beginning of exhaust stroke. This is shown in FIG. 18*i* (see FIG. 4*c* for corresponding position of the piston). FIG. 18*i* is the same geometry shown in FIG. 18*f* after 270 degrees rotation of the crank cam.

It will take another 90 degrees rotation of the crank cam after point 124 passes through the connection mechanism 108, in order to have point 121 reaching connection mechanism 108 and ending the exhaust stroke and completing the four stroke cycle. This was already shown in FIG. 18*f* (see FIG. 4*d* for corresponding position of the piston).

Thus it could be seen that the duration of time for intake, compression, power and exhaust strokes are 29.17% ($^{105}/_{360}$), 20.83% ($^{75}/_{360}$), 25% ($^{90}/_{360}$) and 25% ($^{90}/_{360}$) of the duration of the full cycle respectively. Unlike the crank cam profile presented in Option 11, the presence of piston at any of the top or bottom dead centers is instantaneous for the crank cam profile shown in Option 12.

From what was illustrated in Options 11 and 12, one can see that other manipulations of the profile of the crank cam are also possible in order to obtain a desired compression ratio, different time intervals for each stroke or other possible requirements. In addition to that the cam profile can have a combination of concave and convex shapes (in the figures illustrated in this disclosure all profiles of the cams have convex shape). The cases presented in Options 11 and 12 are only examples of the concept.

Option 13: a crankshaft with variable weir thickness. FIGS. 19*a* to 19*d* (4 figures) are the figures associated with Option 13. In all the cases presented so far for both muffler cap spinner and engine crankshaft, the weir of the cam had constant thickness around its perimeter. In addition to that, in all cases which involved two pins and had one pin inside the cam's weir and one pin outside the cam's weir, the centers of the two pins had motion with respect to each other. Even in the cases like the First Method and the Second Method in which the distance between the two said pins remained the same, the centers of the said two pins were not at rest with respect to each other. In Option 13 it will be illustrated that by having variable thickness for the cam's weir, the centers of the said two pins could be at rest with respect to each other.

Since the concept of reciprocation of motion has been discussed in depth thus far for the cases presented, here for Option 13 in figures FIGS. 19*a* to 19*d* (4 figures) only a portion of the crank cam is shown. This is because only the concepts of variable thickness of the crank cam's weir and the fact that the centers of the said two pins are at rest with respect to each other, will be under consideration.

In FIG. 19*a* an isometric view of the mechanism is shown. FIG. 19*b* is the same mechanism disassembled. FIG. 19*c* is a geometrical illustration of the mechanism and FIG. 19*d* is the same geometry shown in FIG. 19*c* after 15 degrees rotation of the cam in clockwise direction. The mechanism has two parts 151 and 152 and they are as follows:

Piston 151. Piston 151 has a piston portion at one end and two pins at the opposite end and the said piston and said two pins are connected with a piston rod and all said sections of the piston 151 make one solid piece. The said two pins have half circle profiles (they could also be full circles). In FIG. 19*c* and FIG. 19*d*, the half circle of the pin outside the cam's weir is referred to as numeral 153 and the half circle of the pin inside the cam's weir is referred to as numeral 154. The centers of half circles 154 and 153 have one degree of freedom and only move along Y-axis and the centers of the said two half circles have no motion with respect to each other. The weir of crank cam 152 is held between the said two half circles 153 and 154 without any slack. As crank cam 152 rotates about its center E, the half circle 153 is always tangent to loop 155 of the crank cam 152's weir and the half circle 154 is always tangent to loop 156 of the crank cam 152's weir.

Crank cam 152. As far as reciprocation of the motion is concerned, the function of crank cam 152 is the same as all crank cams discussed so far. Referring to FIG. 19*c* and FIG. 19*d*, crank cam 152 rotates about its center E and its weir passes between end pins of piston 151. A portion of the crank cam 152's weir is shown as hatched area between loops 155 and 156. The outer loop of crank cam 152's weir is referred to as numeral 155 and that of inner loop as numeral 156. Loops 155 and 156 are tangent to half circles 153 and 154 respectively at all times during 360 degrees rotation of crank cam 152. Comparison of FIG. 19*c* and FIG. 19*d* shows that in order to have loops 155 and 156 tangent to half circles 153 and 154 respectively, the thickness of the crank cam 152's weir must change. It is neither the intention nor the scope of this disclosure to address any specific geometry, but those skilled in mathematical geometry or numerical methods can determine the profiles needed for loops 153 and 154 for any given geometry. That is if information such as the radii of half circles 153 and 154, the distance between the centers of the two half circles 153 and 154 and the required length of strokes of piston 151 are known, then by mathematical equations or numerical methods the profiles of loops 155 and 156 could be determined. In fact there might be more than one set of solution for loops 155 and 156 for every given geometry.

In this disclosure Option 13 has been presented for engine crankshaft, however the same concept could be applied to muffler cap spinner and in reality Option 13 could be regarded as the Seventh Method of reciprocation of motion for the purpose of this disclosure.

This brings the description of the Options for muffler cap spinner and engine crankshaft to an end.

The disclosure being thus described, it is obvious that the same may be varied in many ways and combinations for cases presented or applications not described. Such variations are not considered as a departure from the core philosophy of the invented and illustrated mechanisms. All such variations and modifications which are obvious to those skilled in the art are considered to be within the scope of this disclosure and embodied in the claims made.

What is claimed is:

1. An apparatus for converting between reciprocating, linear motion and rotational motion, the apparatus comprising:

a sliding member constrained to reciprocate linearly relative to a stationary member, the sliding member having a sliding member longitudinal axis;

a connecting member rigidly coupled to the sliding member at a first end of the connecting member, the connecting member having a connecting member longitudinal axis;

a cam rigidly coupled to a cam shaft, the cam shaft having an axis of rotation intersecting with and perpendicular to the sliding member longitudinal axis, the cam having a non-circular, arcuate periphery and a lip having a constant thickness extending from the periphery of the cam in a direction parallel to the axis of rotation of the cam shaft, said non-circular cam having a geometry profile which determines the position, speed and acceleration of the sliding member; and a pin assembly for coupling a second end of the connecting member to the cam, the pin assembly configured to rotate the cam as the sliding member reciprocates and likewise to move the sliding member as the cam rotates; the pin assembly being configured to engage and roll along the periphery of the cam upon the sliding member reciprocating relative to the stationary member, said pin assembly comprises:

a first pin having a first bushing engaging an outer surface of the lip;

a second pin having a second bushing engaging an inner surface of the lip, the second pin being spaced from and parallel to the first pin; and a linking member linking the first pin and the second pin;

wherein the first bushing is configured to roll along the outer surface of the lip and the second bushing is configured to roll along the inner surface of the lip upon the sliding member reciprocating relative to the stationery member.

2. The apparatus of claim 1 for converting reciprocating linear motion to rotational motion for a four-stroke internal combustion engine, wherein:

the sliding member is a piston constrained to reciprocate linearly within a hollow cylinder of an engine block, the piston having a piston longitudinal axis;

the connecting member is a piston rod rigidly coupled to the piston at a first end of the piston rod, the piston rod having a piston rod longitudinal axis aligned with the piston longitudinal axis;

the cam, the cam shaft and the lip function as a crank shaft of the four-stroke internal combustion engine, the crank shaft having an axis of rotation intersecting with and perpendicular to the piston longitudinal axis, and the pin assembly engages the lip of the crank shaft and is configured to rotate the crank shaft as the piston reciprocates within the cylinder.

3. The apparatus of claim 2, wherein the piston rod is fixedly coupled to the first pin to maintain alignment of the first bushing of the first pin with the longitudinal axes of the piston and the piston rod upon the piston reciprocating within the cylinder, and the second pin rotates about the first pin upon the piston reciprocating within the cylinder.

4. The apparatus of claim 2, wherein the piston rod is fixedly coupled to the second pin to maintain alignment of the second bushing of the second pin with the longitudinal axes of the piston and the piston rod upon the piston reciprocating within the cylinder, and the first pin rotates about the second pin upon the piston reciprocating within the cylinder.

5. The apparatus of claim 2 wherein the pin assembly comprises a biasing element to maintain the second bushing engaging the inner surface of the lip and the first bushing engaging the outer surface of the lip.

6. The apparatus of claim 5, wherein the biasing element is a spring under compression.

7. The apparatus of claim 5, wherein the biasing element is a spring under tension and is laterally spaced from the longitudinal axes of the piston.

8. The apparatus of claim 2, wherein the pin assembly comprises a third pin, the second end of the piston rod being coupled to the third pin to maintain alignment of the third pin with the longitudinal axis of the piston upon the piston reciprocating within the cylinder, the first bushing of the first pin engaging the outer surface of the lip and rotating about the third pin upon the piston reciprocating within the cylinder and the second bushing of the second pin engaging the inner surface of the lip and rotating about the third pin upon the piston reciprocating within the cylinder.

9. The apparatus of claim 2 further comprising a stationary support rod to support the piston rod, the stationary support rod coupled at a first end of the stationary support rod to the engine block and slidably coupled at a second end of the stationary support rod to the piston rod, the second end of the stationary support rod defining an aperture therethrough for receiving the piston rod and having one of a bearing or cylindrical rollers positioned within the aperture for reducing friction with the piston rod, the piston rod sliding through the aperture as the piston reciprocates within the cylinder.

10. The apparatus of claim 2, wherein the first and second pins each have an axis of rotation parallel to the axis of rotation of the crank shaft.

11. The apparatus of claim 2, wherein a four-stroke cycle of the combustion engine provides 360 degrees of rotation of the cam.

12. The apparatus of claim 11, wherein the cam comprises four quadrants, each quadrant defined by two radius lines of the cam meeting at the axis of rotation of the cam connected by a portion of the lip of the cam, each quadrant having a vertex, each vertex corresponding to a top dead center or a bottom dead center position of the piston as the piston passes through the four-stroke cycle.

13. The apparatus of claim 12, wherein the vertex being closest to the axis of rotation of the cam corresponds to a bottom dead center position of the piston at the end of a power stroke of the four stroke cycle.

14. The apparatus of claim 12, wherein an angle between radius lines of any consecutive vertices determines a percentage of time of a stroke of the four-stroke cycle relative to a total time of the four stroke cycle.

15. The apparatus of claim 11, wherein the non-circular, arcuate periphery of the cam controls a distance the piston travels along the longitudinal axis of the piston during each stroke of the four-stroke cycle, the distance the piston travels during a power stroke being greater than the distance the piston travels during an intake stroke of the engine.

16. The apparatus of claim 2, wherein a portion of the periphery of the cam is a circular arc to stop the reciprocating linear motion of the piston within the hollow cylinder for a percentage of a cycle time of the engine, the circular arc having a center aligned with the axis of rotation of the crank shaft.

17. The apparatus of claim 2, wherein an outer surface of the first pin and the outer surface of the lip are furnished with interlocking gear teeth or an outer surface of the second pin and the inner surface of the lip are furnished with interlocking gear teeth to inhibit locking of the apparatus.

18. The apparatus of claim 1 wherein the apparatus converts rotational motion into reciprocating linear motion for a muffler end cap spinner for securing a muffler end cap to a muffler shell;

the sliding member is a sliding arm constrained to reciprocate linearly over a stationary support block, the sliding arm having a sliding arm longitudinal axis;

the connecting member is a connecting rod coupled to the sliding arm at a first end of the connecting rod, the connecting rod having a connecting rod longitudinal axis;

the pin assembly is for coupling a second end of the connecting rod to the cam, the pin assembly being configured to reciprocate the sliding arm over the stationary support block as the cam rotates about the axis of rotation of the cam shaft, and the apparatus further comprises a roller configured to engage the muffler end cap to secure the muffler end cap to the muffler shell, the roller being rotatably coupled to a roller arm, the roller arm being rigidly coupled to the connecting rod, parallel to the connecting rod and laterally spaced from the connecting rod.

19. The apparatus of claim 18, wherein the connecting rod is fixedly coupled to the first pin to maintain alignment of the first bushing of the first pin with the longitudinal axis of the sliding arm upon the cam rotating about the axis of rotation of the cam shaft, and the second pin rotates about the first pin upon the cam rotating about the axis of rotation of the cam shaft.

20. The apparatus of claim 18, wherein the connecting rod is fixedly coupled to the second pin to maintain alignment of the second bushing of the second pin with the longitudinal axis of the sliding arm upon the cam rotating about the axis of rotation of the cam shaft, and the first pin rotates about the second pin upon the cam rotating about the axis of rotation of the cam shaft.

21. The apparatus of claim 18, wherein the pin assembly comprises a biasing element to maintain the second bushing engaging the inner surface of the lip and the first bushing engaging the outer surface of the lip.

22. The apparatus of claim 21, wherein the biasing element is a spring.

23. The apparatus of claim 18, wherein the pin assembly comprises a third pin, the second end of the connecting rod being coupled to the third pin to maintain alignment of the third pin with the longitudinal axis of the sliding arm upon the cam rotating about the axis of rotation of the cam shaft, the first bushing of the first pin engaging the outer surface of the lip and rotating about the third pin upon the cam rotating about the axis of rotation of the cam shaft, and the second bushing of the second pin engaging the inner surface of the lip and rotating about the third pin upon the cam rotating about the axis of rotation of the cam shaft.

24. A hydraulic system for controlling an engagement force of the roller of the muffler cap spinner apparatus of claim 18, the engagement force being exerted on the muffler end cap and the muffler shell, the roller being driven to engage the muffler end cap and the muffler shell by a hydraulic piston to secure the muffler end cap to the muffler shell, the hydraulic system comprising:

an oil tank housing oil;

a hydraulic pump fluidly coupled to the oil tank for drawing a flow of oil from the oil tank and directing the flow of the oil towards the hydraulic piston of the roller;

a control valve fluidly coupled to and disposed between the hydraulic pump and the hydraulic piston of the roller for controlling the flow of the oil from the hydraulic pump towards the hydraulic piston of the roller; and a bypass line fluidly coupled to and disposed between the hydraulic pump and the control valve, the bypass line having a bypass valve for re-directing at least a portion of the flow of oil from the hydraulic pump away from the hydraulic piston of the roller to control a pressure of the flow of oil between the hydraulic pump and the hydraulic piston and to control the engagement force of the roller on the muffler end cap as the roller is driven to engage the muffler end cap by the hydraulic piston receiving the flow of oil.

25. The apparatus of claim 18, wherein the sliding arm is coupled to a spring, the spring disposed within the stationary support block to store kinetic energy of the apparatus.

26. The apparatus of claim 18, wherein sliding arm is a hollow closure and the stationary support block is positioned within a cavity of the sliding arm.

27. The apparatus of claim 18, wherein the lip is a first lip, the pin assembly is a first pin assembly and the cam further comprises a second lip extending from the cam in a direction transverse to the sliding arm longitudinal axis along the periphery, the second lip mirroring the first lip about a mirroring plane that is perpendicular to the axis of rotation of the cam shaft and bisects the cam to accommodate a second pin assembly, the second pin assembly mirroring the first pin assembly about the mirroring plane.

28. The apparatus of claim 18, wherein cylindrical rollers are disposed between the stationary support block and the sliding arm or bearings are mounted on the sliding arm and/or the stationary support block to reduce friction therebetween.

29. The apparatus of claim 18, wherein the stationary wall support is a hollow closure and the sliding arm reciprocates within a cavity of the hollow closure to guide the sliding arm.

30. An adjustable closure for guiding and supporting the sliding arm of the apparatus of claim 18, the sliding arm having a rectangular cross- section, the adjustable closure comprising:

a frame having four sides defining a cavity to receive the sliding arm, the frame shaped for a first pair of sides of the frame to slidingly engage the sliding arm and a second pair of sides of the frame to be spaced from the sliding arm, each pair of sides having two sides that are transverse to each other;

a first adjustable having:

a first portion adjustably mounted to one side of the pair of sides of the frame that slidingly engages the sliding rod; and a second portion positioned to slidingly engage the sliding rod; and a second adjustable having:

a first portion mounted to the other side of the pair of sides of the frame that slidingly engages the sliding rod; and a second portion positioned to slidingly engage the sliding rod;

wherein each side of the first pair of sides of the frame defines a plurality of slots extending therethrough, each slot sized to receive a positioning bolt for adjustably mounting one of the first portion of the first adjustable and the first portion of the second adjustable to the frame; and each side of the second pair of sides of the frame defines a plurality of holes extending therethrough, each hole sized to receive a minor adjustment bolt for holding one of the second portion of the first adjustable and the second portion of the second adjustable in a desired position with respect to the sliding arm.

* * * * *